US010045677B2

(12) United States Patent
Baker et al.

(10) Patent No.: US 10,045,677 B2
(45) **Date of Patent: *Aug. 14, 2018**

(54) DISPERSIBLE NONWOVEN WIPE MATERIAL

(71) Applicant: Georgia-Pacific Nonwovens LLC, Atlanta, GA (US)

(72) Inventors: John P. Baker, Gastonia, NC (US); Maria Curran, Belmont, NC (US); Jeffrey S. Hurley, Bartlett, TN (US); Ronald T. Moose, Lakeland, TN (US); Jacek K. Dutkiewicz, Cordova, TN (US); Manuel V. Murcia, Neuenkirchen (DE); Thomas Hess, Frankfurt (DE)

(73) Assignee: Georgia-Pacific Nonwovens LLC, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/606,635

(22) Filed: May 26, 2017

(65) Prior Publication Data

US 2017/0303762 A1 Oct. 26, 2017

Related U.S. Application Data

(63) Continuation of application No. 15/062,804, filed on Mar. 7, 2016, now Pat. No. 9,661,974, which is a continuation of application No. 14/637,046, filed on Mar. 3, 2015, now Pat. No. 9,314,142, which is a continuation of application No. 13/314,373, filed on Dec. 8, 2011, now Pat. No. 9,005,738.

(60) Provisional application No. 61/545,399, filed on Oct. 10, 2011, provisional application No. 61/421,181, filed on Dec. 8, 2010.

(51) Int. Cl.

| | |
|---|---|
| ***D04H 1/70*** | (2012.01) |
| ***D04H 1/425*** | (2012.01) |
| ***D04H 1/44*** | (2006.01) |
| ***D04H 1/541*** | (2012.01) |
| ***D04H 1/587*** | (2012.01) |
| ***D21H 27/30*** | (2006.01) |
| ***D21H 27/38*** | (2006.01) |
| ***A47L 13/16*** | (2006.01) |

(52) U.S. Cl.

CPC ..... *A47L 13/16* (2013.01); *D04H 1/425* (2013.01); *D04H 1/44* (2013.01); *D04H 1/541* (2013.01); *D04H 1/587* (2013.01); *D04H 1/70* (2013.01); *D21H 27/30* (2013.01); *D21H 27/38* (2013.01); *Y10T 428/24612* (2015.01); *Y10T 428/24802* (2015.01); *Y10T 428/2913* (2015.01); *Y10T 428/2931* (2015.01); *Y10T 428/31993* (2015.04)

(58) Field of Classification Search

CPC ..... D04H 1/425; D04H 1/44; D04H 1/541; D04H 1/587; D04H 1/70; D21H 27/30; D21H 27/38; D21H 77/38; A47L 13/16; Y10T 428/24612; Y10T 428/24802; Y10T 428/2913; Y10T 428/31993

USPC ..... 162/123, 125, 129, 132, 135–136, 141, 162/146, 157.1, 157.6–157.7, 158, 169, 162/175, 180; 428/156, 172, 537.5, 428/195.1, 359, 364, 373–374; 264/109–115; 15/104.93, 209.1

See application file for complete search history.

(56) References Cited

U.S. PATENT DOCUMENTS

| | | | |
|---|---|---|---|
| 3,561,447 | A | 2/1971 | Alexander |
| 3,804,092 | A | 4/1974 | Tunc |
| 3,939,836 | A | 2/1976 | Tunc |
| 4,002,171 | A | 1/1977 | Taft |
| 4,755,421 | A | 7/1988 | Manning et al. |
| 5,196,470 | A | 3/1993 | Anderson et al. |
| 5,384,189 | A | 1/1995 | Kuroda et al. |
| 5,437,908 | A | 8/1995 | Demura et al. |
| 5,509,913 | A | 4/1996 | Yeo |
| 5,629,081 | A | 5/1997 | Richards et al. |
| 5,770,528 | A | 6/1998 | Mumick et al. |
| 5,935,880 | A | 8/1999 | Wang et al. |
| 6,174,412 | B1 | 1/2001 | Paterson-Brown et al. |
| 6,194,517 | B1 | 2/2001 | Pomplun et al. |
| 6,287,419 | B1 | 9/2001 | Naohito et al. |
| 6,291,372 | B1 | 9/2001 | Mumick et al. |
| 6,410,155 | B2 | 6/2002 | Mumick et al. |
| 6,410,644 | B2 | 6/2002 | Mumick et al. |
| 6,451,429 | B2 | 9/2002 | Mumick et al. |
| 6,451,718 | B1 | 9/2002 | Yamada et al. |

(Continued)

FOREIGN PATENT DOCUMENTS

| | | |
|---|---|---|
| EP | 0 007 134 A1 | 1/1980 |
| EP | 0 608 460 A1 | 8/1994 |

(Continued)

OTHER PUBLICATIONS

U.S. Appl. No. 13/314,373 (U.S. Pat. No. 9,005,738), filed Dec. 8, 2011 (Apr. 14, 2015).

(Continued)

*Primary Examiner* — Jose A Fortuna

(74) *Attorney, Agent, or Firm* — Baker Botts L.L.P.; Sandra S. Lee; Ram W. Sabnis

(57) ABSTRACT

A dispersible, nonwoven multistrata wipe material is provided that is stable in a wetting liquid and flushable in use. More particularly, multilayered structures including, but not limited to, two, three, or four layers are provided to form the dispersible nonwoven wipe material. The layers contain combinations of cellulosic and noncellulosic fibers, and optionally a binder or additive.

24 Claims, 33 Drawing Sheets

(56) References Cited

U.S. PATENT DOCUMENTS

| | | | |
|---|---|---|---|
| 6,479,164 | B1 | 11/2002 | Lorcks et al. |
| 6,530,910 | B1 | 3/2003 | Pomplun et al. |
| 6,586,529 | B2 | 7/2003 | Mumick et al. |
| 6,749,718 | B2 | 6/2004 | Takai et al. |
| 6,808,598 | B1 | 10/2004 | Takeuchi et al. |
| 6,828,014 | B2 | 12/2004 | Branham et al. |
| 6,897,168 | B2 | 5/2005 | Branham et al. |
| 6,951,598 | B2 | 10/2005 | Flugge et al. |
| 6,989,193 | B2 | 1/2006 | Haile et al. |
| 7,064,091 | B2 | 6/2006 | Goldstein et al. |
| 7,070,854 | B2 | 7/2006 | Chang et al. |
| 7,101,612 | B2 | 9/2006 | Lang et al. |
| 7,381,299 | B2 | 6/2008 | Shannon et al. |
| 7,670,967 | B2 | 3/2010 | Runge et al. |
| 7,732,357 | B2 | 6/2010 | Annis et al. |
| 7,838,725 | B2 | 11/2010 | Noda et al. |
| 7,902,094 | B2 | 3/2011 | Haile et al. |
| 8,080,489 | B2 | 12/2011 | Brennan |
| 8,123,905 | B2 | 2/2012 | Luu et al. |
| 8,241,743 | B2 | 8/2012 | Brennan |
| 8,257,553 | B2 | 9/2012 | Zwick et al. |
| 8,257,628 | B2 | 9/2012 | Gupta et al. |
| 8,480,852 | B2 | 7/2013 | Wenzel et al. |
| 8,603,297 | B2 | 12/2013 | Zwick et al. |
| 9,005,738 | B2 | 4/2015 | Baker et al. |
| 9,314,142 | B2 | 4/2016 | Baker et al. |
| 9,661,974 | B2 * | 5/2017 | Baker ..... A47L 13/16 |
| 2002/0177827 | A1 | 11/2002 | Noda et al. |
| 2003/0000665 | A1 | 1/2003 | Takai et al. |
| 2003/0027470 | A1 | 2/2003 | Chang et al. |
| 2003/0032352 | A1 | 2/2003 | Chang et al. |
| 2003/0045191 | A1 | 3/2003 | Goldstein et al. |
| 2003/0190852 | A1 | 10/2003 | Dutkiewicz et al. |
| 2004/0030080 | A1 | 2/2004 | Chang et al. |
| 2004/0058600 | A1 | 3/2004 | Bunyard et al. |
| 2004/0112558 | A1 | 6/2004 | Garnier et al. |
| 2004/0154768 | A1 | 8/2004 | Trokhan et al. |
| 2004/0260034 | A1 | 12/2004 | Haile et al. |
| 2004/0266650 | A1 | 12/2004 | Lambotte et al. |
| 2005/0215146 | A1 | 9/2005 | Shannon |
| 2006/0008621 | A1 | 1/2006 | Gusky et al. |
| 2006/0130986 | A1 | 6/2006 | Flugge-Berendes et al. |
| 2006/0135018 | A1 | 6/2006 | Brennan |
| 2006/0137842 | A1 | 6/2006 | Garnier et al. |
| 2007/0141936 | A1 | 6/2007 | Bunyard et al. |
| 2007/0152365 | A1 | 7/2007 | Dutkiewicz et al. |
| 2007/0254543 | A1 | 11/2007 | Bunyard et al. |
| 2007/0295464 | A1 | 12/2007 | Fetner et al. |
| 2007/0295465 | A1 | 12/2007 | Dyer et al. |
| 2008/0044644 | A1 | 2/2008 | Luu et al. |
| 2008/0076313 | A1 | 3/2008 | Uitenbroek et al. |
| 2008/0076314 | A1 | 3/2008 | Blanz et al. |
| 2008/0216977 | A1 | 9/2008 | Dyer et al. |
| 2009/0092809 | A1 | 4/2009 | Hurley et al. |
| 2009/0308551 | A1 | 12/2009 | Kokko et al. |
| 2009/0311478 | A1 | 12/2009 | Ehlerding et al. |
| 2010/0224338 | A1 | 9/2010 | Harper et al. |
| 2010/0280472 | A1 | 11/2010 | Takeuchi et al. |
| 2011/0290437 | A1 | 12/2011 | Vogel et al. |
| 2011/0293931 | A1 | 12/2011 | Vogel et al. |
| 2012/0035526 | A1 | 2/2012 | Colin et al. |
| 2012/0089075 | A1 | 4/2012 | Colin et al. |
| 2012/0090119 | A1 | 4/2012 | Carrier et al. |
| 2012/0144611 | A1 | 6/2012 | Baker et al. |
| 2012/0160436 | A1 | 6/2012 | Zwick et al. |
| 2012/0160715 | A1 | 6/2012 | Muvundamina et al. |
| 2012/0199301 | A1 | 8/2012 | Strandqvist |
| 2012/0255694 | A1 | 10/2012 | Druecke et al. |
| 2012/0272465 | A1 | 11/2012 | Brennan |
| 2012/0297560 | A1 | 11/2012 | Zwick et al. |
| 2012/0302120 | A1 | 11/2012 | Clark et al. |
| 2013/0004552 | A1 | 1/2013 | Pedoja |
| 2014/0005620 | A1 | 1/2014 | Wang et al. |
| 2014/0311695 | A1 * | 10/2014 | Clark ..... D21H 13/02 162/145 |
| 2014/0367060 | A1 | 12/2014 | Colin et al. |
| 2014/0367063 | A1 | 12/2014 | Colin et al. |
| 2015/0135457 | A1 | 5/2015 | Dutkiewicz et al. |
| 2015/0238062 | A1 | 8/2015 | Baker et al. |
| 2015/0330029 | A1 | 11/2015 | Ramaratnam et al. |
| 2016/0183758 | A1 | 6/2016 | Baker et al. |
| 2017/0303762 | A1 * | 10/2017 | Baker ..... D21H 27/30 |

FOREIGN PATENT DOCUMENTS

| | | | |
|---|---|---|---|
| EP | 0 896 089 | A1 | 2/1999 |
| EP | 1 884 581 | A1 | 2/2008 |
| FR | 2948696 | A1 | 2/2011 |
| JP | 2006-000565 | A | 1/2006 |
| JP | 2006-002277 | A | 1/2006 |
| JP | 2012-148090 | A | 8/2012 |
| WO | WO 1997/036053 | A2 | 10/1997 |
| WO | WO 1997/047227 | A1 | 12/1997 |
| WO | WO 1998/008475 | A1 | 3/1998 |
| WO | WO 1998/029461 | A1 | 7/1998 |
| WO | WO 2000/039378 | A2 | 7/2000 |
| WO | WO 2001/083666 | A2 | 11/2001 |
| WO | WO 2002/022352 | A1 | 3/2002 |
| WO | WO 2003/005874 | A1 | 1/2003 |
| WO | WO 2006/025895 | A2 | 3/2006 |
| WO | WO 2006/069119 | A2 | 6/2006 |
| WO | WO 2006/073710 | A2 | 7/2006 |
| WO | WO 2006/103232 | A2 | 10/2006 |
| WO | WO 2008/132614 | A1 | 11/2008 |
| WO | WO 2010/019726 | A1 | 2/2010 |
| WO | WO 2012/085708 | A2 | 6/2012 |

OTHER PUBLICATIONS

U.S. Appl. No. 14/542,437 (U.S. Pat. No. 9,439,549), filed Nov. 14, 2014 (Sep. 13, 2016).

U.S. Appl. No. 14/637,046 (U.S. Pat. No. 9,314,142), filed Mar. 3, 2015 (Apr. 19, 2016).

U.S. Appl. No. 15/062,804 (U.S. Pat. No. 9,661,974), filed Mar. 7, 2016 (May 30, 2017).

U.S. Appl. No. 14/637,046, filed Mar. 7, 2016 Issue Fee Payment.

U.S. Appl. No. 14/637,046, filed Dec. 11, 2015 Notice of Allowance.

U.S. Appl. No. 14/637,046, filed Oct. 6, 2015 Response to Non-Final Office Action.

U.S. Appl. No. 14/637,046, filed Jun. 18, 2015 Non-Final Office Action.

U.S. Appl. No. 14/542,437, filed Aug. 2, 2016 Issue Fee Payment.

U.S. Appl. No. 14/542,437, filed Jun. 1, 2016 Notice of Allowance.

U.S. Appl. No. 14/542,437, filed Mar. 16, 2016 Response to Non-Final Office Action.

U.S. Appl. No. 14/542,437, filed Feb. 19, 2016 Applicant Initiated Interview Summary.

U.S. Appl. No. 14/542,437, filed Dec. 17, 2015 Non-Final Office Action.

U.S. Appl. No. 14/542,437, filed Nov. 30, 2015 Amendment and Request for Continued Examination (RCE).

U.S. Appl. No. 14/542,437, filed Aug. 31, 2015 Final Office Action.

U.S. Appl. No. 14/542,437, filed Jun. 26, 2015 Response to Non-Final Office Action.

U.S. Appl. No. 14/542,437, filed Mar. 27, 2015 Non-Final Office Action.

U.S. Appl. No. 13/314,373, filed Mar. 3, 2015 Issue Fee Payment.

U.S. Appl. No. 13/314,373, filed Dec. 4, 2014 Notice of Allowance.

U.S. Appl. No. 13/314,373, filed Nov. 26, 2014 Response to Non-Final Office Action.

U.S. Appl. No. 13/314,373, filed Aug. 29, 2014 Non-Final Office Action.

U.S. Appl. No. 13/314,373, filed Aug. 6, 2014 Amendment and Request for Continued Examination (RCE).

U.S. Appl. No. 13/314,373, filed Apr. 3, 2014 Final Office Action.

U.S. Appl. No. 13/314,373, filed Jan. 17, 2014 Response to Non-Final Office Action.

(56) References Cited

OTHER PUBLICATIONS

U.S. Appl. No. 13/314,373, filed Oct. 17, 2013 Non-Final Office Action.
U.S. Appl. No. 13/314,373, filed Aug. 27, 2013 Amendment and Request for Continued Examination (RCE).
U.S. Appl. No. 13/314,373, filed Jun. 4, 2013 Final Office Action.
U.S. Appl. No. 13/314,373, filed Apr. 15, 2013 Response to Non-Final Office Action.
U.S. Appl. No. 13/314,373, filed Jan. 15, 2013 Non-Final Office Action.
U.S. Appl. No. 15/062,804, filed Apr. 26, 2017 Issue Fee Payment.
U.S. Appl. No. 15/062,804, filed Feb. 15, 2017 Notice of Allowance.
U.S. Appl. No. 15/062,804, filed Dec. 22, 2016 Response after Final Office Action.
U.S. Appl. No. 15/062,804, filed Oct. 26, 2016 Final Office Action.
U.S. Appl. No. 15/062,804, filed Aug. 15, 2016 Response to Non-Final Office Action.
U.S. Appl. No. 15/062,804, filed May 17, 2016 Non-Final Office Action.
European Search report for Ep Application No. EP 11 19 2569, dated Feb. 22, 2012.
European Search report for EP Application No. EP 17 16 0055, dated May 15, 2017.
International Search Report and Written Opinion for PCT Application No. PCT/US2011/063934, dated Feb. 29, 2012.

* cited by examiner

1: Counter box reset
2: Start button
3: Emergency stop
4: Electrical Box (Hoffman Cat. No. A20N16ALP)
5: Motor (Applied Motion Products, 2 phase step motor, model 1.8 DG/Step)
6: Apparatus Stand
7: Gear Box (Thomas Micro, NEMA True 34 gear box 20:1)
8: Counter (Cuttler Hammer, model E50SA)
9: Mounting bracket (Holds axle to apparatus stand)
10: Tube w/ rubber seal and threaded lids (3" Inner Diameter x 20" Length)
11: Tube w/ rubber seal and threaded lids (3" Inner Diameter x 20" Length)
12: Tube w/ rubber seal and threaded lids (3" Inner Diameter x 20" Length)
13: Tube w/ rubber seal and threaded lids (3" Inner Diameter x 20" Length)
14: Tube w/ rubber seal and threaded lids (3" Inner Diameter x 20" Length)
15: Tube w/ rubber seal and threaded lids (3" Inner Diameter x 20" Length)
16: Mounting bracket (Holds axle to apparatus stand)
17: Axle and Mounting Bracket for Tubes
18: Apparatus Stand
19: Base plate to stabilize apparatus
20: Tube (3" Diameter x 20" length, has threads for screw on lid)
21: Rubber Seal (fits inside lid)
22: Threaded lid for tube

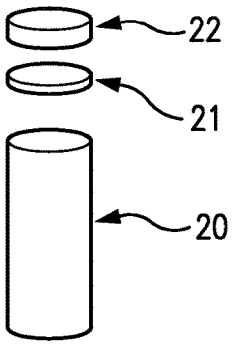

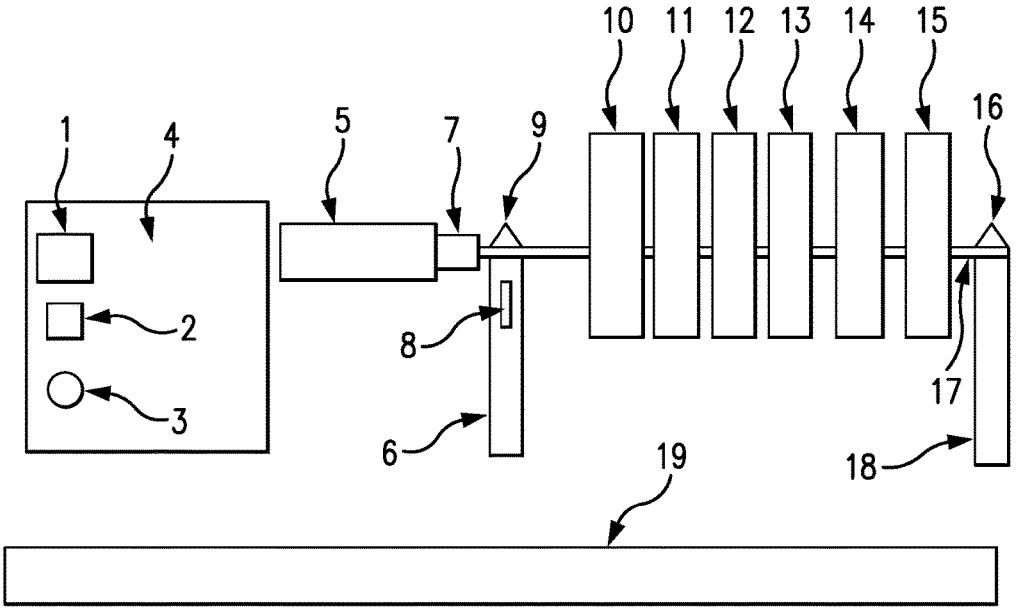

FIG. 4

Potential Components of PEG200
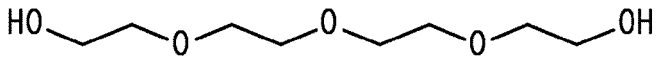
3,6,9-trioxaundecane-1,11-diol
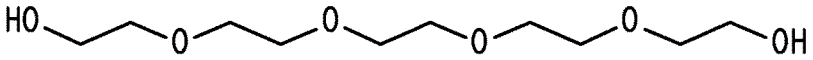
3,6,9,12-tetraoxatetradecane-1,14-diol
FIG. 11A
Potential Components of PEG700
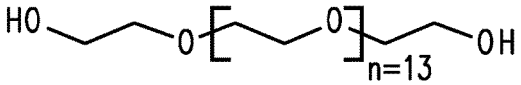
3,6,9,12,15,18,21,24,27,30,33,36,39,42 - tetradecaoxatetratetracontane-1,44-diol
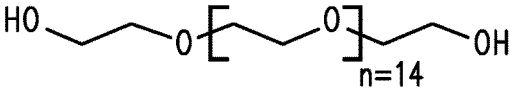
3,6,9,12,15,18,21,24,27,30,33,36,39,42,45-pentadecaoxaheptatetracontane-1,47-diol
FIG. 11B Platform Shaker Apparatus 1. Innova 2300 Platform Shaker from Brunswick Scientific
2. Shaker Platform
3. Pyrex® USA 2800mL 4424-2XL flask with baffles
4. Digital Display/Control panel Top View of Platform Shaker Apparatus 1. Shaker Platform (30" x 16")
2. Flask Mount (6.5" Diameter)
3. Flask
4. Flask Mount (6.5" Diameter)
5. Flask Mount Arm (1.75")
6. Flask Mount Security Spring (12.5")
7. Distance Between Flask Mounts (12")

1. Agitator (steel sheet metal 11.75" x 11.75" with 16")
2. Agitator (inverted view, .75" diameter holes)
3. Fill reservoir part A (metal box 12" x 12" x 11.5")
4. Hinge
5. Screen
6. Water line in (1" inner diameter)
7. Hinge
8. Fill reservoir part B (metal box 14" x 14" x 11.5")
9. Water drain pipe (2" inner diameter)
10. Low vacuum on button
11. Low vacuum off button
12. High vacuum on button
13. High vacuum off button
14. Vacuum slot (13" x 1/16")
15. Vacuum pipe (2" inner)
16. Vacuum pipe (2" outer)
17. Vacuum pipe (2" inner)
18. Vacuum pipe (2" outer)
19. Vacuum pipe (2" outer)
20. Deep sink
21. Water drain pipe (2" inner)
22. Water drain pipe (2" inner)
23. Countertop
24. Control valve for vacuum
25. Rubber gasket (1" width)
26. Hand Sheet screen (100 mesh)

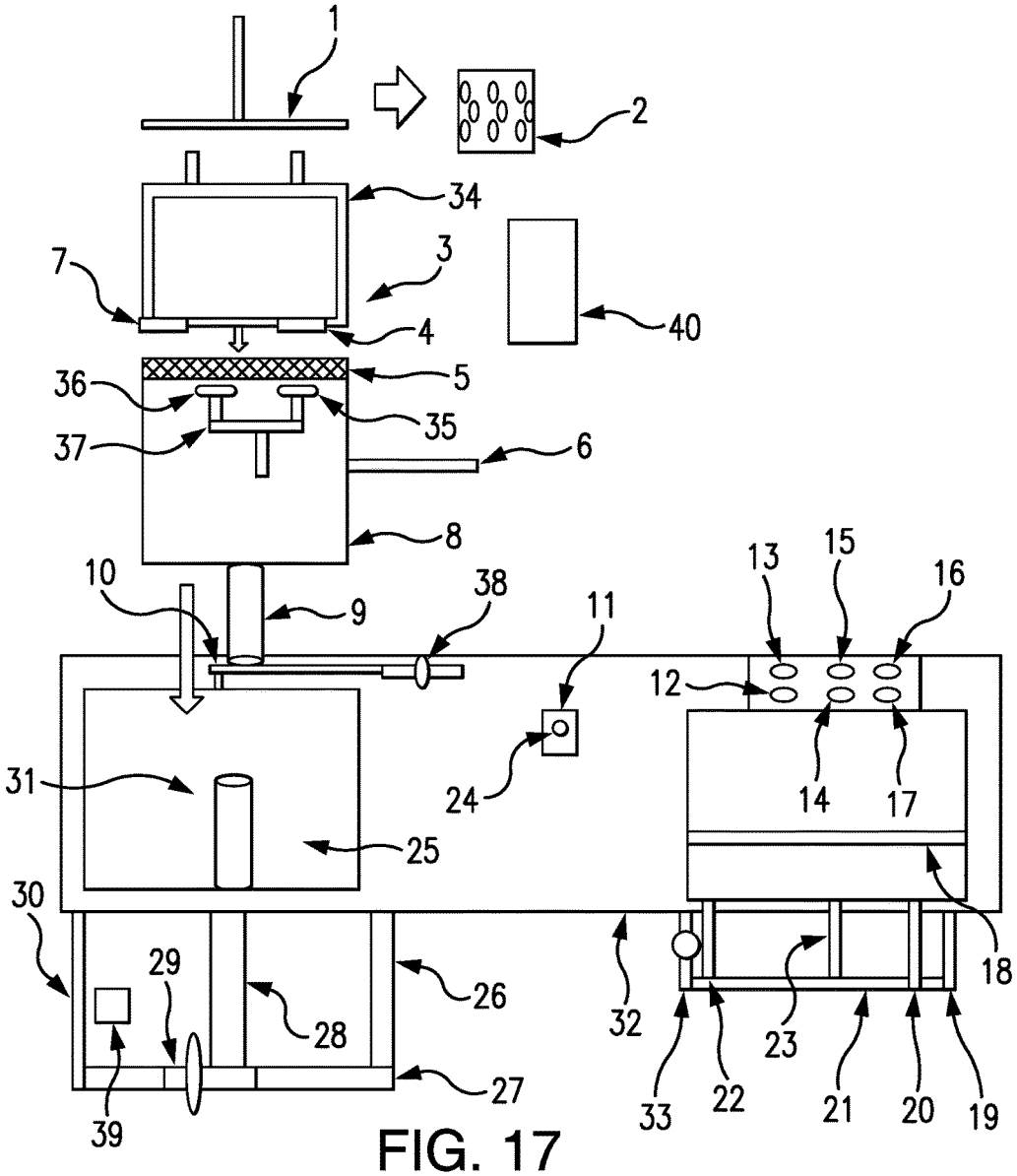

FIG. 17

1. American Kohler Toilet, (1.6 Gallons/Flush)
2. Toilet mount platform
3. Two 45 degree couplings (4" ID) to form 90 degree turn
4. Run of pipe (4' of 4" ID)
5. Two 45 degree couplings (4" ID) to form 90 degree turn
6. Run of pipe (12' of 4" ID)
7. Two 45 degree couplings (4" ID) to form 90 degree turn
8. Two 45 degree couplings (4" ID) to form 90 degree turn
9. Run of pipe (6'4" of 4" ID)
10. Two 45 degree couplings (4" ID) to form 90 degree turn
11. Two 45 degree couplings (4" ID) to form 90 degree turn
12. Support rail (height 4')
13. Support rail (height 4')
14. Run of pipe (12'8" of 4" ID)
15. Support rail (height 4')
16. Two 45 degree couplings (4" ID) to form 90 degree turn
17. Support rail (height 4')
18. Run of pipe (6'3" of 4" ID)
19. Two 45 degree couplings (4" ID) to form 90 degree turn
20. Support rail (height 4')
21. Run of pipe (13' of 4" ID)
22. Support rail (height 4')
23. Support rail (height 4')
24. Support rail (height 4')
25. Support rail (height 4')
26. Support rail (height 4')
27. Support rail (height 4')
28. Run of pipe (12'10" of 4" ID)
29. Two 45 degree couplings (4" ID) to form 90 degree turn
30. Run of pipe (5'6" of 4" ID)
31. Two 45 degree couplings (4" ID) to form 90 degree turn
32. Support rail (height 4')
33. Support rail (height 4')
34. Water and wipe catch basin
35. Run of pipe (6'3" of 4" ID)

North American Toilet Bowl and Drain Line Clearance Test

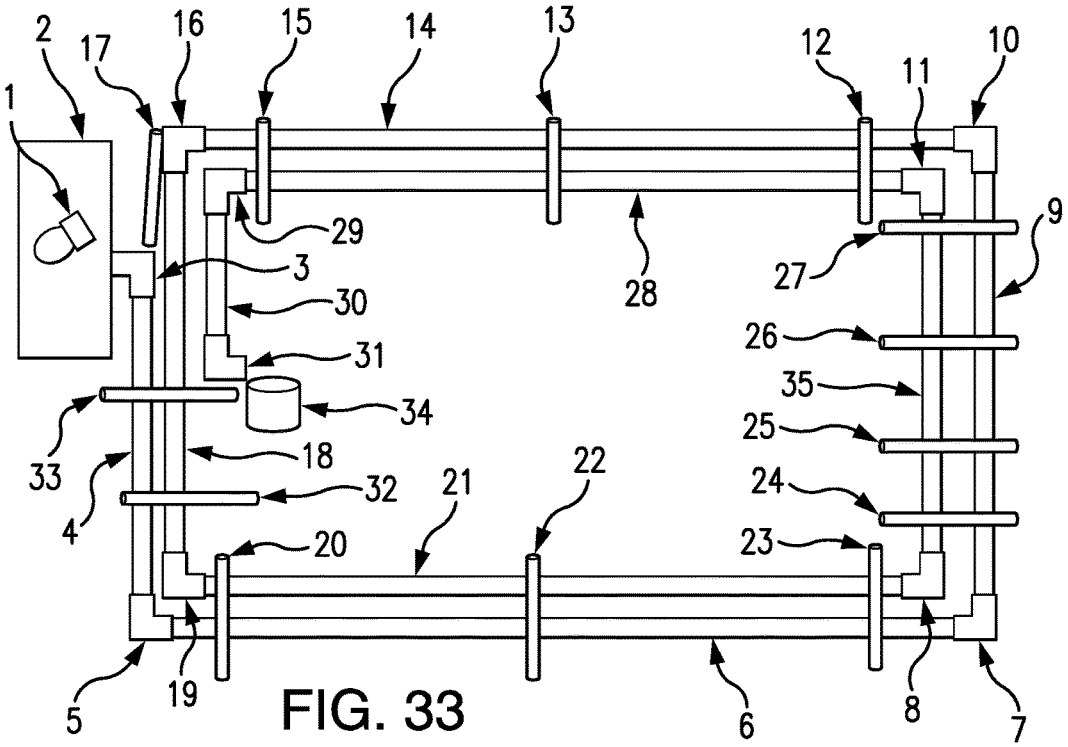

FIG. 33

1. American Kohler Toilet, (4.5 Liters/Flush)
2. Toilet mount platform
3. Two 45 degree couplings (3" ID) to form 90 degree turn
4. Run of pipe (2' of 3" ID)
5. Two 45 degree couplings (3" ID) to form 90 degree turn
6. Run of pipe (12' of 3" ID)
7. Two 45 degree couplings (3" ID) to form 90 degree turn
8. Two 45 degree couplings (3" ID) to form 90 degree turn
9. Run of pipe (6'4" of 3" ID)
10. Two 45 degree couplings (3" ID) to form 90 degree turn
11. Two 45 degree couplings (3" ID) to form 90 degree turn
12. Support rail (height 4')
13. Support rail (height 4')
14. Run of pipe (12'8" of 3" ID)
15. Support rail (height 4')
16. Two 45 degree couplings (3" ID) to form 90 degree turn
17. Support rail (height 4')
18. Run of pipe (6'3" of 3" ID)
19. Two 45 degree couplings (3" ID) to form 90 degree turn
20. Support rail (height 4')
21. Run of pipe (13' of 3" ID)
22. Support rail (height 4')
23. Support rail (height 4')
24. Support rail (height 4')
25. Support rail (height 4')
26. Support rail (height 4')
27. Support rail (height 4')
28. Run of pipe (12'10" of 3" ID)
29. Two 45 degree couplings (3" ID) to form 90 degree turn
30. Run of pipe (5'6" of 3" ID)
31. Two 45 degree couplings (3" ID) to form 90 degree turn
32. Support rail (height 4')
33. Support rail (height 4')
34. Water and wipe catch basin
35. Run of pipe (6'3" of 3" ID)

European Toilet Bowl and Drain Line Clearance Test

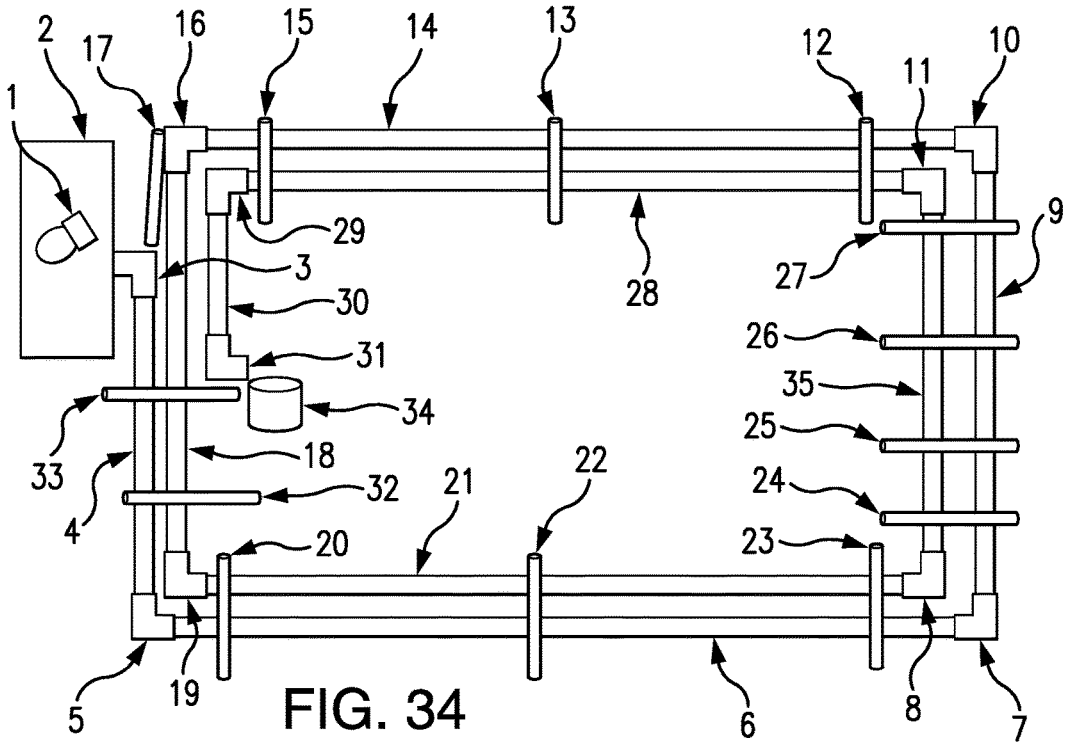

FIG. 34

DISPERSIBLE NONWOVEN WIPE MATERIAL

CROSS-REFERENCE TO RELATED APPLICATIONS

This application is a continuation of U.S. patent application Ser. No. 15/062,804, filed on Mar. 7, 2016, and issued as U.S. Pat. No. 9,661,974 issued on May 30, 2017, which is a continuation of U.S. patent application Ser. No. 14/637,046, filed on Mar. 3, 2015, and issued as U.S. Pat. No. 9,314,142 on Apr. 19, 2016, which is a continuation of U.S. patent application Ser. No. 13/314,373, filed on Dec. 8, 2011, and issued as U.S. Pat. No. 9,005,738 on Apr. 14, 2015, which claims priority under 35 U.S.C. § 119 to U.S. Application Ser. No. 61/421,181, filed Dec. 8, 2010, and U.S. Application Ser. No. 61/545,399, filed Oct. 10, 2011, all of which are hereby incorporated by reference herein in their entireties.

FIELD OF THE INVENTION

The presently disclosed subject matter relates to a dispersible wipe material which is soft, economical, and has sufficient in-use strength while maintaining flushability in conventional toilets and their associated wastewater conveyance and treatment systems. More particularly, the presently disclosed subject matter relates to a nonwoven wipe material suitable for use as a moist toilet tissue or baby wipe that is safe for septic tank and sewage treatment plants. The presently disclosed subject matter also provides a process for preparing the dispersible wipe material.

BACKGROUND OF THE INVENTION

Disposable wipe products have added great convenience as such products are relatively inexpensive, sanitary, quick, and easy to use. Disposal of such products becomes problematic as landfills reach capacity and incineration contributes to urban smog and pollution. Consequently, there is a need for disposable products that can be disposed of without the need for dumping or incineration. One alternative for disposal is to use municipal sewage treatment and private residential septic systems.

Some current non-dispersible wipes are erroneously treated as flushable by the consumer because they typically clear a toilet and drain line of an individual residence. This, however, merely passes the burden of the non-dispersible wipes to the next step in the waste water conveyance and treatment system. The non-dispersible wipes may accumulate, causing a blockage and place a significant stress on the entire wastewater conveyance and treatment system. Municipal wastewater treatment entities around the world have identified non-dispersible wipes as a problem, identifying a need to find options to prevent further stress from being placed on the waste systems.

Numerous attempts have been made to produce flushable and dispersible products that are sufficiently strong enough for their intended purpose, and yet disposable by flushing in conventional toilets. One approach to producing a flushable and dispersible product is to limit the size of the product so that it will readily pass through plumbing without causing obstructions or blockages. However, such products often have high wet strength but fail to disintegrate after flushing in a conventional toilet or while passing through the wastewater conveyance and treatment system. This approach can lead to blockages and place stress on the waste water conveyance and treatment system. This approach to flushability suffers the further disadvantage of being restricted to small sized articles.

One alternative to producing a flushable and dispersible wipe material is taught in U.S. Pat. No. 5,437,908 to Demura. Demura discloses multi-layered structures that are not permanently attached to each other for use as bathroom tissue. These structures are designed to break down when placed in an aqueous system, such as a toilet. However, the disadvantage of these wipes is that they lose strength when placed in any aqueous environment, such as an aqueous-based lotion. Thus, they would readily break down during the converting process into a premoistened wipe or when stored in a tub of pre-moistened wipes.

Another alternative to produce a flushable and dispersible wipe material is the incorporation of water-soluble or redispersible polymeric binders to create a pre-moistened wipe. Technical problems associated with pre-moistened wipes and tissues using such binders include providing sufficient binder in the nonwoven material to provide the necessary dry and wet tensile strength for use in its intended application, while at the same time protecting the dispersible binder from dissolving due to the aqueous environment during storage.

Various solutions in the art include using water soluble binders with a "trigger" component. A trigger can be an additive that interacts with water soluble binders to increase wet tensile strength of the nonwoven web. This allows the nonwoven web, bound with water-soluble binder and a trigger, or with a trigger in a separate location such as in a lotion that is in intimate contact with the wipe, to function in applications such as moist toilet tissue or wet wipes, where the web needs to maintain its integrity under conditions of use. When the dispersible web is placed in excess water, such as a toilet bowl and the subsequent wastewater conveyance and treatment system, the concentration of these triggers is diluted, breaking up the interaction between the binder and trigger and resulting in a loss of wet tensile strength. When the wet tensile strength of the web is diminished, the material can break up under mechanical action found in the toilet and wastewater conveyance and treatment systems and separate into smaller pieces. These smaller pieces can more easily pass through these systems. Some non-limiting examples of triggers include boric acid, boric acid salts, sodium citrate, and sodium sulfate.

The disadvantage of using triggers is that they are only viable in water with certain chemical characteristics. Water that falls outside the viable range for a specific trigger can render it ineffective. For example, some triggers are ion-sensitive and require water with little or no ions present in order to facilitate the trigger mechanism. When wipes using these ion sensitive triggers are placed in water with a higher level of certain ions, such as in hard water, the trigger is rendered ineffective. Hard water is found in toilets, wastewater conveyance, and wastewater treatment systems across North America and Europe and limits where wipes with these types of triggers can effectively be used.

Nonwoven articles using water-sensitive films are also known in the art. However, difficulties have been identified with these articles because many water-sensitive materials like polyvinyl alcohol become dimensionally unstable when exposed to conditions of moderate to high humidity and tend to weaken, stretch, or even breakdown completely when the wipe is pre-moistened, for example a moist toilet tissue or baby wipe. Such materials can stretch out of shape and/or weaken to the point of tearing during use. While increasing film thickness adds stability, it also results in an unacceptable cost and renders disposal difficult. Articles made of thicker films have a greater tendency to remain intact on flushing and clog toilets or downstream systems.

Thus, there remains a need for a wipe material that is strong enough for its intended use, and yet be easily disposed of in an existing toilet and subsequent wastewater conveyance and treatment system. There is also the need for a flushable wipe material with the desired degree of softness for use on skin that can be prepared in an economical manner. The disclosed subject matter addresses these needs.

SUMMARY OF THE INVENTION

The presently disclosed subject matter advantageously provides for an economical wipe material that not only has sufficient dry and wet strength for use in cleaning bodily waste, but also easily disperses after being flushed in a toilet and passing through a common wastewater conveyance system and treatment system.

In certain embodiments, the material is a dispersible, multistrata nonwoven wipe material. In particular embodiments, the nonwoven wipe material includes a first layer that includes from about 50 to about 100 weight percent cellulosic fibers and from about 0 to about 50 weight percent bicomponent fibers; and a second layer that includes from about 50 to about 100 weight percent cellulosic fibers and from about 0 to about 50 weight percent bicomponent fibers. In particular embodiments, the nonwoven wipe material further includes a third layer that includes from about 50 to about 100 weight percent cellulosic fibers and from about 0 to about 50 weight percent bicomponent fibers. In one embodiment, the nonwoven wipe material further includes a fourth layer that includes from about 50 to about 100 weight percent cellulosic fibers and from about 0 to about 50 weight percent bicomponent fibers.

In one embodiment, the first and third layers comprise from about 75 to about 100 weight percent cellulosic fibers and from about 0 to about 25 weight percent bicomponent fibers; and the second layer includes from about 95 to about 100 weight percent cellulosic fibers and from about 0 to about 5 weight percent bicomponent fibers.

In certain embodiments, the dispersible, multistrata nonwoven wipe material includes a first layer that includes from about 50 to about 100 weight percent cellulosic fibers and from about 0 to about 50 weight percent bicomponent fibers; the second layer includes from about 95 to about 100 weight percent cellulosic fibers and from about 0 to about 5 weight percent bicomponent fibers; and the third layer includes from about 50 to about 95 weight percent cellulosic fibers and from about 5 to about 50 weight percent bicomponent fibers.

In particular embodiments, the dispersible, multistrata nonwoven wipe material includes four layers. In one embodiment, the first layer includes from about 60 to about 100 weight percent cellulosic fibers and from about 0 to about 40 weight percent bicomponent fibers; the second and third layers comprise from about 95 to about 100 weight percent cellulosic fibers and from about 0 to about 5 weight percent bicomponent fibers; and the fourth layer includes from about 50 to about 95 weight percent cellulosic fibers and from about 5 to about 50 weight percent bicomponent fibers.

In certain embodiments, the dispersible, multistrata nonwoven wipe material is stable in a wetting liquid.

In certain embodiments, at least a portion of at least one outer layer of the dispersible, multistrata nonwoven wipe material is coated with binder. In particular embodiments, the binder is water-soluble. In one embodiment, the binder is selected from the group that includes polyethylene powders, copolymer binders, vinylacetate ethylene binders, styrene-butadiene binders, urethanes, urethane-based binders, acrylic binders, thermoplastic binders, natural polymer based binders, and mixtures thereof. In particular embodiments, the amount of binder is from about 4 to about 12 weight percent of the material.

In one embodiment, the dispersible, multistrata nonwoven wipe material has a basis weight of from about 30 gsm to about 200 gsm. In some embodiments, the nonwoven wipe material has a CDW greater than about 200 gli. In particular embodiments, the nonwoven wipe material has a CDW greater than about 250 gli. In one embodiment, the nonwoven wipe material has a caliper of from about 0.25 mm to about 4 mm.

In certain embodiments, the dispersible, multistrata nonwoven wipe material passes an INDA Guidelines FG 512.1 Column Settling Test. In one embodiment, the nonwoven wipe material passes an INDA Guidelines FG 521.1 30 Day Laboratory Household Pump Test. In particular embodiments, the nonwoven wipe material has greater than about a 90% weight percent of wipes passing through system in an INDA Guidelines FG 521.1 30 Day Laboratory Household Pump Test.

In particular embodiments of the dispersible, multistrata nonwoven wipe material, the first layer includes a bottom surface and a top surface wherein at least a portion of the top surface of the first layer is coated with binder; and the third layer includes a bottom surface and a top surface wherein at least a portion of the bottom surface of the third layer is coated with binder.

In some embodiments, at least a portion of the cellulose fiber is modified in at least one layer of the dispersible, multistrata nonwoven wipe material. In particular embodiments, the cellulose fiber is modified by at least one compound selected from the group consisting of polyvalent cation containing compound, polycationic polymer, and polyhydroxy compound.

In one embodiment, the dispersible, multistrata nonwoven wipe material includes a first layer that includes from about 75 to about 100 weight percent cellulosic fibers and from about 0 to about 25 weight percent bicomponent fibers; a second layer that includes from about 0 to about 20 weight percent cellulosic fibers and from about 80 to about 100 weight percent bicomponent fibers; and a third layer that includes from about 75 to about 100 weight percent cellulosic fibers and from about 0 to about 25 weight percent bicomponent fibers; wherein the nonwoven wipe material is stable in a wetting liquid. In one embodiment, the first layer includes a bottom surface and a top surface wherein at least a portion of the top surface of the first layer is coated with binder. In certain embodiments, the third layer includes a bottom surface and a top surface wherein at least a portion of the bottom surface of the third layer is coated with binder. In some embodiments, at least a portion of the cellulose fiber is modified in at least one layer.

BRIEF DESCRIPTION OF THE DRAWINGS

FIG. 4 depicts a schematic of the Tip Tube apparatus.

FIG. 11A depicts the chemical structures of 3,6,9-trioxaundecane-1,11-diol and 3,6,9,12-tetraoxatetradecane-1,14-diol. FIG. 11B depicts the chemical structure of 3,6,9,12,15,18,21,24,27,30,33,36,39,42-tetradecaoxatetratetracontane-1,44-diol and 3,6,9,12,15,18,21,24,27,30,33,36,39,42,45-pentadecaoxaheptatetracontane-1,47-diol.

FIG. 17 depicts the lab wet-forming apparatus used to form wipe sheets.

FIG. 33 depicts a schematic of the North American Toilet Bowl and Drain line Clearance Test.

FIG. 34 depicts a schematic of the European Toilet Bowl and Drain line Clearance Test.

DETAILED DESCRIPTION

Figure 1:
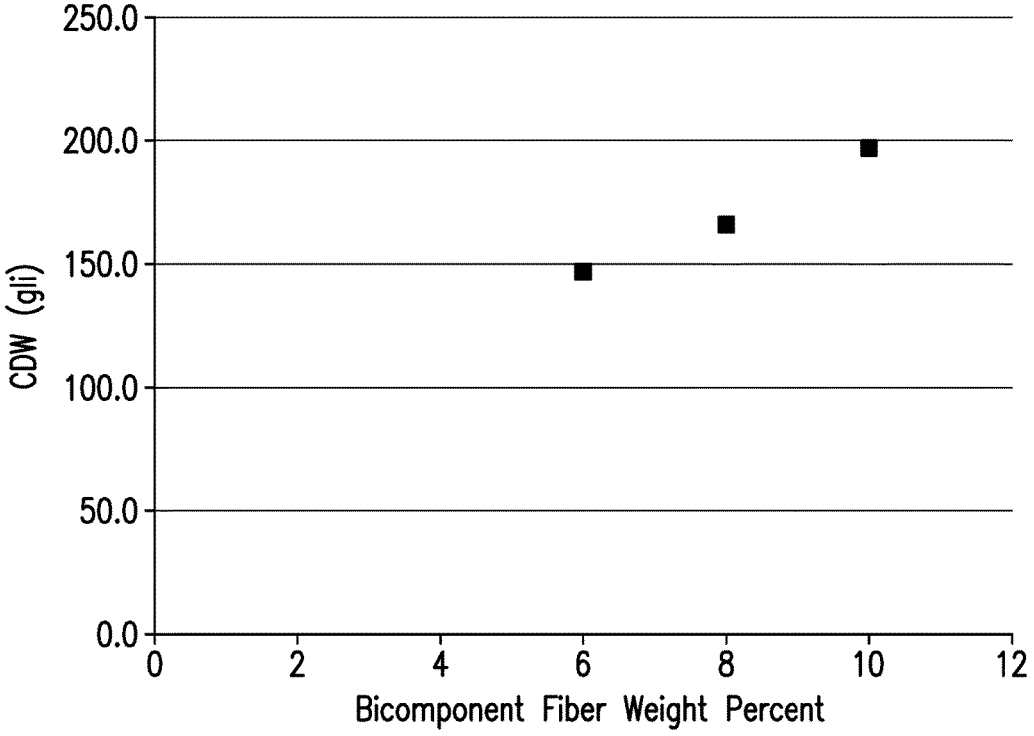
FIG. 1 depicts a graph showing the CDW tensile strength of the samples as the weight percentage of bicomponent fiber increases. The graph shows the CDW tensile strength (y-axis) versus the weight percent of bicomponent fiber in the sample (x-axis).

The presently disclosed subject matter provides a flushable and dispersible nonwoven wipe material that maintains high strength in a wetting solution. The presently disclosed subject matter also provides for a process for making such wipe materials. These and other aspects of the invention are discussed more in the detailed description and examples.

Definitions

The terms used in this specification generally have their ordinary meanings in the art, within the context of this invention and in the specific context where each term is used. Certain terms are defined below to provide additional guidance in describing the compositions and methods of the invention and how to make and use them.

As used herein, a "nonwoven" refers to a class of material, including but not limited to textiles or plastics. Nonwovens are sheet or web structures made of fiber, filaments, molten plastic, or plastic films bonded together mechanically, thermally, or chemically. A nonwoven is a fabric made directly from a web of fiber, without the yarn preparation necessary for weaving or knitting. In a nonwoven, the assembly of fibers is held together by one or more of the following: (1) by mechanical interlocking in a random web or mat; (2) by fusing of the fibers, as in the case of thermoplastic fibers; or (3) by bonding with a cementing medium such as a natural or synthetic resin.

As used herein, a "wipe" is a type of nonwoven article suitable for cleansing or disinfecting or for applying or removing an active compound. In particular, this term refers to an article for cleansing the body, including the removal of bodily waste.

As used herein, the term "flushable" refers to the ability of a material, when flushed, to clear the toilet and trap and the drain lines leading to the municipal wastewater conveyance system.

As used herein, the term "dispersible" refers to the ability of a material to readily break apart in water due to physical forces. In particular, the term "dispersible" refers to the ability of a material to readily break apart due to the physical forces encountered during flushing in a common toilet, conveyance in a common wastewater system, and processing in a common treatment system. In certain embodiments, the term "dispersible" refers to materials which pass the INDA & EDANA Guidance Document for Assessing the Flushability of Nonwoven Consumer Products, Second Edition, July 2009 FG 521.1 Laboratory Household Pump Test.

As used herein, the term "buoyancy" refers to the ability of a material to settle in various wastewater treatment systems (e.g., septic tanks, grit chamber, primary and secondary clarifiers, and sewage pump basin and lift station wet wells). In particular, the term "buoyancy" refers to materials which pass the INDA & EDANA Guidance Document for Assessing the Flushability of Nonwoven Consumer Products, Second Edition, July 2009 FG 512.1 Column Settling Test.

As used herein, the term "aerobic biodegradation" refers to the ability of a material to disintegrate in aerobic environments. In particular, the term "aerobic biodegradation" refers to the disintegration measured by the INDA & EDANA Guidance Document for Assessing the Flushability of Nonwoven Consumer Products, Second Edition, July 2009 FG 513.2 Aerobic Biodegradation Test.

As used herein, the term "weight percent" is meant to refer to either (i) the quantity by weight of a constituent/component in the material as a percentage of the weight of a layer of the material; or (ii) to the quantity by weight of a constituent/component in the material as a percentage of the weight of the final nonwoven material or product.

The term "basis weight" as used herein refers to the quantity by weight of a compound over a given area. Examples of the units of measure include grams per square meter as identified by the acronym "gsm".

As used herein, the terms "high strength" or "high tensile strength" refer to the strength of the material and is typically measured in cross directional wet strength and machine direction dry strength but, can also be measured in cross directional dry strength and machine direction wet strength. It can also refer to the strength required to delaminate strata or layers within a structure in the wet or dry state.

As used herein, the terms "gli," "g/in," and "G/in" refer to "grams per linear inch" or "gram force per inch." This refers to the width, not the length, of a test sample for tensile strength testing.

As used in the specification and the appended claims, the singular forms "a," "an" and "the" include plural referents unless the context clearly dictates otherwise. Thus, for example, reference to "a compound" includes mixtures of compounds.

The term "about" or "approximately" means within an acceptable error range for the particular value as determined by one of ordinary skill in the art, which will depend in part on how the value is measured or determined, i.e., the limitations of the measurement system. For example, "about" can mean within 3 or more than 3 standard deviations, per the practice in the art. Alternatively, "about" can mean a range of up to 20%, preferably up to 10%, more preferably up to 5%, and more preferably still up to 1% of a given value. Alternatively, particularly with respect to systems or processes, the term can mean within an order of magnitude, preferably within 5-fold, and more preferably within 2-fold, of a value.

Fibers

The nonwoven material of the presently disclosed subject matter comprises fibers. The fibers can be natural, synthetic, or a mixture thereof. In one embodiment, the fibers can be cellulose-based fibers, one or more synthetic fibers, or a mixture thereof. Any cellulose fibers known in the art, including cellulose fibers of any natural origin, such as those derived from wood pulp, can be used in a cellulosic layer. Preferred cellulose fibers include, but are not limited to, digested fibers, such as kraft, prehydrolyzed kraft, soda, sulfite, chemi-thermal mechanical, and thermo-mechanical treated fibers, derived from softwood, hardwood or cotton linters. More preferred cellulose fibers include, but are not limited to, kraft digested fibers, including prehydrolyzed kraft digested fibers. Non-limiting examples of cellulosic fibers suitable for use in this invention are the cellulose fibers derived from softwoods, such as pines, firs, and spruces. Other suitable cellulose fibers include, but are not limited to, those derived from Esparto grass, bagasse, kemp, flax, hemp, kenaf, and other lignaceous and cellulosic fiber sources. Suitable cellulose fibers include, but are not limited to, bleached Kraft southern pine fibers sold under the trademark FOLEY FLUFFS® (Buckeye Technologies Inc., Memphis, Tenn.).

The nonwoven materials of the invention can also include, but are not limited to, a commercially available bright fluff pulp including, but not limited to, southern softwood fluff pulp (such as Treated FOLEY FLUFFS®) northern softwood sulfite pulp (such as T 730 from Weyerhaeuser), or hardwood pulp (such as eucalyptus). The preferred pulp is Treated FOLEY FLUFFS® from Buckeye Technologies Inc. (Memphis, Tenn.), however any absorbent fluff pulp or mixtures thereof can be used. Also preferred is wood cellulose, cotton linter pulp, chemically modified cellulose such as cross-linked cellulose fibers and highly purified cellulose fibers. The most preferred pulps are FOLEY FLUFFS® FFTAS (also known as FFTAS or Buckeye Technologies FFT-AS pulp), and Weyco CF401. The fluff fibers can be blended with synthetic fibers, for example polyester, nylon, polyethylene or polypropylene.

In particular embodiments, the cellulose fibers in a particular layer comprise from about 25 to about 100 percent by weight of the layer. In one embodiment, the cellulose fibers in a particular layer comprise from about 0 to about 20 percent by weight of the layer, or from about 0 to about 25 percent by weight of the layer. In certain embodiments, the cellulose fibers in a particular layer comprise from about 50 to about 100 percent by weight of the layer, or from about 60 to about 100 percent by weight of the layer, or from about 50 to about 95 percent by weight of the layer. In one preferred embodiment, the cellulose fibers in a particular layer comprise from about 75 to about 100 percent by weight of the layer. In some embodiments, the cellulose fibers in a particular layer comprise from about 80 to about 100 percent by weight of the layer. In another preferred embodiment, the cellulose fibers in a particular layer comprise from about 95 to about 100 percent by weight of the layer.

Other suitable types of cellulose fiber include, but are not limited to, chemically modified cellulose fibers. In particular embodiments, the modified cellulose fibers are crosslinked cellulose fibers. U.S. Pat. Nos. 5,492,759; 5,601,921; 6,159,335, all of which are hereby incorporated by reference in their entireties, relate to chemically treated cellulose fibers useful in the practice of this invention. In certain embodiments, the modified cellulose fibers comprise a polyhydroxy compound. Non-limiting examples of polyhydroxy compounds include glycerol, trimethylolpropane, pentaerythritol, polyvinyl alcohol, partially hydrolyzed polyvinyl acetate, and fully hydrolyzed polyvinyl acetate. In certain embodiments, the fiber is treated with a polyvalent cation-containing compound. In one embodiment, the polyvalent cation-containing compound is present in an amount from about 0.1 weight percent to about 20 weight percent based on the dry weight of the untreated fiber. In particular embodiments, the polyvalent cation containing compound is a polyvalent metal ion salt. In certain embodiments, the polyvalent cation containing compound is selected from the group consisting of aluminum, iron, tin, salts thereof, and mixtures thereof. In a preferred embodiment, the polyvalent metal is aluminum.

Any polyvalent metal salt including transition metal salts may be used. Non-limiting examples of suitable polyvalent metals include beryllium, magnesium, calcium, strontium, barium, titanium, zirconium, vanadium, chromium, molybdenum, tungsten, manganese, iron, cobalt, nickel, copper, zinc, aluminum and tin. Preferred ions include aluminum, iron and tin. The preferred metal ions have oxidation states of +3 or +4. Any salt containing the polyvalent metal ion may be employed. Non-limiting examples of examples of suitable inorganic salts of the above metals include chlorides, nitrates, sulfates, borates, bromides, iodides, fluorides, nitrides, perchlorates, phosphates, hydroxides, sulfides, carbonates, bicarbonates, oxides, alkoxides phenoxides, phosphites, and hypophosphites. Non-limiting examples of examples of suitable organic salts of the above metals include formates, acetates, butyrates, hexanoates, adipates, citrates, lactates, oxalates, propionates, salicylates, glycinates, tartrates, glycolates, sulfonates, phosphonates, glutamates, octanoates, benzoates, gluconates, maleates, succinates, and 4,5-dihydroxy-benzene-1,3-disulfonates. In addition to the polyvalent metal salts, other compounds such as complexes of the above salts include, but are not limited to, amines, ethylenediaminetetra-acetic acid (EDTA), diethylenetriaminepenta-acetic acid (DIPA), nitrilotri-acetic acid (NTA), 2,4-pentanedione, and ammonia may be used.

In one embodiment, the cellulose pulp fibers are chemically modified cellulose pulp fibers that have been softened or plasticized to be inherently more compressible than unmodified pulp fibers. The same pressure applied to a plasticized pulp web will result in higher density than when applied to an unmodified pulp web. Additionally, the densified web of plasticized cellulose fibers is inherently softer than a similar density web of unmodified fiber of the same wood type. Softwood pulps may be made more compressible using cationic surfactants as debonders to disrupt inter-fiber associations. Use of one or more debonders facilitates the disintegration of the pulp sheet into fluff in the airlaid process. Examples of debonders include, but are not limited to, those disclosed in U.S. Pat. Nos. 4,432,833, 4,425,186 and 5,776,308, all of which are hereby incorporated by reference in their entireties. One example of a debonder-treated cellulose pulp is FFLE+. Plasticizers for cellulose, which can be added to a pulp slurry prior to forming wetlaid sheets, can also be used to soften pulp, although they act by a different mechanism than debonding agents. Plasticizing agents act within the fiber, at the cellulose molecule, to make flexible or soften amorphous regions. The resulting fibers are characterized as limp. Since the plasticized fibers lack stiffness, the comminuted pulp is easier to densify compared to fibers not treated with plasticizers. Plasticizers include, but are not limited to, polyhydric alcohols such as glycerol; low molecular weight polyglycol such as polyethylene glycols and polyhydroxy compounds. These and other plasticizers are described and exemplified in U.S. Pat. Nos. 4,098,996, 5,547,541 and 4,731,269, all of which are hereby incorporated by reference in their entireties. Ammonia, urea, and alkylamines are also known to plasticize wood products, which mainly contain cellulose (A. J. Stamm, Forest Products Journal 5(6):413, 1955, hereby incorporated by reference in its entirety.

In particular embodiments, the cellulose fibers are modified with a polycationic polymer. Such polymers include, but are not limited to, homo- or copolymers of at least one monomer including a functional group. The polymers can have linear or branched structures. Non-limiting examples of polycationic polymers include cationic or cationically modified polysaccharides, such as cationic starch derivatives, cellulose derivatives, pectin, galactoglucommanan, chitin, chitosan or alginate, a polyallylamine homo- or copolymer, optionally including modifier units, for example polyallylamine hydrochloride; polyethylenemine (PEI), a polyvinylamine homo- or copolymer optionally including modifier units, poly(vinylpyridine) or poly(vinylpyridinium salt) homo- or copolymer, including their N-alkyl derivatives, polyvinylpyrrolidone homo- or copolymer, a polydiallyldialkyl, such as poly(N,N-diallyl-N,N-dimethylammonium chloride) (PDDA), a homo- or copolymer of a quaternized di-C.sub.1-C.sub.4-alkyl-aminoethyl acrylate or methacrylate, for example a poly(2-hydroxy-3-methacryloylpropyl-tri-C.sub.1-C.sub.2-alkylammonium salt) homopolymer such as a poly(2-hydroxy-3-methacryloylpropyl trimethylammonium chloride), or a quaternized poly(2-dimethylaminoethyl methacrylate or a quaternized poly(vinylpyrrolidone-co-2-dimethylaminoethyl methacrylate) a poly(vinylbenzyl-tri-C.sub.1-C.sub.4-alkylammonium salt), for example a poly(vinylbenzyl-tri-methylammoniumchloride), polymers formed by reaction between ditertiary amines or secondary amines and dihaloalkanes, including a polymer of an aliphatic or araliphatic dihalide and an aliphatic N,N,N',N'-tetra-C.sub.1-C.sub.4-alkyl-alkylenediamine, a polyaminoamide (PAMAM), for example a linear PAMAM or a PAMAM dendrimer, cationic acrylamide homo- or copolymers, and their modification products, such as poly(acrylamide-co-diallyldimethylammonium chloride) or glyoxal-acrylamide-resins; polymers formed by polymerisation of N-(dialkylaminoalkyl)acrylamide monomers, condensation products between dicyandiamides, formaldehyde and ammonium salts, typical wet strength agents used in paper manufacture, such as urea-formaldehyde resins, melamine-formaldehyde resins, polyvinyl amine, polyureide-formaldehyde resins, glyoxal-acrylamide resins and cationic materials obtained by the reaction of polyalkylene polyamines with polysaccharides such as starch and various natural gums, as well as 3-hydroxyazetidinium ion-containing resins, which are obtained by reacting nitrogen-containing compounds (e.g., ammonia, primary and secondary amine or N-containing polymers) with epichlorohydrine such as polyaminoamide-epichlorohydrine resins, polyamine-epichlorohydrine resins and aminopolymer-epichlorohydrine resins.

In addition to the use of cellulose fibers, the presently disclosed subject matter also contemplates the use of synthetic fibers. In one embodiment, the synthetic fibers comprise bicomponent fibers. Bicomponent fibers having a core and sheath are known in the art. Many varieties are used in the manufacture of nonwoven materials, particularly those produced for use in airlaid techniques. Various bicomponent fibers suitable for use in the presently disclosed subject matter are disclosed in U.S. Pat. Nos. 5,372,885 and 5,456,982, both of which are hereby incorporated by reference in their entireties. Examples of bicomponent fiber manufacturers include, but are not limited to, Trevira (Bobingen, Germany), Fiber Innovation Technologies (Johnson City, Tenn.) and ES Fiber Visions (Athens, Ga.).

Bicomponent fibers can incorporate a variety of polymers as their core and sheath components. Bicomponent fibers that have a PE (polyethylene) or modified PE sheath typically have a PET (polyethyleneterephthalate) or PP (polypropylene) core. In one embodiment, the bicomponent fiber has a core made of polyester and sheath made of polyethylene. The denier of the bicomponent fiber preferably ranges from about 1.0 dpf to about 4.0 dpf, and more preferably from about 1.5 dpf to about 2.5 dpf. The length of the bicomponent fiber is from about 3 mm to about 36 mm, preferably from about 3 mm to about 12 mm, more preferably from about 6 mm to about 12 In particular embodiments, the length of the bicomponent fiber is from about 8 mm to about 12 mm, or about 10 mm to about 12 mm. A preferred bicomponent fiber is Trevira T255 which contains a polyester core and a polyethylene sheath modified with maleic anhydride. T255 has been produced in a variety of deniers, cut lengths and core—sheath configurations with preferred configurations having a denier from about 1.7 dpf to 2.0 dpf and a cut length of about 4 mm to 12 mm and a concentric core-sheath configuration and a most preferred bicomponent fiber being Trevira 1661, T255, 2.0 dpf and 12 mm in length. In an alternate embodiment, the bicomponent fiber is Trevira 1663, T255, 2.0 dpf, 6 mm. Bicomponent fibers are typically fabricated commercially by melt spinning. In this procedure, each molten polymer is extruded through a die, for example, a spinneret, with subsequent pulling of the molten polymer to move it away from the face of the spinneret. This is followed by solidification of the polymer by heat transfer to a surrounding fluid medium, for example chilled air, and taking up of the now solid filament. Non-limiting examples of additional steps after melt spinning can also include hot or cold drawing, heat treating, crimping and cutting. This overall manufacturing process is generally carried out as a discontinuous two-step process that first involves spinning of the filaments and their collection into a tow that comprises numerous filaments. During the spinning step, when molten polymer is pulled away from the face of the spinneret, some drawing of the filament does occur which can also be called the draw-down. This is followed by a second step where the spun fibers are drawn or stretched to increase molecular alignment and crystallinity and to give enhanced strength and other physical properties to the individual filaments. Subsequent steps can include, but are not limited to, heat setting, crimping and cutting of the filament into fibers. The drawing or stretching step can involve drawing the core of the bicomponent fiber, the sheath of the bicomponent fiber or both the core and the sheath of the bicomponent fiber depending on the materials from which the core and sheath are comprised as well as the conditions employed during the drawing or stretching process.

Bicomponent fibers can also be formed in a continuous process where the spinning and drawing are done in a continuous process. During the fiber manufacturing process it is desirable to add various materials to the fiber after the melt spinning step at various subsequent steps in the process. These materials can be referred to as "finish" and be comprised of active agents such as, but not limited to, lubricants and anti-static agents. The finish is typically delivered via an aqueous based solution or emulsion. Finishes can provide desirable properties for both the manufacturing of the bicomponent fiber and for the user of the fiber, for example in an airlaid or wetlaid process. In accordance with standard terminology of the fiber and filament industry, the following definitions apply to the terms used herein:

References relating to fibers and filaments, including those of man-made thermoplastics, and incorporated herein by reference, are, for example: (a) Encyclopedia of Polymer Science and Technology, Interscience, New York, vol. 6 (1967), pp. 505-555 and vol. 9 (1968), pp. 403-440; (b) Kirk-Othmer Encyclopedia of Chemical Technology, vol. 16 for "Olefin Fibers", John Wiley and Sons, New York, 1981, 3rd edition; (c) Man Made and Fiber and Textile Dictionary, Celanese Corporation; (d) Fundamentals of Fibre Formation—The Science of Fibre Spinning and Drawing, Adrezij Ziabicki, John Wiley and Sons, London/New York, 1976; and (e) Man Made Fibres, by R. W. Moncrieff, John Wiley and Sons, London/New York, 1975.

Numerous other processes are involved before, during and after the spinning and drawing steps and are disclosed in U.S. Pat. Nos. 4,950,541, 5,082,899, 5,126,199, 5,372,885, 5,456,982, 5,705,565, 2,861,319, 2,931,091, 2,989,798, 3,038,235, 3,081,490, 3,117,362, 3,121,254, 3,188,689, 3,237,245, 3,249,669, 3,457,342, 3,466,703, 3,469,279, 3,500,498, 3,585,685, 3,163,170, 3,692,423, 3,716,317, 3,778,208, 3,787,162, 3,814,561, 3,963,406, 3,992,499, 4,052,146, 4,251,200, 4,350,006, 4,370,114, 4,406,850, 4,445,833, 4,717,325, 4,743,189, 5,162,074, 5,256,050, 5,505,889, 5,582,913, and 6,670,035, all of which are hereby incorporated by reference in their entireties.

The presently disclosed subject matter can also include, but are not limited to, articles that contain bicomponent fibers that are partially drawn with varying degrees of draw or stretch, highly drawn bicomponent fibers and mixtures thereof. These can include, but are not limited to, a highly drawn polyester core bicomponent fiber with a variety of sheath materials, specifically including a polyethylene sheath such as Trevira T255 (Bobingen, Germany) or a highly drawn polypropylene core bicomponent fiber with a variety of sheath materials, specifically including a polyethylene sheath such as ES FiberVisions AL-Adhesion-C (Varde, Denmark). Additionally, Trevira T265 bicomponent fiber (Bobingen, Germany), having a partially drawn core with a core made of polybutylene terephthalate (PBT) and a sheath made of polyethylene can be used. The use of both partially drawn and highly drawn bicomponent fibers in the same structure can be leveraged to meet specific physical and performance properties based on how they are incorporated into the structure.

The bicomponent fibers of the presently disclosed subject matter are not limited in scope to any specific polymers for either the core or the sheath as any partially drawn core bicomponent fiber could provide enhanced performance regarding elongation and strength. The degree to which the partially drawn bicomponent fibers are drawn is not limited in scope as different degrees of drawing will yield different enhancements in performance. The scope of the partially drawn bicomponent fibers encompasses fibers with various core sheath configurations including, but not limited to concentric, eccentric, side by side, islands in a sea, pie segments and other variations. The relative weight percentages of the core and sheath components of the total fiber can be varied. In addition, the scope of this invention covers the use of partially drawn homopolymers such as polyester, polypropylene, nylon, and other melt spinnable polymers. The scope of this invention also covers multicomponent fibers that can have more than two polymers as part of the fibers structure.

In particular embodiments, the bicomponent fibers in a particular layer comprise from about 0 to about 100 percent by weight of the layer. In certain embodiments, the bicomponent fibers in a particular layer comprise from about 0 to about 75 percent by weight of the layer, or from about 0 to about 80 percent by weight of the layer. In a particular embodiment, the bicomponent fibers in a particular layer comprise from about 0 to about 50 percent by weight of the layer. In certain embodiments, the bicomponent fibers in a particular layer comprise from about 5 to about 50 percent by weight of the layer. In a preferred embodiment, the bicomponent fibers in a particular layer comprise from about 0 to about 25 percent by weight of the layer. In another preferred embodiment, the bicomponent fibers in a particular layer comprise from about 0 to about 5 percent by weight of the layer. In certain embodiments, the bicomponent fibers in a particular layer comprise from about 50 to about 95 percent by weight of the layer, or from about 80 to about 100 percent by weight of the layer. In particular embodiments, the bicomponent fibers in a particular layer comprise about 0 to about 40 percent by weight of the layer.

Other synthetic fibers suitable for use in various embodiments as fibers or as bicomponent binder fibers include, but are not limited to, fibers made from various polymers including, by way of example and not by limitation, acrylic, polyamides (including, but not limited to, Nylon 6, Nylon 6/6, Nylon 12, polyaspartic acid, polyglutamic acid), polyamines, polyimides, polyacrylics (including, but not limited to, polyacrylamide, polyacrylonitrile, esters of methacrylic acid and acrylic acid), polycarbonates (including, but not limited to, polybisphenol A carbonate, polypropylene carbonate), polydienes (including, but not limited to, polybutadiene, polyisoprene, polynorbomene), polyepoxides, polyesters (including, but not limited to, polyethylene terephthalate, polybutylene terephthalate, polytrimethylene terephthalate, polycaprolactone, polyglycolide, polylactide, polyhydroxybutyrate, polyhydroxyvalerate, polyethylene adipate, polybutylene adipate, polypropylene succinate), polyethers (including, but not limited to, polyethylene glycol (polyethylene oxide), polybutylene glycol, polypropylene oxide, polyoxymethylene (paraformaldehyde), polytetramethylene ether (polytetrahydrofuran), polyepichlorohydrin), polyfluorocarbons, formaldehyde polymers (including, but not limited to, urea-formaldehyde, melamine-formaldehyde, phenol formaldehyde), natural polymers (including, but not limited to, cellulosics, chitosans, lignins, waxes), polyolefins (including, but not limited to, polyethylene, polypropylene, polybutylene, polybutene, polyoctene), polyphenylenes (including, but not limited to, polyphenylene oxide, polyphenylene sulfide, polyphenylene ether sulfone), silicon containing polymers (including, but not limited to, polydimethyl siloxane, polycarbomethyl silane), polyurethanes, polyvinyls (including, but not limited to, polyvinyl butyral, polyvinyl alcohol, esters and ethers of polyvinyl alcohol, polyvinyl acetate, polystyrene, polymethylstyrene, polyvinyl chloride, polyvinyl pryrrolidone, polymethyl vinyl ether, polyethyl vinyl ether, polyvinyl methyl ketone), polyacetals, polyarylates, and copolymers (including, but not limited to, polyethylene-co-vinyl acetate, polyethylene-co-acrylic acid, polybutylene terephthalate-co-polyethylene terephthalate, polylauryllactam-block-polytetrahydrofuran), polybuylene succinate and polylactic acid based polymers.

Useful in various embodiments of this invention are multicomponent fibers having enhanced reversible thermal properties as described in U.S. Pat. No. 6,855,422, which is hereby incorporated by reference in its entirety. These multicomponent fibers contain temperature regulating materials, generally phase change materials have the ability to absorb or release thermal energy to reduce or eliminate heat flow. In general, a phase change material can comprise any substance, or mixture of substances, that has the capability of absorbing or releasing thermal energy to reduce or eliminate heat flow at or within a temperature stabilizing range. The temperature stabilizing range can comprise a particular transition temperature or range of transition temperatures. A phase change material used in conjunction with various embodiments of the invention preferably will be capable of inhibiting a flow of thermal energy during a time when the phase change material is absorbing or releasing heat, typically as the phase change material undergoes a transition between two states, including, but not limited to, liquid and solid states, liquid and gaseous states, solid and gaseous states, or two solid states. This action is typically transient, and will occur until a latent heat of the phase change material is absorbed or released during a heating or cooling process. Thermal energy can be stored or removed from the phase change material, and the phase change material typically can be effectively recharged by a source of heat or cold. By selecting an appropriate phase change material, the multi-component fiber can be designed for use in any one of numerous products.

In certain non-limiting embodiments of this invention, high strength bicomponent fibers are included. It is desired to use a minimal amount of synthetic bicomponent fiber in the wiping substrate in order to reduce cost, reduce environmental burden and improve biodegradability performance. Bicomponent fiber that delivers higher strength, especially higher wet strength, can be used at a lower add-on level versus standard bicomponent fiber to help achieve these desired performance attributes in a Flushable Dispersible wipe. These higher strength bicomponent fibers can be used in other wipes, for example, non-flushable, non-dispersible wipes such as baby wipes, hard surface cleaning wipes or in other products made by the airlaid manufacturing process such as floor cleaning substrates, feminine hygiene substrates and table top substrates or in other technologies with varied end-use applications including, but not limited to nonwoven processes such as but not limited to carding, spunlacing, needlepunching, wetlaid and other various nonwoven, woven and web forming processes.

Increasing the strength of a bicomponent fiber is known in the art via a number of different approaches or technologies that have been presented in presentations, patents, journal articles, etc. These technologies have been demonstrated individually and in combination with each other. For example, when a bicomponent fiber has a polyethylene sheath, then known technologies such incorporating maleic anhydride or other chemically similar additives to the polyethylene sheath have been show to increase the bonding strength, as measured by the cross directional wet strength, in an airlaid web. Such bicomponent fibers with a polyethylene sheath may have polyester core, a polypropylene core, a polylactic acid core, a nylon core or any other melt-spinnable polymer with a higher melting point than the polyethylene sheath. Another example is reducing the denier of the bicomponent fiber such that there are more fibers per unit mass which provides more bonding points in the web. Combining the lower denier technology with the maleic anhydride technology has also been shown to provide a further increase in strength over either of these technologies by themselves.

This invention shows that a further, significant increase in bonding strength can be achieved by the addition of very low levels of polyethylene glycols, such as PEG200, to the surface of the polyethylene sheath based bicomponent fiber. The mechanism behind this increase in strength is not fully defined and may include, but is not limited to, enhancing the bonding or efficiency of bonding between the bicomponent fiber and itself or other bicomponent fibers, between the bicomponent fiber and the cellulose fibers or between the cellulose fiber and itself or other cellulose fibers. Such bonding efficiency my include, but is not limited to, covalent bonding, hydrogen bonding, chelation effects, steric effects or other mechanisms that may enhance the strength of the airlaid web. In certain embodiments, the concentration of PEG200 is about 50 ppm to about 1,000 ppm. In particular embodiments, the concentration of PEG200 is about 50 ppm to about 500 ppm.

Other materials that may have similar function include, but are not limited to, ethylene glycol, glycerol and polyethylene glycols of any molecular weight, but preferably of about 100 molecular weight to about 2000 molecular weight, ethoxylated penterythiritol, ethoxylated sorbitol, polyvinyl alcohols, 4-hydroxybutanoic acid, 5-hydroxypentanoic acid, 6-hydroxyhexanoic acid, 7-hydroxyheptanoic acid, 8-hydroxyoctanoic acid, 9-hydroxynonanoic acid, 10-hydroxydecanoic acid, 11-hydroxyundecanoic acid, 12-hydroxydodecanoic acid and polypropylene glycols.

Polyethylene glycols, including PEG 200, are widely available in a range of commercial grades. Polyethylene glycols, including PEG200, are typically not a single defined structure, but a blend of materials with a nominal basis weight. For example, PEG200 defines a polyethylene glycol with a nominal molecular weight of 200 grams per mole. For example, commercially available PEG200 could be a blend of materials including predominantly 3,6,9-trioxaundecane-1,11-diol and a minority amount of 3,6,9,12-tetraoxatetradecane-1,14-diol as shown in FIG. 11, but could also include other polyethylene glycols.

For example, PEG700 defines a polyethylene glycol with a nominal molecular weight of 700 grams per mole. For example, commercially available PEG700 could be a blend of materials including approximately equal proportions of 3,6,9,12,15,18,21,24,27,30,33,36,39,42-tetradecaoxatetratetracontane-1,44-diol and 3,6,9,12,15,18,21,24,27,30,33,36,39,42,45-pentadecaoxaheptatetracontane-1,47-diol as shown in FIG. 11B, but could also include other polyethylene glycols.

PEG200 should be applied to the surface of the polyethylene sheath bicomponent fiber in order to have the maximum positive impact on the strength of the web. The PEG200 can be added to the surface of the bicomponent fiber during the manufacturing of the bicomponent fiber, for example as part of a blend of lubricants and antistatic compounds that are typically added to a synthetic fiber for processing at the fiber manufacturer or the downstream customer, or it can be added by itself during a separate step of the manufacturing process. The PEG200 can also be added after the manufacturing of the bicomponent fiber in a secondary process.

Binders and Other Additives

Suitable binders include, but are not limited to, liquid binders and powder binders. Non-limiting examples of liquid binders include emulsions, solutions, or suspensions of binders. Non-limiting examples of binders include polyethylene powders, copolymer binders, vinylacetate ethylene binders, styrene-butadiene binders, urethanes, urethane-based binders, acrylic binders, thermoplastic binders, natural polymer based binders, and mixtures thereof.

Suitable binders include, but are not limited to, copolymers, vinylacetate ethylene ("VAE") copolymers which can have a stabilizer such as Wacker Vinnapas EF 539, Wacker Vinnapas EP907, Wacker Vinnapas EP129 Celanese Duroset E130, Celanese Dur-O-Set Elite 130 25-1813 and Celanese Dur-O-Set TX-849, Celanese 75-524A, polyvinyl alcohol-polyvinyl acetate blends such as Wacker Vinac 911, vinyl acetate homopolyers, polyvinyl amines such as BASF Luredur, acrylics, cationic acrylamides—polyacryliamides such as Bercon Berstrength 5040 and Bercon Berstrength 5150, hydroxyethyl cellulose, starch such as National Starch CATO RTM 232, National Starch CATO RTM 255, National Starch Optibond, National Starch Optipro, or National Starch OptiPLUS, guar gum, styrene-butadienes, urethanes, urethane-based binders, thermoplastic binders, acrylic binders, and carboxymethyl cellulose such as Hercules Aqualon CMC. In particular embodiments, the binder is a natural polymer based binder. Non-limiting examples of natural polymer based binders include polymers derived from starch, cellulose, chitin, and other polysaccharides.

In certain embodiments, the binder is water-soluble. In one embodiment, the binder is a vinylacetate ethylene copolymer. One non-limiting example of such copolymers is EP907 (Wacker Chemicals, Munich, Germany). Vinnapas EP907 can be applied at a level of about 10% solids incorporating about 0.75% by weight Aerosol OT (Cytec Industries, West Paterson, N.J.), which is an anionic surfactant. Other classes of liquid binders such as styrene-butadiene and acrylic binders can also be used.

In certain embodiments, the binder is not water-soluble. Examples of these binders include, but are not limited to, AirFlex 124 and 192 (Air Products, Allentown, Pa.) having an opacifier and whitener, including, but not limited to, titanium dioxide, dispersed in the emulsion can also be used. Other preferred binders include, but are not limited to, Celanese Emulsions (Bridgewater, N.J.) Elite 22 and Elite 33.

Polymers in the form of powders can also be used as binders. These powders can be thermoplastic or thermoset in nature. The powders can function in a similar manner as the fibers described above. In particular embodiments, polyethylene powder is used. Polyethylene includes, but is not limited to, high density polyethylene, low density polyethylene, linear low density polyethylene and other derivatives thereof. Polyethylenes are a preferred powder due to their low melting point. These polyethylene powders can have an additive to increase adhesion to cellulose such as a maleic or succinic additive. Other polymers suitable for use in various embodiments as powders, which may or may not contain additives to further enhance their bonding effectiveness, include, by way of example and not limitation, acrylic, polyamides (including, but not limited to, Nylon 6, Nylon 6/6, Nylon 12, polyaspartic acid, polyglutamic acid), polyamines, polyimides, polyacrylics (including, but not limited to, polyacrylamide, polyacrylonitrile, esters of methacrylic acid and acrylic acid), polycarbonates (including, but not limited to, polybisphenol A carbonate, polypropylene carbonate), polydienes (including, but not limited to, polybutadiene, polyisoprene, polynorbomene), polyepoxides, polyesters (including, but not limited to, polyethylene terephthalate, polybutylene terephthalate, polytrimethylene terephthalate, polycaprolactone, polyglycolide, polylactide, polyhydroxybutyrate, polyhydroxyvalerate, polyethylene adipate, polybutylene adipate, polypropylene succinate), polyethers (including, but not limited to, polyethylene glycol (polyethylene oxide), polybutylene glycol, polypropylene oxide, polyoxymethylene (paraformaldehyde), polytetramethylene ether (polytetrahydrofuran), polyepichlorohydrin), polyfluorocarbons, formaldehyde polymers (including, but not limited to, urea-formaldehyde, melamine-formaldehyde, phenol formaldehyde), natural polymers (including, but not limited to, cellulosics, chitosans, lignins, waxes), polyolefins (including, but not limited to, polyethylene, polypropylene, polybutylene, polybutene, polyoctene), polyphenylenes (including, but not limited to, polyphenylene oxide, polyphenylene sulfide, polyphenylene ether sulfone), silicon containing polymers (including, but not limited to, polydimethyl siloxane, polycarbomethyl silane), polyurethanes, polyvinyls (including, but not limited to, polyvinyl butyral, polyvinyl alcohol, esters and ethers of polyvinyl alcohol, polyvinyl acetate, polystyrene, polymethylstyrene, polyvinyl chloride, polyvinyl pryrrolidone, polymethyl vinyl ether, polyethyl vinyl ether, polyvinyl methyl ketone), polyacetals, polyarylates, and copolymers (including, but not limited to, polyethylene-co-vinyl acetate, polyethylene-co-acrylic acid, polybutylene terephthalate-co-polyethylene terephthalate, polylauryllactam-block-polytetrahydrofuran), polybuylene succinate and polylactic acid based polymers.

In particular embodiments where binders are used in the nonwoven material of the presently disclosed subject matter, binders are applied in amounts ranging from about 0 to about 40 weight percent based on the total weight of the nonwoven material. In certain embodiments, binders are applied in amounts ranging from about 1 to about 35 weight percent, preferably from about 1 to about 20 weight percent, and more preferably from about 2 to about 15 weight percent. In certain embodiments, the binders are applied in amounts ranging from about 4 to about 12 weight percent. In particular embodiments, the binders are applied in amounts ranging from about 6 to about 10 weight percent, or from about 7 to about 15 weight percent. These weight percentages are based on the total weight of the nonwoven material. Binder can be applied to one side or both sides of the nonwoven web, in equal or disproportionate amounts with a preferred application of equal amounts of about 4 weight percent to each side.

The materials of the presently disclosed subject matter can also include additional additives including, but not limited to, ultra white additives, colorants, opacity enhancers, delustrants and brighteners, and other additives to increase optical aesthetics as disclosed in U.S. Patent Publn. No. 20040121135 published Jun. 24, 2004, which is hereby incorporated by reference in its entirety.

In certain embodiments, the binder may have high dry strength and high wet strength when placed in a commercially available lotion, such as lotion that is expressed from Wal-Mart Parents Choice baby wipes, but have low wet strength when placed in water, such as found in a toilet or a municipal water system or waste treatment system. The strength in water may be low enough such that the binders become dispersible. Suitable binders would include, but are not limited to, acrylics such as Dow KSR8478, Dow KSR8570, Dow KSR8574, Dow KSR8582, Dow KSR8583, Dow KSR8584, Dow KSR8586, Dow KSR 8588, Dow KSR8592, Dow KSR8594, Dow KSR8596, Dow KSR8598, Dow KSR8607, Dow KSR8609, Dow KSR8611, Dow KSR8613, Dow KSR8615, Dow KSR8620, Dow KSR8622, Dow KSR8624, Dow KSR8626, Dow KSR8628, Dow KSR8630, Dow EXP4482, Dow EXP4483, Dow KSR4483, Dow KSR8758, Dow KSR8760, Dow KSR8762, Dow KSR8764, Dow KSR8811, Dow KSR8845, Dow KSR8851, Dow KSR8853 and Dow KSR8855. These binders may have a surfactant incorporated into them during the manufacturing process or may have a surfactant incorporated into them after manufacturing and before application to the web. Such surfactants would include, but would not be limited to, the anionic surfactant Aerosol OT (Cytec Industries, West Paterson, N.J.) which may be incorporated at about 0.75% by weight into the binder.

In certain embodiments, the binder is a thermoplastic binder. The thermoplastic binder includes, but is not limited to, any thermoplastic polymer which can be melted at temperatures which will not extensively damage the cellulosic fibers. Preferably, the melting point of the thermoplastic binding material will be less than about 175° C. Examples of suitable thermoplastic materials include, but are not limited to, suspensions of thermoplastic binders and thermoplastic powders. In particular, the thermoplastic binding material may be, for example, polyethylene, polypropylene, polyvinylchloride, and/or polyvinylidene chloride.

In particular embodiments, the vinylacetate ethylene binder is non-crosslinkable. In one embodiment, the vinylacetate ethylene binder is crosslinkable. In certain embodiments, the binder is WD4047 urethane-based binder solution supplied by HB Fuller. In one embodiment, the binder is Michem Prime 4983-45N dispersion of ethylene acrylic acid ("EAA") copolymer supplied by Michelman. In certain embodiments, the binder is Dur-O-Set Elite 22LV emulsion of VAE binder supplied by Celanese Emulsions (Bridgewater, N.J.).

Nonwoven Material

The presently disclosed subject matter provides for a nonwoven material. The nonwoven material comprises two or more layers wherein each layer comprises cellulosic fiber. In certain embodiments, the layers are bonded on at least a portion of at least one of their outer surfaces with binder. It is not necessary that the binder chemically bond with a portion of the layer, although it is preferred that the binder remain associated in close proximity with the layer, by coating, adhering, precipitation, or any other mechanism such that it is not dislodged from the layer during normal handling of the layer until it is introduced into a toilet or wastewater conveyance or treatment system. For convenience, the association between the layer and the binder discussed above can be referred to as the bond, and the compound can be said to be bonded to the layer.

In certain embodiments, the nonwoven material comprises three layers. In one embodiment, the first layer comprises cellulosic and synthetic fibers. In certain embodiments, the first layer is coated with binder on its outer surface. A second layer disposed adjacent to the first layer, comprises cellulosic fibers and synthetic fibers. In a particular embodiment, the second layer is coated on its top and bottom surfaces with binder that has penetrated the first layer and third layer and can further have penetrated throughout the second layer. In certain embodiments, the structure is saturated with binder. In one embodiment, the third layer comprises cellulosic and synthetic fibers. In a particular embodiment, the upper surface of the binder-coated second layer is in contact with the bottom surface of the third layer and the lower surface of the binder-coated second layer is in contact with the top surface of the first layer.

In certain embodiments of the invention, the first layer comprises from about 50 to about 100 weight percent cellulosic fibers and from about 0 to about 50 weight percent bicomponent fibers. In some embodiments of the invention, the first layer comprises from about 60 to about 100 weight percent cellulosic fibers and from about 0 to about 40 weight percent bicomponent fibers. In one particular embodiment of the invention, the first layer comprises from about 75 to about 100 weight percent cellulosic fibers and from about 0 to about 25 weight percent bicomponent fibers. In certain embodiments of the invention, the first layer comprises from about 80 to about 100 weight percent cellulosic fibers and from about 0 to about 20 weight percent bicomponent fibers. In particular embodiments of the invention, the first layer comprises from about 70 to about 100 weight percent cellulosic fibers and from about 0 to about 30 weight percent bicomponent fibers.

In certain embodiments of the invention, the second layer comprises cellulosic fibers. In another particular embodiment of the invention, the second layer comprises from about 95 to about 100 weight percent cellulosic fibers and from about 0 to about 5 weight percent bicomponent fibers. In some embodiments of the invention, the second layer comprises from about 50 to about 100 weight percent cellulosic fibers and from about 0 to about 50 weight percent bicomponent fibers. In certain embodiments of the invention, the second layer comprises from about 0 to about 20 weight percent cellulosic fibers and from about 80 to about 100 weight percent bicomponent fibers. In particular embodiments of the invention, the second layer comprises from about 60 to about 100 weight percent cellulosic fibers and from about 0 to about 40 weight percent bicomponent fibers.

In certain embodiments of the invention, the third layer comprises from about 75 to about 100 weight percent cellulosic fibers and from about 0 to about 25 weight percent bicomponent fibers. In certain embodiments of the invention, the third layer comprises from about 50 to about 95 weight percent cellulosic fibers and from about 5 to about 50 weight percent bicomponent fibers. In particular embodiments of the invention, the third layer comprises from about 50 to about 100 weight percent cellulosic fibers and from about 0 to about 50 weight percent bicomponent fibers. In one embodiment of the invention, the third layer comprises from about 80 to about 100 weight percent cellulosic fibers and from about 0 to about 20 weight percent bicomponent fibers. In some embodiments of the invention, the third layer comprises from about 95 to about 100 weight percent cellulosic fibers and from about 0 to about 5 weight percent bicomponent fibers.

In particular embodiments of the invention, the first layer comprises from about 75 to about 100 weight percent cellulosic fibers and from about 0 to about 25 weight percent bicomponent fibers. In certain embodiments of the invention, the second layer comprises from about 0 to about 25 weight percent cellulosic fibers and from about 75 to about 100 weight percent bicomponent fibers. In some embodiments of the invention, the third layer comprises from about 75 to about 100 weight percent cellulosic fibers and from about 0 to about 25 weight percent bicomponent fibers.

In one embodiment of the invention, the nonwoven wipe material comprises three layers, wherein the first and third layers comprise from about 75 to about 100 weight percent cellulosic fibers and from about 0 to about 25 weight percent bicomponent fibers. In this embodiment, the second layer comprises from about 95 to about 100 weight percent cellulosic fibers and from about 0 to about 5 weight percent bicomponent fibers.

In another embodiment of the invention, the nonwoven wipe material comprises three layers, wherein the first layer comprises from about 50 to about 100 weight percent cellulosic fibers and from about 0 to about 50 weight percent bicomponent fibers. In this embodiment, the second layer comprises from about 95 to about 100 weight percent cellulosic fibers and from about 0 to about 5 weight percent bicomponent fibers and the third layer comprises from about 50 to about 95 weight percent cellulosic fibers and from about 5 to about 50 weight percent bicomponent fibers.

In yet another embodiment of the invention, the nonwoven wipe material comprises three layers, wherein the first and third layers comprise from about 75 to about 100 weight percent cellulosic fibers and from about 0 to about 25 weight percent bicomponent fibers. In this embodiment, the second layer comprises from about 0 to about 20 weight percent cellulosic fibers and from about 80 to about 100 weight percent bicomponent fibers.

In certain embodiments of the invention, at least a portion of at least one outer layer is coated with binder. In particular embodiments of the invention, at least a portion of each outer layer is coated with binder.

In certain embodiments, the nonwoven material comprises two layers. In one embodiment, the first layer comprises cellulosic and synthetic fibers. In certain embodiments, the first layer is coated with binder on its outer surface. A second layer disposed adjacent to the first layer, comprises cellulosic and synthetic fibers. In certain embodiments, the wipe material is a multilayer nonwoven comprising two layers. In certain embodiments the first and second layer are comprised from about 50 to about 100 weight percent cellulosic fibers and from about 0 to about 50 weight percent bicomponent fibers. In particular embodiments of the invention, at least a portion of at least one outer layer is coated with binder. In particular embodiments, at least a portion of the outer surface of each layer is coated with a binder. In certain embodiments, the binder comprises from about 1 to about 15 percent of the material by weight.

In certain embodiments, the first and second layer are comprised of from about 50 to about 100 weight percent cellulosic fibers and from about 0 to about 50 weight percent bicomponent fibers. In particular embodiments, the outer surface of each layer is coated with a binder. In certain embodiments, the binder comprises from about 1 to about 15 percent of the material by weight.

In certain embodiments, the nonwoven material comprises four layers. In one embodiment, the first and fourth layers comprise cellulosic and synthetic fibers. In particular embodiments, the second and third layers comprise cellulosic fibers. In certain embodiments, the first layer is coated with binder on its outer surface. In one embodiment, the fourth layer is coated with binder on its outer surface. In certain embodiments, the structure is saturated with binder. In a particular embodiment, the upper surface of the second layer is in contact with the bottom surface of the first layer, the bottom surface of the second layer is in contact with the upper surface of the third layer, and the bottom surface of the third layer is in contact with the upper surface of the fourth layer. In particular embodiments of the invention, at least one outer layer is coated with binder at least in part. In certain embodiments, the nonwoven material is coated on at least a part of each of its outer surfaces with binder.

In particular embodiments, the first layer comprises between 10 and 25 weight percent bicomponent fiber and between 75 and 90 weight percent cellulose fiber. In certain embodiments, the fourth layer comprises between 15 and 50 weight percent bicomponent fiber and between 50 and 85 weight percent cellulose fiber. In one embodiment, the third and fourth layers comprise between 90 and 100 weight percent cellulose fiber. In certain embodiments, the binder comprises from about 1 to about 15 percent of the material by weight.

In one embodiment, the nonwoven wipe material comprises four layers, wherein the first and fourth layers comprise between about 50 and about 100 weight percent cellulose fibers and between about 0 and about 50 weight percent bicomponent fibers. In this particular embodiment, the second and third layers comprise between about 95 and about 100 weight percent cellulose fibers and between about 0 and about 5 weight percent bicomponent fibers.

In still other embodiments, the multilayer nonwoven material comprises five, or six, or more layers.

In particular embodiments of the invention, at least one outer layer is coated with binder at least in part. In particular embodiments, the binder comprises from about 0 to about 40 weight percent based on the total weight of the nonwoven material. In certain embodiments, the binder comprises from about 1 to about 35 weight percent, preferably from about 1 to about 20 weight percent, and more preferably from about 2 to about 15 weight percent. In certain embodiments, the binder comprises from about 4 to about 12 weight percent, or about 6 to about 15 weight percent, or about 10 to about 20 weight percent. In particular embodiments, the binders are applied in amounts ranging from about 6 to about 10 weight percent. These weight percentages are based on the total weight of the nonwoven material.

In one aspect, the wipe material has a basis weight of from about 10 gsm to about 500 gsm, preferably from about 20 gsm to about 450 gsm, more preferably from about 20 gsm to about 400 gsm, and most preferably from about 30 gsm to about 200 gsm. In certain embodiments, the wipe material has a basis weight of from about 50 gsm to about 150 gsm, or about 50 gsm to about 100 gsm, or about 60 gsm to about 90 gsm.

The caliper of the nonwoven material refers to the caliper of the entire nonwoven material. In certain embodiments, the caliper of the nonwoven material ranges from about 0.1 to about 18 mm, more preferably about 0.1 mm to about 15 mm, more preferably from about 0.1 to 10 mm, more preferably from about 0.5 mm to about 4 mm, and most preferably from about 0.5 mm to about 2.5 mm.

In certain embodiments, the nonwoven material may be comprised of one layer. In one particular embodiment of the invention, the one layer is coated with binder on its outer surfaces. In one particular embodiment of this invention the one layer is comprised of cellulosic fibers. In certain embodiments, the binder comprises from about 5 to about 45 weight percent of the total weight of the nonwoven material. In certain embodiments the binder comprises from about 10 to about 35 weight percent, preferably from about 15 to about 25 weight percent of the total weight of the nonwoven material.

Dispersibility and Strength Features

The presently disclosed subject matter provides for wipes with high Machine Direction ("MD") and cross directional wet ("CDW") strength that are dispersible and flushable. The dispersibility and flushability of the presently disclosed materials are measured according to the industry standard guidelines. In particular, the measures are conducted using the INDA & EDANA Guidance Document for Assessing the Flushability of Nonwoven Consumer Products (Second Edition, July 2009) ("INDA Guidelines").

In certain embodiments, the nonwoven materials of the presently disclosed subject matter pass the INDA Guidelines FG 512.1 Column Settling Test. In particular embodiments, the nonwoven materials of the presently disclosed subject matter pass the INDA Guidelines FG 521.1 30 Day Laboratory Household Pump Test. In certain embodiments, more than about 90%, preferably more than 95%, more preferably more than 98%, and most preferably more than about 99% or more of the nonwoven materials of the presently disclosed subject matter pass through the system in a 30 Day Laboratory Household Pump Test as measured by weight percent.

In certain embodiments, the nonwoven wipe material is stable in a wetting liquid, such as for example a lotion. In a particular embodiment, the wetting liquid is expressed from commercially available baby wipes via a high pressure press. In certain embodiments, the lotion is expressed from Wal-Mart Parents Choice Unscented Baby Wipes. The nonwoven wipe material has expressed lotion from Wal-Mart Parents Choice Unscented Baby Wipes added to it at a level of 300% to 400% by weight of the nonwoven wipe. After loading the wipes with lotion, they are allowed to set for a period of about 1 hour to about 30 days before testing.

Lotions are typically comprised of a variety of ingredients that can include, but are not limited to, the following ingredients: Water, Glycerin, Polysorbate 20, Disodium Cocoaamphodiacetate, Aloe Barbadensis Leaf Extract, Tocopheryl acetate, *Chamomilla Recutita* (*Matricaria*) Flower extract, Disodium EDTA, Phenoxyethanol, DMDM Hydantoin, Iodopropynyl Butylcarbamate, Citric acid, fragrance, Xanthan Gum, Bis-Peg/PPG-16/PEG/PPG-16/16 Dimethicone, Caprylic/Capric Triglyceride, Sodium Benzoate, PEG-40 Hydrogenated Castor Oil, Benzyl Alcohol, Sodium Citrate, Ethylhexylglycerin, Sodium Chloride, Propylene Glycol, Sodium Lauryl Glucose Carboxylate, Lauryl Glucoside, Malic Acid, Methylisothiazolinone, Aloe Barbadensis Leaf Juice, benzyl alcohol, iodopropynyl butycarbamate, sodium hydroxymethylglycinte, pentadecalactone Potassium Laureth Phosphate and Tetrasodium EDTA, Methylparaben.

Commercially available lotions that can be used in these applications would include, but would not be limited to, the following: Kroger's Nice 'n Soft Flushable Moist Wipes lotion which is comprised of Water, Glycerin, Polysorbate 20, Disodium Cocoaamphodiacetate, Aloe Barbadensis Leaf Extract, Tocopheryl acetate, *Chamomilla Recutita* (*Matricaria*) Flower extract, Disodium EDTA, Phenoxyethanol, DMDM Hydantoin, Iodopropynyl Butylcarbamate, Citric acid and fragrance from the Kroger Company of Cincinnati, Ohio; Pampers Stages Sensitive Thick Care wipes lotion which is comprised of Water, Disodium EDTA, Xanthan Gum, Bis-Peg/PPG-16/PEG/PPG-16/16 Dimethicone, Caprylic/Capric Triglyceride, Sodium Benzoate, PEG-40 Hydrogenated Castor Oil, Benzyl Alcohol, Citric Acid, Sodium Citrate, Phenoxyethanol and Ethylhexylglycerin from Procter & Gamble of Cincinnati, Ohio; Kimberly-Clark Pull Ups Flushable Moist Wipes lotion which is comprised of Water, Sodium Chloride, Propylene Glycol, Sodium Benzoate, Polysorbate 20, Sodium Lauryl Glucose Carboxylate, Lauryl Glucoside, Malic Acid, Methylisothiazolinone, Aloe Barbadensis Leaf juice, Tocopherylacetate and Fragrance from the Kimberly-Clark Corporation; Kimberly-Clark Kleenex Cottonelle Fresh lotion which is comprised of Water, Sodium Chloride, Propylene Glycol, Sodium Benzoate, Polysorbate 20, Sodium Lauryl Glucose Carboxylate, Lauryl Glucoside, Malic Acid, Methylisothiazolinone, Aloe Barbadensis Leaf Juice, Tocopheryl Acetate and Fragrance from the Kimberly-Clark Corporation; Pampers Kandoo Flushable Wipes lotion which is comprised of Water, Disodium EDTA, Xanthan Gum, BIS-PEG/PPG-16/16 PEG/PPG-16/16 Dimethicone, caprylic/capric triglyceride, benzyl alcohol, iodopropynyl butylcarbamate, sodium hydroxymethylglycinate, PEG-40 Hydrogenated castor oil, citric acid and pentadecalactone from Procter & Gamble; Huggies Natural Care wipes lotion which is comprised of Water, Potassium Laureth Phosphate, Glycerin, Polysorbate 20, Tetrasodium EDTA, Methylparaben, Malic Acid, Methylisothiazolinone, Aloe Barbadensis Leaf Extract and Tocopheryl Acetate from the Kimberly-Clark Corporation. In particular embodiments, the lotion comprises a polyvalent cation containing compound. Any polyvalent metal salt including transition metal salts may be used. Non-limiting examples of suitable polyvalent metals include beryllium, magnesium, calcium, strontium, barium, titanium, zirconium, vanadium, chromium, molybdenum, tungsten, manganese, iron, cobalt, nickel, copper, zinc, aluminum and tin. Preferred ions include aluminum, iron and tin. The preferred metal ions have oxidation states of +3 or +4. Any salt containing the polyvalent metal ion may be employed. Non-limiting examples of examples of suitable inorganic salts of the above metals include chlorides, nitrates, sulfates, borates, bromides, iodides, fluorides, nitrides, perchlorates, phosphates, hydroxides, sulfides, carbonates, bicarbonates, oxides, alkoxides phenoxides, phosphites, and hypophosphites. Non-limiting examples of examples of suitable organic salts of the above metals include formates, acetates, butyrates, hexanoates, adipates, citrates, lactates, oxalates, propionates, salicylates, glycinates, tartrates, glycolates, sulfonates, phosphonates, glutamates, octanoates, benzoates, gluconates, maleates, succinates, and 4,5-dihydroxy-benzene-1,3-disulfonates. In addition to the polyvalent metal salts, other compounds such as complexes of the above salts include, but are not limited to, amines, ethylenediaminetetra-acetic acid (EDTA), diethyl enetriaminepenta-acetic acid (DIPA), nitrilotri-acetic acid (NTA), 2,4-pentanedione, and ammonia may be used.

The present material has a Cross Direction Wet strength of from about 50 g/in to about 1,500 g/in. In certain embodiments, the CDW tensile strength ranges from about 100 g/in to about 500 g/in. Preferably, the tensile strength is over about 200 g/in, more preferably over about 250 g/in. In particular embodiments, depending on the amount of the bicomponent makeup of the nonmaterial woven, the CDW tensile strength is about 140 g/in or greater, or about 205 g/in or greater, or about 300 g/in or greater.

The present material has a Machine Direction Dry ("MDD") strength of from about 200 g/in to about 2,000 g/in. In certain embodiments, the MDD tensile strength ranges from about 600 g/in to about 1100 g/in, or about 700 g/in to about 1,000 g/in. Preferably, the tensile strength is over about 600 g/in, or over about 700 g/in, or over about 900 g/in, more preferably over about 1000 g/in. In particular embodiments, depending on the amount of the bicomponent makeup of the nonmaterial woven, the MDD tensile strength is over about 1100 g/in or greater.

The integrity of the material can be evaluated by a cross direction wet tensile strength test described as follows. A sample is cut perpendicular to the direction in which the airlaid nonwoven is being produced on the machine. The sample should be four inches long and one inch wide. The center portion of the sample is submerged in water for a period of 2 seconds. The sample is then placed in the grips of a tensile tester. A typical tensile tester is an EJA Vantage 5 produced by Thwing-Albert Instrument Company (Philadelphia, Pa.). The grips of the instrument are pulled apart by an applied force from a load cell until the sample breaks. The distance between the grips is set to 2 inches, the test speed that the grips are moved apart at for testing is set at 12 inches per minute and the unit is fitted with a 10 Newton load cell or a 50 Newton load cell. The tensile tester records the force required to break the sample. This number is reported as the CDW and the typical units are grams per centimeter derived from the amount of force (in grams) over the width of the sample (in centimeters or inches).

The integrity of the sample can also be evaluated by a machine direction dry strength test as follows. A sample is cut parallel to the direction in which the airlaid nonwoven is being produced on the machine. The sample should be four inches long and one inch wide. The sample is then placed in the grips of a tensile tester. A typical tensile tester is an EJA Vantage 5 produced by Thwing-Albert Instrument Company (Philadelphia, Pa.). The grips of the instrument are pulled apart by an applied force from a load cell until the sample breaks. The distance between the grips is set to 2 inches, the test speed that the grips are moved apart at for testing is set at 12 inches per minute and the unit is fitted with a 50 Newton load cell. The tensile tester records the force required to break the sample. This number is reported as the MDD and the typical units are grams per centimeter derived from the amount of force (in grams) over the width of the sample (in centimeters or inches).

In certain embodiments, the multistrata nonwoven material delaminates. Delamination is when the sample separates into strata or between strata, potentially giving multiple, essentially intact layers of the sample near equivalent in size to the original sample. Delamination shows a breakdown in a structure due to mechanical action primarily in the "Z" direction. The "Z" direction is perpendicular to the Machine and Cross direction of the web and is typically measured as the thickness of the sheet in millimeters with a typical thickness range for these products being, but not limited to, approximately 0.2 mm to 10 mm. During delamination, further breakdown of a layer or layers can occur including complete breakdown of an individual layer while another layer or layers retain their form or complete breakdown of the structure. Delamination can aid in the dispersibility of a multistrata material.

Methods of Making Dispersible and Flushable Wipe Material

Various materials, structures and manufacturing processes useful in the practice of this invention are disclosed in U.S. Pat. Nos. 6,241,713; 6,353,148; 6,353,148; 6,171,441; 6,159,335; 5,695,486; 6,344,109; 5,068,079; 5,269,049; 5,693,162; 5,922,163; 6,007,653; 6,420,626, 6,355,079, 6,403,857, 6,479,415, 6,495,734, 6,562,742, 6,562,743, 6,559,081; U.S. Publn. No. 20030208175; U.S. Publn. No. 20020013560, and U.S. patent application Ser. No. 09/719,338 filed Jan. 17, 2001; all of which are hereby incorporated by reference in their entireties.

A variety of processes can be used to assemble the materials used in the practice of this invention to produce the flushable materials of this invention, including but not limited to, traditional wet laying process or dry forming processes such as airlaying and carding or other forming technologies such as spunlace or airlace. Preferably, the flushable materials can be prepared by airlaid processes. Airlaid processes include, but are not limited to, the use of one or more forming heads to deposit raw materials of differing compositions in selected order in the manufacturing process to produce a product with distinct strata. This allows great versatility in the variety of products which can be produced.

In one embodiment, the nonwoven material is prepared as a continuous airlaid web. The airlaid web is typically prepared by disintegrating or defiberizing a cellulose pulp sheet or sheets, typically by hammermill, to provide individualized fibers. Rather than a pulp sheet of virgin fiber, the hammermills or other disintegrators can be fed with recycled airlaid edge trimmings and off-specification transitional material produced during grade changes and other airlaid production waste. Being able to thereby recycle production waste would contribute to improved economics for the overall process. The individualized fibers from whichever source, virgin or recycled, are then air conveyed to forming heads on the airlaid web-forming machine. A number of manufacturers make airlaid web forming machines suitable for use in this invention, including Dan-Web Forming of Aarhus, Denmark, M&J Fibretech A/S of Horsens, Denmark, Rando Machine Corporation, Macedon, N.Y. which is described in U.S. Pat. No. 3,972,092, Margasa Textile Machinery of Cerdanyola del Valles, Spain, and DOA International of Wels, Austria. While these many forming machines differ in how the fiber is opened and air-conveyed to the forming wire, they all are capable of producing the webs of the presently disclosed subject matter.

The Dan-Web forming heads include rotating or agitated perforated drums, which serve to maintain fiber separation until the fibers are pulled by vacuum onto a foraminous forming conveyor or forming wire. In the M&J machine, the forming head is basically a rotary agitator above a screen. The rotary agitator may comprise a series or cluster of rotating propellers or fan blades. Other fibers, such as a synthetic thermoplastic fiber, are opened, weighed, and mixed in a fiber dosing system such as a textile feeder supplied by Laroche S. A. of Cours-La Ville, France. From the textile feeder, the fibers are air conveyed to the forming heads of the airlaid machine where they are further mixed with the comminuted cellulose pulp fibers from the hammer mills and deposited on the continuously moving forming wire. Where defined layers are desired, separate forming heads may be used for each type of fiber.

The airlaid web is transferred from the forming wire to a calendar or other densification stage to densify the web, if necessary, to increase its strength and control web thickness. In one embodiment, the fibers of the web are then bonded by passage through an oven set to a temperature high enough to fuse the included thermoplastic or other binder materials. In a further embodiment, secondary binding from the drying or curing of a latex spray or foam application occurs in the same oven. The oven can be a conventional through-air oven, be operated as a convection oven, or may achieve the necessary heating by infrared or even microwave irradiation. In particular embodiments, the airlaid web can be treated with additional additives before or after heat curing.

Techniques for wetlaying cellulosic fibrous material to form sheets such as dry lap and paper are well known in the art. Suitable wetlaying techniques include, but are not limited to, handsheeting, and wetlaying with the utilization of paper making machines as disclosed, for instance, by L. H. Sanford et al. in U.S. Pat. No. 3,301,746.

In one embodiment, the fibers comprising the individual layers are allowed to soak overnight in room temperature tap water. The fibers of each individual layer are then slurried. A Tappi disintegrator may be used for slurrying. In particular embodiments, the Tappi disintegrator is use for from about 15 to about 40 counts. The fibers are then added to a wetlaid handsheet former handsheet basin and the water is evacuated through a screen at the bottom forming the handsheet. In a particular embodiment, the handsheet basin is a Buckeye Wetlaid Handsheet Former handsheet basin. This individual stratum, while still on the screen, is then removed from the handsheet basin. Multiple strata may be formed in by this process.

In one embodiment, the second stratum is made by this process and then carefully laid on top of the first stratum. The two strata, while still on the screen used to form the first stratum, are then drawn across a low pressure vacuum. In specific embodiments, the low pressure vacuum is at from about 1 in. Hg to about 3.5 in. Hg. The vacuum can be applied to the strata for from about 5 to about 25 seconds. This low pressure vacuum is applied to separate the second stratum from the forming screen and to bring the first stratum and second stratum into intimate contact. In certain embodiments, the third stratum, while still on the forming screen, is placed on top of the second stratum, which is atop the first stratum. The three strata are then drawn across the low pressure vacuum with the first stratum still facing downward. In specific embodiments, the low pressure vacuum is at from about 1 in. Hg to about 3.5 in. Hg. The vacuum can be applied to the strata for from about 3 to about 25 seconds. This low pressure vacuum is applied to separate the third stratum from the forming screen and bring the second stratum and third stratum into intimate contact.

The three strata, with the first stratum downwards and in contact with the forming screen, are then drawn across a high vacuum to remove more water from the three layer structure. In specific embodiments, the high pressure vacuum is at from about 6 in. Hg to about 10 in. Hg. The three layer structure, while still on the forming screen, is then run through a handsheet drum dryer with the screen facing away from the drum for approximately 50 seconds at a temperature of approximately 127° C. to remove additional moisture and further consolidate the web. In one embodiment, the handsheet drum dryer is a Buckeye Handsheet Drum Dryer. The structure is run through the handsheet drum dryer for from about 30 seconds to about 90 seconds. The temperature of the run is from about 90° C. to about 150° C. The structure is then cured in a static air oven to cure the bicomponent fiber. The curing temperature is from about 120° C. to about 180° C. and the curing time is from about 2 minutes to about 10 minutes. The structure is then cooled to room temperature. A binder is then was then sprayed to one side of the structure and then cured. The curing temperature is from about 120° C. to about 180° C. and the curing time is from about 2 minutes to about 10 minutes.

In certain embodiments, wetlaid webs can be made by depositing an aqueous slurry of fibers on to a foraminous forming wire, dewatering the wetlaid slurry to form a wet web, and drying the wet web. Deposition of the slurry is typically accomplished using an apparatus known in the art as a headbox. The headbox has an opening, known as a slice, for delivering the aqueous slurry of fibers onto the foraminous forming wire. The forming wire can be of construction and mesh size used for dry lap or other paper making processing. Conventional designs of headboxes known in the art for drylap and tissue sheet formation may be used. Suitable commercially available headboxes include, but are not limited to, open, fixed roof, twin wire, inclined wire, and drum former headboxes. Machines with multiple headboxes can be used for making wetlaid multilayer structures.

Once formed, the wet web is dewatered and dried. Dewatering can be performed with foils, suction boxes, other vacuum devices, wet-pressing, or gravitational flow. After dewatering, the web can be, but is not necessarily, transferred from the forming wire to a drying fabric which transports the web to drying apparatuses.

Drying of the wet web may be accomplished utilizing many techniques known in the art. Drying can be accomplished via, for example, a thermal blow-through dryer, a thermal air-impingement dryer, and heated drum dryers, including Yankee type dryers.

Processes and equipment useful for the production of the nonwoven material of this invention are known in the state of the art and U.S. Pat. Nos. 4,335,066; 4,732,552; 4,375,448; 4,366,111; 4,375,447; 4,640,810; 206,632; 2,543,870; 2,588,533; 5,234,550; 4,351,793; 4,264,289; 4,666,390; 4,582,666; 5,076,774; 874,418; 5,566,611; 6,284,145; 6,363,580; 6,726,461, all of which are hereby incorporated by reference in their entireties.

In one embodiment of this invention, a structure is formed with from one to six forming heads to produce material with one or more strata. The forming heads are set according to the specific target material, adding matrix fibers to the production line. The matrix fibers added to each forming head will vary depending on target material, where the matrix fibers can be cellulosic, synthetic, or a combination of cellulosic and synthetic fibers. In one embodiment, the forming head for an inner stratum produces a stratum layer comprising from about 0 to over about 50 weight percent bicomponent. In another embodiment, forming head for the outer strata comprises cellulose, synthetic or a combination thereof. The higher the number of forming heads having 100% bicomponent fibers, the less synthetic material is necessary in the outer strata. The forming heads form the multistrata web which is compacted by a compaction roll. In one embodiment, the web can be sprayed with binder on one surface, cured, sprayed with binder on another surface, and then can be cured. The web is then cured at temperatures approximately between 130° C.-200° C., wound and collected at a machine speed of approximately 10 meters per minute to approximately 500 meters per minute.

Various manufacturing processes of bicomponent and multicomponent fibers, and treatment of such fibers with additives, useful in the practice of this invention are disclosed in U.S. Pat. Nos. 4,394,485, 4,684,576, 4,950,541, 5,045,401, 5,082,899, 5,126,199, 5,185,199, 5,705,565, 6,855,422, 6,811,871, 6,811,716, 6,838,402, 6,783,854, 6,773,810, 6,846,561, 6,841,245, 6,838,402, and 6,811,873 all of which are hereby incorporated by reference in their entireties. In one embodiment, the ingredients are mixed, melted, cooled, and rechipped. The final chips are then incorporated into a fiber spinning process to make the desired bicomponent fiber. In certain embodiments, the polymer can be directly melt spun from monomers. The rate of forming or temperatures used in the process are similar to those known in the art, for example similar to U.S. Pat. No. 4,950,541, where maleic acid or maleic compounds are integrated into bicomponent fibers, and which is incorporated herein by reference.

In one aspect of the invention, the flushable nonwoven material can be used as component of a wide variety of absorbent structures, including but not limited to moist toilet tissue, wipes, diapers, feminine hygiene materials, incontinent devices, cleaning products, and associated materials.

EXAMPLES

The following examples are merely illustrative of the presently disclosed subject matter and they should not be considered as limiting the scope of the invention in any way.

Example 1

Dispersible Wipes

Wipes according to the invention were prepared and tested for various parameters including basis weight, CDW, MDD, and caliper.

METHODS/MATERIALS: Samples 1, 1B, 1C, 2, 3, 4, 5, 6 and 7 were made on a commercial airlaid drum forming line with through air drying. The compositions of these samples are given in Tables 1-9. The level of raw materials was varied to influence the physical properties and flushable—dispersible properties. Product lot analysis was carried out on each roll.

TABLE 1

Sample 1

| Layer | Raw Materials | Basis Weight (gsm) | Weight % |
|---|---|---|---|
| Top | Wacker Vinnapas EP907 | 2.8 | 4.0 |
| 3 | Trevira Merge 1661 T255 bicomponent fiber, 2.2 dtex × 12 mm | 1.1 | 1.6 |
| | Buckeye Technologies FFT-AS pulp | 8.9 | 12.8 |
| 2 | Trevira Merge 1661 T255 bicomponent fiber, 2.2 dtex × 12 mm | 0.0 | 0.0 |
| | Buckeye Technologies FFT-AS pulp | 15.4 | 22.0 |
| 1 | Trevira Merge 1661 T255 bicomponent fiber, 2.2 dtex × 12 mm | 6.1 | 8.7 |
| | Buckeye Technologies FFT-AS pulp | 32.9 | 47.0 |
| Bottom | Wacker Vinnapas EP907 | 2.8 | 4.0 |
| | Total | 70.0 | |

TABLE 2

Sample 1B

| Layer | Raw Materials | Basis Weight (gsm) | Weight % |
|---|---|---|---|
| Top | Wacker Vinnapas EP907 | 2.8 | 4.0 |
| 3 | Trevira Merge 1661 T255 bicomponent fiber, 2.2 dtex × 12 mm | 0.9 | 1.2 |
| | Buckeye Technologies FFT-AS pulp | 9.2 | 13.1 |
| 2 | Buckeye Technologies FFT-AS pulp | 15.2 | 22.0 |
| 1 | Trevira Merge 1661 T255 bicomponent fiber, 2.2 dtex × 12 mm | 4.7 | 6.7 |
| | Buckeye Technologies FFT-AS pulp | 34.2 | 48.9 |
| Bottom | Wacker Vinnapas EP907 | 2.8 | 4.0 |
| | Total | 70.0 | |

TABLE 3

Sample 1C

| Layer | Raw Materials | Basis Weight (gsm) | Weight % |
|---|---|---|---|
| Top | Wacker Vinnapas EP907 | 2.4 | 3.5 |
| 3 | Trevira Merge 1661 T255 bicomponent fiber, 2.2 dtex × 12 mm | 1.1 | 1.6 |
| | Buckeye Technologies FFT-AS pulp | 4.5 | 6.5 |
| | Weyerhaeuser CF401 pulp | 4.5 | 6.5 |
| 2 | Buckeye Technologies FFT-AS pulp | 15.4 | 22.0 |
| 1 | Trevira Merge 1661 T255 bicomponent fiber, 2.2 dtex × 12 mm | 6.1 | 8.7 |
| | Buckeye Technologies FFT-AS pulp | 9.0 | 12.9 |
| | Weyerhaeuser CF401 pulp | 24.4 | 34.9 |
| Bottom | Wacker Vinnapas EP907 | 2.4 | 3.5 |
| | Total | 70.0 | |

TABLE 4

Sample 2

| Layer | Raw Materials | Basis Weight (gsm) | Weight % |
|---|---|---|---|
| Top | Wacker Vinnapas EP907 | 2.3 | 3.5 |
| 3 | Trevira Merge 1661 T255 bicomponent fiber, 2.2 dtex × 12 mm | 1.1 | 1.6 |
| | Buckeye Technologies FFT-AS pulp | 4.2 | 6.5 |
| | Weyerhaeuser CF401 pulp | 4.2 | 6.5 |
| 2 | Trevira Merge 1661 T255 bicomponent fiber, 2.2 dtex × 12 mm | 1.8 | 2.7 |
| | Buckeye Technologies FFT-AS pulp | 14.3 | 22.0 |
| 1 | Trevira Merge 1661 T255 bicomponent fiber, 2.2 dtex × 12 mm | 3.9 | 6.0 |
| | Buckeye Technologies FFT-AS pulp | 8.4 | 12.9 |
| | Weyerhaeuser CF401 pulp | 22.7 | 34.9 |
| Bottom | Wacker Vinnapas EP907 | 2.3 | 3.5 |
| | Total | 65.0 | |

TABLE 5

Sample 3

| Layer | Raw Materials | Basis Weight (gsm) | Weight % |
|---|---|---|---|
| Top | Wacker Vinnapas EP907 | 2.3 | 3.5 |
| 3 | Trevira Merge 1661 T255 bicomponent fiber, 2.2 dtex × 12 mm | 1.1 | 1.6 |
| | Buckeye Technologies FFT-AS pulp | 4.2 | 6.5 |
| | Weyerhaeuser CF401 pulp | 4.2 | 6.5 |
| 2 | Trevira Merge 1661 T255 bicomponent fiber, 2.2 dtex × 12 mm | 1.8 | 2.7 |
| | Buckeye Technologies FFT-AS pulp | 14.3 | 22.0 |
| 1 | Trevira Merge 1661 T255 bicomponent fiber, 2.2 dtex × 12 mm | 3.9 | 6.0 |
| | Buckeye Technologies FFT-AS pulp | 8.4 | 12.9 |
| | Weyerhaeuser CF401 pulp | 22.7 | 34.9 |
| Bottom | Wacker Vinnapas EP907 | 2.3 | 3.5 |
| | Total | 65.0 | |

TABLE 6

Sample 4

| Layer | Raw Materials | Basis Weight (gsm) | Weight % |
|---|---|---|---|
| Top | Wacker Vinnapas EP907 | 2.4 | 3.5 |
| 3 | Trevira Merge 1661 T255 bicomponent fiber, 2.2 dtex × 12 mm | 1.1 | 1.6 |
| | Buckeye Technologies FFT-AS pulp | 4.5 | 6.5 |
| | Weyerhaeuser CF401 pulp | 4.5 | 6.5 |
| 2 | Trevira Merge 1661 T255 bicomponent fiber, 2.2 dtex × 12 mm | 1.9 | 2.7 |
| | Buckeye Technologies FFT-AS pulp | 15.4 | 22.0 |
| 1 | Trevira Merge 1661 T255 bicomponent fiber, 2.2 dtex × 12 mm | 4.2 | 6.0 |
| | Buckeye Technologies FFT-AS pulp | 9.0 | 12.9 |
| | Weyerhaeuser CF401 pulp | 24.4 | 34.9 |
| Bottom | Wacker Vinnapas EP907 | 2.4 | 3.5 |
| | Total | 70.0 | |

TABLE 7

| Sample 5 | | | |
|---|---|---|---|
| Layer | Raw Materials | Basis Weight (gsm) | Weight % |
| Top | Wacker Vinnapas EP907 | 2.8 | 4.0 |
| 3 | Trevira Merge 1661 T255 bicomponent fiber, 2.2 dtex × 12 mm | 0.7 | 0.9 |
| | Buckeye Technologies FFT-AS pulp | 7.9 | 11.3 |
| | Lenzing Tencel TH400 Merge 945 fiber, 1.7 dtex × 8 mm | 1.5 | 2.2 |
| 2 | Trevira Merge 1661 T255 bicomponent fiber, 2.2 dtex × 12 mm | 0.0 | 0.0 |
| | Buckeye Technologies FFT-AS pulp | 15.4 | 22.0 |
| 1 | Trevira Merge 1661 T255 bicomponent fiber, 2.2 dtex × 12 mm | 3.5 | 5.1 |
| | Buckeye Technologies FFT-AS pulp | 27.1 | 38.8 |
| | Lenzing Tencel TH400 Merge 945 fiber, 1.7 dtex × 8 mm | 8.3 | 11.9 |
| Bottom | Wacker Vinnapas EP907 | 2.8 | 4.0 |
| | Total | 70.0 | |

TABLE 8

| Sample 6 | | | |
|---|---|---|---|
| Layer | Raw Materials | Basis Weight (gsm) | Weight % |
| Top | Wacker Vinnapas EP907 | 2.8 | 4.0 |
| 3 | Trevira Merge 1661 T255 bicomponent fiber, 2.2 dtex × 12 mm | 0.9 | 1.3 |
| | Buckeye Technologies FFT-AS pulp | 7.7 | 10.9 |
| | Lenzing Tencel TH400 Merge 945 fiber, 1.7 dtex × 8 mm | 1.5 | 2.2 |
| 2 | Trevira Merge 1661 T255 bicomponent fiber, 2.2 dtex × 12 mm | 0.0 | 0.0 |
| | Buckeye Technologies FFT-AS pulp | 15.4 | 22.0 |
| 1 | Trevira Merge 1661 T255 bicomponent fiber, 2.2 dtex × 12 mm | 4.7 | 6.8 |
| | Buckeye Technologies FFT-AS pulp | 26.0 | 37.1 |
| | Lenzing Tencel TH400 Merge 945 fiber, 1.7 dtex × 8 mm | 8.3 | 11.8 |
| Bottom | Wacker Vinnapas EP907 | 2.8 | 4.0 |
| | Total | 70.0 | |

TABLE 9

| Sample 7 | | | |
|---|---|---|---|
| Layer | Raw Materials | Basis Weight (gsm) | Weight % |
| Top | Wacker Vinnapas EP907 | 2.8 | 4.0 |
| 3 | Trevira Merge 1661 T255 bicomponent fiber, 2.2 dtex × 12 mm | 1.1 | 1.6 |
| | Buckeye Technologies FFT-AS pulp | 7.4 | 10.6 |
| | Lenzing Tencel TH400 Merge 945 fiber, 1.7 dtex × 8 mm | 1.5 | 2.2 |
| 2 | Trevira Merge 1661 T255 bicomponent fiber, 2.2 dtex × 12 mm | 0.0 | 0.0 |
| | Buckeye Technologies FFT-AS pulp | 15.4 | 22.0 |
| 1 | Trevira Merge 1661 T255 bicomponent fiber, 2.2 dtex × 12 mm | 5.9 | 8.4 |
| | Buckeye Technologies FFT-AS pulp | 24.8 | 35.4 |
| | Lenzing Tencel TH400 Merge 945 fiber, 1.7 dtex × 8 mm | 8.3 | 11.8 |
| Bottom | Wacker Vinnapas EP907 | 2.8 | 4.0 |
| | Total | 70.0 | |

RESULTS: The results of the product lot analysis are provided in Table 10 below.

TABLE 10

| Product Lot Analysis | | | |
|---|---|---|---|
| Sample | Basis Weight (gsm) | Caliper (mm) | CDW (gli) |
| Sample 1 | 70 | 1.16 | 202 |
| Sample 1B | 74 | 1.05 | 171 |
| Sample 1C | 72 | 1.00 | 217 |
| Sample 2 | 74 | 1.05 | 171 |
| Sample 3 | 71 | 1.34 | 147 |
| Sample 4 | 72 | 1.23 | 166 |
| Sample 5 | 71 | 1.34 | 147 |
| Sample 6 | 72 | 1.23 | 166 |
| Sample 7 | 65 | 1.28 | 197 |

DISCUSSION: A comparison of the CDW tensile strength between samples of similar composition, with the only difference being the use of Tencel in place of traditional fluff pulp, shows that Tencel does not provide any additional CDW strength benefit. Sample 1 with traditional fluff pulps has equivalent strength to Sample 7 that has Tencel. Sample 1B with traditional fluff pulps has equivalent strength to Sample 6 that has Tencel. Increasing the level of bicomponent fiber from 6% to 8% to 10% in Sample 5, Sample 6 and Sample 7 respectively gives an increase in CDW strength as shown in FIG. 1. A comparison of CDW tensile strength between samples having similar composition, with the difference being a stratum with a higher content of bicomponent fiber, as taught in U.S. Pat. No. 7,465,684 B2, gives higher CDW tensile strength. Sample 1 which has a higher level of bicomponent fiber in the third layer (15.6%) and has a higher CDW tensile strength than Sample 2 (11.1% bicomponent fiber in layer 3) and Sample 3 (11.1% bicomponent fiber in the third layer) and Sample 4 (11.1% bicomponent fiber in layer 3).

Example 2

Sample 1 Aging Study

Figure 2:
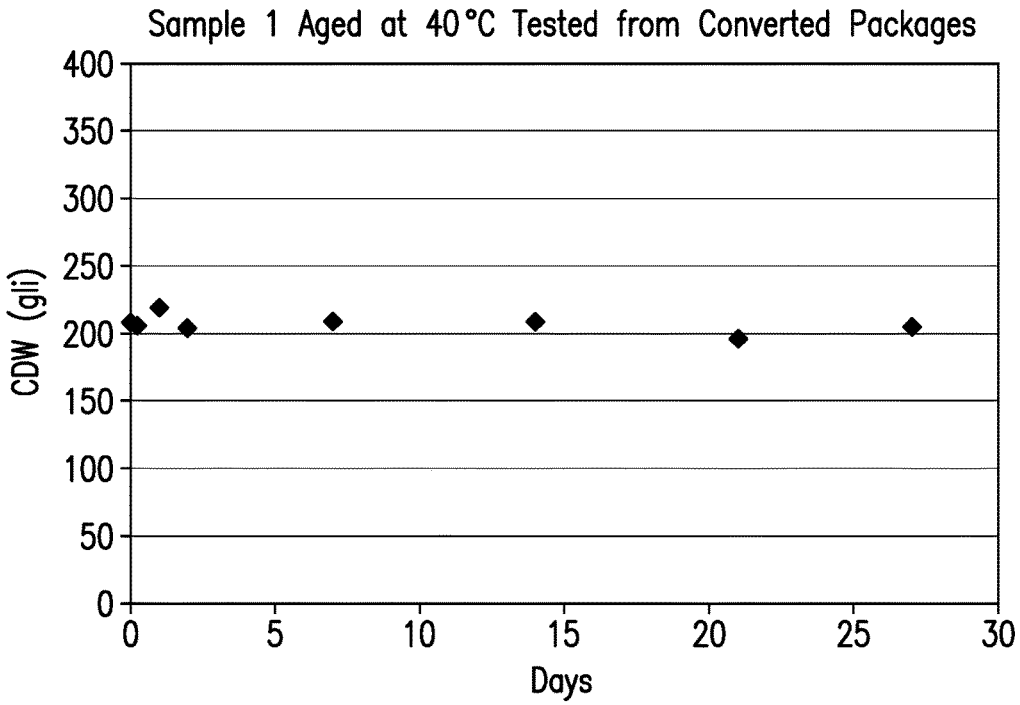
FIG. 2 depicts a graph showing the results of an aging study of converted Sample 1 as described in Example 2. The graph shows the cross-directional wet strength (y-axis) over time (x-axis).

An aging study was conducted to determine if the Sample 1 wipe would be adversely impacted over time after converting. The study was accelerated by placing the wipes, sealed in their original packaging, at a temperature of 40° C. The study was conducted over a 27 day period after which point it was stopped based on the results of the testing given in Table 2 and FIG. 2.

METHODS/MATERIALS: Sample 1 was converted by wetting the wipe with lotion, cutting it, and packaging it in a sealed container. Converted packages were placed in an oven at 40° C. for the period of time shown in Table 2. The time of "0" days indicates that the material was taken straight from the package and tested before being placed in the oven. At least ten wipes were tested for each data point using an average of 5 packages of previously unopened wipes. Using an unopened package of wipes is critical to ensure that no contamination or loss of moisture occurs with the wipes. All of the data is given in Tables 11-18 while the average for each Aging Time is given in Table 19 and plotted in FIG. 2.

TABLE 11

Sample 1 Aging Study - Control with no Aging Day 0

| Sample | Basis Weight (gsm) | CDW (in lotion) (gli) | CDW Elongation (percent) |
|---|---|---|---|
| Sample 1-1 | 70 | 218 | 22 |
| Sample 1-2 | 69 | 198 | 24 |
| Sample 1-3 | 66 | 154 | 21 |
| Sample 1-4 | 67 | 204 | 18 |
| Sample 1-5 | 67 | 195 | 23 |
| Sample 1-6 | 71 | 207 | 19 |
| Sample 1-7 | 70 | 195 | 19 |
| Sample 1-8 | 85 | 170 | 28 |
| Sample 1-9 | 77 | 161 | 15 |
| Sample 1-10 | 76 | 220 | 24 |
| Sample 1-11 | 78 | 272 | 28 |
| Sample 1-12 | 80 | 236 | 24 |
| Sample 1-13 | 61 | 168 | 22 |
| Sample 1-14 | 74 | 192 | 20 |
| Sample 1-15 | 76 | 360 | 24 |
| Sample 1-16 | 72 | 264 | 24 |
| Sample 1-17 | 71 | 148 | 24 |
| Sample 1-18 | 74 | 191 | 24 |
| Sample 1-19 | 74 | 217 | 26 |
| Sample 1-20 | 67 | 182 | 21 |
| Sample 1-Average | 72 | 208 | 23 |

TABLE 12

Sample 1 Aging Study - 0.25 Days of Aging at 40° C.

| Sample | Basis Weight (gsm) | CDW (in lotion) (gli) | CDW Elongation (percent) |
|---|---|---|---|
| Sample 1-1 | | 198 | 24 |
| Sample 1-2 | | 272 | 24 |
| Sample 1-3 | | 185 | 24 |
| Sample 1-4 | | 214 | 19 |
| Sample 1-5 | | 191 | 21 |
| Sample 1-6 | | 219 | 24 |
| Sample 1-7 | | 203 | 23 |
| Sample 1-8 | | 189 | 23 |
| Sample 1-9 | | 182 | 24 |
| Sample 1-10 | | 209 | 22 |
| Sample 1-Average | | 206 | 23 |

TABLE 13

Sample 1 Aging Study - 1 Day of Aging at 40° C.

| Sample | Basis Weight (gsm) | CDW (in lotion) (gli) | CDW Elongation (percent) |
|---|---|---|---|
| Sample 1-1 | | 257 | 21 |
| Sample 1-2 | | 200 | 24 |
| Sample 1-3 | | 206 | 22 |
| Sample 1-4 | | 206 | 22 |
| Sample 1-5 | | 242 | 26 |
| Sample 1-6 | | 195 | 19 |
| Sample 1-7 | | 251 | 24 |
| Sample 1-8 | | 197 | 28 |
| Sample 1-9 | | 115 | 16 |
| Sample 1-10 | | 316 | 23 |
| Sample 1-Average | | 219 | 22 |

TABLE 14

Sample 1 Aging Study - 2 Days of Aging at 40° C.

| Sample | Basis Weight (gsm) | CDW (in lotion) (gli) | CDW Elongation (percent) |
|---|---|---|---|
| Sample 1-1 | | 210 | 24 |
| Sample 1-2 | | 270 | 26 |
| Sample 1-3 | | 198 | 24 |
| Sample 1-4 | | 208 | 22 |
| Sample 1-5 | | 219 | 20 |
| Sample 1-6 | | 194 | 24 |
| Sample 1-7 | | 187 | 21 |
| Sample 1-8 | | 193 | 23 |
| Sample 1-9 | | 185 | 17 |
| Sample 1-10 | | 172 | 17 |
| Sample 1-Average | | 204 | 22 |

TABLE 15

Sample 1 Aging Study - 7 Days of Aging at 40° C.

| Sample | Basis Weight (gsm) | CDW (in lotion) (gli) | CDW Elongation (percent) |
|---|---|---|---|
| Sample 1-1 | | 177 | 22 |
| Sample 1-2 | | 222 | 22 |
| Sample 1-3 | | 198 | 16 |
| Sample 1-4 | | 268 | 24 |
| Sample 1-5 | | 207 | 24 |
| Sample 1-6 | | 220 | 22 |
| Sample 1-7 | | 220 | 24 |
| Sample 1-8 | | 169 | 18 |
| Sample 1-9 | | 213 | 24 |
| Sample 1-10 | | 191 | 22 |
| Sample 1-Average | | 209 | 22 |

TABLE 16

Sample 1 Aging Study - 14 Days of Aging at 40° C.

| Sample | Basis Weight (gsm) | CDW (in lotion) (gli) | CDW Elongation (percent) |
|---|---|---|---|
| Sample 1-1 | 75 | 195 | 21 |
| Sample 1-2 | 73 | 181 | 18 |
| Sample 1-3 | 64 | 168 | 20 |
| Sample 1-4 | 73 | 211 | 20 |
| Sample 1-5 | 76 | 236 | 20 |
| Sample 1-6 | 71 | 223 | 20 |
| Sample 1-7 | 63 | 164 | 17 |
| Sample 1-8 | 71 | 183 | 24 |
| Sample 1-9 | 74 | 240 | 24 |
| Sample 1-10 | 75 | 235 | 23 |
| Sample 1-11 | 70 | 256 | 21 |
| Sample 1-12 | 60 | 160 | 18 |
| Sample 1-13 | 66 | 160 | 16 |
| Sample 1-14 | 69 | 263 | 21 |
| Sample 1-15 | 74 | 240 | 20 |
| Sample 1-16 | 69 | 196 | 22 |
| Sample 1-17 | 64 | 206 | 20 |
| Sample 1-18 | 66 | 235 | 25 |
| Sample 1-19 | 70 | 191 | 20 |
| Sample 1-20 | 73 | 246 | 24 |
| Sample 1-Average | 70 | 209 | 21 |

TABLE 17

Sample 1 Aging Study - 21 Days of Aging at 40° C.

| Sample | Basis Weight (gsm) | CDW in lotion (gli) | CDW Elongation (percent) |
|---|---|---|---|
| Sample 1-1 | 66 | 223 | 18 |
| Sample 1-2 | 67 | 272 | 20 |
| Sample 1-3 | 66 | 225 | 17 |
| Sample 1-4 | 76 | 301 | 20 |
| Sample 1-5 | 58 | 181 | 19 |
| Sample 1-6 | 63 | 180 | 22 |
| Sample 1-7 | 63 | 215 | 25 |
| Sample 1-8 | 62 | 212 | 22 |
| Sample 1-9 | 61 | 144 | 22 |
| Sample 1-10 | 73 | 181 | 27 |
| Sample 1-11 | 69 | 163 | 24 |
| Sample 1-12 | 66 | 143 | 24 |
| Sample 1-13 | 67 | 154 | 27 |
| Sample 1-14 | 71 | 202 | 24 |
| Sample 1-15 | 73 | 193 | 26 |
| Sample 1-16 | 73 | 210 | 24 |
| Sample 1-17 | 72 | 137 | 21 |
| Sample 1-18 | 4 | 188 | 21 |
| Sample 1-19 | 74 | 218 | 21 |
| Sample 1-20 | 71 | 170 | 21 |
| Sample 1-Average | 65 | 196 | 22 |

TABLE 18

Sample 1 Aging Study - 27 Days of Aging at 40° C.

| Sample | Basis Weight (gsm) | CDW (in lotion) (gli) | CDW Elongation (percent) |
|---|---|---|---|
| Sample 1-1 | 71 | 183 | 18 |
| Sample 1-2 | 76 | 204 | 20 |
| Sample 1-3 | 71 | 256 | 28 |
| Sample 1-4 | 63 | 136 | 13 |
| Sample 1-5 | 70 | 228 | 21 |
| Sample 1-6 | 74 | 154 | 12 |
| Sample 1-7 | 76 | 183 | 24 |
| Sample 1-8 | 72 | 171 | 17 |
| Sample 1-9 | 76 | 220 | 24 |
| Sample 1-10 | 71 | 218 | 26 |
| Sample 1-11 | 75 | 245 | 26 |
| Sample 1-12 | 71 | 190 | 26 |
| Sample 1-13 | 72 | 221 | 26 |
| Sample 1-14 | 71 | 207 | 26 |
| Sample 1-15 | 69 | 269 | 24 |
| Sample 1-16 | 70 | 234 | 24 |
| Sample 1-17 | 72 | 212 | 24 |
| Sample 1-18 | 68 | 188 | 24 |
| Sample 1-19 | 68 | 176 | 27 |
| Sample 1-20 | 70 | 203 | 20 |
| Sample 1-Average | 71 | 205 | 23 |

TABLE 19

Sample 1 Aging Study Average Results

| Aging Time (in days) | CDW (in lotion) (gli) | CDW Elongation (%) |
|---|---|---|
| 0 | 208 | 23 |
| 0.25 | 206 | 23 |
| 1 | 219 | 22 |
| 2 | 204 | 22 |
| 7 | 209 | 22 |
| 14 | 209 | 20 |

TABLE 19-continued

Sample 1 Aging Study Average Results

| Aging Time (in days) | CDW (in lotion) (gli) | CDW Elongation (%) |
|---|---|---|
| 21 | 196 | 22 |
| 27 | 205 | 23 |

DISCUSSION: As shown in Tables 11-19 and FIG. 2, the Sample 1 maintained its cross directional wet strength over the course of 27 days and did not have any discernable change in odor, color, or appearance. This confirmed that no undesirable degradation of the binder and no breakdown of the bonding within the wipe occurred. These results indicate that this wipe design will have stability after being converted from the dry state and packaged such that it is setting in a commercially available lotion, such as when wipes are converted and stored by the converter or retailer prior to use by the consumer.

Example 3

Aerobic Biodegradability and Biodisintegration

Sample 1 was tested for biodisintegration and aerobic biodegradability according to the industry accepted standards as set forth in the Guidance Document for Assessing Flushability of Nonwoven Consumer Products, Second Edition, July 2009 and published by the Association of the Nonwoven Fabrics Industry ("INDA Guidelines"). These tests are the INDA Guidelines FG 513.2 test and the Organisation for Economic Co-operation and Development ("OECD") 301B test and the International Organization for Standardization's ISO 14852 method.

METHODS/MATERIALS: Aerobic biodegradation was determined by $CO_2$ production. Prior to testing, a mineral medium was prepared and inoculated with activated sludge from the Ann Arbor Waste Water Treatment Plant. Activated sludge was adjusted from a measured total suspended solids value of 2000 mg/L to 3000 mg/L by decanting an appropriate amount of supernatant. The samples used were Sample 1. The materials used are summarized in Table 20 below.

TABLE 20

TSS and carbon content properties

| Property | Requirement | Actual |
|---|---|---|
| Total Suspended Solids (TSS) of activated sludge | 3000 mg/L | 3000 mg/L |
| TSS of mineral medium + Inoculums | 30 mg/L | 30 mg/L |
| Carbon content of samples | 10-20 mg/L | 12 mg/L |

Flasks were prepared by wrapping 2 liter glass bottles in opaque brown paper to reduce light penetration, and then placed onto a rotary shaker which spun at a continuous 110 rpm. Samples were run in triplicate, blanks were run in duplicate, and there was one positive control containing sodium benzoate. One liter of the aforementioned inoculated mineral medium was added to each bottle. The Sample 1 sample was then added to each sample chamber. Carbon content of the sample was measured, and it was determined that the addition of 27 mg of sample to each sample chamber would provide 12 mg of carbon. The blanks were prepared in the same way as the sample chambers, but without any sample or extra carbon sourced added. The positive control was prepared in the same manner as the sample chambers, but with sodium benzoate added as a sole known biodegradable carbon source.

A Micro-Oxymax respirometer from Columbus Instruments was used to monitor levels of oxygen and carbon dioxide in the head space of each chamber. This information was used to calculate the amount of oxygen consumed and amount of carbon dioxide produced during the testing period. Based on this data, the cumulative amount of carbon dioxide evolved from each vessel was calculated. This information was compared to the amount of $CO_2$ evolved from blank specimens to determine percent degradation.

Biodisintegration of the samples was determined after 28 days of testing as per INDA Guidelines FG 513.2. Each sample chamber was emptied onto a 1 mm sieve and then rinsed at 4 L/min for 2 minutes. Three separate tubs were used, measuring approximately 10"×12"×6", and filled with approximately one liter of tap water. Each wipe was gently rinsed by sloshing it back and forth for 30 seconds, the wipe was gently squeezed, and then the wipe was transferred to the next tub. The rinsing sequence was repeated in each tub until all three rinsing sequences were completed. After all of the wipes were rinsed, they were introduced to the activated sludge. Any recovered sample was dried and weighed.

Figure 3:
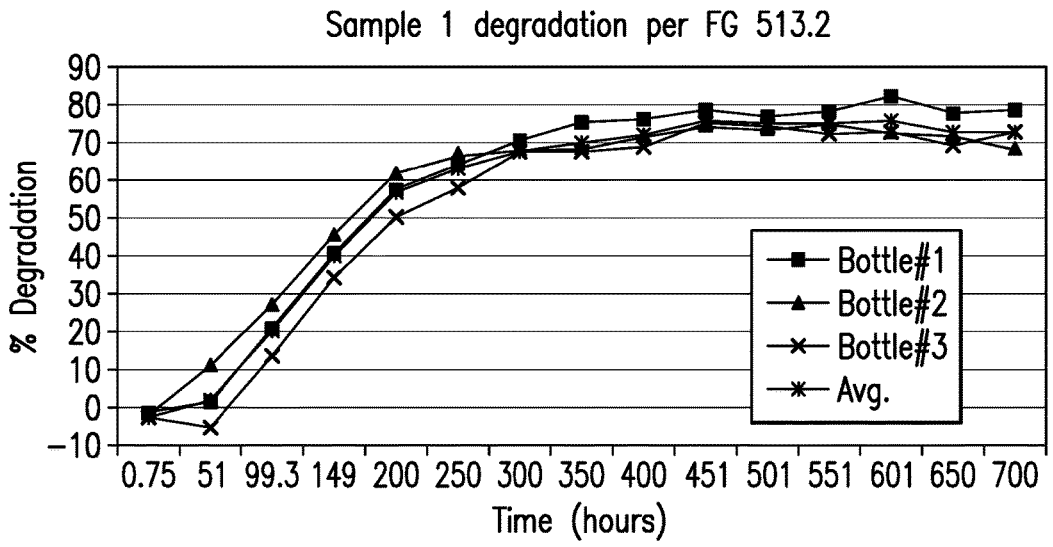
FIG. 3 depicts a graph showing the progression of Sample 1 degradation based upon $CO_2$ evolution as described in Example 3. The graph shows the percent degradation (y-axis) over time (x-axis).

RESULTS: FIG. 3 shows the progression of degradation based upon $CO_2$ evolution as a function of time over the four week period of testing. Sample 1 exhibited an average of 72.84% degradation.

Table 21 show percent degradation as measured by cumulative carbon dioxide production from each sample after subtracting carbon dioxide evolution from blank samples at the end of the testing period. Calculations were made based on total organic carbon measurements.

TABLE 21

Percent degradation of Sample 1

| Sample | Sample $CO_2$ evolution (g) | % Degradation of sample |
|---|---|---|
| Sample 1 - First | 67.73 | 77.98 |
| Sample 1 - Second | 63.58 | 68.55 |
| Sample 1 - Third | 65.22 | 71.99 |
| Sample 1 - Average | 65.51 | 72.84 |
| Control | 65.46 | 72.77 |
| Blank 1 | 33.83 | NA |
| Blank 2 | 33.02 | NA |

In the biodisintegration test, no sample material remained on the sieve after rinsing.

DISCUSSION: The Sample 1 passed the inherent biodegradation test because it exhibited an average of 72.84% degradation, which is beyond the required 60% as stated by both INDA Guidelines FG 513.2 and OECD 301B. The Sample 1 also passed the biodisintegration test because 100% of the sample Sample 1 passed through the sieve after 28 days of testing, which is beyond the 95% required by the INDA Guidelines. Sample 1 demonstrated excellent biodisintegration and inherent biodegradation by easily passing both criteria with all of its samples.

Example 4

INDA Dispersibility Tipping Tube Test and Delamination Testing

The INDA Guidelines FG 511.2 Dispersibility Tipping Tube Test was used to assess the dispersibility or physical breakup of a flushable product during its transport through household and municipal conveyance systems (e.g., sewer pipe, pumps and lift stations) as shown in FIG. 4. This test assessed the rate and extent of disintegration of the samples of the presently disclosed subject matter by turbulent water via a capped tube that is tipped up and down. Results from this test were used to evaluate the compatibility of test materials with household and municipal wastewater conveyance systems.

Delamination testing was also carried out as a measure of dispersibility. Delamination is when the sample separates into strata or between strata, potentially giving multiple, essentially intact layers of the sample near equivalent in size to the original sample. Delamination shows a breakdown in a structure due to mechanical action primarily in the "Z" direction. The "Z" direction is perpendicular to the Machine and Cross direction of the web and is typically measured as the thickness of the sheet in millimeters with a typical thickness range for these products being, but not limited to, approximately 0.2 mm to 10 mm. During delamination, further breakdown of a layer or layers can occur including complete breakdown of an individual layer while another layer or layers retain their form or complete breakdown of the structure.

METHODS/MATERIALS: The samples used were Sample 1, Sample 1C, Sample 2, Sample 3, Sample 5 and Sample 6. The composition of the samples is given in Table 1, Table 3, Table 4, Table 5, Table 7 and Table 8 respectively. Each sample was 4×4" and loaded with three times its weight with lotion expressed from Wal-Mart Parents Choice Baby Wipes, Fragrance free, hypoallergenic with Aloe.

Lotion is obtained by the following process. Commercially available Wal-Mart Parents Choice Baby Wipes, Fragrance free, Hypoallergenic with Aloe from Wal-Mart Stores, Inc., of Bentonville, Ark. are removed from the package and placed two stacks high by two stacks wide on a 16.5"×14"×1" deep drain pan. The drain pan has a drainage port that is connected to a drain tube that is connected to a catch basin that is placed at a lower height than the drain pan to allow for gravity feed of the lotion as it is expressed from the wipes. The drain pan is placed in a Carver Inc. Auto Series Press. The Carver Press is activated and 5000 pounds of pressure is applied to the stack of wipes for approximately 3 minutes. During the application of the 5000 pounds of pressure, lotion is physically expressed from the wipes and collected via the drain tube into the catch basin. Commercially available Wal-Mart Parents Choice Baby Wipes, Fragrance free, Hypoallergenic with Aloe contains the following ingredients; water, propylene glycol, aloe barbadensis leaf juice, tocopheryl acetate, PEG-75 lanolin, disodium cocoamphodiacetate, polysorbate 20, citric acid, disodium phosphate, disodium EDTA, methylisothiazolinone, 2-bromo-2-nitropropane-1,3-diol, and iodopropinil butylcarbamate.

The samples were preconditioned to simulate product delivery to the sewer by flushing the product through a toilet. A 1 L graduated cylinder was used to deliver 700 mL of room temperature tap water into a clear plastic acrylic tube measuring 500 mm (19.7 in) in height, with an inside diameter of 73 mm (2.9 in).

Each sample was dropped into the tube and allowed to be in contact with the water for 30 s. The top of the plastic tube was sealed with a water tight screw cap fitted with a rubber seal. The tube was started in a vertical position and then rotated 180 degrees in a counter clockwise direction (in approximately 1 s) and stopped (for approximately 1 s), then rotated another 180 degrees in a clockwise direction (in approximately 1 s) and stopped (1 s). This represents 1 cycle. The test was stopped after 240 cycles.

The contents in the tube were then quickly poured over two screens arranged from top to bottom in descending order: 12 mm and 1.5 mm (diameter opening). A hand held showerhead spray nozzle held approximately 10-15 cm above the sieve and the material was gently rinsed through the nested screens for 2 min at a flow rate of 4 L/min (1 gal/min). The flow rate was assessed by measuring the time it took to fill a 4 L beaker. The average of three flow rates was 60±2 s. After the two minutes of rinsing, the top screen was removed.

After rinsing was completed, the retained material was removed from each of the screens the 12 mm sieve retained material was placed upon a separate, labeled tared aluminum weigh pan. The pan was placed into a drying oven for greater than 12 hours at 105±3° C. until the sample was dry. The dried samples were cooled in a desiccator. After the samples were dry, their mass was determined. The retained fraction and the percentage of disintegration were calculated based on the initial starting mass of the test material.

The tube was rinsed in between samples. Each test product was tested a minimum of three times.

Delamination testing was carried out on six samples of Sample 1. Delamination testing was done using the INDA Guidelines FG511.2 Dispersibility Tipping Tube test, with a modification to measure the individual delaminated portions. Each sample was dropped into the tube and allowed to be in contact with the water for 30 s. The top of the plastic tube was sealed with a water tight screw cap. The tube was started in a vertical position and then rotated 180 degrees in a counter clockwise direction (in approximately 1 s) and stopped (for approximately 1 s), then rotated another 180 degrees in a clockwise direction (in approximately 1 s) and stopped (1 s). This represents 1 cycle. The test was stopped after 240 cycles.

The contents in the tube were then quickly poured over two screens arranged from top to bottom in descending order: 12 mm and 1.5 mm (diameter opening). A hand held showerhead spray nozzle held approximately 10-15 cm above the sieve and the material was gently rinsed through the nested screens for 2 min at a flow rate of 4 L/min (1 gal/min). The flow rate was assessed by measuring the time it took to fill a 4 L beaker. The average of three flow rates was 60±2 s. During the two minutes of rinsing, the presence of separate strata was made visually. If more than one stratum was identified, then the two strata were separated from each other for the remainder of the two minutes of rinsing.

After rinsing was completed, the retained material was removed from each of the screens and the individual strata on the 12 mm sieve material were placed on separate, labeled tared aluminum weigh pans. The pans were placed into a drying oven for greater than 12 hours at 105±3° C. until the samples were dry. The dried samples were cooled down in a desiccator. After the samples were dry, their mass was determined.

The delamination of the outer layers, Side A and Side B, was determined by weighing them. The delamination of the middle layer and binder were calculated mathematically. The mass of the remaining portion of the sample was calculated by the following equation:

Starting Sample Mass−(Side *A* Mass+Side *B* Mass)=Remaining Mass

In some embodiments, a two layered structure was used that was produced via an airlaid process. Testing of the two layered structures was identical to the three layered structures except that there was only one layer remaining after the INDA Guidelines FG 511.2 Dispersibility Tipping Tube Test. This one layer, Layer A, was then handled and measured as described above for the three layer structures. The mass of the remaining portion of the structure was calculated by the following equation:

Starting Mass−Side *A* Mass=Remaining Mass

Samples 61, 62, and 63 are two layer designs made by the airlaid process on a pad former.

TABLE 22

Sample 61

| | Raw Material | Basis Weight (gsm) | Weight Percent |
|---|---|---|---|
| | Wacker EP907 | 3.5 | 5.0% |
| Layer 1 | FFTAS | 13.0 | 18.6% |
| Layer 2 | FFTAS | 40.0 | 57.1% |
| | Trevira 1661 T255 6 mm Bicomponent Fiber | 10.0 | 14.3% |
| | Wacker EP907 | 3.5 | 5.0% |
| | TOTAL | 70.0 | |

TABLE 23

Sample 62

| | Raw Material | Basis Weight (gsm) | Weight Percent |
|---|---|---|---|
| | Wacker EP907 | 4.0 | 5.7% |
| Layer 1 | FFTAS | 27.0 | 38.6% |
| Layer 2 | FFTAS | 26.0 | 37.1% |
| | Trevira 1661 T255 6 mm Bicomponent Fiber | 10.0 | 14.3% |
| | Wacker EP907 | 3.0 | 4.3% |
| | TOTAL | 70.0 | |

TABLE 24

Sample 63

| | Raw Material | Basis Weight (gsm) | Weight Percent |
|---|---|---|---|
| | Wacker EP907 | 5.0 | 7.1% |
| Layer 1 | FFTAS | 40.0 | 57.1% |
| Layer 2 | FFTAS | 13.0 | 18.6% |
| | Trevira 1661 T255 6 mm Bicomponent Fiber | 10.0 | 14.3% |
| | Wacker EP907 | 2.0 | 2.9% |
| | TOTAL | 70.0 | |

TABLE 25

Product Analysis of Samples 61, 62, and 63

| Product | Basis Weight (gsm) | Caliper (mm) | Wet Tensile (gli) |
|---|---|---|---|
| Sample 61A | 73 | 1.06 | 505 |
| Sample 61B | 69 | 1.12 | 429 |
| Sample 61C | 80 | 1.18 | 544 |
| Sample 61 Average | 74 | 1.12 | 493 |
| Sample 62A | 75 | 1.08 | 560 |
| Sample 62B | 70 | 1.04 | 536 |
| Sample 62C | 65 | 1.06 | 450 |
| Sample 62 Average | 70 | 1.06 | 515 |

TABLE 25-continued

| Product Analysis of Samples 61, 62, and 63 | | | |
|---|---|---|---|
| Product | Basis Weight (gsm) | Caliper (mm) | Wet Tensile (gli) |
| Sample 63A | 79 | 1.42 | 1041 |
| Sample 63B | 71 | 1.24 | 731 |
| Sample 63C | 75 | 1.24 | 809 |
| Sample 63 Average | 75 | 1.30 | 860 |

RESULTS: The results of the INDA Guidelines FG 511.2 Dispersibility Tipping Tube Test are shown in Table 26 below. Multiple samples were run for each Sample. A lower amount of material retained on the 12 mm sieve indicates a better result.

TABLE 26

| INDA Guidelines FG 511.2 Dispersibility Tipping Tube Test | | | | | | |
|---|---|---|---|---|---|---|
| | Sample 5 | Sample 6 | Sample 1 | Sample 2 | Sample 3 | Sample 1C |
| Amount of material retained on the 12 mm Sieve | 45 | 52 | 62 | 92 | 85 | 69 |
| | 48 | 53 | 61 | 91 | 82 | 66 |
| | 53 | 51 | 66 | 88 | 85 | 66 |
| | | | 64 | 77 | | 65 |
| | | | 61 | 83 | | 68 |
| | | | 66 | 85 | | 74 |
| | | | 60 | 86 | | 69 |
| | | | 57 | | | 70 |
| | | | 71 | | | 73 |
| | | | 68 | | | 75 |
| | | | 67 | | | 71 |
| | | | 68 | | | 62 |
| | | | 69 | | | 62 |
| | | | 68 | | | |
| | | | 72 | | | |
| | | | 52 | | | |
| | | | 42 | | | |
| | | | 40 | | | |
| Average retained on 12 mm Sieve | 49 | 52 | 62 | 86 | 84 | 68 |

TABLE 27

| INDA Guidelines FG 511.2 Dispersibility Tipping Tube Test | |
|---|---|
| Sample | Weight Percent Retained on 12 mm Sieve |
| Sample 61A | 86 |
| Sample 61B | 83 |
| Sample 61C | 83 |
| Sample 61 Average | 84 |
| Sample 62A | 74 |
| Sample 62B | 69 |
| Sample 62C | 67 |
| Sample 62 Average | 70 |
| Sample 63A | 49 |
| Sample 63B | 54 |
| Sample 63C | 47 |
| Sample 63 Average | 50 |

TABLE 28

| Delamination of Sample 1 | | | |
|---|---|---|---|
| Sample | Side A (grams) | Side B (grams) | Remainder (grams) |
| Sample 1-A | 27% | 51% | 21% |
| Sample 1-B | 23% | 50% | 27% |

TABLE 28-continued

| Delamination of Sample 1 | | | |
|---|---|---|---|
| Sample | Side A (grams) | Side B (grams) | Remainder (grams) |
| Sample 1-C | 25% | 51% | 24% |
| Sample 1-D | 28% | 47% | 24% |
| Sample 1-E | 28% | 50% | 22% |
| Sample 1-F | 29% | 53% | 18% |
| Sample 1-Average | 27% | 50% | 23% |

Figure 7:
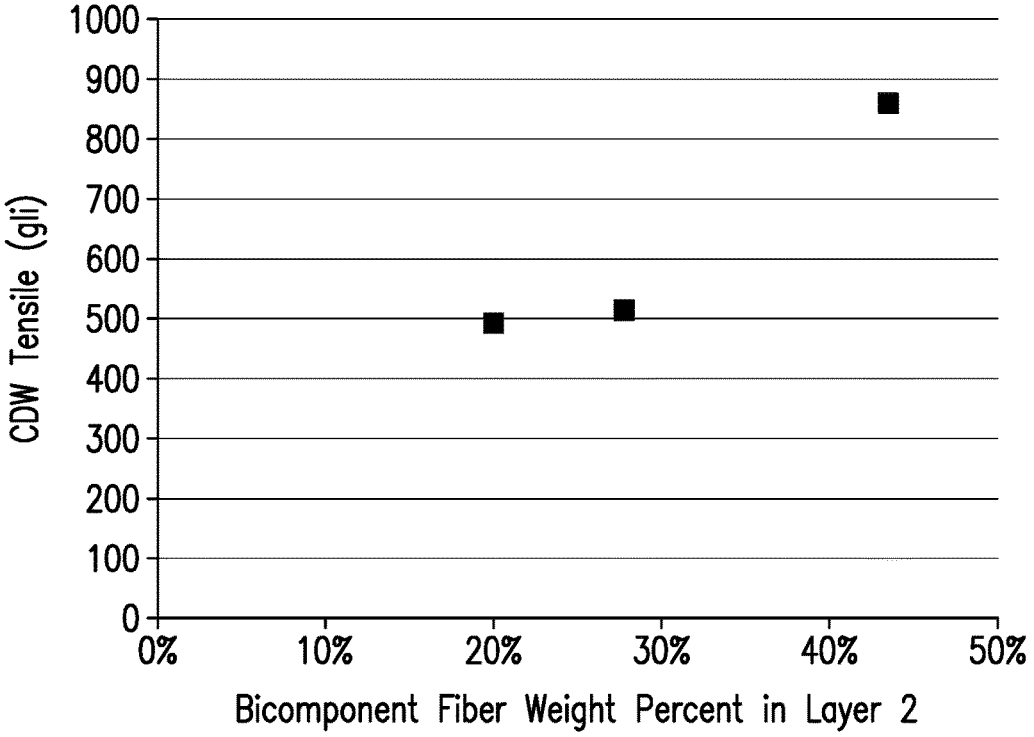
FIG. 7 depicts a graph showing the CDW tensile strength of the samples as the bicomponent fiber weight percent in layer 2 is varied. The graph shows the CDW tensile strength (y-axis) versus the weight percent of bicomponent fiber in layer 2 of the samples (x-axis).
Figure 8:
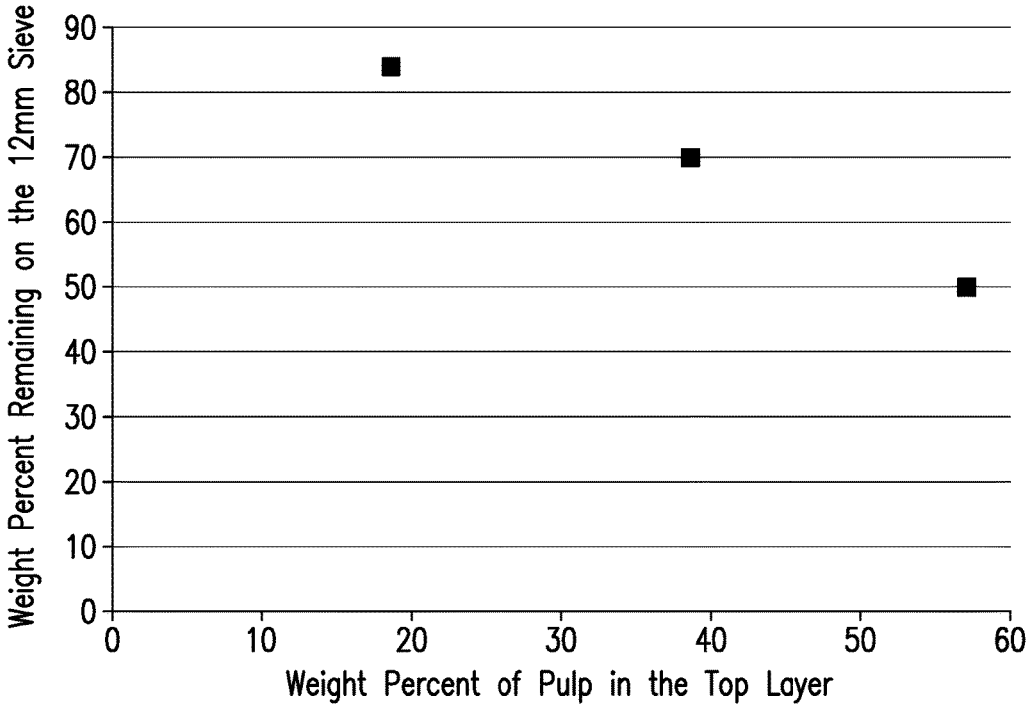
FIG. 8 depicts a graph showing the results of INDA Guidelines FG 511.2 Dispersibility Tipping Tube Test as the weight percent of pulp in the top layer is varied. The graph shows the weight percent of the samples passing through a 12 mm sieve (y-axis) versus the weight percent of pulp in the top layer of the samples (x-axis).

DISCUSSION: As the weight percent of bicomponent fiber is increased in Layer 2 from Sample 61 to Sample 62 and again to Sample 63, the CDW tensile strength also goes up as shown in FIG. 7. This has been taught previously in patent U.S. Pat. No. 7,465,684. The remainder in Table 28 is the material left on the 12 mm sieve after the other components have washed away. As the weight percent of the pulp is increased in Layer 1 from Sample 61 to Sample 62 to Sample 63, the amount of material retained on the 12 mm sieve decreases, indicating that a higher weight percentage of the sample is breaking down. This is shown in FIG. 8. Increasing the weight percent of the bicomponent fiber in one layer while increasing the weight percent of pulp in the opposite layer increases the CDW tensile strength while also improving dispersibility performance in the INDA Guidelines FG 511.2 Dispersibility Tipping Tube Test.

The results in Table 28 show that Sample 1 delaminates into two different layers with the remainder of the material passing through the 12 mm sieve. The average weight percent of Side B in Table 28 is 50 weight percent of the total weight which correlates to the weight percent of Layer 1 in Table 1 which is 55.7 weight percent of the total weight. Layer 1 of Sample 1 is delaminated Side B as shown in Table 28. Delaminated Side A of Sample 1 in Table 28 is Layer 3 of Sample 1 as shown in Table 1. There is less correlation between the weight percent of delaminated Sample 1 Side A in Table 28, which is 27 weight percent of the total weight, and Sample 1 Layer 3 of Table 1, which is 14.4 weight percent of the total weight. The higher amount of retained material that is found on delaminated Side A is due to bonding between the bicomponent fibers of delaminated Side A and the cellulose fibers of Sample 1 Layer 2. The majority of the fibers in Layer 2 of Sample 1 in Table 1 are breaking down and passing through the 12 mm sieve. Without being bound to a particular theory, the bonding of the fibers in Layer 2 of Sample 1 are believed to be from the binder that is applied to both sides, and not from bicomponent fibers.

Example 5

Column Settling Test

Figure 5:
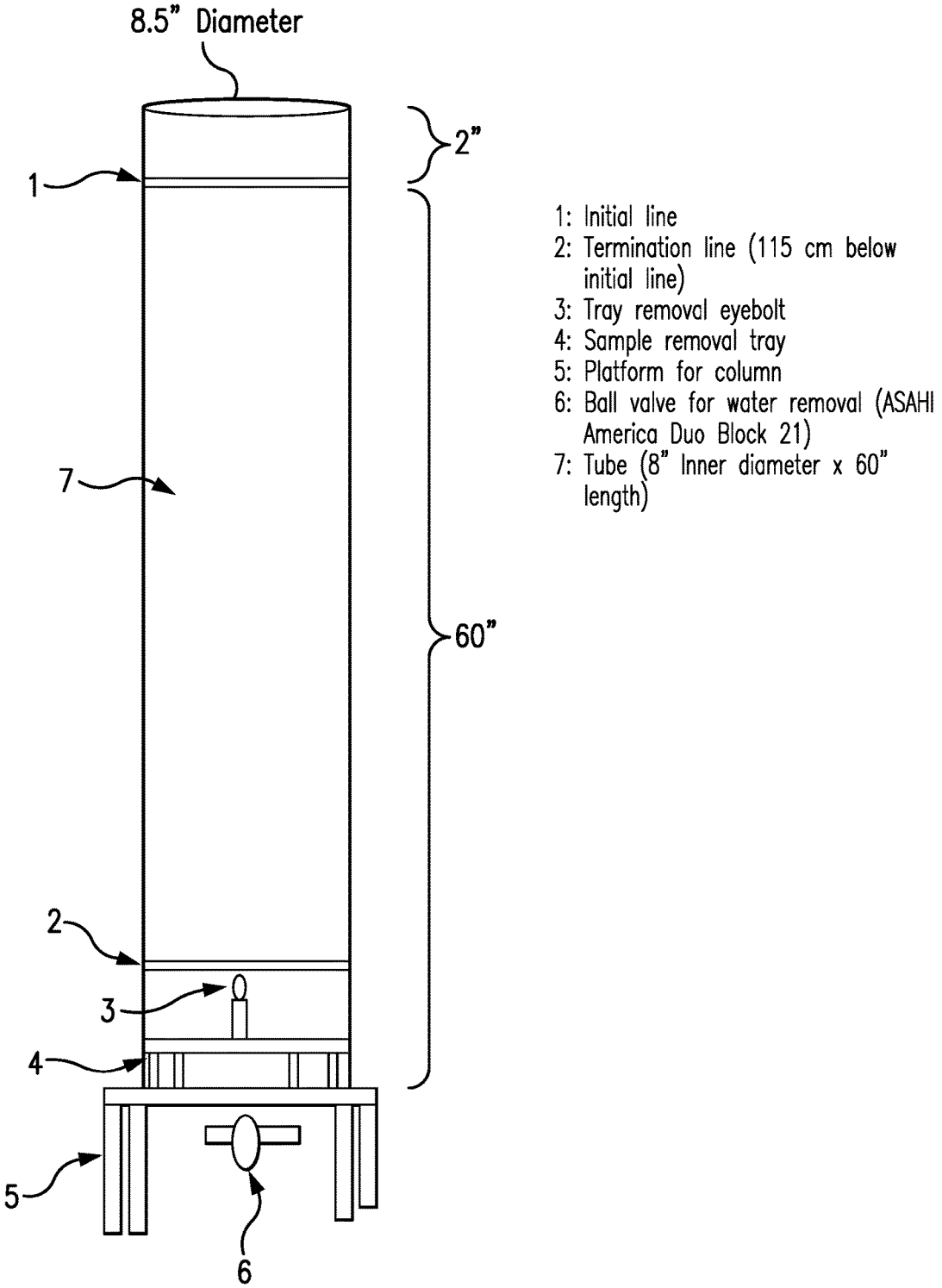
FIG. 5 depicts a schematic of the Settling Column apparatus.

The INDA Guidelines FG 512.1 Column Settling Test was used to assess the rate of product settling in various wastewater treatment systems (e.g., septic tanks, grit chamber, primary and secondary clarifiers, and sewage pump basin and lift station wet wells) as shown in FIG. 5. This test evaluated the extent to which a test material would settle in septic tank or wastewater conveyance (e.g., sewage pump wet wells) or treatment (e.g., grit removal, primary or secondary treatment) systems. If a product does not settle in a septic tank, it can leave the tank with the effluent and potentially cause problems in the drainage field. Likewise, if a product does not settle and accumulates in a sewage pump wet well, it can cause a system failure by interfering with the float mechanism that controls turning the pump on and off. Also, solids sedimentation is important for municipal treatment systems, and laboratory settling information provides evidence of effective removal in grit chambers as well as primary and secondary clarifiers. The Column Settling Test quickly identifies products that can not settle at an adequate rate to be removed in these various wastewater treatment systems.

METHODS/MATERIALS: Samples 1, 1B, 5, 6 and 7 were made on a commercial airlaid line according to the compositions given in Table 1, Table 2, Table 7, Table 8 and Table 9 respectively.

The INDA Guidelines FG 512.1 Column Settling Test was carried out using a transparent plastic pipe that was mounted vertically on a test stand as shown in FIG. 5. A pipe depth of approximately 150 cm (5 ft) with an inside diameter of 20 cm (8 in) was used to minimize sidewall effects. A wire screen was tethered with a nylon cord and be placed at the bottom of the column. A ball valve was attached to the underneath the column so that the water can be easily drained.

This test was combined with a toilet bowl clearance test. As the product cleared the toilet, it passed into the basin containing the pump and was collected. The product was then placed into the test column that has been filled with water to a mark approximately 5 cm (2 in) from the top of the column. The timer was started when the sample entered the column of water. The length of time it took for the sample to settle 115 cm was recorded. The test was terminated after 20 minutes as all of the samples sank below the 115 cm point indicating that they passed the Column Settling Test.

RESULTS: The results of the INDA Guidelines FG 512.1 Column Settling Test are shown in Table 29 below.

TABLE 29

INDA Guidelines FG 512.1 Column Settling Test

| | Sample 1 | Sample 1B | Sample 5 | Sample 6 | Sample 7 |
|---|---|---|---|---|---|
| Time in Minutes | 1.9 | 1.2 | 0.6 | 2.7 | 1.8 |
| | 1.9 | 1.7 | 2.0 | 2.5 | |
| | 1.7 | 3.2 | 1.2 | 2.3 | |
| | 2.8 | | | 1.2 | |
| | 5.2 | | | 1.7 | |
| | 5.7 | | | 3.2 | |
| | 1.5 | | | | |
| | 1.4 | | | | |
| | 1.5 | | | | |
| | 1.0 | | | | |
| | 1.5 | | | | |
| | 2.3 | | | | |
| Average Time (Minutes) | 2.4 | 2.0 | 1.3 | 2.2 | 1.8 |

DISCUSSION: The Sample 1, Sample 1B, Sample 5, Sample 6 and Sample 7 samples passed the INDA Guidelines FG 512.1 Settling Column Test because the samples settled all the way to the bottom of the column within 24 hours. The results show the changes in the composition of these samples and the variation of the strata did not have a significant impact on their settling properties.

Example 6

INDA Guidelines FG 521.1 Laboratory Household Pump Test

The INDA Guidelines FG 521.1 Laboratory Household Pump Test was used to assess the compatibility of a flushable product in residential and commercial pumping systems. Plumbing fixtures that are installed below the sewer lines need to have a means of transporting wastewater to the level of the main drainline. Sewage ejector pumps are commonly used in these situations and have the ability to pump a high volume of water with solids up to 2 in (5 cm) size. In Europe, macerator pump toilets are used for the same purpose. A household can also be on a pressure sewer system, which utilizes a small pump to discharge the wastewater to a main sewer pipe. Pressure sewer systems use a pump basin that collects the entire household wastewater without pretreatment. It is typically recommended that a grinder pump be used in these systems. In principle, these pumps grind the wastewater solids to particles small enough to pass through the pump, valves and piping without clogging.

Figure 6:
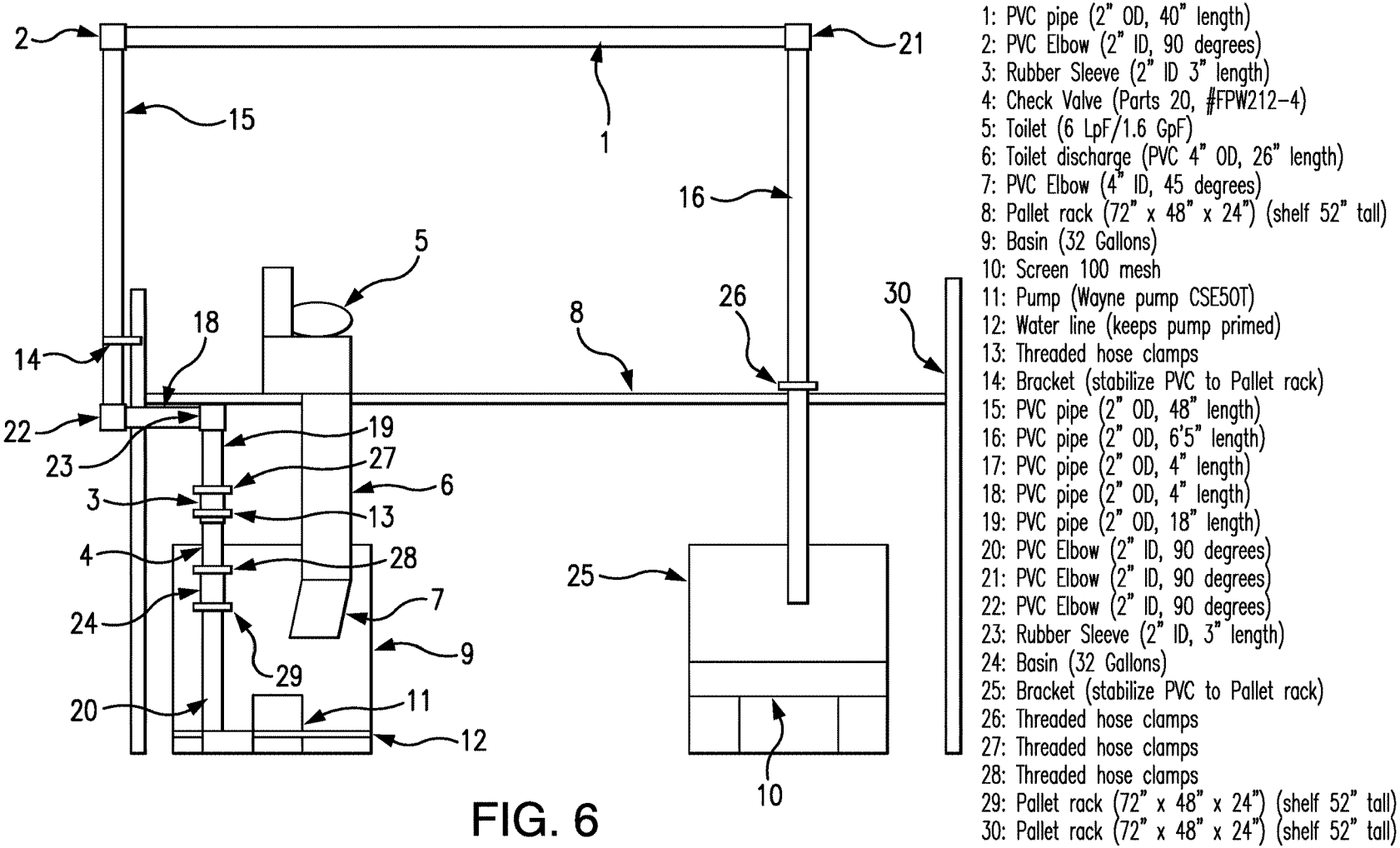
FIG. 6 depicts a schematic of the Building Pump apparatus.

METHODS/MATERIALS: As shown in FIG. 6, a pallet rack test stand approximately 8 ft (2.44 m) in height, 2 ft (0.61 m) in depth, and 4.5 ft (1.37 m) in width was assembled and anchored to the ceiling for additional support. Two Rubbermaid, BRUTE open top, flat bottom, cylindrical basins with a bottom diameter of 17-19 inches (43-48 cm) in diameter were used. A Wayne Pump CSE50T was placed in the bottom of the pump basin which received the effluent from the toilet. The basins were placed under the shelf, with one serving as the pump basin and the other as the evacuated contents collection basin. A two inch (5.08 in) inner diameter pipe was used exclusively for the following construction. An eighteen inch (45.7 cm) long pipe was used to connect the pump to the check valve. A Parts2O Flapper Style Check Valve #FPW212-4 was connected to the two inch inner diameter pipe and placed approximately 3 ft (0.91 m) above the bottom of the pump basin. A two 2 inch (5.08 cm) pipe was connected to the top of the check valve with a rubber sleeve giving a total height of approximately 4 ft (1.22 m) from the floor of the basin. The piping then made a 90 degree turn to the left, running parallel to the floor. The piping then traveled 6 in (0.18 m) where it turned 90 degrees upward, traveling perpendicular to the floor. The piping traveled up 4 ft (1.22 m) and turned 90 degrees to the right, becoming parallel to the floor. The piping traveled another 3.33 ft (1.02 m) and then turned 90 degrees downward. The piping traveled 6 ft 5 in (1.65 m) and ended approximately 9 in (23 cm) above the 100 mesh collection screen. The bottom of the receiving basin is fitted with a valve and hose for draining the water from the basin.

The pump basin was dosed with 6 L (1.6 gal) of tap water via a toilet to simulate a predetermined toilet volume, along with two Sample 1 samples. The samples were dosed to the pump basin in a flush sequence that represented a household of four individuals (two males and two females). The flush sequence consisted of 17 flushes, where flushes 1, 3, 5, 6, 8, 10, 11, 13, 15, and 16 contained product while flushes 2, 4, 7, 9, 12, 14, and 17 were empty. This sequence was repeated seven times to simulate a 7-day equivalent loading to the pump system or thirty times to simulate a 30-day equivalent loading to the pump system. The product loading of this test simulated the high end user (e.g., 90th percentile user) based on habits and practices. The flush sequence for a single day is summarized in Table 8. This sequence is repeated 7 times or 30 times depending on the length of the test.

TABLE 30

| Flush Sequence for INDA Guidelines FG 521.1 Laboratory Household Pump Test | |
|---|---|
| Flush # | Loading |
| 1 | Product |
| 2 | Empty |
| 3 | Product |
| 4 | Empty |
| 5 | Product |
| 6 | Product |
| 7 | Empty |
| 8 | Product |
| 9 | Empty |
| 10 | Product |
| 11 | Product |
| 12 | Empty |
| 13 | Product |
| 14 | Empty |
| 15 | Product |
| 16 | Product |
| 17 | |

At the end of the test, the test materials remaining within the pump basin, the pump chamber and the check valve were collected. The collected materials were placed on a 1-mm sieve and rinsed as described in Example 4. After rinsing was completed, the retained material was removed from the sieve using forceps. The sieve contents were transferred to separate aluminum tare weight pans and used as drying containers. The material was placed in a drying oven for greater than 12 hours at 105° C. The dried samples were allowed to cool in a desiccator. After all the samples were dry, the materials were weighed and the percent of material collected from each location in the test system was calculated.

RESULTS: The results of the 7 and 30 day Laboratory Household Pump Tests are shown in Tables 31 and 32 below.

TABLE 31

| INDA Guidelines FG 521.1 7 Day Laboratory Household Pump Test | | | | | |
|---|---|---|---|---|---|
| Test Time Length | 7 day | 7 day | 7 day | 7 day | 7 day |
| Grade | Sample 2 | Sample 3 | Sample 1 | Sample 1 | Sample 1 |
| Sheet Size | 5.5" × 7.25" | 5.5" × 7.25" | 5.25" × 7.75" | 5.25" × 7.75" | 5.25" × 7.75" |
| Wipes Introduced into Basin | 140 | 140 | 140 | 140 | 140 |
| Number of Wipes Left in Pump Basin | 6 | 3 | 4 | 3 | 7 |
| Number of Wipes Passing Through System | 134 | 137 | 136 | 137 | 133 |
| Weight Percent of Wipes Passing Through System | 95.7 | 97.9 | 97.1 | 97.9 | 95.0 |

TABLE 32

| INDA Guidelines FG 521.1 30 Day Laboratory Household Pump Test | | | | | | | |
|---|---|---|---|---|---|---|---|
| Test Time Length | 30 day | 30 day | 30 day | 30 day | 30 day | 30 day | 30 day |
| Grade | Sample 1 | Sample 1 | Sample 1 | Sample 1 | Sample 1 | Sample 1C | Sample 1C |
| Sheet Size | 5.5" × 7.25" | 5.5" × 7.25" | 5.5" × 7.25" | 5.5" × 7.25" | 5.5" × 7.25" | 5.25" × 7.75" | 5.25" × 7.75" |
| Wipes Introduced into Basin | 600 | 600 | 600 | 600 | 600 | 600 | 600 |
| Number of Wipes Left in Pump Basin | 6 | 6 | 5 | 5 | 4 | 9 | 18 |
| Number of Wipes Passing Through System | 594 | 594 | 595 | 595 | 596 | 591 | 582 |
| Weight Percent of Wipes Passing Through System | 99.0 | 99.0 | 99.2 | 99.2 | 99.3 | 98.5 | 97.0 |

DISCUSSION: The wipe materials did not meet the INDA Guidelines FG 521.1 7 Day Laboratory Pump Test. Although there were no wipes blocking the pump or valve, there were wipes left in the basin at the end of the test. INDA Guidelines FG521.1 requires proceeding to the 30 Day Laboratory Pump test with these results to get final results. All of the samples passed the INDA Guidelines FG 521.1 30 Day Laboratory Pump Test because the wipe materials passed through the pump without clogging and there was no additional accumulation of the product in either the pump impeller chamber, check valve, or pump basin when compared to the 7 day equivalent test. The lack of plugging in the valve and the piping of the test system, combined with the extremely high level of wipes that passed through the system, demonstrate good performance against this test method.

Example 7

Interface Between Layers

Figure 9:
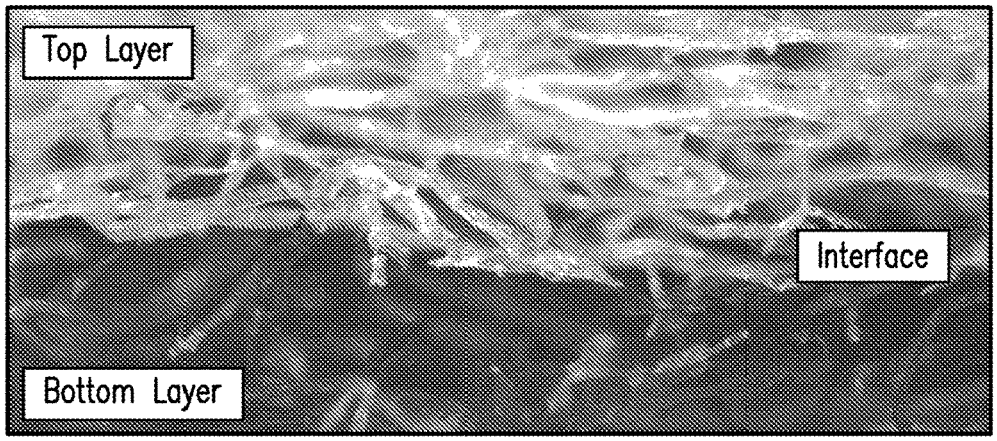
FIG. 9 depicts an approximate 100× magnification of the airlaid structure Sample 99.

The interface between the different layers of a structure can have an impact on the potential for a structure to delaminate. Thermal bonding between the bicomponent fiber within the layers or entanglement of the fibers between the layers can have an impact. The interface between the layers in Sample 99 is depicted in FIG. 9. The composition of Sample 9 is given in Table 33 and the Product Analysis is given in Table 34. Foley Fluffs dyed black were used to make the middle layer in order to show the contrast between the layers and more clearly see the interface.

TABLE 33

Sample 99

| | Raw Material | Basis Weight (gsm) | Weight Percent |
|---|---|---|---|
| | Wacker EP907 | 2.8 | 4% |
| Layer 1 | FFTAS | 18.6 | 26% |
| | Trevira 1661 T255 6 mm Bicomponent Fiber | 3.4 | 5% |
| Layer 2 | FOLEY FLUFFS | 20.0 | 28% |
| | Trevira 1661 T255 6 mm Bicomponent Fiber | 2.0 | 3% |
| Layer 3 | FFTAS | 19.6 | 27% |
| | Trevira 1661 T255 6 mm Bicomponent Fiber | 2.4 | 3% |
| | Wacker EP907 | 2.8 | 4% |
| | TOTAL | 71.6 | |

TABLE 34

Product Analysis of Sample 99

| | Basis Weight (gsm) | Caliper (mm) |
|---|---|---|
| 1 | 70 | 1.42 |
| 2 | 71 | 1.30 |
| 3 | 72 | 1.58 |
| Average | 71 | 1.36 |

RESULTS: There is very little fiber entanglement between the fibers of the top layer (white colored) and the fibers of the middle layer (black colored) in Sample 99. The top layer and middle layer are shown in FIG. 9.

DISCUSSION: FIG. 9 shows that there is little physical entanglement between the fibers of the two layers. The bonding between these layers is hypothesized to be from the bicomponent fibers that are contained in each layer and not from mechanical entanglement. Thus, increasing the amount of bicomponent fiber in a layer or layers can increase the bonding at the interface. As there is little physical entanglement of fibers between layers, layers with no bicomponent fibers, such as Layer 2 of Sample 1, will not use bicomponent fiber to provide bonding within the layer. Binding in Layer 2 of Sample 1 is proposed to be from the binder that is applied to each surface which penetrates through Layer 1 and or Layer 3.

Example 8

Dispersible Wipes with Embossing

The embossed CDW tensile strength of Sample 1X was measured. Sample 1X was produced on a commercial airlaid line. The finished product was subjected to an off-line post production embossing with a static emboss plate. The composition of Sample 1X is given in Table 35.

TABLE 35

Sample 1X

| Layer | Raw Materials | Basis Weight (gsm) | Weight % |
|---|---|---|---|
| Top | Wacker Vinnapas EP907 | 2.8 | 4.0 |
| 3 | Trevira Merge 1661 T255 bicomponent fiber, 2.2 dtex × 12 mm | 1.1 | 1.6 |
| | Buckeye Technologies FFT-AS pulp | 8.9 | 12.8 |
| 2 | Trevira Merge 1661 T255 bicomponent fiber, 2.2 dtex × 12 mm | 0.0 | 0.0 |
| | Buckeye Technologies FFT-AS pulp | 15.4 | 22.0 |
| 1 | Trevira Merge 1661 T255 bicomponent fiber, 2.2 dtex × 12 mm | 6.1 | 8.7 |
| | Buckeye Technologies FFT-AS pulp | 32.9 | 47.0 |
| Bottom | Wacker Vinnapas EP907 | 2.8 | 4.0 |
| | Total | 70.0 | |

Figure 10:
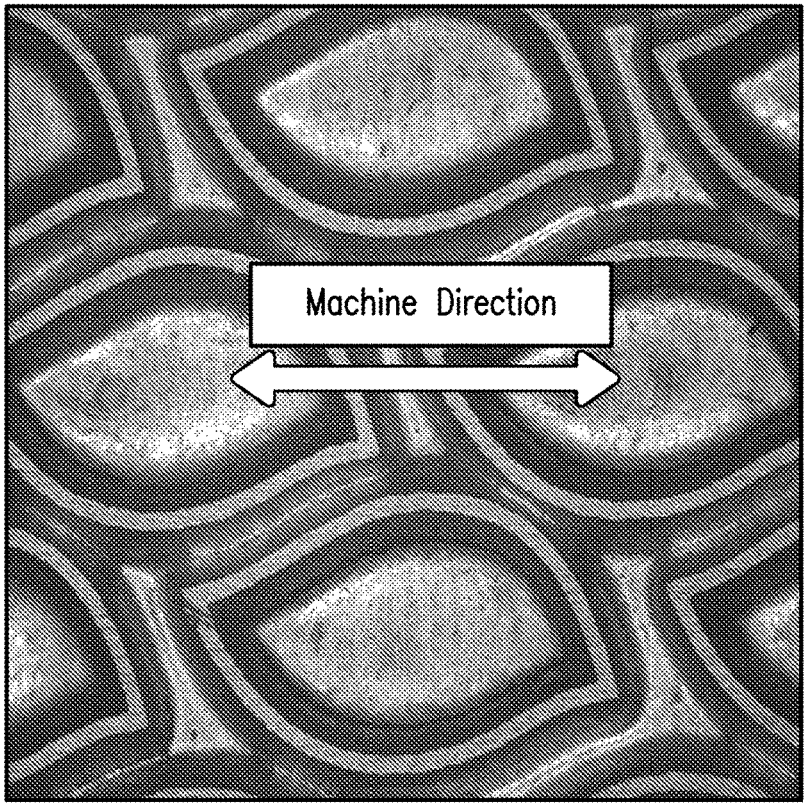
FIG. 10 depicts the emboss plate that was used for Example 8.
Figure 12:
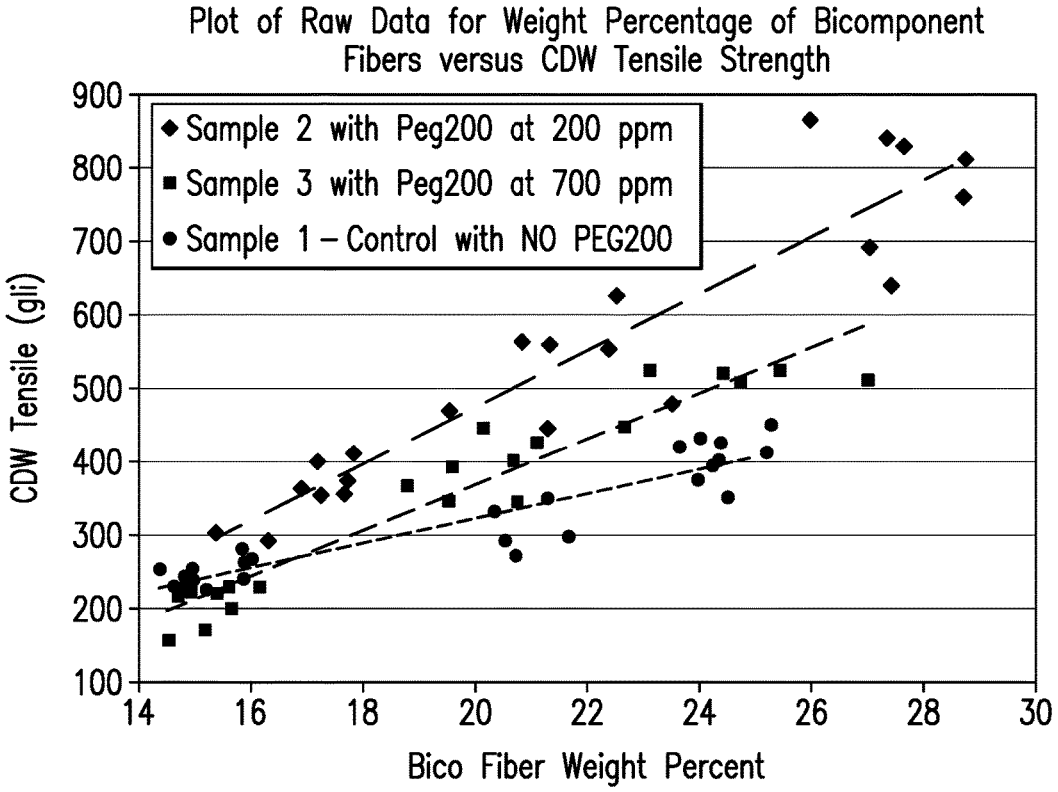
FIG. 12 depicts a graph showing the raw data CDW tensile strength of the samples as the bicomponent fiber weight percent is varied. The graph shows the CDW tensile strength (y-axis) versus the weight percent of bicomponent fiber in the samples (x-axis).

METHODS/MATERIALS: An emboss plate with the pattern shown in FIG. 10 was placed in a Carver Press and heated to 150° C. A piece of Sample 1X approximately 7"×14" was placed on the emboss plate. The emboss plate was oriented such that the ovals were in the machine direction of Sample 1X. A force of approximately 5000 lbs was applied to the embossing plate, which was in contact with Sample 1, for a period of 5 seconds. The embossed piece of Sample 1 was removed from the Carver Press and allowed to cool to room temperature. This sample is designated 2X A piece approximately 7"×14" of Sample 1X was embossed by this same process, but with the emboss plate orientated in the cross direction. This sample is designated 3X.

A piece of Sample 1X approximately 7"×14" was placed in a frame to prevent it from being compressed or shrinking while in the Carver Press. The Carver Press was heated to 150° C. and the sample was placed in the press and the press was closed for 5 seconds without further compacting or embossing the sample. The sample was removed and allowed to cool to room temperature. This sample is designated 4X.

RESULTS: The Product Lot Analysis results are shown in Table 36, the tensile strength and elongation results are shown in Table 37 and the Tip Tube and Dispersibility results are shown in Table 38, Table 39, Table 40 and Table 41 below.

TABLE 36

Product Lot Analysis

| Sample | BW | Caliper |
|---|---|---|
| Sample 1XA | 66 | |
| Sample 1XB | 66 | |
| Sample 1XC | 66 | |
| Sample 1XD | 66 | |
| Sample 1XE | 66 | |

TABLE 36-continued

| Product Lot Analysis | | |
|---|---|---|
| Sample | BW | Caliper |
| Sample 1XF | 66 | |
| Sample 1X Average | 66 | |
| Sample 2XA | 64 | 0.78 |
| Sample 2XB | 66 | 0.80 |
| Sample 2XC | 69 | 0.84 |
| Sample 2X Average | 66 | 0.81 |
| Sample 3XA | 69 | 0.78 |
| Sample 3XB | 67 | 0.80 |
| Sample 3XC | 65 | 0.72 |
| Sample 3X Average | 67 | 0.77 |
| Sample 4XA | 69 | 0.78 |
| Sample 4XB | 67 | 0.80 |
| Sample 4XC | 65 | 0.72 |
| Sample 4X Average | 67 | 0.77 |

TABLE 38-continued

| Sample 1X Delamination with Dispersibility using INDA Guidelines FG 511.2 Dispersibility Tipping Tube Test of Off-Line Post Production Embossed Wipes - No Additional Processing | | |
|---|---|---|
| Sample | Layer or Total | Weight Retained on 12 mm Sieve |
| 6 | A | 53 |
| | B | 29 |
| | Remainder | 18 |
| Side A Average | | 50 |
| Side B Average | | 27 |
| Remainder Average | | 23 |

TABLE 37

| CDW Tensile of Off-Line Post Production Embossed Wipes | | | | | | | | |
|---|---|---|---|---|---|---|---|---|
| | Sample 1X No Further Treatment | | Sample 2X MD Aligned Embossing | | Sample 3X CD Aligned Embossing | | Sample 4X Heated no emboss | |
| | CDW (gli) | Elongation % | CDW (gli) | Elongation (%) | CDW (gli) | Elongation % | CDW (gli) | Elongation (%) |
| 1 | 305 | 20 | 337 | 20 | 313 | 24 | 339 | 24 |
| 2 | 306 | 22 | 358 | 22 | 338 | 27 | 288 | 23 |
| 3 | 283 | 21 | 405 | 22 | 413 | 26 | 317 | 21 |
| 4 | 262 | 17 | | | | | | |
| 5 | 300 | 16 | | | | | | |
| 6 | 296 | 18 | | | | | | |
| 7 | 231 | 16 | | | | | | |
| 8 | 276 | 23 | | | | | | |
| 9 | 273 | 24 | | | | | | |
| 10 | 268 | 24 | | | | | | |
| 11 | 263 | 24 | | | | | | |
| 12 | 270 | 21 | | | | | | |
| 13 | 255 | 30 | | | | | | |
| 14 | 274 | 25 | | | | | | |
| 15 | 266 | 22 | | | | | | |
| 16 | 292 | 24 | | | | | | |
| 17 | 288 | 24 | | | | | | |
| 18 | 275 | 18 | | | | | | |
| 19 | 306 | 26 | | | | | | |
| 20 | 281 | 23 | | | | | | |
| Average | 279 | 22 | 367 | 21 | 354 | 26 | 314 | 23 |

TABLE 38

| Sample 1X Delamination with Dispersibility using INDA Guidelines FG 511.2 Dispersibility Tipping Tube Test of Off-Line Post Production Embossed Wipes - No Additional Processing | | |
|---|---|---|
| Sample | Layer or Total | Weight Retained on 12 mm Sieve |
| 1 | A | 51 |
| | B | 27 |
| | Remainder | 22 |
| 2 | A | 50 |
| | B | 23 |
| | Remainder | 27 |
| 3 | A | 51 |
| | B | 25 |
| | Remainder | 24 |
| 4 | A | 47 |
| | B | 28 |
| | Remainder | 25 |
| 5 | A | 50 |
| | B | 28 |
| | Remainder | 22 |

TABLE 39

| Sample 2X Delamination with Dispersibility using INDA Guidelines FG 511.2 Dispersibility Tipping Tube Test of Off-Line Post Production Embossed Wipes with Embossing in MD Direction | | |
|---|---|---|
| Sample | Layer or Total | Weight Retained on 12 mm Sieve |
| 1 | A | 54 |
| | B | 27 |
| | Remainder | 19 |
| 2 | A | 64 |
| | B | 28 |
| | Remainder | 8 |
| 3 | A | 60 |
| | B | 24 |
| | Remainder | 16 |
| Side A Average | | 59 |
| Side B Average | | 26 |
| Remainder Average | | 15 |

TABLE 40

Sample 3X Delamination with Dispersibility using INDA Guidelines FG 511.2 Dispersibility Tipping Tube Test of Off-Line Post Production Embossed Wipes with Embossing in CD Direction

| Sample | Layer or Total | Weight Retained on 12 mm Sieve |
|---|---|---|
| 1 | A | 59 |
| | B | 31 |
| | Remainder | 10 |
| 2 | A | 56 |
| | B | 30 |
| | Remainder | 14 |
| 3 | A | 54 |
| | B | 33 |
| | Remainder | 13 |
| Side A Average | | 56 |
| Side B Average | | 31 |
| Middle Average | | 13 |

TABLE 41

Sample 4X Delamination with Dispersibility using INDA Guidelines FG 511.2 Dispersibility Tipping Tube Test of Off-Line Post Production Embossed Wipes with Heating and No Embossing

| Sample | Layer or Total | Weight Retained on 12 mm Sieve |
|---|---|---|
| 1 | A | 61 |
| | B | 16 |
| | Remainder | 23 |
| 2 | A | 59 |
| | B | 22 |
| | Remainder | 19 |
| 3 | A | 58 |
| | B | 31 |
| | Remainder | 11 |
| Side A Average | | 59 |
| Side B Average | | 23 |
| Remainder Average | | 18 |

TABLE 42

Summarized Averages of Delamination testing using INDA Guidelines FG 511.2 Dispersibility Tipping Tube Test and CDW Tensile Strength

| Sample | Average Weight % Retained on 12 mm Sieve | Average CDW Tensile (gli) |
|---|---|---|
| 1X Layer A | 50 | 279 |
| 1X Layer B | 27 | |
| 1X Remainder | 23 | |
| 2X Layer A | 59 | 367 |
| 2X Layer B | 26 | |
| 2X Remainder | 15 | |
| 3X Layer A | 56 | 354 |
| 3X Layer B | 31 | |
| 3X Remainder | 13 | |

TABLE 42-continued

Summarized Averages of Delamination testing using INDA Guidelines FG 511.2 Dispersibility Tipping Tube Test and CDW Tensile Strength

| Sample | Average Weight % Retained on 12 mm Sieve | Average CDW Tensile (gli) |
|---|---|---|
| 4X Layer A | 59 | 314 |
| 4X Layer B | 23 | |
| 4X Remainder | 18 | |

DISCUSSION: A comparison of the untreated Sample 1X and heated, but not embossed Sample 4X, shows that the additional heat increases the CDW strength 12.5% and reduces the amount of material passing through the 12 mm sieve 21.7%. This is hypothesized to be from an increase in thermal bonding of the bicomponent fiber.

A comparison of unembossed, but heated, Sample 4x to heated and embossed Sample 2x and heated and embossed Sample 3x show that embossing increases the CDW tensile strength 12.7% to 14.4% and reduces the amount of material passing through the 12 mm sieve 16.6% to 27.7%. Without being bound to a particular theory, the increase in CDW strength is proposed to be from the additional bonding that occurs from the heat and pressure of embossing. These results show that embossing can increase the strength of this product design but will also reduce the amount of material passing through the 12 mm sieve. It is of particular interest that although the CDW strength of Sample 1X increased with additional heat as shown by Sample 2X and further increased by embossing as shown by Sample 3X and Sample 4X, all of these samples retained the ability to delaminate in the INDA Guidelines FG 511.2 Tipping Tube Test.

Example 9

High Strength Bicomponent Fiber for Dispersible Wipes

Wipes according to the invention were prepared and tested for various parameters including basis weight, CDW and caliper. Samples were made with no PEG200 on the bicomponent fiber, with PEG200 at 200 parts per million (ppm) by weight of the overall weight of the bicomponent fiber and with PEG200 at 700 ppm by weight of the overall weight of the bicomponent fiber.

METHODS/MATERIALS: Samples 1-1 to 1-23, 2-1 to 2-22, and 3-1 to 3-22 were all made on a pilot scale airlaid drum forming line with through air drying. The compositions of samples 1-1 to 1-23 are given in Table 43, the compositions of samples 2-1 to 2-22 are given in Table 44 and the compositions of samples 3-1 to 3-22 are given in Table 45. The type and level of raw materials for these samples were varied to influence the physical properties and flushable-dispersible properties.

TABLE 43

Samples of Bicomponent Fiber with no PEG200

| | | Sample number | | | | | | | | | |
|---|---|---|---|---|---|---|---|---|---|---|---|
| | | 1-1 | | 1-2 | | 1-3 | | 1-4 | | 1-5 | |
| Layer | Raw Materials | Basis Weight (gsm) | Weight % | Basis Weight (gsm) | Weight % | Basis Weight (gsm) | Weight % | Basis Weight (gsm) | Weight % | Basis Weight (gsm) | Weight % |
| 1 | Trevira Merge 1663 T255 bicomponent fiber, 2.2 dtex × 6 mm | 14.5 | 23.6 | 14.4 | 24.5 | 15.7 | 25.2 | 16.8 | 24.0 | 14.3 | 24.0 |
| | Buckeye Technologies FFT-AS pulp | 46.8 | 76.4 | 44.4 | 75.5 | 46.6 | 74.8 | 53.2 | 76.0 | 45.4 | 76.0 |
| | Total | 61.3 | 100 | 58.8 | 100 | 62.2 | 100 | 70.1 | 100 | 59.8 | 100 |

| | Sample | | | | | | | | | | | | | |
|---|---|---|---|---|---|---|---|---|---|---|---|---|---|---|
| | 1-6 | | 1-7 | | 1-8 | | 1-9 | | 1-10 | | 1-11 | | 1-12 | |
| | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % |
| | 15.7 | 25.3 | 15.5 | 24.4 | 14.6 | 24.2 | 15.3 | 24.3 | 11.6 | 20.7 | 12.0 | 21.7 | 13.7 | 21.3 |
| | 46.5 | 74.7 | 48.1 | 75.6 | 45.8 | 75.8 | 47.6 | 75.7 | 44.3 | 79.3 | 43.2 | 78.3 | 50.6 | 78.7 |
| Total | 62.2 | 100 | 63.6 | 100 | 60.5 | 100 | 62.9 | 100 | 55.8 | 100 | 55.2 | 100 | 64.3 | 100 |

| | Sample | | | | | | | | | | | | | |
|---|---|---|---|---|---|---|---|---|---|---|---|---|---|---|
| | 1-13 | | 1-14 | | 1-15 | | 1-16 | | 1-17 | | 1-18 | | 1-19 | |
| | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % |
| | 12.5 | 20.3 | 12.3 | 20.5 | 10.1 | 14.6 | 9.9 | 15.9 | 10.2 | 14.4 | 10.1 | 15.2 | 9.9 | 15.9 |
| | 49.0 | 79.7 | 47.8 | 79.5 | 59.3 | 85.4 | 52.5 | 84.1 | 61.0 | 85.6 | 56.6 | 84.8 | 52.3 | 84.1 |
| Total | 61.5 | 100 | 60.1 | 100 | 69.4 | 100 | 62.4 | 100 | 71.2 | 100 | 66.8 | 100 | 62.1 | 100 |

| | Sample | | | | | | | |
|---|---|---|---|---|---|---|---|---|
| | 1-20 | | 1-21 | | 1-22 | | 1-23 | |
| | Basis Weight (gsm) | Weight % | Basis Weight (gsm) | Weight % | Basis Weight (gsm) | Weight % | Basis Weight (gsm) | Weight % |
| | 10.5 | 16.0 | 10.9 | 15.8 | 9.5 | 14.8 | 10.1 | 14.9 |
| | 55.0 | 84.0 | 57.8 | 84.2 | 54.8 | 85.2 | 57.4 | 85.1 |
| Total | 65.5 | 100 | 68.7 | 100 | 64.3 | 100 | 67.4 | 100 |

TABLE 44

Samples of Bicomponent Fiber with PEG200 at 200 ppm add-on

| | | Sample number | | | | | | | | | |
|---|---|---|---|---|---|---|---|---|---|---|---|
| | | 2-1 | | 2-2 | | 2-3 | | 2-4 | | 2-5 | |
| Layer | Raw Materials | Basis Weight (gsm) | Weight % | Basis Weight (gsm) | Weight % | Basis Weight (gsm) | Weight % | Basis Weight (gsm) | Weight % | Basis Weight (gsm) | Weight % |
| 1 | Trevira Merge 1663 T255 bicomponent fiber, 2.2 dtex × 6 mm w/PEG200 treatment at add-on level of 200 ppm by wt of bicomp. fiber | 18.2 | 27.6 | 17.5 | 27.3 | 17.1 | 27.4 | 18.8 | 28.7 | 16.7 | 27.1 |

TABLE 44-continued

| Samples of Bicomponent Fiber with PEG200 at 200 ppm add-on | | | | | | | | | | | |
|---|---|---|---|---|---|---|---|---|---|---|---|
| Buckeye Technologies FFT-AS pulp | 47.7 | 72.4 | 46.6 | 72.7 | 45.3 | 72.6 | 46.6 | 71.3 | 45.1 | 72.9 |
| Total | 65.9 | 100 | 64.2 | 100 | 62.4 | 100 | 65.3 | 100 | 61.8 | 100 |

| | Sample | | | | | | | | | | | | | |
|---|---|---|---|---|---|---|---|---|---|---|---|---|---|---|
| | 2-6 | | 2-7 | | 2-8 | | 2-9 | | 2-10 | | 2-11 | | 2-12 | |
| | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % |
| | 18.9 | 26.0 | 18.8 | 28.7 | 13.8 | 20.8 | 14.4 | 22.5 | 14.2 | 23.5 | 16.2 | 22.4 | 14.0 | 19.5 |
| | 54.0 | 74.0 | 46.6 | 71.3 | 52.7 | 79.2 | 49.6 | 77.5 | 46.1 | 76.5 | 56.3 | 77.6 | 57.9 | 80.5 |
| Total | 72.9 | 100 | 65.3 | 100 | 66.5 | 100 | 64.0 | 100 | 60.2 | 100 | 72.6 | 100 | 71.9 | 100 |

| | Sample | | | | | | | | | | | | | |
|---|---|---|---|---|---|---|---|---|---|---|---|---|---|---|
| | 2-13 | | 2-14 | | 2-15 | | 2-16 | | 2-17 | | 2-18 | | 2-19 | |
| | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % |
| | 13.0 | 21.3 | 14.3 | 21.3 | 11.6 | 17.2 | 10.9 | 17.2 | 9.9 | 16.3 | 11.0 | 17.7 | 12.7 | 17.8 |
| | 48.0 | 78.7 | 52.6 | 78.7 | 56.1 | 82.8 | 52.3 | 82.8 | 50.8 | 83.7 | 51.1 | 82.3 | 58.7 | 82.2 |
| Total | 61.0 | 100 | 66.9 | 100 | 67.7 | 100 | 63.2 | 100 | 60.7 | 100 | 62.0 | 1001 | 71.5 | 100 |

| | Sample | | | | | |
|---|---|---|---|---|---|---|
| | 2-20 | | 2-21 | | 2-22 | |
| | Basis Weight (gsm) | Weight % | Basis Weight (gsm) | Weight % | Basis Weight (gsm) | Weight % |
| | 11.3 | 17.6 | 10.0 | 15.3 | 10.8 | 16.9 |
| | 52.7 | 82.4 | 54.9 | 84.7 | 53.0 | 83.1 |
| Total | 64.1 | 100 | 64.9 | 100 | 63.8 | 100 |

TABLE 45

| Samples of Bicomponent Fiber with PEG200 at 700 ppm add-on | | | | | | | | | | | |
|---|---|---|---|---|---|---|---|---|---|---|---|
| | | Sample number | | | | | | | | | |
| | | 3-1 | | 3-2 | | 3-3 | | 3-4 | | 3-5 | |
| Layer | Raw Materials | Basis Weight (gsm) | Weight % | Basis Weight (gsm) | Weight % | Basis Weight (gsm) | Weight % | Basis Weight (gsm) | Weight % | Basis Weight (gsm) | Weight % |
| 1 | Trevira Merge 1663 T255 bicomponent fiber, 2.2 dtex × 6 mm w/PEG700 treatment at add-on level of 700 ppm by wt of bicomp. fiber | 14.8 | 22.7 | 16.6 | 24.7 | 15.4 | 23.1 | 13.5 | 21.1 | 16.7 | 27.0 |
| | Buckeye Technologies FFT-AS pulp | 50.6 | 77.3 | 50.5 | 75.3 | 51.2 | 76.9 | 50.6 | 78.9 | 45.3 | 73.0 |
| | Total | | | | | | | | | | |

| | Sample | | | | | | | | | | | | | |
|---|---|---|---|---|---|---|---|---|---|---|---|---|---|---|
| | 3-6 | | 3-7 | | 3-8 | | 3-9 | | 3-10 | | 3-11 | | 3-12 | |
| | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % |
| | 16.0 | 24.4 | 17.2 | 25.4 | 13.6 | 19.5 | 14.4 | 20.1 | 13.3 | 19.6 | 14.0 | 20.7 | 13.6 | 20.7 |
| | 49.6 | 75.6 | 50.4 | 74.6 | 56.3 | 80.5 | 57.3 | 79.9 | 54.9 | 80.4 | 54.0 | 79.3 | 52.2 | 79.3 |

TABLE 45-continued

| Samples of Bicomponent Fiber with PEG200 at 700 ppm add-on | | | | | | | | | | | | | | |
|---|---|---|---|---|---|---|---|---|---|---|---|---|---|---|
| | Sample | | | | | | | | | | | | | |
| | 3-13 | | 3-14 | | 3-15 | | 3-16 | | 3-17 | | 3-18 | | 3-19 | |
| | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % |
| | 13.5 | 18.8 | 9.6 | 14.9 | 9.6 | 14.7 | 9.7 | 15.2 | 10.8 | 15.6 | 9.9 | 14.9 | 10.1 | 15.4 |
| | 58.3 | 81.2 | 54.9 | 85.1 | 56.0 | 85.3 | 54.3 | 84.8 | 58.5 | 84.4 | 56.8 | 85.1 | 55.4 | 84.6 |
| Total | | | | | | | | | | | | | | |

| | Sample | | | | | |
|---|---|---|---|---|---|---|
| | 3-20 | | 3-21 | | 3-22 | |
| | Basis Weight (gsm) | Weight % | Basis Weight (gsm) | Weight % | Basis Weight (gsm) | Weight % |
| | 10.0 | 15.6 | 10.5 | 16.2 | 8.8 | 14.5 |
| | 53.9 | 84.4 | 54.5 | 83.8 | 52.0 | 85.5 |
| Total | | | | | | |

RESULTS: Product lot analysis was carried out on each sample. Basis weight, caliper, cross directional wet tensile strength and the amount of bicomponent fiber was determined for each sample. Cross direction wet tensile strength was normalized for the differences in basis weight and caliper between the samples. The results of the product lot analysis and the calculated normalized cross direction wet tensile strength are provided in Tables 46, 47, and 48 below.

TABLE 46

| Product Lot Analysis Samples 1-1 to 1-23 | | | | | |
|---|---|---|---|---|---|
| Sample 1 | Basis Weight (gsm) | Caliper (mm) | CDW (gli) | Normalized CDW (gli) | Bicomponent Fiber Level (weight %) |
| Sample 1-1 | 61.3 | 1.30 | 419 | 481 | 23.6 |
| Sample 1-2 | 58.8 | 1.30 | 350 | 419 | 24.5 |
| Sample 1-3 | 62.2 | 1.44 | 411 | 515 | 25.2 |
| Sample 1-4 | 70.1 | 1.30 | 431 | 433 | 24.0 |
| Sample 1-5 | 59.8 | 1.26 | 375 | 428 | 24.0 |
| Sample 1-6 | 62.2 | 1.22 | 451 | 478 | 25.3 |
| Sample 1-7 | 63.6 | 1.28 | 425 | 463 | 24.4 |
| Sample 1-8 | 60.5 | 1.20 | 394 | 423 | 24.2 |
| Sample 1-9 | 62.9 | 1.36 | 402 | 471 | 24.3 |
| Sample 1-10 | 55.8 | 1.18 | 272 | 312 | 20.7 |
| Sample 1-11 | 55.2 | 1.08 | 298 | 316 | 21.7 |
| Sample 1-12 | 64.3 | 1.14 | 348 | 334 | 21.3 |
| Sample 1-13 | 61.5 | 1.24 | 331 | 362 | 20.3 |
| Sample 1-14 | 60.1 | 1.10 | 292 | 289 | 20.5 |
| Sample 1-15 | 69.4 | 1.16 | 228 | 207 | 14.6 |
| Sample 1-16 | 62.4 | 1.08 | 262 | 246 | 15.9 |
| Sample 1-17 | 71.2 | 1.16 | 252 | 223 | 14.4 |
| Sample 1-18 | 66.8 | 1.16 | 225 | 211 | 15.2 |
| Sample 1-19 | 62.1 | 1.06 | 240 | 222 | 15.9 |
| Sample 1-20 | 65.5 | 1.14 | 265 | 249 | 16.0 |
| Sample 1-21 | 68.7 | 1.06 | 279 | 234 | 15.8 |
| Sample 1-22 | 64.3 | 1.00 | 242 | 204 | 14.8 |
| Sample 1-23 | 67.4 | 1.06 | 253 | 215 | 14.9 |

TABLE 47

| Product Lot Analysis Samples 2-1 to 2-22 | | | | | |
|---|---|---|---|---|---|
| Sample 2 | Basis Weight (gsm) | Caliper (mm) | CDW (gli) | Normalized CDW (gli) | Bicomponent Fiber Level (weight %) |
| Sample 2-1 | 65.9 | 1.12 | 830 | 764 | 27.6 |
| Sample 2-2 | 64.2 | 1.26 | 841 | 895 | 27.3 |
| Sample 2-3 | 62.4 | 1.10 | 640 | 612 | 27.4 |
| Sample 2-4 | 65.3 | 1.20 | 811 | 807 | 28.7 |
| Sample 2-5 | 61.8 | 1.14 | 691 | 691 | 27.1 |
| Sample 2-6 | 72.9 | 1.16 | 866 | 746 | 26.0 |
| Sample 2-7 | 65.3 | 1.20 | 760 | 756 | 28.7 |
| Sample 2-8 | 66.5 | 1.22 | 563 | 559 | 20.8 |
| Sample 2-9 | 64.0 | 1.18 | 626 | 626 | 22.5 |
| Sample 2-10 | 60.2 | 1.2 | 479 | 517 | 23.5 |
| Sample 2-11 | 72.6 | 1.3 | 554 | 537 | 22.4 |
| Sample 2-12 | 71.9 | 1.1 | 470 | 390 | 19.5 |
| Sample 2-13 | 61.0 | 1.16 | 446 | 460 | 21.3 |
| Sample 2-14 | 66.9 | 1.24 | 560 | 563 | 21.3 |
| Sample 2-15 | 67.7 | 1.10 | 399 | 351 | 17.2 |
| Sample 2-16 | 63.2 | 1.04 | 353 | 315 | 17.2 |
| Sample 2-17 | 60.7 | 1.02 | 292 | 265 | 16.3 |
| Sample 2-18 | 62.0 | 1.02 | 374 | 333 | 17.7 |
| Sample 2-19 | 71.5 | 1.18 | 410 | 367 | 17.8 |
| Sample 2-20 | 64.1 | 0.96 | 355 | 288 | 17.6 |
| Sample 2-21 | 64.9 | 1.12 | 303 | 283 | 15.3 |
| Sample 2-22 | 63.8 | 1.02 | 363 | 314 | 16.9 |

TABLE 48

| Product Lot Analysis Samples 3-1 to 3-22 | | | | | |
|---|---|---|---|---|---|
| Sample 3 | Basis Weight (gsm) | Caliper (mm) | CDW (gli) | Normalized CDW (gli) | Bicomponent Fiber Level (weight %) |
| Sample 3-1 | 65.5 | 1.12 | 447 | 414 | 22.7 |
| Sample 3-2 | 67.1 | 1.14 | 509 | 468 | 24.7 |
| Sample 3-3 | 66.6 | 1.18 | 525 | 504 | 23.1 |
| Sample 3-4 | 64.1 | 1.12 | 424 | 401 | 21.1 |
| Sample 3-5 | 62.0 | 1.18 | 513 | 529 | 27.0 |
| Sample 3-6 | 65.7 | 1.22 | 520 | 523 | 24.4 |
| Sample 3-7 | 67.6 | 1.26 | 526 | 530 | 25.4 |
| Sample 3-8 | 69.9 | 1.30 | 346 | 348 | 19.5 |

TABLE 48-continued

| Product Lot Analysis Samples 3-1 to 3-22 | | | | | |
|---|---|---|---|---|---|
| Sample 3 | Basis Weight (gsm) | Caliper (mm) | CDW (gli) | Normalized CDW (gli) | Bicomponent Fiber Level (weight %) |
| Sample 3-9 | 71.7 | 1.46 | 447 | 492 | 20.1 |
| Sample 3-10 | 68.3 | 1.46 | 391 | 453 | 19.6 |
| Sample 3-11 | 68.0 | 1.38 | 399 | 439 | 20.7 |
| Sample 3-12 | 65.8 | 1.38 | 344 | 391 | 20.7 |
| Sample 3-13 | 71.7 | 1.40 | 365 | 386 | 18.8 |
| Sample 3-14 | 64.5 | 1.28 | 223 | 240 | 14.9 |
| Sample 3-15 | 65.6 | 1.30 | 219 | 235 | 14.7 |
| Sample 3-16 | 64.1 | 1.22 | 171 | 176 | 15.2 |
| Sample 3-17 | 69.4 | 1.26 | 228 | 224 | 15.6 |
| Sample 3-18 | 66.7 | 1.28 | 223 | 232 | 14.9 |
| Sample 3-19 | 65.5 | 1.28 | 219 | 232 | 15.4 |
| Sample 3-20 | 63.9 | 1.18 | 199 | 199 | 15.6 |
| Sample 3-21 | 65.0 | 1.32 | 228 | 251 | 16.2 |
| Sample 3-22 | 60.8 | 1.24 | 157 | 173 | 14.5 |

TABLE 49

| Bicomponent Fiber Level to Achieve a Normalized CDW of 400 gli | | | |
|---|---|---|---|
| Sample | Weight Percent Bicomponent Fiber | Weight Percent Reduction of Bicomponent Fiber from Control with NO PEG200 | Weight Reduction of Bicomponent Fiber in grams for a 65 gsm wipe |
| No PEG200 (control) | 22.5% | 0% | 0 grams |
| 200 ppm PEG200 | 19.0% | 3.5% | 2.3 grams |
| 700 ppm PEG200 | 20.5% | 2.0% | 1.3 grams |

TABLE 50

| CDW Tensile Strength at the Same Composition | | | |
|---|---|---|---|
| Sample | Weight Percent Bicomponent Fiber | CDW (gli) at the Same Composition | Percent Increase in CDW Strength Over Control |
| No PEG200 (control) | 22.5% | 400 | 0% |
| 200 ppm PEG200 | 22.5% | 550 | 37.5% |
| 700 ppm PEG200 | 22.5% | 450 | 12.5% |

Figure 13:
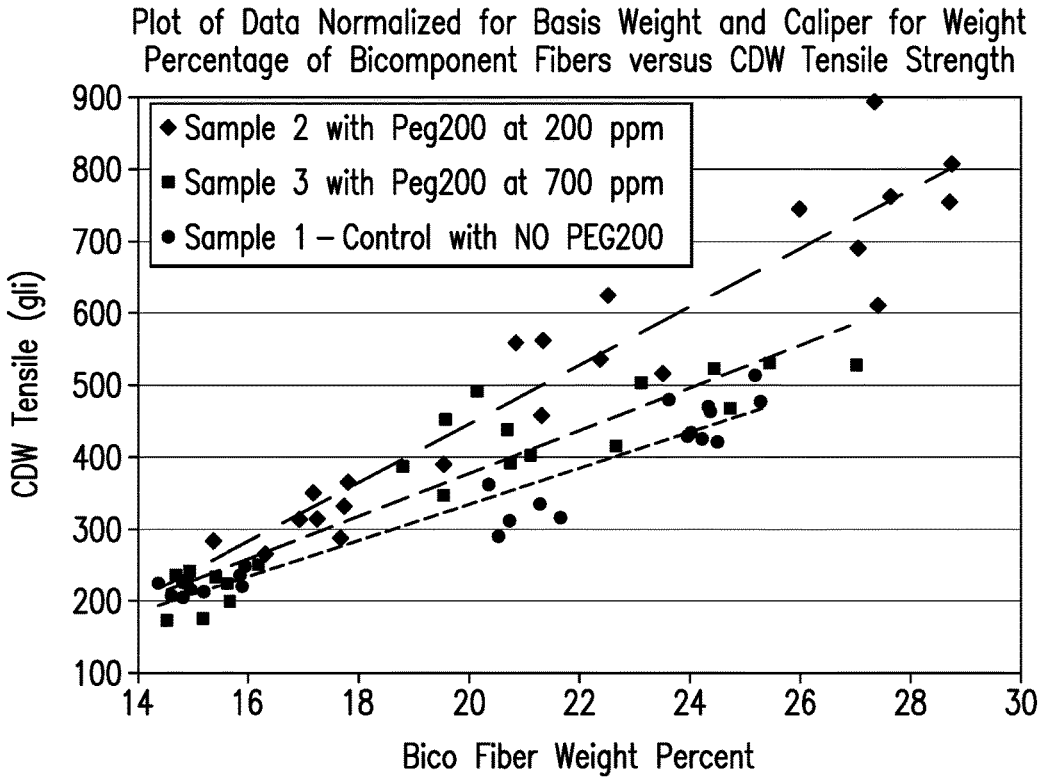
FIG. 13 depicts a graph showing the data in FIG. 12 normalized for basis weight and caliper for the CDW tensile strength of the samples as the bicomponent fiber weight percent is varied. The graph shows the CDW tensile strength (y-axis) versus the weight percent of bicomponent fiber in the samples (x-axis).

DISCUSSION: In FIG. 13, a comparison of the CDW tensile strength (normalized) between samples over a range of similar compositions incorporating no PEG200 on the sheath of the polyester sheath bicomponent fiber, with 200 ppm of PEG200 on the sheath of the bicomponent fiber and with 700 ppm of PEG 200 on the sheath of the bicomponent fiber shows that the addition of PEG200 at either level increases the CDW tensile strength. Bicomponent fibers with 200 ppm of PEG200 added to the sheath of the bicomponent fiber had the highest increase in CDW tensile strength of the airlaid webs.

The significant increase in strength from the addition of the PEG200 can be seen by focusing on the amount of bicomponent fiber required to achieve a specific CDW tensile strength. A CDW strength target of 400 gli is representative of a commercially available personal care wipe based on airlaid technology, such as a baby wipe or a moist toilet tissue, with a basis weight of 65 gsm. A comparison of the amount of bicomponent fiber required to achieve the target value 400 gli CDW from FIG. 13 (normalized) is shown in Table 49. The weight percent of bicomponent fiber to achieve the CDW 400 gli can be reduced from 22.5% to 19.0% when the PEG200 is added to the sheath of the bicomponent fiber. This reduction of 3.5% in the weight percent of bicomponent fiber required to achieve the 400 gli CDW performance as shown in Table 49, is equivalent to a reduction of about 15.6% in the weight percent of bicomponent fiber.

The significant increase in strength from the addition of the PEG200 to the sheath of the bicomponent fiber can also be seen by focusing on the increase in strength between samples that have the same levels of bicomponent fiber or same overall composition. The only difference between the samples is the addition of the PEG200 to the sheath of the bicomponent fiber. The control sample of Table 49 that has no PEG200 added to the sheath of the bicomponent fiber and a CDW tensile strength of 400 gli is used as the control again and compared to samples of the same composition (same level of bicomponent fiber) that have 200 ppm PEG200 and 700 ppm PEG 200 respectively added to the sheath of the bicomponent fiber. The results in Table 50 show that with the same composition, the addition of 200 ppm of PEG200 to the surface of the bicomponent fiber increased the CDW tensile strength 37.5% or 150 gli over the control material with no PEG200.

Example 10

High Strength Binders for Flushable Dispersible Wipes

Wipes according to the invention were prepared and tested for various parameters including MDD, CDD, CDW and CDW in Lotion where the wet refers to lotion versus the water that is standard in this testing. The lotion used to test these samples was expressed from Wal-Mart Parents Choice Baby Wipes.

METHODS/MATERIALS: Samples 4-12 were all made on an airlaid pilot line. The compositions of samples 4-12 are given in Tables 51-60. The type and level of raw materials for these samples were varied to influence the physical properties and flushable-dispersible properties. The samples were cured at 175° C. in a through air oven.

TABLE 51

| Sample 4 (Dow KSR8592 Binder) | | | |
|---|---|---|---|
| Layer | Raw Materials | Basis Weight (gsm) | Weight % |
| Top | Dow KSR8592 | 4.1 | 7.4 |
| 1 | Buckeye Technologies FFT-AS pulp | 47.8 | 85.3 |
| Bottom | Dow KSR8592 | 4.1 | 7.3 |
| | Total | 56 | 100 |

TABLE 52

| Sample 5 (Dow KSR8592 Binder) | | | |
|---|---|---|---|
| Layer | Raw Materials | Basis Weight (gsm) | Weight % |
| Top | Dow KSR8592 | 4.7 | 7.4 |
| 1 | Trevira Merge 1663 T255 bicomponent fiber, 2.2 dtex × 3 mm | 2.6 | 4.0 |
| | Buckeye Technologies FFT-AS pulp | 52.0 | 81.3 |
| Bottom | Dow KSR8592 | 4.7 | 7.3 |
| | Total | 64.0 | 100 |

TABLE 53

| Sample 6 (Dow KSR8596 Binder) | | | |
|---|---|---|---|
| Layer | Raw Materials | Basis Weight (gsm) | Weight % |
| Top | Dow KSR8596 | 4.0 | 7.4 |
| 1 | Trevira Merge 1663 T255 bicomponent fiber, 2.2 dtex × 3 mm | 2.2 | 4.0 |
| | Buckeye Technologies FFT-AS pulp | 43.9 | 81.3 |
| Bottom | Dow KSR8596 | 3.9 | 7.2 |
| | Total | 54.0 | 100 |

TABLE 54

| Sample 7 (Dow KSR8586 Binder) | | | |
|---|---|---|---|
| Layer | Raw Materials | Basis Weight (gsm) | Weight % |
| Top | Dow KSR8586 | 4.5 | 7.4 |
| 1 | Trevira Merge 1663 T255 bicomponent fiber, 2.2 dtex × 3 mm | 2.4 | 4.0 |
| | Buckeye Technologies FFT-AS pulp | 49.6 | 81.3 |
| Bottom | Dow KSR8586 | 4.5 | 7.3 |
| | Total | 61.0 | 100 |

TABLE 55

| Sample 8 (Dow KSR8594 Binder) | | | |
|---|---|---|---|
| Layer | Raw Materials | Basis Weight (gsm) | Weight % |
| Top | Dow KSR8594 | 4.8 | 7.4 |
| 1 | Trevira Merge 1663 T255 bicomponent fiber, 2.2 dtex × 3 mm | 2.6 | 4.0 |
| | Buckeye Technologies FFT-AS pulp | 52.8 | 81.3 |
| Bottom | Dow KSR8594 | 4.8 | 7.4 |
| | Total | 65.0 | 100 |

TABLE 56

| Sample 9 (Dow KSR8598 Binder) | | | |
|---|---|---|---|
| Layer | Raw Materials | Basis Weight (gsm) | Weight % |
| Top | Dow KSR8598 | 3.4 | 7.4 |
| 1 | Buckeye Technologies FFT-AS pulp | 39.2 | 85.3 |
| Bottom | Dow KSR8598 | 3.4 | 7.3 |
| | Total | 46.0 | 100 |

TABLE 57

| Sample 10 (Dow KSR8598 Binder) | | | |
|---|---|---|---|
| Layer | Raw Materials | Basis Weight (gsm) | Weight % |
| Top | Dow KSR8598 | 4.4 | 7.4 |
| 1 | Trevira Merge 1663 T255 bicomponent fiber, 2.2 dtex × 3 mm | 2.4 | 4.0 |
| | Buckeye Technologies FFT-AS pulp | 48.0 | 81.3 |
| Bottom | Dow KSR8598 | 4.3 | 7.3 |
| | Total | 59.0 | 100 |

TABLE 58

| Sample 11 (Dow KSR8588 Binder) | | | |
|---|---|---|---|
| Layer | Raw Materials | Basis Weight (gsm) | Weight % |
| Top | Dow KSR8588 | 3.6 | 7.4 |
| 1 | Buckeye Technologies FFT-AS pulp | 41.8 | 85.3 |
| Bottom | Dow KSR8588 | 3.6 | 7.3 |
| | Total | 49.0 | 100 |

TABLE 59

| Sample 12 (Dow KSR8588 Binder) | | | |
|---|---|---|---|
| Layer | Raw Materials | Basis Weight (gsm) | Weight % |
| Top | Dow KSR8588 | 4.6 | 7.4 |
| 1 | Trevira Merge 1663 T255 bicomponent fiber, 2.2 dtex × 3 mm | 2.5 | 4.0 |
| | Buckeye Technologies FFT-AS pulp | 50.4 | 81.3 |
| Bottom | Dow KSR8588 | 4.5 | 7.3 |
| | Total | 62.0 | 100 |

TABLE 60

| Sample 13 (Control with No Binder) | | | |
|---|---|---|---|
| Layer | Raw Materials | Basis Weight (gsm) | Weight % |
| Top | No Binder | | |
| 1 | Trevira Merge 1663 T255 bicomponent fiber, 2.2 dtex × 3 mm | 2.5 | 4.7 |
| | Buckeye Technologies FFT-AS pulp | 50.4 | 95.3 |
| Bottom | | | |
| | Total | 52.9 | 100 |

RESULTS: Product lot analysis was carried out on each sample. Machine direction dry tensile strength, cross direction dry tensile strength (CDD), cross directional wet tensile strength and cross direction wet tensile strength in lotion (CDW in Lotion) was determined for each sample. The results of the product lot analysis are provided in Tables 61-69 below. Basis weight, caliper and Tip Tube Dispersibility testing was determined for each sample. The results of the product analysis are provided in Tables 70-79 below.

TABLE 61

| Product Lot Analysis Sample 4 (Dow KSR8592 Binder) | | | | |
|---|---|---|---|---|
| Sample 4 | MDD (gli) | CDD (gli) | CDW (gli) | CDW in Lotion (gli) |
| Sample 4-1 | 296 | 524 | 91 | 65 |
| Sample 4-2 | 295 | 545 | 93 | 66 |
| Sample 4-3 | 279 | 503 | 94 | 68 |
| Sample 4-4 | 437 | 477 | 98 | 71 |
| Sample 4-5 | 286 | 233 | 44 | 70 |
| Sample 4-6 | 397 | 253 | 52 | 56 |
| Sample 4-7 | 680 | 270 | 57 | 61 |
| Sample 4-8 | 734 | 268 | 90 | 52 |
| Sample 4-9 | 558 | 540 | 89 | 59 |
| Sample 4-10 | 363 | 487 | 89 | 56 |
| Sample 4-11 | 432 | 410 | 80 | 62 |

TABLE 62

Product Lot Analysis Sample 5 (Dow KSR8592 Binder)

| Sample 5 | MDD (gli) | CDD (gli) | CDW (gli) | CDW in Lotion (gli) |
|---|---|---|---|---|
| Sample 5-1 | 377 | 402 | 106 | 65 |
| Sample 5-2 | 418 | 387 | 120 | 70 |
| Sample 5-3 | 479 | 378 | 117 | 72 |
| Sample 5-4 | 395 | 404 | 114 | 61 |
| Sample 5-5 | 766 | 361 | 124 | 67 |
| Sample 5-6 | 970 | 352 | 117 | 63 |
| Sample 5-7 | 805 | 405 | 119 | 66 |
| Sample 5-8 | 624 | 392 | 117 | 70 |
| Sample 5-9 | 445 | 414 | 106 | 68 |
| Sample 5-10 | 513 | 473 | 115 | 65 |
| Sample 5-11 | 579 | 397 | 115 | 67 |

TABLE 63

Product Lot Analysis Sample 6 (Dow KSR8596 Binder)

| Sample 6 | MDD (gli) | CDD (gli) | CDW (gli) | CDW in Lotion (gli) |
|---|---|---|---|---|
| Sample 6-1 | 329 | 245 | 60 | 53 |
| Sample 6-2 | 215 | 267 | 60 | 58 |
| Sample 6-3 | 414 | 265 | 60 | 52 |
| Sample 6-4 | 468 | 256 | 61 | 50 |
| Sample 6-5 | 341 | 240 | 65 | 45 |
| Sample 6-6 | 379 | 242 | 61 | 56 |
| Sample 6-7 | 407 | 233 | 62 | 47 |
| Sample 6-8 | 272 | 242 | 52 | 54 |
| Sample 6-9 | 413 | 205 | 55 | 48 |
| Sample 6-10 | 338 | 206 | 57 | 55 |
| Sample 6-11 | 358 | 240 | 59 | 52 |

TABLE 64

Product Lot Analysis Sample 7 (Dow KSR8586 Binder)

| Sample 7 | MDD (gli) | CDD (gli) | CDW (gli) | CDW in Lotion (gli) |
|---|---|---|---|---|
| Sample 7-1 | 343 | 366 | 79 | 62 |
| Sample 7-2 | 390 | 374 | 83 | 60 |
| Sample 7-3 | 527 | 342 | 86 | 62 |
| Sample 7-4 | 602 | 331 | 88 | 66 |
| Sample 7-5 | 480 | 376 | 89 | 76 |
| Sample 7-6 | 463 | 376 | 87 | 71 |
| Sample 7-7 | 459 | 345 | 87 | 73 |
| Sample 7-8 | 382 | 380 | 86 | 72 |
| Sample 7-9 | 328 | 417 | 85 | 67 |
| Sample 7-10 | 363 | 457 | 86 | 72 |
| Sample 7-11 | 434 | 376 | 85 | 68 |

TABLE 65

Product Lot Analysis Sample 8 (Dow KSR8594 Binder)

| Sample 8 | MDD (gli) | CDD (gli) | CDW (gli) | CDW in Lotion (gli) |
|---|---|---|---|---|
| Sample 8-1 | 391 | 249 | 61 | 57 |
| Sample 8-2 | 626 | 230 | 61 | 45 |
| Sample 8-3 | 488 | 223 | 61 | 50 |
| Sample 8-4 | 609 | 258 | 57 | 54 |
| Sample 8-5 | 393 | 390 | 63 | 55 |
| Sample 8-6 | 382 | 347 | 71 | 55 |
| Sample 8-7 | 335 | 356 | 72 | 75 |
| Sample 8-8 | 389 | 327 | 64 | 66 |
| Sample 8-9 | 356 | 397 | 71 | 67 |
| Sample 8-10 | 328 | 437 | 72 | 67 |
| Sample 8-11 | 430 | 321 | 65 | 59 |

TABLE 66

Product Lot Analysis Sample 9 (Dow KSR8598 Binder)

| Sample 9 | MDD (gli) | CDD (gli) | CDW (gli) | CDW in Lotion (gli) |
|---|---|---|---|---|
| Sample 9-1 | 417 | 293 | 54 | 48 |
| Sample 9-2 | 476 | 298 | 54 | 31 |
| Sample 9-3 | 383 | 386 | 56 | 49 |
| Sample 9-4 | 298 | 353 | 52 | 24 |
| Sample 9-5 | 309 | 430 | 57 | 46 |
| Sample 9-6 | 212 | 380 | 56 | 28 |
| Sample 9-7 | 159 | 419 | 54 | 50 |
| Sample 9-8 | 186 | 393 | 42 | 23 |
| Sample 9-9 | 147 | 362 | 43 | 48 |
| Sample 9-10 | 154 | 359 | 38 | * |
| Sample 9-11 | 274 | 367 | 50 | 38 |

TABLE 67

Product Lot Analysis Sample 10 (Dow KSR8598 Binder)

| Sample 10 | MDD (gli) | CDD (gli) | CDW (gli) | CDW in Lotion (gli) |
|---|---|---|---|---|
| Sample 10-1 | 406 | 326 | 67 | 66 |
| Sample 10-2 | 444 | 327 | 68 | 68 |
| Sample 10-3 | 364 | 342 | 70 | 68 |
| Sample 10-4 | 375 | 356 | 65 | 63 |
| Sample 10-5 | 463 | 306 | 76 | 75 |
| Sample 10-6 | 579 | 322 | 80 | 58 |
| Sample 10-7 | 626 | 309 | 86 | 64 |
| Sample 10-8 | 656 | 317 | 79 | 59 |
| Sample 10-9 | 565 | 302 | 78 | 69 |
| Sample 10-10 | 541 | 302 | 77 | 67 |
| Sample 10-11 | 502 | 321 | 75 | 66 |

TABLE 68

Product Lot Analysis Sample 11 (Dow KSR8588 Binder)

| Sample 11 | MDD (gli) | CDD (gli) | CDW (gli) | CDW in Lotion (gli) |
|---|---|---|---|---|
| Sample 11-1 | 413 | 313 | 52 | 53 |
| Sample 11-2 | 201 | 445 | 45 | 51 |
| Sample 11-3 | 185 | 473 | 53 | 52 |
| Sample 11-4 | 285 | 473 | 48 | 48 |
| Sample 11-5 | 323 | 482 | 52 | 54 |
| Sample 11-6 | 283 | 451 | 62 | 59 |
| Sample 11-7 | 393 | 422 | 56 | 55 |
| Sample 11-8 | 697 | 497 | 60 | 55 |
| Sample 11-9 | 613 | 360 | 66 | 55 |
| Sample 11-10 | 465 | 327 | 54 | * |
| Sample 11-11 | 386 | 424 | 55 | 54 |

TABLE 69

Product Lot Analysis Sample 12 (Dow KSR8588 Binder)

| Sample 12 | MDD (gli) | CDD (gli) | CDW (gli) | CDW in Lotion (gli) |
|---|---|---|---|---|
| Sample 12-1 | 335 | 347 | 63 | 60 |
| Sample 12-2 | 414 | 346 | 59 | 70 |
| Sample 12-3 | 330 | 317 | 58 | 63 |
| Sample 12-4 | 386 | 315 | 55 | 63 |
| Sample 12-5 | 434 | 323 | 60 | 78 |
| Sample 12-6 | 398 | 367 | 62 | 59 |
| Sample 12-7 | 374 | 369 | 68 | 56 |
| Sample 12-8 | 449 | 551 | 68 | 62 |
| Sample 12-9 | 410 | 588 | 62 | 56 |
| Sample 12-10 | 368 | 588 | 64 | 53 |
| Sample 12-11 | 390 | 411 | 62 | 62 |

TABLE 70

| Product Lot Analysis Sample 4 (Dow KSR8592 Binder) | | | |
|---|---|---|---|
| Sample 4 | Basis Weight (gsm) | Caliper (mm) | Material Remaining on 12 mm Screen (weight percent) |
| Sample 4-12 | 55 | 1.64 | 90 |
| Sample 4-13 | 56 | 1.46 | 88 |
| Sample 4-14 | 57 | 1.42 | 90 |

TABLE 71

| Product Lot Analysis Sample 5 (Dow KSR8592 Binder) | | | |
|---|---|---|---|
| Sample 5 | Basis Weight (gsm) | Caliper (mm) | Material Remaining on 12 mm Screen (weight percent) |
| Sample 5-12 | 67 | 1.52 | 63 |
| Sample 5-13 | 60 | 1.54 | 60 |
| Sample 5-14 | 66 | 1.52 | 51 |

TABLE 72

| Product Lot Analysis Sample 6 (Dow KSR8596 Binder) | | | |
|---|---|---|---|
| Sample 6 | Basis Weight (gsm) | Caliper (mm) | Material Remaining on 12 mm Screen (weight percent) |
| Sample 6-12 | 53 | 1.42 | 72 |
| Sample 6-13 | 54 | 1.44 | 66 |
| Sample 6-14 | 55 | 1.40 | 66 |

TABLE 73

| Product Lot Analysis Sample 7 (Dow KSR8586 Binder) | | | |
|---|---|---|---|
| Sample 7 | Basis Weight (gsm) | Caliper (mm) | Material Remaining on 12 mm Screen (weight percent) |
| Sample 7-12 | 60 | 1.58 | 67 |
| Sample 7-13 | 60 | 1.48 | 53 |
| Sample 7-14 | 62 | 1.52 | 56 |

TABLE 74

| Product Lot Analysis Sample 8 (Dow KSR8594 Binder) | | | |
|---|---|---|---|
| Sample 8 | Basis Weight (gsm) | Caliper (mm) | Material Remaining on 12 mm Screen (weight percent) |
| Sample 8-12 | 59 | 1.48 | 62 |
| Sample 8-13 | 68 | 1.60 | 46 |
| Sample 8-14 | 69 | 1.66 | 34 |

TABLE 75

| Product Lot Analysis Sample 9 (Dow KSR8598 Binder) | | | |
|---|---|---|---|
| Sample 9 | Basis Weight (gsm) | Caliper (mm) | Material Remaining on 12 mm Screen (weight percent) |
| Sample 9-12 | 44 | 1.30 | 89 |
| Sample 9-13 | 46 | 1.32 | 90 |
| Sample 9-14 | 47 | 1.38 | 90 |

TABLE 76

| Product Lot Analysis Sample 10 (Dow KSR8598 Binder) | | | |
|---|---|---|---|
| Sample 10 | Basis Weight (gsm) | Caliper (mm) | Material Remaining on 12 mm Screen (weight percent) |
| Sample 10-12 | 59 | 1.66 | 56 |
| Sample 10-13 | 60 | 1.50 | 54 |
| Sample 10-14 | 58 | 1.54 | 56 |

TABLE 77

| Product Lot Analysis Sample 11 (Dow KSR8588 Binder) | | | |
|---|---|---|---|
| Sample 11 | Basis Weight (gsm) | Caliper (mm) | Material Remaining on 12 mm Screen (weight percent) |
| Sample 11-12 | 49 | 1.50 | 89 |
| Sample 11-13 | 49 | 1.42 | 89 |
| Sample 11-14 | 50 | 1.40 | 88 |

TABLE 78

| Product Lot Analysis Sample 12 (Dow KSR8588 Binder) | | | |
|---|---|---|---|
| Sample 12 | Basis Weight (gsm) | Caliper (mm) | Material Remaining on 12 mm Screen (weight percent) |
| Sample 12-12 | 60 | 1.58 | 56 |
| Sample 12-13 | 61 | 1.64 | 80 |
| Sample 12-14 | 66 | 1.66 | 66 |

TABLE 79

| Product Lot Analysis Sample 13 (Dow KSR8588 Binder) | | | |
|---|---|---|---|
| Sample 13 | Basis Weight (gsm) | Caliper (mm) | Material Remaining on 12 mm Screen (weight percent) |
| Sample 13-12 | 44 | 0.92 | 71 |
| Sample 13-13 | 45 | 0.90 | 66 |
| Sample 13-14 | 43 | 0.98 | 58 |

RESULTS: Product lot analysis was carried out on each sample. FG511.2 Tipping Tube Test was done on each sample after the samples were aged in Wal-Mart Parents Choice baby wipe lotion for a period of about 24 hours at 40° C. The results of the product lot analysis for the FG511.2 Tipping Tube Test are provided in Table 80.

TABLE 80

| Product Lot Analysis Samples 4-13 FG511.2 Tipping Tube Test | | |
|---|---|---|
| Sample | Binder | FG511.2 Tip Tube Test (percent remaining on 12 mm sieve) |
| Sample 4-1 | Dow KSR8592 | 0 |
| Sample 4-2 | Dow KSR8592 | 0 |
| Sample 4-3 | Dow KSR8592 | 0 |
| Sample 5-1 | Dow KSR8592 | 27 |
| Sample 5-2 | Dow KSR8592 | 29 |
| Sample 5-3 | Dow KSR8592 | 37 |
| Sample 6-1 | Dow KSR8596 | 21 |
| Sample 6-2 | Dow KSR8596 | 26 |
| Sample 6-3 | Dow KSR8596 | 26 |
| Sample 7-1 | Dow KSR8586 | 24 |
| Sample 7-2 | Dow KSR8586 | 38 |
| Sample 7-3 | Dow KSR8586 | 36 |
| Sample 8-1 | Dow KSR8594 | 26 |
| Sample 8-2 | Dow KSR8594 | 44 |
| Sample 8-3 | Dow KSR8594 | 53 |

TABLE 80-continued

| Product Lot Analysis Samples 4-13 FG511.2 Tipping Tube Test | | |
|---|---|---|
| Sample | Binder | FG511.2 Tip Tube Test (percent remaining on 12 mm sieve) |
| Sample 9-1 | Dow KSR8598 | 0 |
| Sample 9-2 | Dow KSR8598 | 0 |
| Sample 9-3 | Dow KSR8598 | 0 |
| Sample 10-1 | Dow KSR8598 | 24 |
| Sample 10-2 | Dow KSR8598 | 32 |
| Sample 10-3 | Dow KSR8598 | 31 |
| Sample 11-1 | Dow KSR8588 | 0 |
| Sample 11-2 | Dow KSR8588 | 0 |
| Sample 11-3 | Dow KSR8588 | 0 |
| Sample 12-1 | Dow KSR8588 | 27 |
| Sample 12-2 | Dow KSR8588 | 8 |
| Sample 12-3 | Dow KSR8588 | 14 |
| Sample 13-1 | no binder | 20 |
| Sample 13-2 | no binder | 26 |
| Sample 13-3 | no binder | 31 |

DISCUSSION: The product lot analysis in Tables 61-69 show that there is a significant drop in strength of Samples 4-12 after the samples are wetted with water by comparing the cross direction dry strength to the cross direction wet strength. The product lot analysis in Tables 61-69 also shows that there is a significant drop in strength in Samples 4-12 after the samples are wetted with lotion by comparing the cross direction dry strength to the cross direction wet strength in lotion. The product lot analysis in Tables 61-69 also shows that the CDW in lotion was lower than the CDW in water for most of the samples, regardless if they had bicomponent fiber in their composition.

The product lot analysis in Tables 70-79 showed that all of these samples failed the FG511.2 Tip Tube Test as they had greater than 5% of material remaining on the 12 mm sieve. The samples with and without bicomponent fiber all had values substantially over the 5% maximum level of fiber retention on the 12 mm sieve.

The product lot analysis in Table 80 showed that aging for 24 hours in lotion expressed from Wal-Mart Parents Choice Baby Wipes significantly increased the breakdown of all of the samples in the FG511.2 Tip Tube Test, thus improving their performance. All of the samples that had only binder providing structural integrity, specifically Samples 4, 9 and 11, showed the most improvement with all three of them passing the test with no fiber left on the 12 mm sieve. All of the samples that contained bicomponent fiber and binder still failed the FG511.2 Tip Tube Test, but they all had improved performance. The control sample that had only bicomponent fiber to provide structural integrity failed the test. The use of bicomponent fiber in this type of design, even at minimal levels, will prevent the sample from passing the FG511.2 Tip Tube Test.

Example 11

High Strength Binders for Flushable Dispersible Wipes

Wipes according to the invention were prepared and tested for various parameters including basis weight, caliper and CDW.

METHODS/MATERIALS: Samples 14-16 were all made on an airlaid pilot line. The compositions of samples 14-16 are given in Tables 81-83. The type and level of raw materials for these samples were varied to influence the physical properties and flushable-dispersible properties. The samples were cured at 175° C. in a through air oven during manufacture on the pilot line and then subsequently cured an additional 15 minutes at 150° C. in a lab scale static oven. The additional cure was done to further activate the bonding of the binder and bicomponent fiber.

TABLE 81

| Sample 14 (Dow KSR8592 Binder with Additional Cure) | | | |
|---|---|---|---|
| Layer | Raw Materials | Basis Weight (gsm) | Weight % |
| Top | Dow KSR8592 | 4.1 | 7.4 |
| 1 | Buckeye Technologies FFT-AS pulp | 47.8 | 85.3 |
| Bottom | Dow KSR8592 | 4.1 | 7.3 |
| | Total | 56 | 100 |

TABLE 82

| Sample 15 (Dow KSR8598 Binder with Additional Cure) | | | |
|---|---|---|---|
| Layer | Raw Materials | Basis Weight (gsm) | Weight % |
| Top | Dow KSR8598 | 3.4 | 7.4 |
| 1 | Buckeye Technologies FFT-AS pulp | 39.2 | 85.3 |
| Bottom | Dow KSR8598 | 3.4 | 7.3 |
| | Total | 46.0 | 100 |

TABLE 83

| Sample 16 (Dow KSR8588 Binder with Additional Cure) | | | |
|---|---|---|---|
| Layer | Raw Materials | Basis Weight (gsm) | Weight % |
| Top | Dow KSR8588 | 3.6 | 7.4 |
| 1 | Buckeye Technologies FFT-AS pulp | 41.8 | 85.3 |
| Bottom | Dow KSR8588 | 3.6 | 7.3 |
| | Total | 49.0 | 100 |

RESULTS: Product lot analysis was carried out on each sample. Basis weight, caliper and cross directional wet tensile strength was determined for each sample. Cross direction wet tensile strength was normalized for the differences in basis weight and caliper between the samples. The results of the product lot analysis and the calculated normalized cross direction wet tensile strength are provided in Tables 84, 85 and 86 below.

TABLE 84

| Product Lot Analysis Sample 14 (Dow KSR8592 Binder with Additional Cure) | | | | |
|---|---|---|---|---|
| Sample 14 | Basis Weight (gsm) | Caliper (mm) | CDW (gli) | Normalized CDW (gli) |
| Sample 14-1 | 60.8 | 1.30 | 120 | 111 |
| Sample 14-2 | 52.7 | 1.22 | 56 | 56 |
| Sample 14-3 | 54.3 | 1.14 | 96 | 87 |
| Sample 14-4 | 53.8 | 1.36 | 85 | 93 |
| Sample 14-5 | 58.4 | 1.22 | 105 | 95 |
| Sample 14-6 | 48.3 | 1.02 | 79 | 72 |
| Sample 14-7 | 53.2 | 1.24 | 86 | 87 |
| Sample 14-8 | 52.4 | 1.04 | 70 | 60 |
| Sample 14-9 | 62.0 | 1.28 | 132 | 118 |
| Sample 14-10 | 55.7 | 1.24 | 85 | 82 |

TABLE 85

| Product Lot Analysis Sample 15 (Dow KSR8598 Binder with Additional Cure) | | | | |
|---|---|---|---|---|
| Sample 15 | Basis Weight (gsm) | Caliper (mm) | CDW (gli) | Normalized CDW (gli) |
| Sample 15-1 | 47.2 | 1.12 | 55 | 57 |
| Sample 15-2 | 41.5 | 1.12 | 56 | 65 |
| Sample 15-3 | 46.8 | 1.06 | 69 | 68 |
| Sample 15-4 | 48.3 | 1.22 | 79 | 87 |
| Sample 15-5 | 43.9 | 1.08 | 65 | 70 |
| Sample 15-6 | 47.3 | 1.22 | 99 | 110 |
| Sample 15-7 | 42.2 | 1.22 | 52 | 65 |
| Sample 15-8 | 48.2 | 1.14 | 59 | 60 |
| Sample 15-9 | 46.3 | 1.30 | 49 | 59 |
| Sample 15-10 | 50.6 | 1.14 | 59 | 58 |

TABLE 86

| Product Lot Analysis Sample 16 (Dow KSR8588 Binder with Additional Cure) | | | | |
|---|---|---|---|---|
| Sample 16 | Basis Weight (gsm) | Caliper (mm) | CDW (gli) | Normalized CDW (gli) |
| Sample 16-1 | 60.6 | 1.34 | 124 | 118 |
| Sample 16-2 | 56.9 | 1.20 | 110 | 100 |
| Sample 16-3 | 55.0 | 1.24 | 57 | 56 |
| Sample 16-4 | 48.8 | 1.12 | 55 | 54 |
| Sample 16-5 | 51.2 | 1.16 | 54 | 53 |
| Sample 16-6 | 50.5 | 1.18 | 43 | 43 |
| Sample 16-7 | 50.8 | 1.28 | 52 | 57 |
| Sample 16-8 | 54.6 | 1.36 | 62 | 67 |
| Sample 16-9 | 56.0 | 1.34 | 103 | 107 |
| Sample 16-10 | 63.2 | 1.32 | 121 | 110 |

DISCUSSION: Samples 14, 15 and 16 have the same composition as Samples 4, 9 and 11 respectively with the difference being additional curing time in a lab scale oven at 150° C. to promote additional bonding of the binder to provide additional strength in the Samples. Samples 14, 15 and 16 with additional cure had higher cross directional wet tensile strength than Samples 4, 9 and 11 respectively. The additional curing gave increased cross directional wet tensile strength.

Example 12

High Strength Binders for Flushable Dispersible Wipes

Wipes according to the invention were prepared and tested for various parameters including basis weight, caliper and CDW in Lotion where the wet refers to lotion versus the water that is standard in this testing. The lotion used to test these samples was expressed from Wal-Mart Parents Choice Baby Wipes. Testing in lotion was done after placing the samples in the lotion for a period of about 1-2 seconds (a quick dip) and after placing the samples in lotion for approximately 24 hours in a sealed environment at a temperature of 40° C. Placing the wipe sample in the sealed environment at 40° C.

METHODS/MATERIALS: Samples 17-40 were all made on a lab scale pad former. The compositions of samples 17-40 are given in Tables 87-92. The type and level of raw materials for these samples were varied to influence the physical properties and flushable-dispersible properties. The samples were cured at 150° C. in a static oven.

TABLE 87

| Samples with Dow KSR4483 Binder | | | | | | | | | |
|---|---|---|---|---|---|---|---|---|---|
| | | Sample 17 | | Sample 18 | | Sample 19 | | Sample 20 | |
| Layer | Raw Materials | Basis Weight (gsm) | Weight % | Basis Weight (gsm) | Weight % | Basis Weight (gsm) | Weight % | Basis Weight (gsm) | Weight % |
| Top | Dow KSR4483 | 8.1 | 12.7 | 6.0 | 10.2 | 8.4 | 13.5 | 5.6 | 10.2 |
| 1 | Buckeye Tech. FFT-AS pulp | 47.9 | 74.7 | 46.6 | 79.7 | 45.0 | 73.0 | 43.6 | 79.7 |
| Bottom | Dow KSR4483 | 8.1 | 12.6 | 5.9 | 10.1 | 8.4 | 13.5 | 5.5 | 10.1 |
| | Total | 64.1 | 100 | 58.4 | 100 | 61.6 | 100 | 54.8 | 100 |

TABLE 88

| Samples with Dow KSR8758 | | | | | | | | | |
|---|---|---|---|---|---|---|---|---|---|
| | | Sample 21 | | Sample 22 | | Sample 23 | | Sample 24 | |
| Layer | Raw Materials | Basis Weight (gsm) | Basis Weight (gsm) | Weight % | Basis Weight (gsm) | Weight % | Basis Weight (gsm) | Weight % | Weight % |
| Top | Dow KSR8758 | 6.6 | 6.0 | 7.7 | 12.7 | 5.9 | 10.8 | 9.6 | 14.9 |
| 1 | Buckeye Technologies FFT-AS pulp | 40.9 | 46.6 | 45.4 | 74.7 | 42.8 | 78.5 | 45.2 | 70.3 |
| Bottom | Dow KSR8758 | 6.6 | 5.9 | 7.6 | 12.6 | 5.9 | 10.7 | 9.5 | 14.8 |
| | Total | 54.0 | 58.4 | 46.0 | 100 | 54.6 | 100 | 64.4 | 100 |

TABLE 89

| Samples with Dow KSR8760 Binder | | | | | | | | | |
|---|---|---|---|---|---|---|---|---|---|
| | | Sample 25 | | Sample 26 | | Sample 27 | | | |
| | | Basis | | Basis | | Basis | | Sample 28 | |
| Layer | Raw Materials | Weight (gsm) | Weight % | Weight (gsm) | Weight % | Weight (gsm) | Weight % | Weight % | Weight % |
| Top | Dow KSR8760 | 5.8 | 7.7 | 6.5 | 11.7 | 6.8 | 11.7 | 7.5 | 12.1 |
| 1 | Buckeye Technologies FFT-AS pulp | 44.0 | 45.4 | 42.5 | 76.6 | 44.3 | 76.6 | 47.2 | 75.8 |
| Bottom | Dow KSR8760 | 5.8 | 7.6 | 6.5 | 11.7 | 6.7 | 11.7 | 7.5 | 12.1 |
| | Total | 55.6 | 46.0 | 55.5 | 100 | 57.8 | 100 | 62.2 | 100 |

TABLE 90

| Samples with Dow KSR8762 Binder | | | | | | | | | |
|---|---|---|---|---|---|---|---|---|---|
| | | Sample 29 | | Sample 30 | | | | | |
| | | Basis | Basis | | Basis | Sample 31 | | Sample 32 | |
| Layer | Raw Materials | Weight (gsm) | Weight (gsm) | Weight % | Weight (gsm) | Weight % | Weight % | Weight % | Weight % |
| Top | Dow KSR8762 | 7.5 | 6.5 | 7.1 | 12.9 | 7.5 | 12.9 | 7.7 | 12.5 |
| 1 | Buckeye Technologies FFT-AS pulp | 40.0 | 42.5 | 40.7 | 74.3 | 43.3 | 74.3 | 46.3 | 75.0 |
| Bottom | Dow KSR8762 | 7.4 | 6.5 | 7.0 | 12.8 | 7.5 | 12.8 | 7.7 | 12.5 |
| | Total | 54.9 | 55.5 | 54.8 | 100 | 58.3 | 100 | 61.7 | 100 |

TABLE 91

| Samples with Dow KSR8764 Binder | | | | | | | | | |
|---|---|---|---|---|---|---|---|---|---|
| | | Sample 33 | | Sample 34 | | | | | |
| | | Basis | Basis | Basis | Basis | Sample 35 | | Sample 36 | |
| Layer | Raw Materials | Weight (gsm) | Weight (gsm) | Weight (gsm) | Weight (gsm) | Weight % | Weight % | Weight % | Weight % |
| Top | Dow KSR8764 | 7.2 | 7.2 | 6.5 | 12.0 | 6.9 | 12.6 | 6.9 | 12.0 |
| 1 | Buckeye Technologies FFT-AS pulp | 44.6 | 44.6 | 40.9 | 76.0 | 40.7 | 74.8 | 43.6 | 76.0 |
| Bottom | Dow KSR8764 | 7.2 | 7.2 | 6.4 | 12.0 | 6.8 | 12.6 | 6.9 | 12.0 |
| | Total | 59.0 | 59.0 | 53.9 | 100 | 54.4 | 100 | 57.4 | 100 |

TABLE 92

| Samples with Dow KSR8811 Binder | | | | | | | | | |
|---|---|---|---|---|---|---|---|---|---|
| | | Sample 37 | | Sample 38 | | | | | |
| | | Basis | Basis | Basis | | Sample 39 | | Sample 40 | |
| Layer | Raw Materials | Weight (gsm) | Weight (gsm) | Weight (gsm) | Weight % | Weight % | Weight % | Weight % | Weight % |
| Top | Dow KSR8811 | 7.0 | 6.5 | 7.0 | 12.7 | 9.4 | 14.9 | 7.5 | 12.7 |
| 1 | Buckeye Technologies FFT-AS pulp | 43.3 | 40.9 | 41.5 | 74.7 | 44.3 | 70.2 | 44.4 | 74.7 |
| Bottom | Dow KSR8811 | 6.9 | 6.4 | 7.0 | 12.6 | 9.4 | 14.9 | 7.5 | 12.6 |
| | Total | 57.2 | 53.9 | 55.5 | 100 | 63.1 | 100 | 59.4 | 100 |

RESULTS: Product lot analysis was carried out on each sample. Basis weight, caliper and cross directional wet tensile strength were determined for each sample. CDW tensile strength was done after exposing the wipe to lotion for about 1-2 seconds at ambient temperature and after 24 hours at 40° C. in a sealed environment. CDW tensile strength was normalized for the differences in basis weight and caliper between the samples. The results of the product lot analysis and the calculated normalized cross direction wet tensile strength are provided in Tables 93-104 below.

TABLE 93

Product Lot Analysis Dow KSR4483 Binder with 1-2 Second Dip (Samples 17-18)

| Sample | Basis Weight (gsm) | Caliper (mm) | Binder Level (weight percent) | CDW (gli) | Normalized CDW (gli) |
|---|---|---|---|---|---|
| Sample 17 | 64.1 | 0.94 | 25.3 | 423 | 373 |
| Sample 18 | 58.4 | 0.98 | 20.3 | 269 | 272 |

TABLE 94

Product Lot Analysis Dow KSR4483 Binder with 24 hour aging (Samples 19-20)

| Sample | Basis Weight (gsm) | Caliper (mm) | Binder Level (weight percent) | CDW (gli) | Normalized CDW (gli) |
|---|---|---|---|---|---|
| Sample 19 | 61.6 | 0.9 | 27.0 | 78 | 69 |
| Sample 20 | 54.8 | 0.98 | 20.3 | 60 | 65 |

TABLE 95

Product Lot Analysis Dow KSR8758 Binder with 1-2 Second Dip (Samples 21-22)

| Sample | Basis Weight (gsm) | Caliper (mm) | Binder Level (weight percent) | CDW (gli) | Normalized CDW (gli) |
|---|---|---|---|---|---|
| Sample 21 | 54.0 | 0.94 | 24.4 | 280 | 293 |
| Sample 22 | 60.7 | 0.86 | 25.3 | 334 | 285 |

TABLE 96

Product Lot Analysis Dow KSR8758 Binder with 24 hour aging (Samples 23-24)

| Sample | Basis Weight (gsm) | Caliper (mm) | Binder Level (weight percent) | CDW (gli) | Normalized CDW (gli) |
|---|---|---|---|---|---|
| Sample 23 | 54.6 | 0.86 | 21.5 | 109 | 103 |
| Sample 24 | 64.4 | 0.82 | 29.7 | 177 | 136 |

TABLE 97

Product Lot Analysis Dow KSR8760 Binder with 1-2 Second Dip (Samples 25-26)

| Sample | Basis Weight (gsm) | Caliper (mm) | Binder Level (weight percent) | CDW (gli) | Normalized CDW (gli) |
|---|---|---|---|---|---|
| Sample 25 | 55.6 | 0.96 | 21.0 | 242 | 251 |
| Sample 26 | 55.5 | 0.96 | 23.4 | 272 | 283 |

TABLE 98

Product Lot Analysis Dow KSR8760 Binder with 24 hour aging (Samples 27-28)

| Sample | Basis Weight (gsm) | Caliper (mm) | Binder Level (weight percent) | CDW (gli) | Normalized CDW (gli) |
|---|---|---|---|---|---|
| Sample 27 | 57.8 | 0.96 | 23.4 | 100 | 100 |
| Sample 28 | 62.2 | 0.88 | 24.2 | 134 | 114 |

TABLE 99

Product Lot Analysis Dow KSR8762 Binder with 1-2 Second Dip (Samples 29-30)

| Sample | Basis Weight (gsm) | Caliper (mm) | Binder Level (weight percent) | CDW (gli) | Normalized CDW (gli) |
|---|---|---|---|---|---|
| Sample 29 | 54.9 | 0.94 | 27.3 | 338 | 348 |
| Sample 30 | 54.8 | 0.88 | 25.7 | 333 | 322 |

TABLE 100

| Product Lot Analysis Dow KSR8762 Binder with 24 hour aging (Samples 31-32) | | | | | |
|---|---|---|---|---|---|
| Sample | Basis Weight (gsm) | Caliper (mm) | Binder Level (weight percent) | CDW (gli) | Normalized CDW (gli) |
| Sample 31 | 58.3 | 0.88 | 25.7 | 112 | 102 |
| Sample 32 | 61.7 | 0.92 | 25.0 | 158 | 142 |

TABLE 101

| Product Lot Analysis Dow KSR8764 Binder with 1-2 Second Dip (Samples 33-34) | | | | | |
|---|---|---|---|---|---|
| Sample | Basis Weight (gsm) | Caliper (mm) | Binder Level (weight percent) | CDW (gli) | Normalized CDW (gli) |
| Sample 33 | 59.0 | 0.96 | 24.5 | 208 | 204 |
| Sample 34 | 53.9 | 0.88 | 24.0 | 257 | 253 |

TABLE 102

| Product Lot Analysis Dow KSR8764 Binder with 24 hour aging (Samples 35-36) | | | | | |
|---|---|---|---|---|---|
| Sample | Basis Weight (gsm) | Caliper (mm) | Binder Level (weight percent) | CDW (gli) | Normalized CDW (gli) |
| Sample 35 | 54.4 | 0.88 | 25.2 | 76 | 74 |
| Sample 36 | 57.4 | 0.88 | 24.0 | 124 | 114 |

TABLE 103

| Product Lot Analysis Dow KSR8811 Binder with 1-2 Second Dip (Samples 37-38) | | | | | |
|---|---|---|---|---|---|
| Sample | Basis Weight (gsm) | Caliper (mm) | Binder Level (weight percent) | CDW (gli) | Normalized CDW (gli) |
| Sample 37 | 57.2 | 0.94 | 24.4 | 411 | 406 |
| Sample 38 | 55.5 | 1.02 | 25.3 | 510 | 564 |

TABLE 104

| Product Lot Analysis Dow KSR8811 Binder with 24 hour aging (Samples 39-40) | | | | | |
|---|---|---|---|---|---|
| Sample | Basis Weight (gsm) | Caliper (mm) | Binder Level (weight percent) | CDW (gli) | Normalized CDW (gli) |
| Sample 39 | 63.1 | 1.02 | 29.8 | 117 | 114 |
| Sample 40 | 59.4 | 1.02 | 25.3 | 193 | 200 |

DISCUSSION: Samples with similar composition had significantly lower cross directional wet tensile when subjected to 24 hours of aging in lotion expressed from Wal-Mart Parents Choice Baby Wipes versus samples that were placed in lotion expressed from Wal-Mart Parents Choice Baby Wipes for 1-2 seconds. Samples 19 and 20 with Dow KSR4483 binder, that were aged 24 hours in lotion, showed the largest drop in cross directional wet tensile strength versus Samples 17 and 18 with Dow KSR4483 binder that were placed in lotion for 1-2 seconds, with a loss of about 80% in strength. A comparison of samples with the same binder showed that Samples 21-40 had a drop of about 68% to about 59% in cross directional wet strength after 24 hours of aging in Wal-Mart Parents Choice Baby Wipe lotion versus samples that were placed in lotion for about 1-2 seconds.

Example 13

High Strength Binders for Flushable Dispersible Wipes

Wipes according to the invention were prepared and tested for various parameters including basis weight, caliper, FG511.2 Tipping Tube Test, FG 512.1 Column Settling Test and CDW in Lotion where the wet refers to lotion versus the water that is standard in this testing. The lotion used to test these samples was expressed from Wal-Mart Parents Choice Baby Wipes. Testing in lotion was done after placing the samples in the lotion for a period of about 1-2 seconds (a quick dip) and after placing the samples in lotion for approximately 24 hours in a sealed environment at a temperature of 40° C. Placing the wipe sample in the sealed environment at 40° C.

METHODS/MATERIALS: Samples 41-46 were all made on an airlaid pilot line. The composition of samples 41-46 are given in Tables 105-110. The type and level of raw materials for these samples were varied to influence the physical properties and flushable-dispersible properties. The samples were cured at 175 C in a through air oven.

TABLE 105

| Sample 41 (Dow KSR8620) | | | |
|---|---|---|---|
| Layer | Raw Materials | Basis Weight (gsm) | Weight % |
| Top | Dow KSR8620 | 8.0 | 12.4 |
| 1 | Buckeye Technologies FFT-AS pulp | 48.8 | 75.3 |
| Bottom | Dow KSR8620 | 8.0 | 12.3 |
| | Total | 64.8 | 100 |

TABLE 106

| Sample 42 (Dow KSR8622) | | | |
|---|---|---|---|
| Layer | Raw Materials | Basis Weight (gsm) | Weight % |
| Top | Dow KSR8622 | 8.0 | 12.4 |
| 1 | Buckeye Technologies FFT-AS pulp | 48.8 | 75.3 |
| Bottom | Dow KSR8622 | 8.0 | 12.3 |
| | Total | 64.8 | 100 |

TABLE 107

| Sample 43 (Dow KSR8624 Binder) | | | |
|---|---|---|---|
| Layer | Raw Materials | Basis Weight (gsm) | Weight % |
| Top | Dow KSR8624 | 8.0 | 12.4 |
| 1 | Buckeye Technologies FFT-AS pulp | 48.8 | 75.3 |
| Bottom | Dow KSR8624 | 8.0 | 12.3 |
| | Total | 64.8 | 100 |

TABLE 108

| Sample 44 (Dow KSR8626 Binder) | | | |
|---|---|---|---|
| Layer | Raw Materials | Basis Weight (gsm) | Weight % |
| Top | Dow KSR8626 | 8.0 | 12.4 |
| 1 | Buckeye Technologies FFT-AS pulp | 48.8 | 75.3 |
| Bottom | Dow KSR8626 | 8.0 | 12.3 |
| | Total | 64.8 | 100 |

TABLE 109

| Sample 45 (Dow KSR8628 Binder) | | | |
|---|---|---|---|
| Layer | Raw Materials | Basis Weight (gsm) | Weight % |
| Top | Dow KSR8628 | 8.0 | 12.4 |
| 1 | Buckeye Technologies FFT-AS pulp | 48.8 | 75.3 |
| Bottom | Dow KSR8628 | 8.0 | 12.3 |
| | Total | 64.8 | 100 |

TABLE 110

| Sample 46 (Dow KSR8630 Binder) | | | |
|---|---|---|---|
| Layer | Raw Materials | Basis Weight (gsm) | Weight % |
| Top | Dow KSR8630 | 8.00 | 12.4 |
| 1 | Buckeye Technologies FFT-AS pulp | 48.8 | 75.3 |
| Bottom | Dow KSR8630 | 8.00 | 12.3 |
| | Total | 64.8 | 100 |

RESULTS: Product lot analysis was carried out on each sample. Cross directional wet tensile strength, CDW elongation, FG511.2 Tipping Tube Test and FG 512.1 Column Settling Test were done. The results of the product lot analysis for cross direction wet tensile strength are provided in Tables 111-116, the product lot analysis for the FG511.2 Tipping Tube Test are provided in Table 117 and the product lot analysis for the FG 512.1 Column Settling Test are provided in Table 118.

Figure 16:
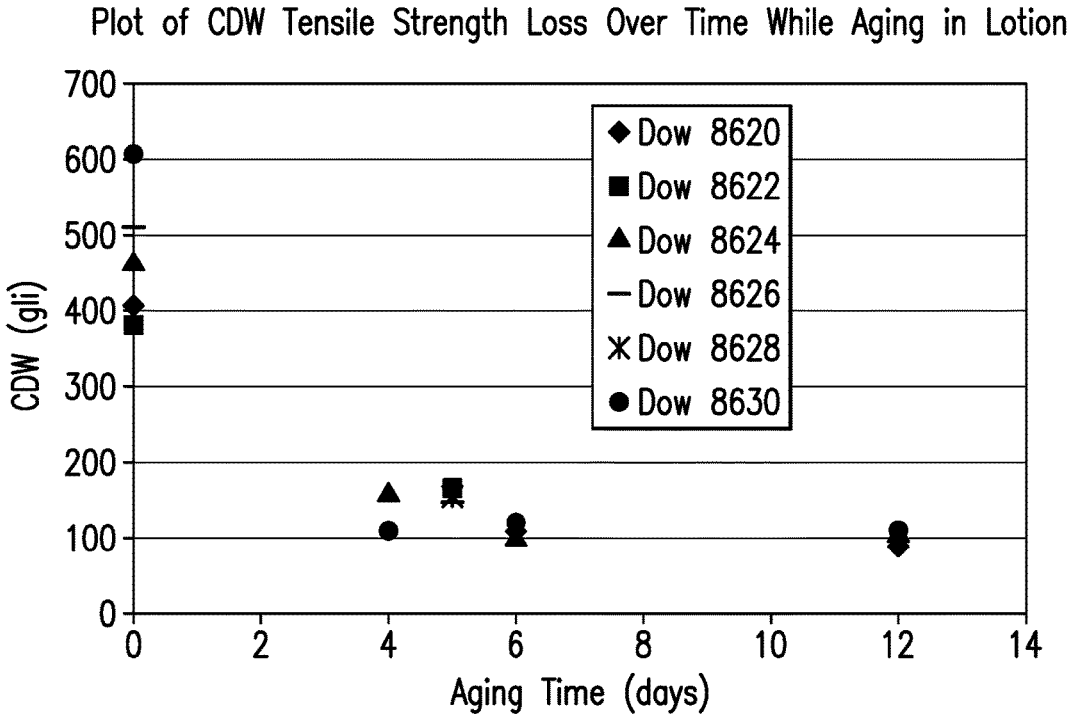
FIG. 16 depicts a graph showing the product lot analysis for aging in lotion using CDW strength. The graph shows the CDW strength (y-axis) versus the number of days that the samples are aged in lotion (x-axis).

The loss of strength when samples are placed in lotion is critical to the long term stability of products prior to use by the consumer. This process is referred to as aging in lotion. The loss in strength can be evaluated by measuring the decay in cross directional wet strength of a binder that is incorporated into a wipe over a period of time. This was done by adding lotion expressed from Wal-Mart Parents Choice Baby Wipes at 350% loading based on the dry weight of the wipe sample, sealing the wipe in a container to prevent evaporation and placing the container with the wipe in an oven at 40° C. for a period of time. The wipes were removed and tested for cross directional wet strength. The results of the product lot analysis for aging in lotion using cross directional wet strength are provided in Table 119 and plotted in FIG. 16.

TABLE 111

| Product Lot Analysis Dow 8620 Binder | | |
|---|---|---|
| Sample 41 | CDW (gli) | CDW Elongation (%) |
| Sample 41-1 | 264 | 17 |
| Sample 41-2 | 389 | 22 |

TABLE 111-continued

| Product Lot Analysis Dow 8620 Binder | | |
|---|---|---|
| Sample 41 | CDW (gli) | CDW Elongation (%) |
| Sample 41-3 | 398 | 15 |
| Sample 41-4 | 396 | 20 |
| Sample 41-5 | 387 | 21 |
| Sample 41-6 | 279 | 18 |
| Sample 41-7 | 518 | 24 |
| Sample 41-8 | 491 | 19 |
| Sample 41-9 | 550 | 22 |
| Sample 41-10 | 756 | 17 |
| Sample 41-11 | 481 | 21 |

TABLE 112

| Product Lot Analysis Dow 8622 Binder | | |
|---|---|---|
| Sample 42 | CDW (gli) | CDW Elongation (%) |
| Sample 42-1 | 239 | 18 |
| Sample 42-2 | 447 | 26 |
| Sample 42-3 | 538 | 24 |
| Sample 42-4 | 463 | 184 |
| Sample 42-5 | 810 | 23 |
| Sample 42-6 | 536 | 28 |

TABLE 113

| Product Lot Analysis Dow 8624 Binder | | |
|---|---|---|
| Sample 43 | CDW (gli) | CDW Elongation (%) |
| Sample 43-1 | 436 | 19 |
| Sample 43-2 | 469 | 20 |
| Sample 43-3 | 604 | 20 |
| Sample 43-4 | 868 | 16 |
| Sample 43-5 | 820 | 18 |
| Sample 43-6 | 517 | 18 |

TABLE 114

| Product Lot Analysis Dow 8626 Binder | | |
|---|---|---|
| Sample 44 | CDW (gli) | CDW Elongation (%) |
| Sample 44-1 | 258 | 13 |
| Sample 44-2 | 889 | 18 |
| Sample 44-3 | 462 | 18 |
| Sample 44-4 | 477 | 19 |
| Sample 44-5 | 617 | 21 |
| Sample 44-6 | 599 | 14 |

TABLE 115

| Product Lot Analysis Dow 8628 Binder | | |
|---|---|---|
| Sample 45 | CDW (gli) | CDW Elongation (%) |
| Sample 45-1 | 513 | 25 |
| Sample 45-2 | 559 | 27 |
| Sample 45-3 | 458 | 23 |
| Sample 45-4 | 378 | 21 |
| Sample 45-5 | 297 | 17 |
| Sample 45-6 | 350 | 17 |

TABLE 116

| Product Lot Analysis Dow 8630 Binder | | |
|---|---|---|
| Sample 46 | CDW (gli) | CDW Elongation (%) |
| Sample 46-1 | 513 | 25 |
| Sample 46-2 | 559 | 27 |
| Sample 46-3 | 458 | 23 |
| Sample 46-4 | 378 | 21 |
| Sample 46-5 | 297 | 17 |
| Sample 46-6 | 350 | 17 |

TABLE 117

| Samples 41-46 FG511.2 Tipping Tube Test and FG 521.1 Laboratory Household Pump Test | | |
|---|---|---|
| Sample | Binder | FG511.2 Tip Tube Test (percent remaining on 12 mm sieve) |
| Sample 41 | Dow KSR8620 | 59 |
| Sample 42 | Dow KSR8622 | 100 |
| Sample 43 | Dow KSR8624 | 100 |
| Sample 44 | Dow KSR8626 | 100 |
| Sample 45 | Dow KSR8628 | 100 |
| Sample 46 | Dow KSR8630 | 100 |

TABLE 118

| FG 512.1 Column Settling Test | | |
|---|---|---|
| | | Sink Time (minutes) |
| Sample 41 | Sample 41-1 | 0.38 |
| | Sample 41-2 | 1.07 |
| | Sample 41-3 | 1.45 |
| Sample 42 | Sample 42-1 | 1.60 |
| | Sample 42-2 | 1.55 |
| | Sample 42-3 | 1.58 |
| Sample 43 | Sample 43-1 | 1.65 |
| | Sample 43-2 | 1.85 |
| | Sample 43-3 | 1.80 |
| Sample 44 | Sample 44-1 | 1.48 |
| | Sample 44-2 | 1.60 |
| | Sample 44-3 | 1.53 |
| Sample 45 | Sample 45-1 | 1.83 |
| | Sample 45-2 | 2.10 |
| | Sample 45-3 | 1.17 |
| Sample 46 | Sample 46-1 | 1.78 |
| | Sample 46-2 | 2.08 |
| | Sample 46-3 | 2.13 |

TABLE 119

| Loss of Tensile Strength Over Time While Aging in Lotion | | | | | | |
|---|---|---|---|---|---|---|
| | | CDW (gli) over Time (in days) | | | | |
| Sample | Binder | 0.01 | 4 | 5 | 6 | 12 |
| Sample 41 | Dow KSR8620 | 408 | 113 | | 110 | 90 |
| Sample 42 | Dow KSR8622 | 383 | | 168 | | |
| Sample 43 | Dow KSR8624 | 468 | 162 | | 104 | 110 |
| Sample 44 | Dow KSR8626 | 512 | | 150 | | |
| Sample 45 | Dow KSR8628 | 396 | | 154 | | |
| Sample 46 | Dow KSR8630 | 609 | 112 | | 122 | 110 |

DISCUSSION: Samples 41-46 all had good initial cross directional wet tensile strength, but failed the FG511.2 Tip Tube Test. Sample 41, using the Dow KSR8620 binder, was the only binder to show any breakdown in the Tip Tube Test, with 59% remaining on the 12 mm sieve. Samples 41-46 all passed the FG512.1 Settling Column Test.

Samples 41-46 all had substantial loss of cross directional wet strength during a long term aging study in Wal-Mart Parents Choice lotion at 40° C. Final cross directional wet strength in lotion values were all about 100 gli, while the values after a quick dip in lotion were all approximately 400-600 gli. Higher initial cross directional wet strength values after the 1-2 second quick dip did not result in higher cross directional wet strength values after 12 days of an aging study.

Example 14

High Strength Binders for Flushable Dispersible Wipes

Wipes according to the invention were prepared and tested for various parameters including basis weight, caliper and CDW in Lotion where the wet refers to lotion versus the water that is standard in this testing. The lotion used to test these samples was expressed from Wal-Mart Parents Choice Baby Wipes. Testing was done after placing the samples in the lotion for a period of about 1-2 seconds (a quick dip) and after placing the samples in lotion for approximately 24 hours in a sealed environment at a temperature of 40° C. Samples 47-58 were tested after the quick dip in lotion while samples 59-69 were tested after 24 hours of aging in Wal-Mart Parents Choice Lotion at 40° C.

METHODS/MATERIALS: Samples 47-69 were all made on a lab scale pad former and cured at 150° C. for 15 minutes. The composition of samples 47-69 are given in Tables 120-125. The type and level of raw materials for these samples were varied to influence the physical properties and flushable-dispersible properties.

TABLE 120

| Samples with Dow KSR4483 | | | | | | | | | |
|---|---|---|---|---|---|---|---|---|---|
| | | Sample 47 | | Sample 48 | | Sample 59 | | Sample 60 | |
| Layer | Raw Materials | Basis Weight (gsm) | Weight % | Basis Weight (gsm) | Weight % | Basis Weight (gsm) | Weight % | Basis Weight (gsm) | Weight % |
| Top | Dow KSR4483 | 8.1 | 12.7 | 5.9 | 10.2 | 8.3 | 13.5 | 5.6 | 10.2 |
| 1 | Buckeye Technologies FFT-AS pulp | 47.9 | 74.7 | 46.6 | 79.7 | 45.0 | 73.0 | 43.6 | 79.7 |
| Bottom | Dow KSR4483 | 8.1 | 12.7 | 5.9 | 10.2 | 8.3 | 13.5 | 5.6 | 10.2 |
| | Total | 64.1 | 100 | 58.4 | 100 | 61.6 | 100 | 54.8 | 100 |

TABLE 121

| Samples with Dow KSR8758 Binder | | | | | | | | | |
|---|---|---|---|---|---|---|---|---|---|
| | | Sample 49 | | Sample 50 | | Sample 61 | | Sample 62 | |
| Layer | Raw Materials | Basis Weight (gsm) | Weight % | Basis Weight (gsm) | Weight % | Basis Weight (gsm) | Weight % | Basis Weight (gsm) | Weight % |
| Top | Dow KSR8758 | 6.6 | 12.2 | 7.7 | 12.6 | 5.9 | 10.8 | 9.6 | 14.9 |
| 1 | Buckeye Technologies FFT-AS pulp | 40.9 | 75.7 | 45.4 | 74.7 | 42.8 | 78.5 | 45.2 | 70.3 |
| Bottom | Dow KSR8758 | 6.6 | 12.2 | 7.7 | 12.6 | 5.9 | 10.8 | 9.6 | 14.9 |
| | Total | 54.0 | 100 | 60.7 | 100 | 54.6 | 100 | 64.4 | 100 |

TABLE 122

| Samples with Dow KSR8760 Binder | | | | | | | | | |
|---|---|---|---|---|---|---|---|---|---|
| | | Sample 51 | | Sample 52 | | Sample 63 | | Sample 64 | |
| Layer | Raw Materials | Basis Weight (gsm) | Weight % | Basis Weight (gsm) | Weight % | Basis Weight (gsm) | Weight % | Basis Weight (gsm) | Weight % |
| Top | Dow KSR8760 | 5.8 | 10.5 | 6.5 | 11.7 | 6.8 | 11.7 | 7.5 | 12.1 |
| 1 | Buckeye Technologies FFT-AS pulp | 44.0 | 79.1 | 42.5 | 76.6 | 44.3 | 76.6 | 47.2 | 75.8 |
| Bottom | Dow KSR8760 | 5.8 | 10.5 | 6.5 | 11.7 | 6.8 | 11.7 | 7.5 | 12.1 |
| | Total | 55.6 | 100 | 55.5 | 100 | 57.8 | 100 | 62.2 | 100 |

TABLE 123

| Samples with Dow KSR8762 Binder | | | | | | | | | |
|---|---|---|---|---|---|---|---|---|---|
| | | Sample 53 | | Sample 54 | | Sample 65 | | Sample 66 | |
| Layer | Raw Materials | Basis Weight (gsm) | Weight % | Basis Weight (gsm) | Weight % | Basis Weight (gsm) | Weight % | Basis Weight (gsm) | Weight % |
| Top | Dow KSR8762 | 7.5 | 13.6 | 7.0 | 12.9 | 7.5 | 12.9 | 7.7 | 12.5 |
| 1 | Buckeye Technologies FFT-AS pulp | 40.0 | 72.7 | 40.7 | 74.3 | 43.3 | 74.3 | 46.3 | 75.0 |
| Bottom | Dow KSR8762 | 7.5 | 13.6 | 7.0 | 12.9 | 7.5 | 12.9 | 7.7 | 12.5 |
| | Total | 54.9 | 100 | 54.8 | 100 | 58.3 | 100 | 61.7 | 100 |

TABLE 124

| Samples with Dow KSR8764 Binder | | | | | | | | | |
|---|---|---|---|---|---|---|---|---|---|
| | | Sample 55 | | Sample 56 | | Sample 67 | | Sample 68 | |
| Layer | Raw Materials | Basis Weight (gsm) | Weight % | Basis Weight (gsm) | Weight % | Basis Weight (gsm) | Weight % | Basis Weight (gsm) | Weight % |
| Top | Dow KSR8764 | 7.2 | 12.2 | 6.5 | 12.0 | 6.9 | 12.6 | 6.9 | 12.0 |
| 1 | Buckeye Technologies FFT-AS pulp | 44.6 | 75.5 | 40.9 | 76.0 | 40.7 | 74.8 | 43.6 | 76.0 |
| Bottom | Dow KSR8764 | 7.2 | 12.2 | 6.5 | 12.0 | 6.9 | 12.6 | 6.9 | 12.0 |
| | Total | 59.0 | 100 | 53.9 | 100 | 54.4 | 100 | 57.4 | 100 |

TABLE 125

| Samples with Dow KSR8811 Binder | | | | | | | | | |
|---|---|---|---|---|---|---|---|---|---|
| | | Sample 57 | | Sample 58 | | Sample 69 | | Sample 70 | |
| Layer | Raw Materials | Basis Weight (gsm) | Weight % | Basis Weight (gsm) | Weight % | Basis Weight (gsm) | Weight % | Basis Weight (gsm) | Weight % |
| Top | Dow KSR8811 | 7.0 | 12.2 | 7.0 | 12.6 | 9.4 | 14.9 | 7.5 | 12.6 |
| 1 | Buckeye Technologies FFT-AS pulp | 43.3 | 75.7 | 41.5 | 74.7 | 44.3 | 70.2 | 44.4 | 74.7 |
| Bottom | Dow KSR8811 | 7.0 | 12.2 | 7.0 | 12.6 | 9.4 | 14.9 | 7.5 | 12.6 |
| | Total | 57.2 | 100 | 55.5 | 100 | 63.1 | 100 | 59.4 | 100 |

RESULTS: Product lot analysis was carried out on each sample. Basis weight, caliper and cross directional wet tensile strength in lotion in an aging study were done.

The loss of strength when samples are place in lotion is critical to the long term stability of products prior to use by the consumer. This process is referred to as aging in lotion. The loss in strength can be evaluated by measuring the decay in cross directional wet strength of a binder that is incorporated into a wipe over a period of time. This was done by adding lotion expressed from Wal-Mart Parents Choice Baby Wipes at 350% loading based on the dry weight of the wipe sample, sealing the wipe in a container to prevent evaporation and placing the container with the wipe in an oven at 40° C. for a period of time. The wipes were removed and tested for cross directional wet strength. The results of the product lot analysis for basis weight, caliper and cross directional wet strength with a quick dip (1-2 seconds) in Wal-Mart Parents Choice Lotion are given in Table 126. The results of the product lot analysis for basis weight, caliper and cross directional wet strength after 24 hours aging in Wal-Mart Parents Choice Lotion at 40° C. are given in Table 127.

TABLE 126

Product Lot Analysis of Basis Weight, Caliper and CDW in Lotion After Quick Dip

| Sample | Binder | BW | mm | CDW (gli) | CDW (gli) normalized for density | CDW (gli) normalized for density and binder level |
|---|---|---|---|---|---|---|
| Sample 47 | KSR4483 | 64.1 | 0.94 | 423 | 424 | 419 |
| Sample 48 | KSR4483 | 58.4 | 0.98 | 269 | 309 | 380 |
| Sample 49 | KSR8758 | 54.0 | 0.94 | 280 | 333 | 342 |
| Sample 50 | KSR8758 | 60.7 | 0.86 | 334 | 324 | 320 |
| Sample 51 | KSR8760 | 55.6 | 0.96 | 242 | 286 | 341 |
| Sample 52 | KSR8760 | 55.5 | 0.96 | 272 | 322 | 344 |
| Sample 53 | KSR8762 | 54.9 | 0.94 | 338 | 396 | 363 |
| Sample 54 | KSR8762 | 54.8 | 0.88 | 333 | 366 | 356 |
| Sample 55 | KSR8764 | 59.0 | 0.96 | 208 | 231 | 237 |
| Sample 56 | KSR8764 | 53.9 | 0.88 | 257 | 287 | 299 |
| Sample 57 | KSR8811 | 57.2 | 0.94 | 411 | 462 | 474 |
| Sample 58 | KSR8811 | 55.5 | 1.02 | 510 | 641 | 635 |

TABLE 127

Product Lot Analysis of Basis Weight, Caliper and CDW in Lotion After 24 Hours

| Sample | Binder | BW | mm | CDW (gli) | CDW (gli) normalized for density | CDW (gli) normalized for density and binder level |
|---|---|---|---|---|---|---|
| Sample 59 | KSR4483 | 61.6 | 0.90 | 78 | 78 | 72 |
| Sample 60 | KSR4483 | 54.8 | 0.98 | 60 | 73 | 90 |
| Sample 61 | KSR8758 | 54.6 | 0.86 | 109 | 117 | 136 |
| Sample 62 | KSR8758 | 64.4 | 0.82 | 177 | 154 | 130 |
| Sample 63 | KSR8760 | 57.8 | 0.96 | 100 | 114 | 121 |
| Sample 64 | KSR8760 | 62.2 | 0.88 | 134 | 130 | 134 |
| Sample 65 | KSR8762 | 58.3 | 0.88 | 112 | 116 | 112 |
| Sample 66 | KSR8762 | 61.7 | 0.92 | 158 | 161 | 162 |
| Sample 67 | KSR8764 | 54.4 | 0.88 | 76 | 84 | 83 |
| Sample 68 | KSR8764 | 57.4 | 0.88 | 124 | 130 | 136 |
| Sample 69 | KSR8811 | 63.1 | 1.02 | 117 | 129 | 109 |
| Sample 70 | KSR8811 | 59.4 | 1.02 | 193 | 227 | 224 |

DISCUSSION: Product lot analysis showed that all of the samples had substantial drops in the cross directional wet strength after aging in lotion for 24 hours. Sample 70 with KSR8811 binder had the highest cross direction wet tensile, significantly higher than the other samples.

Example 15

High Strength Binders for Flushable Dispersible Wipes

Wipes according to the invention were prepared and tested for various parameters including basis weight, caliper and CDW in Lotion where the wet refers to lotion versus the water that is standard in this testing. The lotion used to test these samples was expressed from Wal-Mart Parents Choice Baby Wipes. Testing in lotion was done after placing the samples in the lotion for a period of about 1-2 seconds (a quick dip), after placing the samples in lotion for approximately 24 hours in a sealed environment at a temperature of 40° C. and after placing the samples in lotion for approximately 96 hours in a sealed environment at a temperature of 40° C. Samples 71-86 were tested after the quick dip in lotion, samples 87-102 were tested after about 5 hours of aging in Wal-Mart Parents Choice Lotion at 40° C. and samples 103-116 were tested after about 96 hours of aging in Wal-Mart Parents Choice Lotion at 40° C.

METHODS/MATERIALS: Samples 71-129 were all made on a lab scale pad former and cured at 150° C. for 15 minutes. The composition of samples 71-129 are given in Tables 128-131. The type and level of raw materials for these samples were varied to influence the physical properties and flushable-dispersible properties.

TABLE 128

Samples with Dow KSR8845 Binder

| | | Sample 71 | | Sample 72 | | Sample 73 | | Sample 74 | | Sample 75 | |
|---|---|---|---|---|---|---|---|---|---|---|---|
| Layer | Raw Materials | Basis Weight (gsm) | Weight % | Basis Weight (gsm) | Weight % | Basis Weight (gsm) | Weight % | Basis Weight (gsm) | Weight % | Basis Weight (gsm) | Weight % |
| Top | Dow KSR8845 | 4.0 | 6.2 | 4.4 | 6.5 | 4.4 | 6.5 | 4.0 | 6.2 | 4.2 | 6.4 |
| 1 | Buckeye Technologies FFT-AS pulp | 56.1 | 87.6 | 58.5 | 87.0 | 58.7 | 87.0 | 56.2 | 87.6 | 57.5 | 87.3 |
| Bottom | Dow KSR8845 | 4.0 | 6.2 | 4.4 | 6.5 | 4.4 | 6.5 | 4.0 | 6.2 | 4.2 | 6.4 |
| | Total | 64.0 | 100 | 67.2 | 100 | 67.5 | 100 | 64.1 | 100 | 65.9 | 100 |

| | | Sample 91 | | Sample 92 | | Sample 93 | | Sample 94 | | Sample 95 | |
|---|---|---|---|---|---|---|---|---|---|---|---|
| Layer | Raw Materials | Basis Weight (gsm) | Weight % | Basis Weight (gsm) | Weight % | Basis Weight (gsm) | Weight % | Basis Weight (gsm) | Weight % | Basis Weight (gsm) | Weight % |
| Top | Dow KSR8845 | 3.3 | 5.7 | 3.6 | 5.9 | 3.7 | 6.0 | 3.6 | 5.9 | 3.2 | 5.6 |

TABLE 128-continued

| Samples with Dow KSR8845 Binder | | | | | | | | | | | |
|---|---|---|---|---|---|---|---|---|---|---|---|
| 1 | Buckeye Technologies FFT-AS pulp | 52.0 | 88.7 | 54.0 | 88.2 | 54.5 | 88.1 | 53.8 | 88.2 | 51.5 | 88.8 |
| Bottom | Dow KSR8845 | 3.3 | 5.7 | 3.6 | 5.9 | 3.7 | 6.0 | 3.6 | 5.9 | 3.2 | 5.6 |
| | Total | 58.7 | 100 | 61.3 | 100 | 61.9 | 100 | 61.0 | 100 | 58.0 | 100 |

| | | Sample 111 | | Sample 112 | | Sample 113 | | Sample 114 | | Sample 115 | |
|---|---|---|---|---|---|---|---|---|---|---|---|
| Layer | Raw Materials | Basis Weight (gsm) | Weight % | Basis Weight (gsm) | Weight % | Basis Weight (gsm) | Weight % | Basis Weight (gsm) | Weight % | Basis Weight (gsm) | Weight % |
| Top | Dow KSR8845 | 3.9 | 6.1 | 4.1 | 6.3 | 4.0 | 6.2 | 4.1 | 6.3 | 3.0 | 5.4 |
| 1 | Buckeye Technologies FFT-AS pulp | 55.6 | 87.8 | 57.1 | 87.4 | 56.6 | 87.5 | 57.0 | 87.4 | 50.0 | 89.2 |
| Bottom | Dow KSR8845 | 3.9 | 6.1 | 4.1 | 6.3 | 4.0 | 6.2 | 4.1 | 6.3 | 3.0 | 5.4 |
| | Total | 63.4 | 100 | 65.3 | 100 | 64.7 | 100 | 65.2 | 100 | 56.1 | 100 |

TABLE 129

| Samples with Dow KSR8851 Binder | | | | | | | | | | | |
|---|---|---|---|---|---|---|---|---|---|---|---|
| | | Sample 76 | | Sample 77 | | Sample 78 | | Sample 79 | | Sample 80 | |
| Layer | Raw Materials | Basis Weight (gsm) | Weight % | Basis Weight (gsm) | Weight % | Basis Weight (gsm) | Weight % | Basis Weight (gsm) | Weight % | Basis Weight (gsm) | Weight % |
| Top | Dow KSR8851 | 3.3 | 5.6 | 3.1 | 5.3 | 3.3 | 5.6 | 3.2 | 5.5 | 3.2 | 5.4 |
| 1 | Buckeye Technologies FFT-AS pulp | 53.2 | 88.9 | 51.3 | 89.3 | 53.1 | 88.9 | 52.4 | 89.1 | 52.1 | 89.1 |
| Bottom | Dow KSR8851 | 3.3 | 5.6 | 3.1 | 5.3 | 3.3 | 5.6 | 3.2 | 5.5 | 3.2 | 5.4 |
| | Total | 59.9 | 100 | 57.4 | 100 | 59.7 | 100 | 58.8 | 100 | 58.5 | 100 |

| | | Sample 96 | | Sample 97 | | Sample 98 | | Sample 99 | | Sample 100 | |
|---|---|---|---|---|---|---|---|---|---|---|---|
| Layer | Raw Materials | Basis Weight (gsm) | Weight % | Basis Weight (gsm) | Weight % | Basis Weight (gsm) | Weight % | Basis Weight (gsm) | Weight % | Basis Weight (gsm) | Weight % |
| Top | Dow KSR8851 | 3.9 | 6.0 | 3.9 | 6.0 | 3.7 | 5.9 | 3.7 | 5.9 | 3.5 | 5.7 |
| 1 | Buckeye Technologies FFT-AS pulp | 56.7 | 88.0 | 56.8 | 88.0 | 55.8 | 88.2 | 55.9 | 88.2 | 54.5 | 88.5 |
| Bottom | Dow KSR8851 | 3.9 | 6.0 | 3.9 | 6.0 | 3.7 | 5.9 | 3.7 | 5.9 | 3.5 | 5.7 |
| | Total | 64.4 | 100 | 64.5 | 100 | 63.2 | 100 | 63.4 | 100 | 61.6 | 100 |

| | | Sample 116 | | Sample 117 | | Sample 118 | | Sample 119 | | Sample 120 | |
|---|---|---|---|---|---|---|---|---|---|---|---|
| Layer | Raw Materials | Basis Weight (gsm) | Weight % | Basis Weight (gsm) | Weight % | Basis Weight (gsm) | Weight % | Basis Weight (gsm) | Weight % | Basis Weight (gsm) | Weight % |
| Top | Dow KSR8851 | 3.2 | 5.4 | 3.5 | 5.7 | 3.3 | 5.6 | 3.3 | 5.6 | 3.5 | 5.7 |
| 1 | Buckeye Technologies FFT-AS pulp | 52.1 | 89.1 | 54.6 | 88.5 | 53.1 | 88.9 | 53.3 | 88.8 | 54.5 | 88.5 |
| Bottom | Dow KSR8851 | 3.2 | 5.4 | 3.5 | 5.7 | 3.3 | 5.6 | 3.3 | 5.6 | 3.5 | 5.7 |
| | Total | 58.5 | 100 | 61.7 | 100 | 59.7 | 100 | 60.0 | 100 | 61.6 | 100 |

TABLE 130

Samples with Dow KSR8853 Binder

| | | Sample 81 | | Sample 82 | | Sample 83 | | Sample 84 | | Sample 85 | |
|---|---|---|---|---|---|---|---|---|---|---|---|
| Layer | Raw Materials | Basis Weight (gsm) | Weight % | Basis Weight (gsm) | Weight % | Basis Weight (gsm) | Weight % | Basis Weight (gsm) | Weight % | Basis Weight (gsm) | Weight % |
| Top | Dow KSR8853 | 3.2 | 5.5 | 3.3 | 5.5 | 3.2 | 5.5 | 3.4 | 5.6 | 3.5 | 5.7 |
| 1 | Buckeye Technologies FFT-AS pulp | 52.9 | 89.1 | 53.1 | 89.0 | 52.8 | 89.1 | 53.7 | 88.9 | 54.8 | 88.6 |
| Bottom | Dow KSR8853 | 3.2 | 5.5 | 3.3 | 5.5 | 3.2 | 5.5 | 3.4 | 5.6 | 3.5 | 5.7 |
| | Total | 59.4 | 100 | 59.7 | 100 | 59.3 | 100 | 60.4 | 100 | 61.9 | 100 |

| | | Sample 101 | | Sample 102 | | Sample 103 | | Sample 104 | | Sample 105 | |
|---|---|---|---|---|---|---|---|---|---|---|---|
| Layer | Raw Materials | Basis Weight (gsm) | Weight % | Basis Weight (gsm) | Weight % | Basis Weight (gsm) | Weight % | Basis Weight (gsm) | Weight % | Basis Weight (gsm) | Weight % |
| Top | Dow KSR8853 | 3.5 | 5.7 | 3.4 | 5.6 | 3.3 | 5.5 | 3.5 | 5.7 | 3.8 | 5.9 |
| 1 | Buckeye Technologies FFT-AS pulp | 54.8 | 88.6 | 54.2 | 88.8 | 53.2 | 89.0 | 55.0 | 88.6 | 56.8 | 88.2 |
| Bottom | Dow KSR8853 | 3.5 | 5.7 | 3.4 | 5.6 | 3.3 | 5.5 | 3.5 | 5.7 | 3.8 | 5.9 |
| | Total | 61.9 | 100 | 61.0 | 100 | 59.8 | 100 | 62.1 | 100 | 64.4 | 100 |

| | | Sample 121 | | Sample 122 | | Sample 123 | | Sample 124 | | Sample 125 | |
|---|---|---|---|---|---|---|---|---|---|---|---|
| Layer | Raw Materials | Basis Weight (gsm) | Weight % | Basis Weight (gsm) | Weight % | Basis Weight (gsm) | Weight % | Basis Weight (gsm) | Weight % | Basis Weight (gsm) | Weight % |
| Top | Dow KSR8853 | 3.4 | 5.6 | 3.0 | 5.2 | 3.6 | 5.7 | 3.1 | 5.4 | 3.2 | 5.4 |
| 1 | Buckeye Technologies FFT-AS pulp | 54.2 | 88.8 | 50.9 | 89.5 | 55.1 | 88.6 | 52.1 | 89.3 | 52.4 | 89.2 |
| Bottom | Dow KSR8853 | 3.4 | 5.6 | 3.0 | 5.2 | 3.6 | 5.7 | 3.1 | 5.4 | 3.2 | 5.4 |
| | Total | 61.1 | 100 | 56.9 | 100 | 62.2 | 100 | 58.4 | 100 | 58.8 | 100 |

TABLE 131

Samples with Dow KSR8855 Binder

| | | Sample 86 | | Sample 87 | | Sample 88 | | Sample 89 | | Sample 90 | |
|---|---|---|---|---|---|---|---|---|---|---|---|
| Layer | Raw Materials | Basis Weight (gsm) | Weight % | Basis Weight (gsm) | Weight % | Basis Weight (gsm) | Weight % | Basis Weight (gsm) | Weight % | Basis Weight (gsm) | Weight % |
| Top | Dow KSR8855 | 4.0 | 6.3 | 4.0 | 6.2 | 4.1 | 6.3 | 3.8 | 6.1 | 4.2 | 6.4 |
| 1 | Buckeye Technologies FFT-AS pulp | 56.2 | 87.5 | 55.9 | 87.5 | 56.8 | 87.3 | 54.7 | 87.9 | 57.1 | 87.2 |
| Bottom | Dow KSR8855 | 4.0 | 6.3 | 4.0 | 6.2 | 4.1 | 6.3 | 3.8 | 6.1 | 4.2 | 6.4 |
| | Total | 64.3 | 100 | 63.9 | 100 | 65.1 | 100 | 62.3 | 100 | 65.5 | 100 |

| | | Sample 106 | | Sample 107 | | Sample 108 | | Sample 109 | | Sample 110 | |
|---|---|---|---|---|---|---|---|---|---|---|---|
| Layer | Raw Materials | Basis Weight (gsm) | Weight % | Basis Weight (gsm) | Weight % | Basis Weight (gsm) | Weight % | Basis Weight (gsm) | Weight % | Basis Weight (gsm) | Weight % |
| Top | Dow KSR8855 | 3.7 | 6.0 | 3.8 | 6.1 | 3.4 | 5.8 | 3.6 | 5.9 | 3.7 | 6.0 |

TABLE 131-continued

| Samples with Dow KSR8855 Binder | | | | | | | | | | | |
|---|---|---|---|---|---|---|---|---|---|---|---|
| 1 | Buckeye Technologies FFT-AS pulp | 54.4 | 87.9 | 54.8 | 87.8 | 52.4 | 88.4 | 53.4 | 88.2 | 54.3 | 88.0 |
| Bottom | Dow KSR8855 | 3.7 | 6.0 | 3.8 | 6.1 | 3.4 | 5.8 | 3.6 | 5.9 | 3.7 | 6.0 |
| | Total | 61.8 | 100 | 62.4 | 100 | 59.3 | 100 | 60.6 | 100 | 61.7 | 100 |

| | | Sample 126 | | Sample 127 | | Sample 128 | | Sample 129 | | Sample 130 | |
|---|---|---|---|---|---|---|---|---|---|---|---|
| Layer | Raw Materials | Basis Weight (gsm) | Weight % | Basis Weight (gsm) | Weight % | Basis Weight (gsm) | Weight % | Basis Weight (gsm) | Weight % | Basis Weight (gsm) | Weight % |
| Top | Dow KSR8855 | 3.5 | 5.9 | 4.5 | 6.6 | 4.1 | 6.4 | 4.3 | 6.5 | 4.2 | 6.4 |
| 1 | Buckeye Technologies FFT-AS pulp | 53.1 | 88.3 | 58.7 | 86.8 | 56.9 | 87.3 | 58.0 | 87.0 | 57.1 | 87.2 |
| Bottom | Dow KSR8855 | 3.5 | 5.9 | 4.5 | 6.6 | 4.1 | 6.4 | 4.3 | 6.5 | 4.2 | 6.4 |
| | Total | 60.1 | 100 | 67.6 | 100 | 65.2 | 100 | 66.7 | 100 | 65.4 | 100 |

RESULTS: Product lot analysis was carried out on each sample. Basis weight, caliper and wet tensile strength in lotion in an aging study were done.

The loss of strength when samples are place in lotion is critical to the long term stability of products prior to use by the consumer. This process is referred to as aging in lotion. The loss in strength can be evaluated by measuring the decay in wet strength of a binder that is incorporated into a wipe over a period of time. This was done by adding lotion expressed from Wal-Mart Parents Choice Baby Wipes at 350% loading based on the dry weight of the wipe sample, sealing the wipe in a container to prevent evaporation and placing the container with the wipe in an oven at 40° C. for a period of time. The wipes were removed and tested for wet strength. The wet strength was normalized for the basis weight, caliper and amount of binder. The results of the product lot analysis for basis weight, caliper, wet strength with a quick dip (1-2 seconds) in Wal-Mart Parents Choice Lotion and normalized wet strength are given in Table 132. The results of the product lot analysis for basis weight, caliper, wet strength after 5 hours aging in Wal-Mart Parents Choice Lotion and normalized wet strength at 40° C. are given in Table 133. The results of the product lot analysis for basis weight, caliper, wet strength after 96 hours aging in Wal-Mart Parents Choice Lotion and normalized wet strength at 40° C. are given in Table 134.

TABLE 132

Product Lot Analysis of Samples 71-90 After a Quick Dip in Lotion

| Sample | Caliper (mm) | Basis Weight (gsm) | Wet Strength (gli) | Normalized Wet Strength (gli) |
|---|---|---|---|---|
| Sample 71 | 0.70 | 64.0 | 271 | 258 |
| Sample 72 | 0.74 | 67.2 | 298 | 286 |
| Sample 73 | 0.68 | 67.5 | 353 | 310 |
| Sample 74 | 0.64 | 64.1 | 316 | 275 |
| Sample 75 | 0.68 | 65.9 | 323 | 290 |
| Sample 76 | 0.66 | 59.9 | 138 | 138 |
| Sample 77 | 0.62 | 57.4 | 217 | 212 |
| Sample 78 | 0.70 | 59.7 | 130 | 138 |
| Sample 79 | 0.68 | 58.8 | 127 | 133 |
| Sample 80 | 0.72 | 58.5 | 170 | 189 |

TABLE 132-continued

Product Lot Analysis of Samples 71-90 After a Quick Dip in Lotion

| Sample | Caliper (mm) | Basis Weight (gsm) | Wet Strength (gli) | Normalized Wet Strength (gli) |
|---|---|---|---|---|
| Sample 81 | 0.66 | 59.4 | 188 | 191 |
| Sample 82 | 0.64 | 59.7 | 183 | 179 |
| Sample 83 | 0.68 | 59.3 | 194 | 203 |
| Sample 84 | 0.66 | 60.4 | 257 | 257 |
| Sample 85 | 0.68 | 61.9 | 270 | 271 |
| Sample 86 | 0.58 | 64.3 | 408 | 318 |
| Sample 87 | 0.68 | 63.9 | 324 | 298 |
| Sample 88 | 0.78 | 65.1 | 314 | 325 |
| Sample 89 | 0.74 | 62.3 | 272 | 279 |
| Sample 90 | 0.72 | 65.5 | 319 | 302 |

TABLE 133

Product Lot Analysis of Samples 91-110 after 5 Hours of Aging in Lotion

| Sample | Caliper (mm) | Basis Weight (gsm) | Wet Strength (gli) | Normalized Wet Strength (gli) |
|---|---|---|---|---|
| Sample 91 | 0.58 | 58.7 | 139 | 120 |
| Sample 92 | 0.60 | 61.3 | 148 | 126 |
| Sample 93 | 0.68 | 61.9 | 142 | 136 |
| Sample 94 | 0.66 | 61.0 | 142 | 134 |
| Sample 95 | 0.56 | 58.0 | 154 | 130 |
| Sample 96 | 0.66 | 64.4 | 177 | 164 |
| Sample 97 | 0.60 | 64.5 | 190 | 160 |
| Sample 98 | 0.68 | 63.2 | 127 | 124 |
| Sample 99 | 0.68 | 63.4 | 140 | 136 |
| Sample 100 | 0.66 | 61.6 | 150 | 145 |
| Sample 101 | 0.68 | 61.9 | 135 | 136 |
| Sample 102 | 0.64 | 61.0 | 82 | 79 |
| Sample 103 | 0.64 | 59.8 | 84 | 82 |
| Sample 104 | 0.66 | 62.1 | 101 | 98 |
| Sample 105 | 0.66 | 64.4 | 129 | 121 |
| Sample 106 | 0.70 | 61.8 | 148 | 145 |
| Sample 107 | 0.74 | 62.4 | 154 | 158 |
| Sample 108 | 0.62 | 59.3 | 170 | 153 |
| Sample 109 | 0.70 | 60.6 | 167 | 167 |
| Sample 110 | 0.70 | 61.7 | 137 | 134 |

TABLE 134

Product Lot Analysis of Samples 111-130 after 96 Hours of Aging in Lotion

| Sample | Caliper (mm) | Basis Weight (gsm) | Wet Strength (gli) | Normalized Wet Strength (gli) |
|---|---|---|---|---|
| Sample 111 | 0.64 | 63.4 | 108 | 95 |
| Sample 112 | 0.68 | 65.3 | 117 | 106 |
| Sample 113 | 0.68 | 64.7 | 132 | 121 |
| Sample 114 | 0.68 | 65.2 | 152 | 138 |
| Sample 115 | 0.58 | 56.1 | 117 | 106 |
| Sample 116 | 0.70 | 58.8 | 105 | 113 |
| Sample 117 | 0.64 | 61.7 | 110 | 103 |
| Sample 118 | 0.62 | 59.7 | 114 | 107 |
| Sample 119 | 0.66 | 60.0 | 84 | 84 |
| Sample 120 | 0.68 | 61.6 | 74 | 74 |
| Sample 121 | 0.68 | 61.1 | 109 | 111 |
| Sample 122 | 0.64 | 56.9 | 95 | 98 |
| Sample 123 | 0.68 | 62.2 | 110 | 110 |
| Sample 124 | 0.64 | 58.4 | 109 | 109 |
| Sample 125 | 0.66 | 58.8 | 96 | 99 |
| Sample 126 | 0.70 | 60.1 | 139 | 140 |
| Sample 127 | 0.68 | 67.6 | 194 | 169 |
| Sample 128 | 0.68 | 65.2 | 187 | 168 |
| Sample 129 | 0.74 | 66.7 | 162 | 155 |
| Sample 130 | 0.74 | 65.4 | 137 | 134 |

DISCUSSION: A comparison of the wet tensile strength of Samples 71-75 with the Dow KSR8845 binder that were tested after a quick dip in lotion to Samples 91-95 with the Dow KSR8845 binder that were tested after 5 hours of aging in lotion showed an average drop of about 40% in wet tensile strength. A further comparison of Samples 111-115 with the Dow KSR8845 binder that were tested after 96 hours of aging in lotion showed an average drop of about 12% from Samples 91-95 and a total drop of about 60% from Samples 71-75.

A comparison of the wet tensile strength of Samples 76-80 with the Dow KSR8851 binder that were tested after a quick dip in lotion to Samples 96-100 with the Dow KSR8851 binder that were tested after 5 hours of aging in lotion showed an average drop of about 10% in wet tensile strength. A further comparison of Samples 116-120 with the Dow KSR8851 binder that were tested after 96 hours of aging in lotion showed an average drop of about 34% from Samples 96-100 and a total drop of about 59% from Samples 76-80.

A comparison of the wet tensile strength of Samples 81-85 with the Dow KSR8853 binder that were tested after a quick dip in lotion to Samples 101-105 with the Dow KSR8853 binder that were tested after 5 hours of aging in lotion showed an average drop of about 53% in wet tensile strength. A further comparison of Samples 121-125 with the Dow KSR8835 binder that were tested after 96 hours of aging in lotion showed an average increase of about 2% from Samples 101-105 and a total drop of about 52% from Samples 81-85.

A comparison of the wet tensile strength of Samples 86-90 with the Dow KSR8855 binder that were tested after a quick dip in lotion to Samples 106-110 with the Dow KSR8855 binder that were tested after 5 hours of aging in lotion showed an average drop of about 50% in wet tensile strength. A further comparison of Samples 126-130 with the Dow KSR8855 binder that were tested after 96 hours of aging in lotion showed an average increase of about 1% from Samples 106-110 and a total drop of about 50% from Samples 86-90.

Samples with the Dow KSR8853 binder and Dow KSR8855 binder showed no further degradation in the wet strength between 5 hours and 96 hours of aging in lotion while samples with the Dow KSR8845 and Dow KSR8851 samples continued to show degradation.

Example 16

High Strength Binders for Flushable Dispersible Wipes

Wipes according to the invention were prepared and tested for various parameters including basis weight, caliper and the FG511.2 Tipping Tube Test.

METHODS/MATERIALS: Samples 131-148 were all made on a lab scale pad former. The composition of samples 131-148 are given in Tables 135-140. The type and level of raw materials for these samples were varied to influence the physical properties and flushable-dispersible properties. The samples were cured at 150° C. in a through air oven.

TABLE 135

Samples with Dow KSR4483 Binder

| | | Sample 131 | | Sample 132 | | Sample 133 | |
|---|---|---|---|---|---|---|---|
| Layer | Raw Materials | Basis Weight (gsm) | Weight % | Basis Weight (gsm) | Weight % | Basis Weight (gsm) | Weight % |
| Top | Dow KSR4483 | 9.0 | 14.9 | 7.6 | 12.9 | 8.9 | 15 |
| 1 | Buckeye Technologies FFT-AS pulp | 42.3 | 70.2 | 43.7 | 74.2 | 41.6 | 70 |
| Bottom | Dow KSR4483 | 9.0 | 14.9 | 7.6 | 12.9 | 8.9 | 15 |
| | Total | 60.2 | 100 | 58.9 | 100 | 59.4 | 100 |

TABLE 136

| Samples with Dow KSR8811 Binder | | | | | | | |
|---|---|---|---|---|---|---|---|
| | | Sample 134 | | Sample 135 | | Sample 136 | |
| Layer | Raw Materials | Basis Weight (gsm) | Basis Weight (gsm) | Weight % | Basis Weight (gsm) | Weight % | Weight % |
| Top | Dow KSR8811 | 6.6 | 7.6 | 6.4 | 10.7 | 9.0 | 14.3 |
| 1 | Buckeye Technologies FFT-AS pulp | 43.8 | 43.7 | 46.7 | 78.6 | 45.1 | 71.4 |
| Bottom | Dow KSR8811 | 6.6 | 7.6 | 6.4 | 10.7 | 9.0 | 14.3 |
| | Total | 57.0 | 58.9 | 59.4 | 100 | 63.1 | 100 |

TABLE 137

| Samples with Dow KSR8760 Binder | | | | | | | |
|---|---|---|---|---|---|---|---|
| | | Sample 137 | | Sample 138 | | Sample 139 | |
| Layer | Raw Materials | Basis Weight (gsm) | Weight % | Basis Weight (gsm) | Weight % | Basis Weight (gsm) | Weight % |
| Top | Dow KSR8760 | 7.0 | 11.6 | 6.9 | 11.0 | 8.4 | 12.9 |
| 1 | Buckeye Technologies FFT-AS pulp | 46.2 | 76.8 | 48.8 | 78.0 | 48.2 | 74.2 |
| Bottom | Dow KSR8760 | 7.0 | 11.6 | 6.9 | 11.0 | 8.4 | 12.9 |
| | Total | 60.2 | 100 | 62.5 | 100 | 64.9 | 100 |

TABLE 138

| Samples with Dow KSR8758 Binder | | | | | | | |
|---|---|---|---|---|---|---|---|
| | | Sample 140 | | Sample 141 | | Sample 142 | |
| Layer | Raw Materials | Basis Weight (gsm) | Weight % | Basis Weight (gsm) | Weight % | Basis Weight (gsm) | Weight % |
| Top | Dow KSR8758 | 6.6 | 11.4 | 7.7 | 12.8 | 7.9 | 12.9 |
| 1 | Buckeye Technologies FFT-AS pulp | 44.9 | 77.2 | 44.5 | 74.4 | 45.3 | 74.2 |
| Bottom | Dow KSR8758 | 6.6 | 11.4 | 7.7 | 12.8 | 7.9 | 12.9 |
| | Total | 58.2 | 100 | 59.8 | 100 | 61.1 | 100 |

TABLE 139

| Samples with Dow KSR8764 Binder | | | | | | | |
|---|---|---|---|---|---|---|---|
| | | Sample 143 | | Sample 144 | | Sample 145 | |
| Layer | Raw Materials | Basis Weight (gsm) | Weight % | Basis Weight (gsm) | Weight % | Basis Weight (gsm) | Weight % |
| Top | Dow KSR8764 | 6.2 | 10.8 | 6.5 | 11.1 | 6.9 | 11.8 |
| 1 | Buckeye Technologies FFT-AS pulp | 44.8 | 78.4 | 45.4 | 77.8 | 44.5 | 76.4 |
| Bottom | Dow KSR8764 | 6.2 | 10.8 | 6.5 | 11.1 | 6.9 | 11.8 |
| | Total | 57.2 | 100 | 58.3 | 100 | 58.2 | 100 |

TABLE 140

| Samples with Dow KSR8762 Binder | | | | | | | |
|---|---|---|---|---|---|---|---|
| | | Sample 146 | | Sample 147 | | Sample 148 | |
| Layer | Raw Materials | Basis Weight (gsm) | Weight % | Basis Weight (gsm) | Weight % | Basis Weight (gsm) | Weight % |
| Top | Dow KSR8762 | 7.1 | 11.9 | 6.9 | 11.6 | 7.1 | 11.2 |
| 1 | Buckeye Technologies FFT-AS pulp | 45.7 | 76.2 | 45.8 | 76.8 | 49.0 | 77.6 |
| Bottom | Dow KSR8762 | 7.1 | 11.9 | 6.9 | 11.6 | 7.1 | 11.2 |
| | Total | 60.0 | 100 | 59.6 | 100 | 63.2 | 100 |

RESULTS: Product lot analysis was carried out on each sample. Basis weight, caliper and FG511.2 Tipping Tube Test were done. The results of the product lot analysis are provided in Table 141.

TABLE 141

| Samples 131-148 BW, Caliper and FG511.2 Tipping Tube Test | | | | |
|---|---|---|---|---|
| Sample | Binder | Basis Weight (gsm) | Caliper (mm) | FG511.2 Tip Tube Test (percent remaining on 12 mm sieve) |
| Sample 131 | Dow KSR4483 | 60.2 | 0.88 | 15 |
| Sample 132 | Dow KSR4483 | 58.9 | 0.84 | 19 |
| Sample 133 | Dow KSR4483 | 59.4 | 0.90 | 1 |
| Sample 134 | Dow KSR8811 | 57.0 | 1.00 | 88 |
| Sample 135 | Dow KSR8811 | 59.4 | 1.08 | 54 |
| Sample 136 | Dow KSR8811 | 63.1 | 0.90 | 44 |
| Sample 137 | Dow KSR8760 | 60.2 | 0.92 | 43 |
| Sample 138 | Dow KSR8760 | 62.5 | 0.90 | 29 |
| Sample 139 | Dow KSR8760 | 64.9 | 0.99 | 59 |
| Sample 140 | Dow KSR8758 | 58.2 | 1.00 | 60 |
| Sample 141 | Dow KSR8758 | 59.8 | 0.90 | 52 |
| Sample 142 | Dow KSR8758 | 61.1 | 0.96 | 53 |
| Sample 143 | Dow KSR8764 | 57.2 | 1.16 | 30 |
| Sample 144 | Dow KSR8764 | 58.3 | 1.06 | 3 |
| Sample 145 | Dow KSR8764 | 58.2 | 1.16 | 11 |
| Sample 146 | Dow KSR8762 | 60.0 | 1.06 | 28 |
| Sample 147 | Dow KSR8762 | 59.6 | 0.98 | 21 |
| Sample 148 | Dow KSR8762 | 63.2 | 0.98 | 50 |

DISCUSSION: On average, all of the samples failed the FG511.2 Tip Tube test with greater than 5% of fibers left on the 12 mm sieve. Samples 131-133 with Dow KSR4483 binder had the best overall performance with an average of about 12% of fibers left on the 12 mm sieve and with Sample 133 passing the test with 1% fibers left on the sieve. Samples 143-145 with Dow 8758 binder also had good performance with an average of about 15% of fibers left on the 12 mm sieve and with Sample 144 passing the test with 3% of fibers left on the screen.

Example 17

High Strength Binders for Flushable Dispersible Wipes

Figure 14:
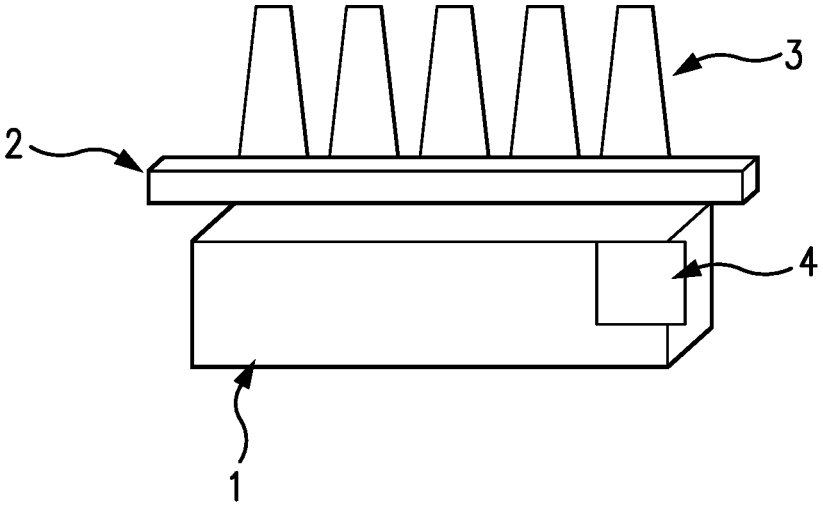
FIG. 14 depicts a schematic of the platform shaker apparatus.
Figure 15:
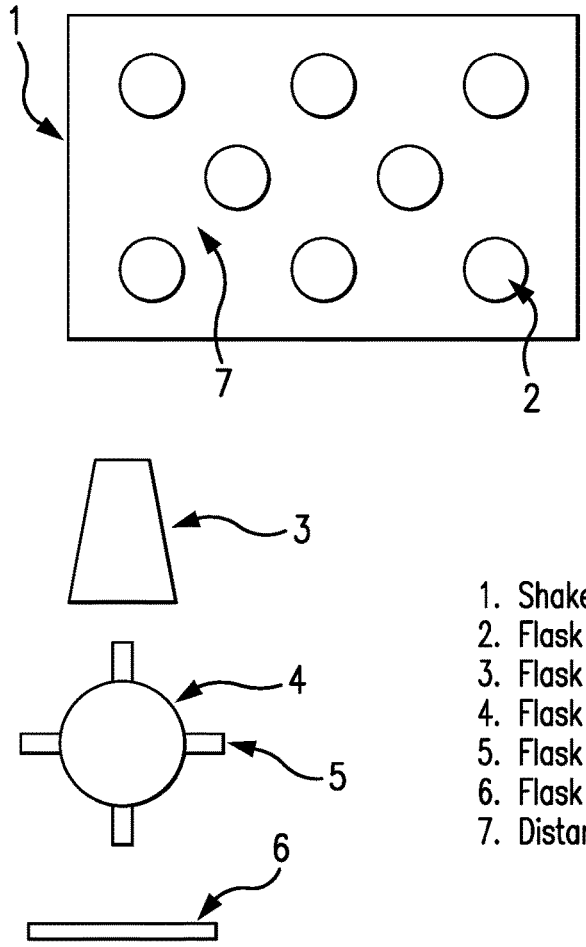
FIG. 15 depicts a schematic of the top view of the platform shaker apparatus.

Wipes according to the invention were prepared and tested for various parameters including FG511.2 Tipping Tube Test and FG511.1 Shake Flask Test. The platform shaker apparatus used in the Shake Flask Test is shown in FIGS. 14-15.

METHODS/MATERIALS: Samples 149-154 were all made on an airlaid pilot line. The composition of samples 149-154 are given in Tables 142-147. The type and level of raw materials for these samples were varied to influence the physical properties and flushable-dispersible properties. The samples were cured at 175° C. in a through air oven. FG511.2 Tipping Tube Test and FG511.1 Shake Flask Test were performed after about 12 hours of aging in Wal-Mart Parents Choice Lotion at 40° C.

TABLE 142

| Sample 149 (Dow KSR4483 Binder) | | | |
|---|---|---|---|
| Layer | Raw Materials | Basis Weight (gsm) | Weight % |
| Top | Dow KSR4483 | 6.5 | 10.0 |
| 1 | Buckeye Technologies EO1123 pulp | 52.0 | 80.0 |
| Bottom | Dow KSR4483 | 6.5 | 10.0 |
| | Total | 65.0 | 100 |

TABLE 143

| Sample 150 (Dow KSR8811 Binder) | | | |
|---|---|---|---|
| Layer | Raw Materials | Basis Weight (gsm) | Weight % |
| Top | Dow KSR8811 | 6.5 | 10.0 |
| 1 | Buckeye Technologies EO1123 pulp | 52.0 | 80.0 |
| Bottom | Dow KSR8811 | 6.5 | 10.0 |
| | Total | 65.0 | 100 |

TABLE 144

| Sample 151 (Dow KSR8760 Binder) | | | |
|---|---|---|---|
| Layer | Raw Materials | Basis Weight (gsm) | Weight % |
| Top | Dow KSR8760 | 6.5 | 10.0 |
| 1 | Buckeye Technologies EO1123 pulp | 52.0 | 80.0 |
| Bottom | Dow KSR8760 | 6.5 | 10.0 |
| | Total | 65.0 | 100 |

TABLE 145

| Sample 152 (Dow KSR8758 Binder) | | | |
|---|---|---|---|
| Layer | Raw Materials | Basis Weight (gsm) | Weight % |
| Top | Dow KSR8758 | 6.5 | 10.0 |
| 1 | Buckeye Technologies EO1123 pulp | 52.0 | 80.0 |
| Bottom | Dow KSR8758 | 6.5 | 10.0 |
| | Total | 65.0 | 100 |

TABLE 146

| Sample 153 (Dow KSR8764 Binder) | | | |
|---|---|---|---|
| Layer | Raw Materials | Basis Weight (gsm) | Weight % |
| Top | Dow KSR8764 | 6.5 | 10.0 |
| 1 | Buckeye Technologies EO1123 pulp | 52.0 | 80.0 |
| Bottom | Dow KSR8764 | 6.5 | 10.0 |
| | Total | 65.0 | 100 |

TABLE 147

| Sample 154 (Dow KSR8762 Binder) | | | |
|---|---|---|---|
| Layer | Raw Materials | Basis Weight (gsm) | Weight % |
| Top | Dow KSR8762 | 6.5 | 10.0 |
| 1 | Buckeye Technologies EO1123 pulp | 52.0 | 80.0 |
| Bottom | Dow KSR8762 | 6.5 | 10.0 |
| | Total | 65.0 | 100 |

RESULTS: Product lot analysis was carried out on each sample. FG511.2 Tipping Tube Test and FG511.1 Shake Flask Test were done. The results of the product lot analysis are provided in Table 148.

TABLE 148

| Product Lot Analysis FG511.2 Tipping Tube Test | | |
|---|---|---|
| Sample | Binder | FG511.2 Tip Tube Test (percent remaining on 12 mm sieve) |
| Sample 149-1 | Dow KSR4483 | 1 |
| Sample 149-2 | Dow KSR4483 | 9 |
| Sample 149-3 | Dow KSR4483 | 12 |
| Sample 150-1 | Dow KSR8811 | 40 |
| Sample 150-2 | Dow KSR8811 | 78 |
| Sample 150-3 | Dow KSR8811 | 94 |
| Sample 151-1 | Dow KSR8760 | 52 |
| Sample 151-2 | Dow KSR8760 | 19 |
| Sample 151-3 | Dow KSR8760 | 79 |
| Sample 152-1 | Dow KSR8758 | 79 |
| Sample 152-2 | Dow KSR8758 | 65 |
| Sample 152-3 | Dow KSR8758 | 91 |
| Sample 153-1 | Dow KSR8764 | 83 |
| Sample 153-2 | Dow KSR8764 | 92 |
| Sample 153-3 | Dow KSR8764 | 33 |
| Sample 154-1 | Dow KSR8762 | 3 |
| Sample 154-2 | Dow KSR8762 | 40 |
| Sample 154-3 | Dow KSR8762 | 19 |

TABLE 149

| Product Lot Analysis FG511.1 Shake Flask Test | | |
|---|---|---|
| Sample | Binder | FG511.1 Shake Flask Test (percent remaining on 12 mm sieve) |
| Sample 149-1 | Dow KSR4483 | 0 |
| Sample 149-2 | Dow KSR4483 | 94 |
| Sample 150-1 | Dow KSR8811 | 81 |
| Sample 150-2 | Dow KSR8811 | 88 |
| Sample 151-1 | Dow KSR8760 | 0 |
| Sample 151-2 | Dow KSR8760 | 0 |
| Sample 152-1 | Dow KSR8758 | 0 |
| Sample 152-2 | Dow KSR8758 | 0 |
| Sample 153-1 | Dow KSR8764 | 21 |
| Sample 153-2 | Dow KSR8764 | 54 |
| Sample 154-1 | Dow KSR8762 | 1 |
| Sample 154-2 | Dow KSR8762 | 83 |

DISCUSSION: On average, all of the samples failed the FG511.2 Tip Tube test with greater than 5% of fibers left on the 12 mm sieve. Samples 149-1, 149-2 and 149-3 with Dow KSR4483 binder had the best overall performance with an average of about 7% of fibers left on the 12 mm sieve and with Sample 149-1 passing the test with 1% fibers left on the sieve. Samples 154-1, 154-2 and 154-3 with Dow 8762 binder also had good performance with an average of about 21% of fibers left on the 12 mm sieve and with Sample 154-2 passing the test with 3% of fibers left on the screen.

Samples 151-1 and 151-2 with Dow KSR8760 binder passed the FG511.1 Shake Flask Test with 0% fibers left on the 12 mm sieve. Samples 152-1 and 152-2 with Dow KSR8578 binder passed the FG511.2 Shake Flask Test with 0% fibers left on the 12 mm sieve. Samples 151-1, 151-2 and 151-3 with the Dow KSR8760 binder failed the FG511.2 Tip Tube Test with an average of 50% of fiber left on the 12 mm sieve and Samples 152-1, 152-2 and 152-3 with Dow KSR8758 binder failed the FG511.2 Tip Tube Test with an average of 78% of fiber left on the 12 mm sieve. The longer exposure to water in the FG511.2 Shake Flask Test at about 6 hours versus the shorter exposure to water in the FG511.1 Tip Tube Test at about 20 minutes may have a significant impact on the breakdown of the Dow KSR8760 and Dow KSR8758 binders.

Example 18

High Strength Binders for Flushable Dispersible Wipes

Wipes according to the invention were prepared and tested for various parameters including basis weight, caliper and CDW in lotion. The lotion used to test these samples was expressed from Wal-Mart Parents Choice Baby Wipes. Testing in lotion was done after placing the samples in the lotion for a period of about 1-2 seconds (a quick dip) and after placing the samples in lotion for approximately 24 hours in a sealed environment at a temperature of 40° C. and after placing the samples in lotion for approximately 72 hours in a sealed environment at a temperature of 40° C.

METHODS/MATERIALS: Samples 155-158 were all made on an airlaid pilot line. The composition of samples 155-158 are given in Tables 150-153. The type and level of raw materials for these samples were varied to influence the physical properties and flushable-dispersible properties. The samples were cured at 175° C. in a through air oven.

TABLE 150

| Sample 155 (Dow KSR8758 Binder) | | | |
|---|---|---|---|
| Layer | Raw Materials | Basis Weight (gsm) | Weight % |
| Top | Dow KSR8758 | 4.9 | 7.5 |
| 1 | Buckeye Technologies EO1123 pulp | 55.2 | 80.0 |
| Bottom | Dow KSR8758 | 4.9 | 7.5 |
| | Total | 65.0 | 100 |

TABLE 151

| Sample 156 (Dow KSR8758 Binder) | | | |
|---|---|---|---|
| Layer | Raw Materials | Basis Weight (gsm) | Weight % |
| Top | Dow KSR8758 | 6.5 | 10.0 |
| 1 | Buckeye Technologies EO1123 pulp | 52.0 | 80.0 |
| Bottom | Dow KSR8758 | 6.5 | 10.0 |
| | Total | 65.0 | 100 |

TABLE 152

| Sample 157 (Dow KSR8758 Binder) | | | |
|---|---|---|---|
| Layer | Raw Materials | Basis Weight (gsm) | Weight % |
| Top | Dow KSR8758 | 8.1 | 12.5 |
| 1 | Buckeye Technologies EO1123 pulp | 48.8 | 80.0 |
| Bottom | Dow KSR8758 | 8.1 | 12.5 |
| | Total | 65.0 | 100 |

TABLE 153

| Sample 158 (Dow KSR8811 Binder) | | | |
|---|---|---|---|
| Layer | Raw Materials | Basis Weight (gsm) | Weight % |
| Top | Dow KSR8811 | 6.5 | 10.0 |
| 1 | Buckeye Technologies EO1123 pulp | 52.0 | 80.0 |
| Bottom | Dow KSR8811 | 6.5 | 10.0 |
| | Total | 65.0 | 100 |

RESULTS: Product lot analysis was carried out on each sample. Basis weight, caliper and cross directional wet tensile strength in lotion in an aging study were done.

The loss of strength when samples are place in lotion is critical to the long term stability of products prior to use by the consumer. This process is referred to as aging in lotion. The loss in strength can be evaluated by measuring the decay in cross directional wet strength of a binder that is incorporated into a wipe over a period of time. This was done by adding lotion expressed from Wal-Mart Parents Choice Baby Wipes at 350% loading based on the dry weight of the wipe sample, sealing the wipe in a container to prevent evaporation and placing the container with the wipe in an oven at 40° C. for a period of time. The wipes were removed and tested for cross directional wet strength. The results of the product lot analysis for basis weight, caliper and cross directional wet strength with a quick dip (1-2 seconds) in Wal-Mart Parents Choice Lotion for Samples 155-157 with Dow KSR8758 binder are given in Tables 154-156. The results of the product lot analysis for basis weight, caliper and cross directional wet strength with a quick dip (1-2 seconds) in Wal-Mart Parents Choice Lotion for Sample 158 with Dow KSR8811 binder are given in Tables 157. The results of the product lot analysis for basis weight, caliper and cross directional wet strength after about 24 hours aging in Wal-Mart Parents Choice Lotion at 40° C. for Samples 155-157 with Dow KSR8758 binder are given in Tables 158-160. The results of the product lot analysis for basis weight, caliper and cross directional wet strength after about 24 hours aging in Wal-Mart Parents Choice Lotion at 40° C. for Sample 158 with Dow KSR8811 binder are given in Table 161. The results of the product lot analysis for basis weight, caliper and cross directional wet strength after about 72 hours aging in Wal-Mart Parents Choice Lotion at 40° C. for Samples 155-157 with Dow KSR8758 binder are given in Tables 162-164. The results of the product lot analysis for basis weight, caliper and cross directional wet strength after about 72 hours aging in Wal-Mart Parents Choice Lotion at 40° C. for Sample 158 with Dow KSR8811 binder are given in Table 165.

TABLE 154

| Dow KSR8758 Binder at 15% by Weight Add-On with Quick Dip in Lotion | | | |
|---|---|---|---|
| Sample 155 | Caliper (mm) | Basis Weight (gsm) | CDW (gli) |
| Sample 155-1 | 0.76 | 62.8 | 79 |
| Sample 155-2 | 0.78 | 61.0 | 106 |
| Sample 155-3 | 0.78 | 62.4 | 80 |
| Sample 155-4 | 0.68 | 57.7 | 99 |
| Sample 155-5 | 0.76 | 61.0 | 72 |
| Sample 155-6 | 0.76 | 63.0 | 93 |
| Sample 155-7 | 0.70 | 62.4 | 119 |
| Sample 155-8 | 0.74 | 61.1 | 108 |
| Sample 155-9 | 0.74 | 60.3 | 94 |

TABLE 155

| Dow KSR8758 Binder at 20% by Weight Add-On with Quick Dip in Lotion | | | |
|---|---|---|---|
| Sample 156 | Caliper (mm) | Basis Weight (gsm) | CDW (gli) |
| Sample 156-1 | 0.82 | 71.5 | 184 |
| Sample 156-2 | 0.70 | 61.6 | 311 |
| Sample 156-3 | 0.90 | 70.2 | 359 |
| Sample 156-4 | 0.84 | 69.8 | 353 |
| Sample 156-5 | 0.84 | 70.0 | 325 |
| Sample 156-6 | 0.84 | 71.4 | 196 |
| Sample 156-7 | 0.76 | 66.8 | 350 |
| Sample 156-8 | 0.82 | 69.2 | 242 |
| Sample 156-9 | 0.90 | 71.7 | 328 |
| Sample 156-10 | 0.86 | 68.3 | 305 |

TABLE 156

| Dow KSR8758 Binder at 25% by Weight Add-On with Quick Dip in Lotion | | | |
|---|---|---|---|
| Sample 157 | Caliper (mm) | Basis Weight (gsm) | CDW (gli) |
| Sample 157-1 | 0.70 | 72.1 | 289 |
| Sample 157-2 | 0.74 | 71.0 | 273 |
| Sample 157-3 | 0.76 | 69.4 | 250 |
| Sample 157-4 | 0.78 | 71.0 | 270 |
| Sample 157-5 | 0.72 | 70.5 | 262 |
| Sample 157-6 | 0.70 | 68.6 | 288 |
| Sample 157-7 | 0.76 | 71.7 | 274 |
| Sample 157-8 | 0.82 | 75.4 | 245 |

TABLE 156-continued

| Dow KSR8758 Binder at 25% by Weight Add-On with Quick Dip in Lotion | | | |
|---|---|---|---|
| Sample 157 | Caliper (mm) | Basis Weight (gsm) | CDW (gli) |
| Sample 157-9 | 0.74 | 73.1 | 274 |
| Sample 157-10 | 0.68 | 67.8 | 269 |

TABLE 157

| Dow KSR8811 Binder at 20% by Weight Add-On with Quick Dip in Lotion | | | |
|---|---|---|---|
| Sample 158 | Caliper (mm) | Basis Weight (gsm) | CDW (gli) |
| Sample 158-1 | 0.70 | 74.6 | 387 |
| Sample 158-2 | 0.70 | 74.2 | 385 |
| Sample 158-3 | 0.68 | 74.3 | 377 |
| Sample 158-4 | 0.66 | 71.5 | 377 |
| Sample 158-5 | 0.70 | 72.8 | 409 |
| Sample 158-6 | 0.70 | 74.1 | 366 |
| Sample 158-7 | 0.70 | 73.8 | 337 |
| Sample 158-8 | 0.66 | 73.5 | 384 |
| Sample 158-9 | 0.72 | 76.4 | 381 |
| Sample 158-10 | 0.68 | 74.4 | 397 |

TABLE 158

| Dow KSR8758 Binder at 15% by Weight Add-On after 24 Hours of Aging in Lotion | | | |
|---|---|---|---|
| Sample 155 | Caliper (mm) | Basis Weight (gsm) | CDW (gli) |
| Sample 155-10 | 0.86 | 61.6 | 119 |
| Sample 155-11 | 0.88 | 57.3 | 69 |
| Sample 155-12 | 0.94 | 63.4 | 138 |
| Sample 155-13 | 0.88 | 57.4 | 68 |
| Sample 155-14 | 0.86 | 66.6 | 117 |
| Sample 155-15 | 0.84 | 65.2 | 119 |
| Sample 155-16 | 0.86 | 61.7 | 70 |
| Sample 155-17 | 0.88 | 64.4 | 113 |
| Sample 155-18 | 0.86 | 59.9 | 67 |
| Sample 155-19 | 0.76 | 60.3 | 68 |

TABLE 159

| Dow KSR8758 Binder at 20% by Weight Add-On after 24 Hours of Aging in Lotion | | | |
|---|---|---|---|
| Sample 156 | Caliper (mm) | Basis Weight (gsm) | CDW (gli) |
| Sample 156-11 | 0.96 | 73.8 | 234 |
| Sample 156-12 | 1.06 | 80.3 | 290 |
| Sample 156-13 | 1.02 | 79.3 | 264 |
| Sample 156-14 | 1.04 | 77.8 | 275 |
| Sample 156-15 | 0.90 | 75.7 | 264 |
| Sample 156-16 | 0.90 | 73.0 | 167 |
| Sample 156-17 | 1.06 | 82.1 | 282 |
| Sample 156-18 | 0.86 | 76.6 | 254 |
| Sample 156-19 | 0.88 | 74.8 | 182 |
| Sample 156-20 | 0.98 | 82.6 | 250 |

TABLE 160

| Dow KSR8758 Binder at 25% by Weight Add-On after 24 Hours of Aging in Lotion | | | |
|---|---|---|---|
| Sample 157 | Caliper (mm) | Basis Weight (gsm) | CDW (gli) |
| Sample 157-11 | 0.76 | 65.3 | 201 |
| Sample 157-12 | 0.74 | 65.2 | 209 |

TABLE 160-continued

| Dow KSR8758 Binder at 25% by Weight Add-On after 24 Hours of Aging in Lotion | | | |
|---|---|---|---|
| Sample 157 | Caliper (mm) | Basis Weight (gsm) | CDW (gli) |
| Sample 157-13 | 0.76 | 64.5 | 198 |
| Sample 157-14 | 0.74 | 67.5 | 211 |
| Sample 157-15 | 0.74 | 66.0 | 226 |
| Sample 157-16 | 0.74 | 64.7 | 220 |
| Sample 157-17 | 0.80 | 67.4 | 203 |
| Sample 157-18 | 0.80 | 65.2 | 194 |
| Sample 157-19 | 0.74 | 64.7 | 195 |
| Sample 157-20 | 0.78 | 67.6 | 205 |

TABLE 161

| Dow KSR8811 Binder at 20% by Weight Add-On after 24 Hours of Aging in Lotion | | | |
|---|---|---|---|
| Sample 158 | Caliper (mm) | Basis Weight (gsm) | CDW (gli) |
| Sample 158-11 | 0.69 | 73.95 | 278.50 |
| Sample 158-12 | 0.69 | 73.95 | 271.50 |
| Sample 158-13 | 0.69 | 73.95 | 254.07 |
| Sample 158-14 | 0.69 | 73.95 | 273.83 |
| Sample 158-15 | 0.69 | 73.95 | 294.84 |
| Sample 158-16 | 0.69 | 73.95 | 274.14 |
| Sample 158-17 | 0.69 | 73.95 | 309.93 |
| Sample 158-18 | 0.69 | 73.95 | 318.49 |
| Sample 158-19 | 0.69 | 73.95 | 291.88 |
| Sample 158-20 | 0.69 | 73.95 | 314.28 |

TABLE 162

| Dow KSR8758 Binder at 15% by Weight Add-On after 72 Hours of Aging in Lotion | | | |
|---|---|---|---|
| Sample 155 | Caliper (mm) | Basis Weight (gsm) | CDW (gli) |
| Sample 155-20 | 0.86 | 61.8 | 88 |
| Sample 155-21 | 0.86 | 61.8 | 64 |
| Sample 155-22 | 0.86 | 61.8 | 68 |
| Sample 155-23 | 0.86 | 61.8 | 67 |
| Sample 155-24 | 0.86 | 61.8 | 66 |
| Sample 155-25 | 0.86 | 61.8 | 76 |
| Sample 155-26 | 0.86 | 61.8 | 110 |
| Sample 155-27 | 0.86 | 61.8 | 92 |

TABLE 163

| Dow KSR8758 Binder at 20% by Weight Add-On after 72 Hours of Aging in Lotion | | | |
|---|---|---|---|
| Sample 156 | Caliper (mm) | Basis Weight (gsm) | CDW (gli) |
| Sample 156-21 | 0.97 | 77.6 | 228 |
| Sample 156-22 | 0.97 | 77.6 | 125 |
| Sample 156-23 | 0.97 | 77.6 | 223 |
| Sample 156-24 | 0.97 | 77.6 | 142 |
| Sample 156-25 | 0.97 | 77.6 | 247 |
| Sample 156-26 | 0.97 | 77.6 | 255 |
| Sample 156-27 | 0.97 | 77.6 | 246 |
| Sample 156-28 | 0.97 | 77.6 | 255 |
| Sample 156-29 | 0.97 | 77.6 | 152 |
| Sample 156-30 | 0.97 | 77.6 | 199 |

TABLE 164

| Dow KSR8758 Binder at 25% by Weight Add-On after 72 Hours of Aging in Lotion | | | |
|---|---|---|---|
| Sample 157 | Caliper (mm) | Basis Weight (gsm) | CDW (gli) |
| Sample 157-21 | 0.76 | 65.9 | 197 |
| Sample 157-22 | 0.76 | 65.9 | 212 |
| Sample 157-23 | 0.76 | 65.9 | 203 |
| Sample 157-24 | 0.76 | 65.9 | 199 |
| Sample 157-25 | 0.76 | 65.9 | 205 |
| Sample 157-26 | 0.76 | 65.9 | 190 |
| Sample 157-27 | 0.76 | 65.9 | 210 |
| Sample 157-28 | 0.76 | 65.9 | 235 |
| Sample 157-29 | 0.76 | 65.9 | 205 |
| Sample 157-30 | 0.76 | 65.9 | 217 |

TABLE 165

| Dow KSR8811 Binder at 20% by Weight Add-On after 72 Hours of Aging in Lotion | | | |
|---|---|---|---|
| Sample 158 | Caliper (mm) | Basis Weight (gsm) | CDW (gli) |
| Sample 158-21 | 0.69 | 74.0 | 255 |
| Sample 158-22 | 0.69 | 74.0 | 256 |
| Sample 158-23 | 0.69 | 74.0 | 270 |
| Sample 158-24 | 0.69 | 74.0 | 241 |
| Sample 158-25 | 0.69 | 74.0 | 238 |
| Sample 158-26 | 0.69 | 74.0 | 222 |
| Sample 158-27 | 0.69 | 74.0 | 240 |
| Sample 158-28 | 0.69 | 74.0 | 208 |
| Sample 158-29 | 0.69 | 74.0 | 209 |
| Sample 158-30 | 0.69 | 74.0 | 224 |

DISCUSSION: Samples with Dow 155-1 to 155-27 KSR8758 binder with a binder add-on level of about 15% by weight showed a drop in cross directional wet strength from samples that were tested with a 1-2 second dip in lotion to samples after 72 hours of aging of about 16%. Samples with Dow 156-1 to 156-30 KSR8758 binder with a binder add-on level of about 20% by weight showed a drop in cross directional wet strength from samples that were tested with a 1-2 second dip in lotion to samples after 72 hours of aging of about 30%. Samples with Dow 157-1 to 157-30 KSR8758 binder with a binder add-on level of about 25% by weight showed a drop in cross directional wet strength from samples that were tested with a 1-2 second dip in lotion to samples after 72 hours of aging of about 23%. Samples with Dow 158-1 to 158-30 KSR8811 binder with a binder add-on level of about 20% by weight showed a drop in cross directional wet strength from samples that were tested with a 1-2 second dip in lotion to samples after 72 hours of aging of about 38%.

Example 19

High Strength Binders for Flushable Dispersible Wipes

Wipes according to the invention were prepared and tested for various parameters including basis weight, caliper and FG511.1 Shake Flask Test. The amount of cure was varied to promote additional bonding of the binder. Cure time, cure temperature and oven type was changed to determine the impact on the dispersibility in the Shake Flask Test. Samples were tested after aging about 12 hours in lotion expressed from Wal-Mart Parents Choice Baby Wipes at a temperature of 40° C.

METHODS/MATERIALS: Samples 159-161 were all made on an airlaid pilot line. The composition of samples 159-161 are given in Tables 166-168. The type and level of raw materials for these samples were varied to influence the physical properties and flushable-dispersible properties. All of the samples were cured once at 175° C. in a pilot line through air oven.

Samples 162-163 were made on an airlaid pilot line. The composition of samples 162-163 are given in Tables 169-170. The type and level of raw materials for these samples were varied to influence the physical properties and flushable-dispersible properties. All of the samples were cured twice at 175° C. in a pilot line through air oven. Samples 164-166 were made on an airlaid pilot line. The composition of samples 164-166 are given in Tables 171-173. The type and level of raw materials for these samples were varied to influence the physical properties and flushable-dispersible properties. All of the samples were cured once at 175° C. in a pilot line through air oven and once at 150° C. for 15 minutes in a static lab scale oven.

TABLE 166

| Sample 159 (Dow KSR8758 Binder) | | | |
|---|---|---|---|
| Layer | Raw Materials | Basis Weight (gsm) | Weight % |
| Top | Dow KSR8758 | 4.9 | 7.5 |
| 1 | Buckeye Technologies EO1123 pulp | 55.2 | 80.0 |
| Bottom | Dow KSR8758 | 4.9 | 7.5 |
| | Total | 65.0 | 100 |

TABLE 167

| Sample 160 (Dow KSR8758 Binder) | | | |
|---|---|---|---|
| Layer | Raw Materials | Basis Weight (gsm) | Weight % |
| Top | Dow KSR8758 | 6.5 | 10.0 |
| 1 | Buckeye Technologies EO1123 pulp | 52.0 | 80.0 |
| Bottom | Dow KSR8758 | 6.5 | 10.0 |
| | Total | 65.0 | 100 |

TABLE 168

| Sample 161 (Dow KSR8758 Binder) | | | |
|---|---|---|---|
| Layer | Raw Materials | Basis Weight (gsm) | Weight % |
| Top | Dow KSR8758 | 8.1 | 12.5 |
| 1 | Buckeye Technologies EO1123 pulp | 48.8 | 80.0 |
| Bottom | Dow KSR8758 | 8.1 | 12.5 |
| | Total | 65.0 | 100 |

TABLE 169

| Sample 162 (Dow KSR8811 Binder) | | | |
|---|---|---|---|
| Layer | Raw Materials | Basis Weight (gsm) | Weight % |
| Top | Dow KSR8811 | 6.5 | 10.0 |
| 1 | Buckeye Technologies EO1123 pulp | 52.0 | 80.0 |
| Bottom | Dow KSR8811 | 6.5 | 10.0 |
| | Total | 65.0 | 100 |

TABLE 170

| Sample 163 (Dow KSR8811 Binder) | | | |
|---|---|---|---|
| Layer | Raw Materials | Basis Weight (gsm) | Weight % |
| Top | Dow KSR8811 | 8.1 | 12.5 |
| 1 | Buckeye Technologies EO1123 pulp | 48.8 | 80.0 |
| Bottom | Dow KSR8811 | 8.1 | 12.5 |
| | Total | 65.0 | 100 |

TABLE 171

| Sample 164 (Dow KSR8758 Binder) | | | |
|---|---|---|---|
| Layer | Raw Materials | Basis Weight (gsm) | Weight % |
| Top | Dow KSR8758 | 4.9 | 7.5 |
| 1 | Buckeye Technologies EO1123 pulp | 55.2 | 80.0 |
| Bottom | Dow KSR8758 | 4.9 | 7.5 |
| | Total | 65.0 | 100 |

TABLE 172

| Sample 165 (Dow KSR8758 Binder) | | | |
|---|---|---|---|
| Layer | Raw Materials | Basis Weight (gsm) | Weight % |
| Top | Dow KSR8758 | 6.5 | 10.0 |
| 1 | Buckeye Technologies EO1123 pulp | 52.0 | 80.0 |
| Bottom | Dow KSR8758 | 6.5 | 10.0 |
| | Total | 65.0 | 100 |

TABLE 173

| Sample 166 (Dow KSR8758 Binder) | | | |
|---|---|---|---|
| Layer | Raw Materials | Basis Weight (gsm) | Weight % |
| Top | Dow KSR8758 | 8.1 | 12.5 |
| 1 | Buckeye Technologies EO1123 pulp | 48.8 | 80.0 |
| Bottom | Dow KSR8758 | 8.1 | 12.5 |
| | Total | 65.0 | 100 |

RESULTS: Product lot analysis was carried out on each sample. The basis weight and caliper were measured. The FG511.1 Shake Flask Test was performed. The results of the product lot analysis for Samples 159-161 that were cured with a single pass in a pilot line through air oven at 175° C. are provided in Tables 174-176. The results of the product lot analysis for Samples 162-163 that were cured with two passes in a pilot line through air oven at 175° C. are provided in Table 177-178. The results of the product lot analysis for Samples 164-166 that were cured with one pass in a pilot line through air oven at 175° C. and then cured at 150° C. in a static lab scale oven are provided in Table 179-181.

TABLE 174

| Dow KSR8758 at 15% Add-On Level with One Pass in an Airlaid Pilot Oven | | | | |
|---|---|---|---|---|
| Sample 159 | Binder | Basis Weight (gsm) | Caliper (mm) | FG511.1 Shake Flask Test (percent remaining on 12 mm sieve) |
| Sample 159-1 | Dow KSR8758 | 66.3 | 1.02 | 0 |
| Sample 159-2 | Dow KSR8758 | 68.1 | 1.06 | 0 |

TABLE 175

| Dow KSR8758 at 20% Add-On Level with One Pass in an Airlaid Pilot Oven | | | | |
|---|---|---|---|---|
| Sample 160 | Binder | Basis Weight (gsm) | Caliper (mm) | FG511.1 Shake Flask Test (percent remaining on 12 mm sieve) |
| Sample 160-1 | Dow KSR8758 | 69.1 | 1.02 | 0 |
| Sample 160-2 | Dow KSR8758 | 68.9 | 1.02 | 0 |

TABLE 176

| Dow KSR8758 at 25% Add-On Level with One Pass in an Airlaid Pilot Oven | | | | |
|---|---|---|---|---|
| Sample 161 | Binder | Basis Weight (gsm) | Caliper (mm) | FG511.1 Shake Flask Test (percent remaining on 12 mm sieve) |
| Sample 161-1 | Dow KSR8758 | 66.4 | 0.80 | 0 |
| Sample 161-2 | Dow KSR8758 | 67.7 | 0.78 | 0 |

TABLE 177

| Dow KSR8811 at 20% Add-On Level with Two Passes in an Airlaid Pilot Oven | | | | |
|---|---|---|---|---|
| Sample 162 | Binder | Basis Weight (gsm) | Caliper (mm) | FG511.1 Shake Flask Test (percent remaining on 12 mm sieve) |
| Sample 162-1 | Dow KSR8811 | 71.4 | 0.80 | 51 |
| Sample 162-2 | Dow KSR8811 | 69.7 | 0.78 | 42 |

TABLE 178

| Dow KSR8811 at 25% Add-On Level with Two Passes in an Airlaid Pilot Oven | | | | |
|---|---|---|---|---|
| Sample 163 | Binder | Basis Weight (gsm) | Caliper (mm) | FG511.1 Shake Flask Test (percent remaining on 12 mm sieve) |
| Sample 163-1 | Dow KSR8811 | 68.3 | 0.94 | 92 |
| Sample 163-2 | Dow KSR8811 | 71.0 | 0.84 | 91 |

TABLE 179

| Dow KSR8758 at 15% Add-On Level with One Pass in an Airlaid Pilot Oven and a Lab Oven | | | | |
|---|---|---|---|---|
| Sample 164 | Binder | Basis Weight (gsm) | Caliper (mm) | FG511.1 Shake Flask Test (percent remaining on 12 mm sieve) |
| Sample 164-1 | Dow KSR8758 | 66.3 | 1.02 | 16 |
| Sample 164-2 | Dow KSR8758 | 68.1 | 1.06 | 6 |

TABLE 180

| Dow KSR8758 at 20% Add-On Level with One Pass in an Airlaid Pilot Oven and a Lab Oven | | | | |
|---|---|---|---|---|
| Sample 165 | Binder | Basis Weight (gsm) | Caliper (mm) | FG511.1 Shake Flask Test (percent remaining on 12 mm sieve) |
| Sample 165-1 | Dow KSR8758 | 72.8 | 1.14 | 93 |
| Sample 165-2 | Dow KSR8758 | 67.9 | 1.08 | 92 |

TABLE 181

| Dow KSR8758 at 25% Add-On Level with One Pass in an Airlaid Pilot Oven and a Lab Oven | | | | |
|---|---|---|---|---|
| Sample 166 | Binder | Basis Weight (gsm) | Caliper (mm) | FG511.1 Shake Flask Test (percent remaining on 12 mm sieve) |
| Sample 166-1 | Dow KSR8758 | 66.0 | 0.98 | 94 |

DISCUSSION: Samples with Dow KSR8758 binder that were cured in one pass on the pilot line, Samples 159-1, 159-2, 160-1, 160-2, 161-1 and 161-2, all passed the FG511.1 Shake Flask Test with 0% fiber remaining on the 12 mm sieve. Samples 162-1, 162-2, 162-1, 163-2, 164-1 and 164-2 with Dow KSR8758 were made with similar compositions to Samples 159-1, 159-2, 160-1, 160-2, 161-1 and 161-2 respectively and were cured initially with one pass on a pilot line and then were subjected to additional curing on in a lab scale oven. These samples of similar composition made with additional curing all failed the FG511.1 Shake Flask Test. Samples 164-1 and 164-2 with the lowest amount of Dow KSR8758 binder had the best average performance with 11% of fiber remaining on the 12 mm sieve while Samples 165-1, 165-2, 166-1 and 166-2 with higher levels of Dow KSR8758 binder all had over 90% of fiber remaining on the 12 mm sieve.

Example 20

High Strength Binders for Flushable Dispersible Wipes

Wipes according to the invention were prepared and tested for various parameters including basis weight, caliper, FG511.1 Shake Flask Test after 24 hours of aging in lotion expressed from Wal-Mart Parents Choice Baby Wipes, cross direction wet strength after a quick dip in lotion expressed from Wal-Mart Parents Choice Baby Wipe lotion, cross direction wet strength after about 24 hours of aging in lotion expressed from Wal-Mart Parents Choice Baby Wipes at a temperature of 40° C. and cross direction wet strength after about 72 hours of aging in lotion expressed from Wal-Mart Parents Choice Baby Wipes at a temperature of 40° C.

METHODS/MATERIALS: Samples 166-167 were all made on an airlaid pilot line. The composition of samples 166-167 are given in Tables 182-183. The type and level of raw materials for these samples were varied to influence the physical properties and flushable-dispersible properties. All of the samples were cured at 175° C. in a pilot line through air oven.

TABLE 182

| Sample 166 (Dow KSR8845 Binder) | | | |
|---|---|---|---|
| Layer | Raw Materials | Basis Weight (gsm) | Weight % |
| Top | Dow KSR8845 | 6.5 | 10.0 |
| 1 | Buckeye Technologies EO1123 pulp | 52.0 | 80.0 |
| Bottom | Dow KSR8845 | 6.5 | 10.0 |
| | Total | 65.0 | 100 |

TABLE 183

| Sample 167 (Dow KSR8855 Binder) | | | |
|---|---|---|---|
| Layer | Raw Materials | Basis Weight (gsm) | Weight % |
| Top | Dow KSR8855 | 6.5 | 10.0 |
| 1 | Buckeye Technologies EO1123 pulp | 52.0 | 80.0 |
| Bottom | Dow KSR8855 | 6.5 | 10.0 |
| | Total | 65.0 | 100 |

RESULTS: Product lot analysis was carried out on each sample. Basis weight, caliper, cross directional wet tensile strength in lotion in an aging study and FG511.1 Shake Flask Test after aging were done.

The results of the product lot analysis for basis weight, caliper and cross directional wet strength with a quick dip (1-2 seconds) in Wal-Mart Parents Choice Lotion for Sample 166 with Dow KSR8845 binder is given in Table 184 and Sample 167 is given in Table 185. The results of the product lot analysis for basis weight, caliper and cross directional wet strength after about 24 hours of aging in Wal-Mart Parents Choice Lotion at 40° C. for Sample 166 with Dow KSR8845 binder is given in Table 186 and Sample 167 is given in Table 187. The results of the product lot analysis for basis weight, caliper and cross directional wet strength after about 72 hours of aging in Wal-Mart Parents Choice Lotion at 40° C. for Sample 166 with Dow KSR8845 binder is given in Table 188 and Sample 167 is given in Table 189.

The results of the product lot analysis for FG511.1 Shake Flask Test after about 24 hours of aging in Wal-Mart Parents Choice Lotion at 40° C. for Sample 166 with Dow KSR8845 binder is given in Table 190 and Sample 167 is given in Table 191.

TABLE 184

| Dow KSR8845 Quick Dip in Lotion | | | | |
|---|---|---|---|---|
| Sample 166 | Caliper (mm) | Basis Weight (gsm) | CDW (gli) | Normalized CDW (gli) |
| Sample 166-1 | 0.60 | 54.9 | 139 | 130 |
| Sample 166-2 | 0.62 | 54.5 | 132 | 129 |
| Sample 166-3 | 0.68 | 56.3 | 144 | 149 |

TABLE 184-continued

| Dow KSR8845 Quick Dip in Lotion | | | | |
|---|---|---|---|---|
| Sample 166 | Caliper (mm) | Basis Weight (gsm) | CDW (gli) | Normalized CDW (gli) |
| Sample 166-4 | 0.70 | 58.8 | 152 | 155 |
| Sample 166-5 | 0.66 | 57.0 | 155 | 154 |
| Sample 166-6 | 0.68 | 59.3 | 168 | 165 |
| Sample 166-7 | 0.64 | 55.9 | 150 | 147 |
| Sample 166-8 | 0.64 | 54.6 | 155 | 156 |
| Sample 166-9 | 0.66 | 56.5 | 157 | 157 |

TABLE 185

| Dow KSR8855 Quick Dip in Lotion | | | | |
|---|---|---|---|---|
| Sample 167 | Caliper (mm) | Basis Weight (gsm) | CDW (gli) | Normalized CDW (gli) |
| Sample 167-1 | 0.72 | 57.2 | 136 | 147 |
| Sample 167-2 | 0.64 | 58.0 | 168 | 159 |
| Sample 167-3 | 0.70 | 56.4 | 173 | 184 |
| Sample 167-4 | 0.72 | 57.7 | 164 | 175 |
| Sample 167-5 | 0.72 | 59.7 | 156 | 161 |
| Sample 167-6 | 0.72 | 59.1 | 156 | 163 |
| Sample 167-7 | 0.70 | 58.5 | 165 | 169 |
| Sample 167-8 | 0.68 | 57.5 | 167 | 169 |
| Sample 167-9 | 0.68 | 57.1 | 138 | 141 |
| Sample 167-10 | 0.72 | 59.6 | 148 | 153 |

TABLE 186

| Dow KSR8845 24 Hour Aging in Lotion | | | | |
|---|---|---|---|---|
| Sample 166 | Caliper (mm) | Basis Weight (gsm) | CDW (gli) | Normalized CDW (gli) |
| Sample 166-10 | 0.68 | 58.3 | 125 | 125 |
| Sample 166-11 | 0.68 | 59.5 | 121 | 119 |
| Sample 166-12 | 0.68 | 59.6 | 101 | 99 |
| Sample 166-13 | 0.68 | 59.1 | 120 | 118 |
| Sample 166-14 | 0.80 | 66.0 | 118 | 123 |
| Sample 166-15 | 0.78 | 65.5 | 118 | 121 |
| Sample 166-16 | 0.74 | 64.7 | 119 | 117 |
| Sample 166-17 | 0.78 | 67.4 | 139 | 138 |
| Sample 166-18 | 0.74 | 66.9 | 151 | 143 |

TABLE 187

| Dow KSR8855 24 Hour Aging in Lotion | | | | |
|---|---|---|---|---|
| Sample 167 | Caliper (mm) | Basis Weight (gsm) | CDW (gli) | Normalized CDW (gli) |
| Sample 167-11 | 0.68 | 59.1 | 131 | 129 |
| Sample 167-12 | 0.70 | 59.6 | 119 | 120 |
| Sample 167-13 | 0.76 | 61.5 | 122 | 129 |
| Sample 167-14 | 0.74 | 59.5 | 131 | 140 |
| Sample 167-15 | 0.74 | 60.2 | 118 | 124 |
| Sample 167-16 | 0.74 | 60.2 | 126 | 133 |
| Sample 167-17 | 0.74 | 61.3 | 133 | 138 |
| Sample 167-18 | 0.72 | 60.9 | 139 | 141 |
| Sample 167-19 | 0.70 | 57.8 | 128 | 133 |
| Sample 167-20 | 0.70 | 57.4 | 110 | 115 |

TABLE 188

| Dow KSR8845 72 Hour Aging in Lotion | | | | |
|---|---|---|---|---|
| Sample 166 | Caliper (mm) | Basis Weight (gsm) | CDW (gli) | Normalized CDW (gli) |
| Sample 166-19 | 0.72 | 64.4 | 131 | 126 |
| Sample 166-20 | 0.70 | 61.8 | 140 | 136 |
| Sample 166-21 | 0.70 | 57.7 | 121 | 126 |
| Sample 166-22 | 0.68 | 55.3 | 132 | 139 |
| Sample 166-23 | 0.66 | 56.7 | 128 | 128 |
| Sample 166-24 | 0.62 | 56.8 | 131 | 123 |
| Sample 166-25 | 0.70 | 58.7 | 131 | 134 |
| Sample 166-26 | 0.66 | 56.0 | 112 | 113 |
| Sample 166-27 | 0.66 | 57.6 | 128 | 126 |

TABLE 189

| Dow KSR8855 72 Hour Aging in Lotion | | | | |
|---|---|---|---|---|
| Sample 167 | Caliper (mm) | Basis Weight (gsm) | CDW (gli) | Normalized CDW (gli) |
| Sample 167-21 | 0.68 | 57.0 | 111 | 114 |
| Sample 167-22 | 0.64 | 56.0 | 110 | 108 |
| Sample 167-23 | 0.68 | 56.9 | 100 | 102 |
| Sample 167-24 | 0.70 | 57.7 | 105 | 109 |
| Sample 167-25 | 0.70 | 57.2 | 108 | 113 |
| Sample 167-26 | 0.72 | 57.4 | 117 | 126 |
| Sample 167-27 | 0.72 | 57.4 | 113 | 121 |
| Sample 167-28 | 0.70 | 57.3 | 125 | 131 |
| Sample 167-29 | 0.70 | 58.0 | 127 | 131 |
| Sample 167-30 | 0.72 | 59.2 | 115 | 120 |

TABLE 190

| Dow KSR8845 Binder FG511.1 Shake Flask Test After About 24 hours of Aging | | | | |
|---|---|---|---|---|
| Sample 166 | Binder | Basis Weight (gsm) | Caliper (mm) | FG511.1 Shake Flask Test (percent remaining on 12 mm sieve) |
| Sample 166-28 | Dow KSR8845 | 64.3 | 0.90 | 1 |
| Sample 166-29 | Dow KSR8845 | 62.1 | 0.78 | 12 |
| Sample 166-30 | Dow KSR8845 | 60.4 | 0.80 | 1 |

TABLE 191

| Dow KSR8845 Binder FG511.1 Shake Flask Test After About 24 hours of Aging | | | | |
|---|---|---|---|---|
| Sample 167 | Binder | Basis Weight (gsm) | Caliper (mm) | FG511.1 Shake Flask Test (percent remaining on 12 mm sieve) |
| Sample 167-31 | Dow KSR8855 | 59.5 | 0.84 | 1 |
| Sample 167-32 | Dow KSR8855 | 60.1 | 0.86 | 5 |
| Sample 167-33 | Dow KSR8855 | 61.2 | 0.90 | 1 |

DISCUSSION: Samples 166-1 to Samples 166-9 with Dow KSR8845 binder had an average cross directional wet tensile strength after a 1-2 second dip in lotion of 149 gli. Samples 166-10 to Samples 166-18 with Dow KSR8845 binder had an average cross directional wet tensile strength after a 24 hour aging in lotion of 123 gli. Samples 166-19 to Samples 166-27 with Dow KSR8845 binder had an average cross directional wet tensile strength after a 72 hour aging in lotion of 128 gli. A comparison of the average cross directional wet tensile strength after a 1-2 second dip in lotion versus a 24 hour aging in lotion showed a drop of about 17%. A comparison of the average cross directional wet tensile strength after a 24 hour aging in lotion versus a 96 hour aging in lotion showed an increase of about 4%. These results show that the KSR8845 binder has stopped degrading in lotion after about 24 hours with a total drop in cross directional wet strength from the 1-2 second dip to the 72 hour aging in lotion of about 14%. Samples 166-28 and 166-30 passed the FG511.1 Shake Flask Test with 1% of fiber remaining on the 12 mm sieve for each. Sample 166-29 failed the FG511.1 Shake Flask Test with 12% fiber remaining on the 12 mm sieve. Samples 166-28, 166-29 and 166-30 had an average FG511.1 Shake Flask Test of about 5% remaining on the 12 mm sieve which passes the test.

Samples 167-1 to Samples 167-10 with Dow KSR8855 binder had an average cross directional wet tensile strength after a 1-2 second dip in lotion of 162 gli. Samples 167-11 to Samples 167-20 with Dow KSR8855 binder had an average cross directional wet tensile strength after a 24 hour aging in lotion of 130 gli. Samples 167-21 to Samples 167-30 with Dow KSR8855 binder had an average cross directional wet tensile strength after a 72 hour aging in lotion of 118 gli. A comparison of the average cross directional wet tensile strength after a 1-2 second dip in lotion versus a 24 hour aging in lotion showed a drop of about 20%. A comparison of the average cross directional wet tensile strength after a 24 hour aging in lotion versus a 96 hour aging in lotion showed a further drop of about 9%. These results show that the KSR8855 binder has slowed down the rate of degradation, but has not stopped degrading in lotion. These results show that the KSR8855 binder has a total drop in cross directional wet strength from the 1-2 second dip to the 72 hour aging in lotion of about 27%. Samples 167-31, 167-2 and 166-33 all passed the FG511.1 Shake Flask Test with 1% to 5% of fiber remaining on the 12 mm sieve for each.

Example 21

High Strength Binders for Flushable Dispersible Wipes

Wipes according to the invention were prepared and tested for various parameters including basis weight, caliper, FG511.1 Shake Flask Test after 24 hours of aging in lotion expressed from Wal-Mart Parents Choice Baby Wipes, cross direction wet strength after a quick dip in lotion expressed from Wal-Mart Parents Choice Baby Wipe lotion, cross direction wet strength after about 24 hours of aging in lotion expressed from Wal-Mart Parents Choice Baby Wipes at a temperature of 40° C. and cross direction wet strength after about 72 hours of aging in lotion expressed from Wal-Mart Parents Choice Baby Wipes at a temperature of 40° C.

METHODS/MATERIALS: Samples 168-169 were all made on an airlaid pilot line. The composition of samples 168-169 with Dow KSR8758 binder are given in Tables 192-193. The type and level of raw materials for these samples were varied to influence the physical properties and flushable-dispersible properties. All of the samples were cured at 175° C. in a pilot line through air oven.

TABLE 192

Sample 168 (Dow KSR8758 Binder and No Bicomponent Fiber)

| Layer | Raw Materials | Basis Weight (gsm) | Weight % |
|---|---|---|---|
| Top | Dow KSR8758 | 6.5 | 10.0 |
| 1 | Buckeye Technologies EO1123 pulp | 52.0 | 80.0 |
| Bottom | Dow KSR8758 | 6.5 | 10.0 |
| | Total | 65.0 | 100 |

TABLE 193

Sample 169 (Dow KSR8758 Binder With Bicomponent Fiber)

| Layer | Raw Materials | Basis Weight (gsm) | Weight % |
|---|---|---|---|
| Top | Dow KSR8758 | 2.3 | 3.6 |
| 1 | Trevira Merge 1661 T255 bicomponent fiber, 2.2 dtex × 6 mm | 3.0 | 4.6 |
| | Buckeye Technologies EO1123 pulp | 8.2 | 12.6 |
| 2 | Buckeye Technologies EO1123 pulp | 14.3 | 22.1 |
| 3 | Trevira Merge 1661 T255 bicomponent fiber, 2.2 dtex × 6 mm | 5.6 | 8.6 |
| | Buckeye Technologies EO1123 pulp | 29.2 | 45.0 |
| Bottom | Dow KSR8758 | 2.3 | 3.5 |
| | Total | 64.9 | 100.0 |

RESULTS: Product lot analysis was carried out on each sample. Basis weight, caliper, cross directional wet tensile strength in lotion in an aging study and FG511.1 Shake Flask Test after aging were done.

The results of the product lot analysis for basis weight, caliper and cross directional wet strength with a quick dip (1-2 seconds) in Wal-Mart Parents Choice Lotion for Sample 168 with Dow KSR8758 binder and no bicomponent fiber is given in Table 194 and Sample 169 with Dow KSR8758 binder and bicomponent fiber is given in Table 195. The results of the product lot analysis for basis weight, caliper and cross directional wet strength after about 24 hours of aging in Wal-Mart Parents Choice Lotion at 40° C. for Sample 168 with Dow KSR8758 binder and no bicomponent is given in Table 196 and Sample 169 with Dow KSR8758 binder and bicomponent fiber is given in Table 197. The results of the product lot analysis for basis weight, caliper and cross directional wet strength after about 72 hours of aging in Wal-Mart Parents Choice Lotion at 40° C. for Sample 168 with Dow KSR8758 binder and no bicomponent fiber is given in Table 198 and Sample 169 is given in Table 199.

The results of the product lot analysis for FG511.1 Shake Flask Test after about 24 hours of aging in Wal-Mart Parents Choice Lotion at 40° C. for Sample 168 with Dow KSR8758 binder and no bicomponent fiber is given in Table 200 and Sample 169 with Dow KSR8758 binder and bicomponent fiber is given in Table 201.

TABLE 194

Dow KSR8758 Binder with No Bicomponent Fiber Quick Dip in Lotion

| Sample 168 | Caliper (mm) | Basis Weight (gsm) | CDW (gli) | Normalized CDW (gli) |
|---|---|---|---|---|
| Sample 168-1 | 0.60 | 60.9 | 198 | 141 |
| Sample 168-2 | 0.60 | 61.8 | 194 | 136 |
| Sample 168-3 | 0.68 | 63.1 | 206 | 160 |
| Sample 168-4 | 0.64 | 63.8 | 219 | 159 |
| Sample 168-5 | 0.68 | 65.4 | 199 | 149 |
| Sample 168-6 | 0.66 | 66.0 | 201 | 145 |
| Sample 168-7 | 0.64 | 67.1 | 209 | 144 |
| Sample 168-8 | 0.70 | 66.7 | 204 | 155 |

TABLE 194-continued

| Dow KSR8758 Binder with No Bicomponent Fiber Quick Dip in Lotion | | | | |
|---|---|---|---|---|
| Sample 168 | Caliper (mm) | Basis Weight (gsm) | CDW (gli) | Normalized CDW (gli) |
| Sample 168-9 | 0.72 | 67.2 | 191 | 148 |
| Sample 168-10 | 0.74 | 65.1 | 186 | 153 |

TABLE 195

| Dow KSR8758 Binder With Bicomponent Fiber Quick Dip in Lotion | | | | |
|---|---|---|---|---|
| Sample 169 | Caliper (mm) | Basis Weight (gsm) | CDW (gli) | Normalized CDW (gli) |
| Sample 169-1 | 1.16 | 63.5 | 129 | 170 |
| Sample 169-2 | 1.14 | 67.3 | 171 | 209 |
| Sample 169-3 | 1.22 | 65.4 | 174 | 234 |
| Sample 169-4 | 1.02 | 65.6 | 155 | 174 |
| Sample 169-5 | 1.12 | 64.8 | 164 | 205 |
| Sample 169-6 | 1.08 | 64.2 | 133 | 162 |
| Sample 169-7 | 1.22 | 64.0 | 157 | 216 |
| Sample 169-8 | 1.14 | 62.9 | 144 | 189 |
| Sample 169-9 | 1.06 | 62.5 | 148 | 181 |
| Sample 169-10 | 1.12 | 61.0 | 140 | 186 |

TABLE 196

| Dow KSR8758 Binder with No Bicomponent Fiber 24 Hour Aging in Lotion | | | | |
|---|---|---|---|---|
| Sample 168 | Caliper (mm) | Basis Weight (gsm) | CDW (gli) | Normalized CDW (gli) |
| Sample 168-11 | 0.64 | 63.9 | 193 | 140 |
| Sample 168-12 | 0.64 | 63.1 | 195 | 143 |
| Sample 168-13 | 0.64 | 64.9 | 187 | 133 |
| Sample 168-14 | 0.64 | 63.4 | 184 | 134 |
| Sample 168-15 | 0.64 | 61.6 | 190 | 143 |
| Sample 168-16 | 0.66 | 62.8 | 178 | 135 |
| Sample 168-17 | 0.64 | 62.9 | 185 | 136 |
| Sample 168-18 | 0.64 | 62.0 | 192 | 143 |
| Sample 168-19 | 0.58 | 61.7 | 194 | 132 |
| Sample 168-20 | 0.60 | 62.2 | 201 | 140 |

TABLE 197

| Dow KSR8758 Binder With Bicomponent Fiber 24 Hour Aging in Lotion | | | | |
|---|---|---|---|---|
| Sample 169 | Caliper (mm) | Basis Weight (gsm) | CDW (gli) | Normalized CDW (gli) |
| Sample 169-11 | 1.14 | 66.2 | 149 | 185 |
| Sample 169-12 | 0.98 | 62.9 | 133 | 150 |
| Sample 169-13 | 1.00 | 61.4 | 148 | 174 |
| Sample 169-14 | 0.94 | 63.6 | 166 | 177 |
| Sample 169-15 | 1.18 | 66.8 | 172 | 219 |
| Sample 169-16 | 1.06 | 65.8 | 162 | 188 |
| Sample 169-17 | 1.10 | 62.9 | 155 | 196 |
| Sample 169-18 | 1.04 | 63.6 | 153 | 181 |
| Sample 169-19 | 1.14 | 69.5 | 175 | 207 |
| Sample 169-20 | 1.12 | 67.7 | 157 | 188 |

TABLE 198

| Dow KSR8758 Binder with No Bicomponent Fiber 72 Hour Aging in Lotion | | | | |
|---|---|---|---|---|
| Sample 168 | Caliper (mm) | Basis Weight (gsm) | CDW (gli) | Normalized CDW (gli) |
| Sample 168-21 | 0.64 | 62.5 | 186 | 138 |
| Sample 168-22 | 0.70 | 67.0 | 209 | 158 |
| Sample 168-23 | 0.68 | 68.6 | 204 | 146 |
| Sample 168-24 | 0.72 | 65.7 | 198 | 157 |
| Sample 168-25 | 0.72 | 65.3 | 181 | 144 |
| Sample 168-26 | 0.68 | 64.3 | 180 | 137 |
| Sample 168-27 | 0.68 | 65.7 | 180 | 135 |
| Sample 168-28 | 0.70 | 65.5 | 192 | 148 |
| Sample 168-29 | 0.74 | 65.6 | 185 | 151 |
| Sample 168-30 | 0.66 | 64.6 | 181 | 134 |

TABLE 199

| Dow KSR8758 Binder With Bicomponent Fiber 72 Hour Aging in Lotion | | | | |
|---|---|---|---|---|
| Sample 169 | Caliper (mm) | Basis Weight (gsm) | CDW (gli) | Normalized CDW (gli) |
| Sample 169-21 | 1.08 | 63.3 | 155 | 191 |
| Sample 169-22 | 1.18 | 63.5 | 156 | 209 |
| Sample 169-23 | 0.94 | 62.4 | 146 | 159 |
| Sample 169-24 | 0.94 | 62.2 | 124 | 135 |
| Sample 169-25 | 1.04 | 62.9 | 150 | 179 |
| Sample 169-26 | 1.12 | 63.4 | 144 | 184 |
| Sample 169-27 | 1.16 | 63.7 | 147 | 193 |
| Sample 169-28 | 1.00 | 62.6 | 150 | 173 |
| Sample 169-29 | 1.18 | 63.1 | 150 | 203 |
| Sample 169-30 | 1.00 | 64.5 | 147 | 165 |

TABLE 200

| Dow KSR8758 Binder With Bicomponent Fiber FG511.1 Shake Flask Test After About 24 hours of Aging | | | |
|---|---|---|---|
| Sample 168 | Caliper (mm) | Basis Weight (gsm) | FG511.1 Shake Flask Test (percent remaining on 12 mm sieve) |
| Sample 168-31 | 0.74 | 58 | 2 |
| Sample 168-32 | 0.78 | 65 | 24 |
| Sample 168-33 | 0.76 | 66 | 71 |

TABLE 201

| Dow KSR8758 Binder with No Bicomponent Fiber FG511.1 Shake Flask Test After About 24 hours of Aging | | | |
|---|---|---|---|
| Sample 169 | Caliper (mm) | Basis Weight (gsm) | FG511.1 Shake Flask Test (percent remaining on 12 mm sieve) |
| Sample 169-1 | 1.32 | 63 | 47 |
| Sample 169-2 | 1.34 | 60 | 49 |
| Sample 169-3 | 1.36 | 63 | 60 |

DISCUSSION: Samples 168-1 to Samples 168-10 with Dow KSR8758 binder and no bicomponent fiber had an average cross directional wet tensile strength after a 1-2 second dip in lotion of about 149 gli. Samples 168-11 to Samples 168-20 with Dow KSR8758 binder and no bicomponent fiber had an average cross directional wet tensile strength after a 24 hour aging in lotion of 138 gli. Samples 168-21 to Samples 168-30 with Dow KSR8578 binder and no bicomponent fiber had an average cross directional wet tensile strength after a 72 hour aging in lotion of 145 gli. A comparison of the average cross directional wet tensile strength after a 1-2 second dip in lotion versus a 24 hour aging in lotion showed a drop of about 7%. A comparison of the average cross directional wet tensile strength after a 24 hour aging in lotion versus a 96 hour aging in lotion showed an increase of about 5%. These results show that the KSR8845 binder has stopped degrading in lotion after about 24 hours with a total drop in cross directional wet strength from the 1-2 second dip to the 72 hour aging in lotion of about 3%. Samples 168-31 passed the FG511.1 Shake Flask Test with 2% of fiber remaining on the 12 mm sieve. Samples 168-32 and Sample 168-33 failed the FG511.1 Shake Flask Test. Samples 168-31, 168-32 and 168-33 had an average FG511.1 Shake Flask Test of about 32% remaining on the 12 mm sieve which fails the test.

Samples 169-1 to Samples 169-10 with Dow KSR8758 binder and with bicomponent fiber had an average cross directional wet tensile strength after a 1-2 second dip in lotion of about 193 gli. Samples 169-11 to Samples 169-20 with Dow KSR8758 binder and with bicomponent fiber had an average cross directional wet tensile strength after a 24 hour aging in lotion of 187 gli. Samples 169-21 to Samples 169-30 with Dow KSR8578 binder and with bicomponent fiber had an average cross directional wet tensile strength after a 72 hour aging in lotion of 179 gli. A comparison of the average cross directional wet tensile strength after a 1-2 second dip in lotion versus a 24 hour aging in lotion showed a drop in strength of about 3%. A comparison of the average cross directional wet tensile strength after a 24 hour aging in lotion versus a 96 hour aging in lotion showed a drop in strength of about 4%. These results show that the KSR8758 binder with bicomponent fiber continues to slowly degrade after 24 hours with a total drop in cross directional wet strength from the 1-2 second dip to the 72 hour aging in lotion of about 7%. Samples 169-31, 169-32 and 169-33 all failed the FG511.1 Shake Flask Test with about 52% of fiber remaining on the 12 mm sieve.

Example 22

High Strength Binders for Flushable Dispersible Wipes

Wipes according to the invention were prepared and tested for various parameters including basis weight, caliper, FG511.1 Shake Flask Test after 24 hours of aging in lotion expressed from Wal-Mart Parents Choice Baby Wipes, cross direction wet strength after a quick dip in lotion expressed from Wal-Mart Parents Choice Baby Wipe lotion, cross direction wet strength after about 24 hours of aging in lotion expressed from Wal-Mart Parents Choice Baby Wipes at a temperature of 40° C. and cross direction wet strength after about 72 hours of aging in lotion expressed from Wal-Mart Parents Choice Baby Wipes at a temperature of 40° C.

METHODS/MATERIALS: Samples 170-171 were all made on an airlaid pilot line. The composition of samples 170-171 with Dow KSR8855 binder are given in Tables 202-203. The type and level of raw materials for these samples were varied to influence the physical properties and flushable-dispersible properties. All of the samples were cured at 175° C. in a pilot line through air oven.

TABLE 202

Sample 170 (Dow KSR8855 Binder and No Bicomponent Fiber)

| Layer | Raw Materials | Basis Weight (gsm) | Weight % |
|---|---|---|---|
| Top | Dow KSR8855 | 6.5 | 10.0 |
| 1 | Buckeye Technologies EO1123 pulp | 52.0 | 80.0 |
| Bottom | Dow KSR8855 | 6.5 | 10.0 |
| | Total | 65.0 | 100 |

TABLE 203

Sample 171 (Dow KSR8855 Binder With Bicomponent Fiber)

| Layer | Raw Materials | Basis Weight (gsm) | Weight % |
|---|---|---|---|
| Top | Dow KSR8855 | 2.3 | 3.6 |
| 1 | Trevira Merge 1661 T255 bicomponent fiber, 2.2 dtex × 6 mm | 3.0 | 4.6 |
| | Buckeye Technologies EO1123 pulp | 8.2 | 12.6 |
| 2 | Buckeye Technologies EO1123 pulp | 14.3 | 22.1 |
| 3 | Trevira Merge 1661 T255 bicomponent fiber, 2.2 dtex × 6 mm | 5.6 | 8.6 |
| | Buckeye Technologies EO1123 pulp | 29.2 | 45.0 |
| Bottom | Dow KSR8855 | 2.3 | 3.5 |
| | Total | 64.9 | 100.0 |

RESULTS: Product lot analysis was carried out on each sample. Basis weight, caliper, cross directional wet tensile strength in lotion in an aging study and FG511.1 Shake Flask Test after aging were done.

The results of the product lot analysis for basis weight, caliper and cross directional wet strength with a quick dip (1-2 seconds) in Wal-Mart Parents Choice Lotion for Sample 170 with Dow KSR8855 binder and no bicomponent fiber is given in Table 204 and Sample 171 with Dow KSR8855 binder and bicomponent fiber is given in Table 205. The results of the product lot analysis for basis weight, caliper and cross directional wet strength after about 24 hours of aging in Wal-Mart Parents Choice Lotion at 40° C. for Sample 170 with Dow KSR8855 binder and no bicomponent is given in Table 206. The results of the product lot analysis for basis weight, caliper and cross directional wet strength after about 72 hours of aging in Wal-Mart Parents Choice Lotion at 40° C. for Sample 170 with Dow KSR8855 binder and no bicomponent fiber is given in Table 207 and Sample 171 is given in Table 208.

The results of the product lot analysis for FG511.1 Shake Flask Test after about 24 hours of aging in Wal-Mart Parents Choice Lotion at 40° C. for Sample 170 with Dow KSR8855 binder and no bicomponent fiber is given in Table 209 and Sample 171 with Dow KSR8855 binder and bicomponent fiber is given in Table 210.

TABLE 204

Dow KSR8855 Binder with No Bicomponent Fiber Quick Dip in Lotion

| Sample 170 | Caliper (mm) | Basis Weight (gsm) | CDW (gli) | Normalized CDW (gli) |
|---|---|---|---|---|
| Sample 170-1 | 0.82 | 63 | 170 | 159 |
| Sample 170-2 | 0.80 | 62 | 179 | 168 |
| Sample 170-3 | 0.76 | 62 | 180 | 158 |
| Sample 170-4 | 0.80 | 64 | 183 | 165 |
| Sample 170-5 | 0.78 | 62 | 182 | 166 |

TABLE 204-continued

| Dow KSR8855 Binder with No Bicomponent Fiber Quick Dip in Lotion | | | | |
|---|---|---|---|---|
| Sample 170 | Caliper (mm) | Basis Weight (gsm) | CDW (gli) | Normalized CDW (gli) |
| Sample 170-6 | 0.76 | 62 | 167 | 147 |
| Sample 170-7 | 0.84 | 64 | 164 | 156 |
| Sample 170-8 | 0.86 | 65 | 169 | 162 |
| Sample 170-9 | 0.80 | 65 | 182 | 161 |
| Sample 170-10 | 0.78 | 64 | 176 | 156 |

TABLE 205

| Dow KSR8855 Binder With Bicomponent Fiber Quick Dip in Lotion | | | | |
|---|---|---|---|---|
| Sample 171 | Caliper (mm) | Basis Weight (gsm) | CDW (gli) | Normalized CDW (gli) |
| Sample 171-1 | 1.00 | 71 | 289 | 294 |
| Sample 171-2 | 0.92 | 71 | 281 | 262 |
| Sample 171-3 | 0.96 | 69 | 268 | 269 |
| Sample 171-4 | 0.82 | 69 | 248 | 214 |
| Sample 171-5 | 0.82 | 70 | 243 | 207 |
| Sample 171-6 | 0.82 | 69 | 230 | 196 |
| Sample 171-7 | 0.98 | 71 | 249 | 250 |
| Sample 171-8 | 0.90 | 67 | 246 | 238 |
| Sample 171-9 | 0.98 | 68 | 268 | 280 |
| Sample 171-10 | 0.96 | 70 | 262 | 260 |

TABLE 206

| Dow KSR8855 Binder with No Bicomponent Fiber 24 Hour Aging in Lotion | | | | |
|---|---|---|---|---|
| Sample 170 | Caliper (mm) | Basis Weight (gsm) | CDW (gli) | Normalized CDW (gli) |
| Sample 170-11 | 0.80 | 66 | 150 | 132 |
| Sample 170-12 | 0.86 | 64 | 158 | 152 |
| Sample 170-13 | 0.80 | 65 | 165 | 147 |
| Sample 170-14 | 0.78 | 62 | 148 | 135 |
| Sample 170-15 | 0.80 | 64 | 162 | 147 |
| Sample 170-16 | 0.78 | 63 | 164 | 147 |
| Sample 170-17 | 0.78 | 64 | 170 | 149 |
| Sample 170-18 | 0.88 | 66 | 170 | 165 |
| Sample 170-19 | 0.82 | 65 | 172 | 157 |

TABLE 207

| Dow KSR8855 Binder with No Bicomponent Fiber 72 Hour Aging in Lotion | | | | |
|---|---|---|---|---|
| Sample 170 | Caliper (mm) | Basis Weight (gsm) | CDW (gli) | Normalized CDW (gli) |
| Sample 170-21 | 0.80 | 65 | 159 | 141 |
| Sample 170-22 | 0.84 | 66 | 129 | 119 |
| Sample 170-23 | 0.80 | 64 | 161 | 146 |
| Sample 170-24 | 0.80 | 65 | 172 | 153 |
| Sample 170-25 | 0.88 | 66 | 156 | 151 |
| Sample 170-26 | 0.80 | 66 | 160 | 139 |
| Sample 170-27 | 0.84 | 66 | 165 | 152 |
| Sample 170-28 | 0.82 | 63 | 168 | 158 |
| Sample 170-29 | 0.74 | 63 | 170 | 145 |
| Sample 170-30 | 0.78 | 63 | 168 | 150 |

TABLE 208

| Dow KSR8855 Binder With Bicomponent Fiber 72 Hour Aging in Lotion | | | | |
|---|---|---|---|---|
| Sample 171 | Caliper (mm) | Basis Weight (gsm) | CDW (gli) | Normalized CDW (gli) |
| Sample 171-11 | 0.82 | 69 | 249 | 213 |
| Sample 171-12 | 0.94 | 70 | 265 | 258 |
| Sample 171-13 | 0.96 | 68 | 242 | 247 |
| Sample 171-14 | 0.84 | 68 | 238 | 212 |
| Sample 171-15 | 0.90 | 69 | 238 | 223 |
| Sample 171-16 | 1.00 | 67 | 232 | 249 |
| Sample 171-17 | 0.92 | 67 | 240 | 237 |
| Sample 171-18 | 0.90 | 68 | 212 | 204 |
| Sample 171-19 | 0.94 | 71 | 269 | 256 |
| Sample 171-20 | 1.00 | 74 | 279 | 271 |

TABLE 209

| Dow KSR8855 Binder With Bicomponent Fiber FG511.1 Shake Flask Test After About 24 hours of Aging | | | |
|---|---|---|---|
| Sample 171 | Caliper (mm) | Basis Weight (gsm) | FG511.1 Shake Flask Test (percent remaining on 12 mm sieve) |
| Sample 171-21 | 1.32 | 71.6 | 86 |
| Sample 171-22 | 1.34 | 67.7 | 86 |
| Sample 171-23 | 1.36 | 69.5 | 91 |

TABLE 210

| Dow KSR8855 Binder with NO Bicomponent Fiber FG511.1 Shake Flask Test After About 24 hours of Aging | | | |
|---|---|---|---|
| Sample 170 | Caliper (mm) | Basis Weight (gsm) | FG511.1 Shake Flask Test (percent remaining on 12 mm sieve) |
| Sample 170-31 | 0.96 | 62.0 | 0.0 |
| Sample 170-32 | 0.98 | 63.4 | 0.0 |
| Sample 170-33 | 0.90 | 66.1 | 0.0 |

DISCUSSION: Samples 170-1 to Samples 170-10 with Dow KSR8855 binder and no bicomponent fiber had an average cross directional wet tensile strength after a 1-2 second dip in lotion of about 160 gli. Samples 170-11 to Samples 170-20 with Dow KSR8855 binder and no bicomponent fiber had an average cross directional wet tensile strength after a 24 hour aging in lotion of 148 gli. Samples 170-21 to Samples 170-30 with Dow KSR8855 binder and no bicomponent fiber had an average cross directional wet tensile strength after a 72 hour aging in lotion of 145 gli. A comparison of the average cross directional wet tensile strength after a 1-2 second dip in lotion versus a 24 hour aging in lotion showed a drop in strength of about 7%. A comparison of the average cross directional wet tensile strength after a 24 hour aging in lotion versus a 96 hour aging in lotion showed a drop in strength of about 2%. These results show that the KSR8855 binder has essentially stopped degrading in lotion after about 24 hours with a total drop in cross directional wet strength from the 1-2 second dip to the 72 hour aging in lotion of about 9%. Samples 170-31, 170-32 and 170-33 all passed the FG511.1 Shake Flask Test with 0% of fiber remaining on the 12 mm sieve.

Samples 171-1 to Samples 171-10 with Dow KSR8855 binder and with bicomponent fiber had an average cross directional wet tensile strength after a 1-2 second dip in lotion of about 247 gli. Samples 171-11 to Samples 171-20 with Dow KSR8855 binder and no bicomponent fiber had an average cross directional wet tensile strength after a 72 hour aging in lotion of 237 gli. A comparison of the average cross directional wet tensile strength after a 1-2 second dip in lotion versus a 72 hour aging in lotion showed a drop in strength of about 4%. These results show that the KSR8855 binder with bicomponent fiber has little degradation from the initial cross directional wet strength from the 1-2 second dip test. Samples 171-21, 171-22 and 171-23 all failed the FG511.1 Shake Flask Test with an average of about 88% of fiber remaining on the 12 mm sieve.

Example 23

Effect of Cellulose Pulp Fibers Modified with Polyvalent Metal Compound on Wet Tensile Strength of Wipe Sheets Bonded with Repulpable VAE Binder Materials: The following main materials were used in the present Example.

(i) Never-dried, wet cellulose pulp fibers at a consistency of 37%, made by Buckeye Technologies Inc., (ii) Aqueous solution of aluminum sulfate at a concentration of 48.5%, supplied from General Chemical, (iii) Vinnapas EP907 repulpable binder emulsion supplied by Wacker.

Preparation of Modified Cellulose Pulp Fibers:

Never-dried, wet cellulose pulp, in an amount of 437 g, was placed in a 5 gallon bucket filled with water and stirred for 10 min. The pH of the slurry was brought to about 4.0 with a 10% aqueous solution of $H_2SO_4$. Aqueous solution of aluminum sulfate, in an amount of 29.1 g, was added to the slurry and the stirring continued for additional 20 min. Afterward, an aqueous, 5% NaOH solution was added to the slurry to bring the pH up to 5.7. The resultant slurry was used to make a cellulose pulp sheet on a lab dynamic handsheet former.

Thus made, still damp cellulose pulp sheet was pressed with a lab press several times first with a lower pressure than with a higher pressure in order to remove excess water. The cellulose pulp sheet was then dried on a lab drum dryer heated to 110° C.

The basis weight of the dried cellulose pulp sheet was about 730 g/m$^2$ and its density was about 0.55 g/cm$^3$.

The whole above-described procedure was repeated twice using various amounts of aqueous solution of aluminum sulfate. Also, a control cellulose pulp sheet was prepared using never-dried Foley Fluffs® cellulose pulp without additional treatment with any of the above-mentioned chemicals. Thus prepared cellulose pulp fiber samples in the form of sheets were analyzed for aluminum content using an ICP Optical Emission Spectrometer, Varian 735-ES. The results of this analysis are summarized in Table 211.

TABLE 211

Content of aluminum in cellulose pulp fiber samples

| Sample | Aluminum Content (ppm) |
|---|---|
| Sample 1 | Untreated control |
| Sample 2 | 5450 |
| Sample 3 | 6220 |
| Sample 4 | 8900 |

Preparation of Wipe Sheet Samples for Wet Tensile Strength Evaluation:

All four cellulose pulp sheets with various contents of aluminum and one without aluminum, described above, were conditioned overnight at 22° C. and 50% relative humidity. The cellulose pulp sheets were disintegrated using a Kamas Cell Mill™ pulp sheet disintegrator, manufactured by Kamas Industri AB of Sweden. After disintegration of the cellulose pulp sheets four separate fluff samples were obtained from each individual cellulose pulp sheet. A custom-made, lab wet-forming apparatus was used to form wipe sheets out of each of the prepared moist fiber samples. The lab wet-forming apparatus for making the wipe sheets is illustrated in FIG. 17. The general method of making the wipe sheet is as follows:

The fluff samples obtained by disintegrating the cellulose pulp sheet are weighed in an amount of 4.53 g each and each weighed sample is soaked separately in water overnight. On the following day, each of the resultant moist fiber samples is transferred to vessel 8 and dispersed in water. The volume of the slurry is adjusted at that point with water so that the level of the dispersion in vessel 8 is at a height of 9⅜ inches (23.8 cm). Subsequently, the fiber is mixed further with metal agitator 1. Water is then completely drained from the vessel and a moist wipe sheet is formed on a 100 mesh screen 26. The slotted vacuum box 14 is subsequently used to remove excess water from the sheet by dragging 100 mesh screen with the moist sheet across the vacuum slot. Each wipe sheet when still on the screen is then dried on the lab drum dryer.

The wipe sheet samples thus prepared had a square shape with dimensions of 12 inches by 12 inches (or 30.5 cm by 30.5 cm). Vinnapas EP907 emulsion at solids content of 10% was prepared and 7.50 g of this emulsion was sprayed onto one side of each of the wipe sheets. Each thus treated wipe sheet was then dried in a lab convection oven at 150° C. for 5 min. Next, the other side of each wipe sheet was sprayed with 7.50 g of the 10% Vinnapas EP907 emulsion and each treated wipe sheet was dried again in the 150° C. oven for 5 min. The caliper of the dried treated wipe sheets was measured using an Ames thickness meter, Model #: BG2110-0-04. The target caliper of the prepared wipe sheets was 1 mm. The same target caliper was used for all wipe sheets prepared in this Example and in all the other Examples in which the wipe sheets were made using the lab wet-forming apparatus. Whenever the caliper of the prepared samples in the present Example and all other said Examples was substantially higher than the 1 mm target then the samples were additionally pressed in a lab press to achieve the target 1 mm caliper.

Figure 18:
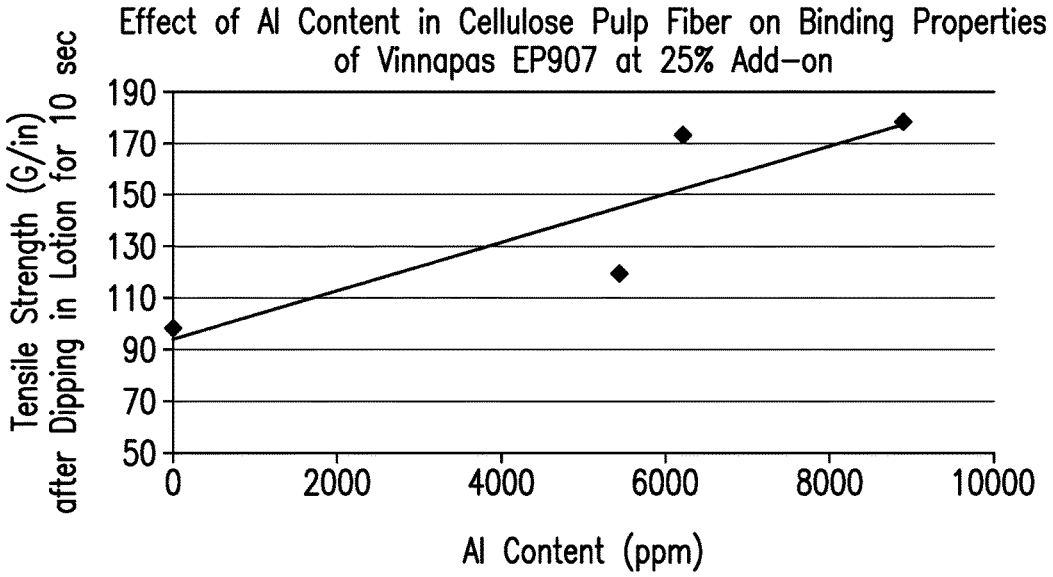
FIG. 18 depicts a graph showing the effect of the content of aluminum in the cellulose fiber used for the preparation of the treated wipe sheets in Example 23 on the tensile strength of the wipe sheets after soaking them in the lotion for 10 seconds. The graph shows the tensile strength (g/in) in dipping in lotion for 10 seconds (y-axis) versus the aluminum content in ppm (x-axis).

Measurement of Tensile Strength of the Treated Wipe Sheets:

The dried treated wipe sheet samples were then cut into strips having the width of 1 inch (or 25 mm) and the length of 4 inches (or 100 mm). Each strip was soaked for 10 sec in the lotion squeezed out from Wal-Mart's Parent's Choice baby wipes. Immediately after soaking the strip in the lotion for 10 sec its tensile strength was measured using an Instron, Model #3345 tester with the test speed set to 12 inches/min (or 300 mm/min) and a load cell of 50 N. FIG. 18 illustrates the effect of the content of aluminum in the cellulose fiber used for the preparation of the wipe sheets on the tensile strength of the wipe sheets after soaking them in the lotion for 10 sec.

It has been discovered that the more aluminum is contained in the cellulose fiber the higher is the tensile strength of the corresponding wipe sheet. This discovery shows that the integrity of the wipe sheet can be controlled by modifying the reactivity of the cellulose pulp which is used to form the wipe sheet.

Example 24

Effect of Modified Cellulose Pulp Fiber on Wet Tensile Strength and Dispersibility of Wipe Sheets Bonded with Repulpable VAE Binder Materials. The following main materials were used in the present Example.

(i) EO1123, experimental cellulose pulp fibers used as a control, made by Buckeye Technologies Inc., (ii) FFLE+, commercial modified cellulose pulp fibers in the sheet form made by Buckeye Technologies Inc., and (iii) Vinnapas EP907 repulpable binder emulsion supplied by Wacker.

Pilot-Scale Production of Experimental Wipe Sheets. Samples of wipe sheets were made on a pilot-scale airlaid drum forming line. The target compositions of the prepared samples 5 and 6 are shown in Table 212 and in Table 213.

TABLE 212

| Sample 5 | | | |
|---|---|---|---|
| Dosing System | Raw Material | Basis Weight ($g/m^2$) | Weight % |
| Surface spray 1 | Vinnapas EP907 at 10% solids | 8.1 (dry) | 12.5 |
| Forming Head 1 | EO1123 pulp | 24.4 | 37.5 |
| Forming Head 2 | EO1123 pulp | 24.4 | 37.5 |
| Surface Spray 2 | Vinnapas EP907 at 10% solids | 8.1 (dry) | 12.5 |
| | Total | 65 | 100 |

TABLE 213

| Sample 6 | | | |
|---|---|---|---|
| Dosing System | Raw Material | Basis Weight ($g/m^2$) | Weight % |
| Surface spray 1 | Vinnapas EP907 at 10% solids | 8.1 (dry) | 12.5 |
| Forming Head 1 | FFLE+ pulp | 24.4 | 37.5 |
| Forming Head 2 | FFLE+ pulp | 24.4 | 37.5 |
| Surface Spray 2 | Vinnapas EP907 at 10% solids | 8.1 (dry) | 12.5 |
| | Total | 65 | 100 |

In order to ensure complete curing of Samples 5 and 6 they were additionally heated in the lab convection oven at 150° C. for 15 min. The caliper of Samples 5 and 6 was measured using an Ames thickness meter, Model #: BG2110-0-04. The caliper of these samples of the wipe sheets varied from about 0.8 mm to about 1.0 mm.

Figure 19:
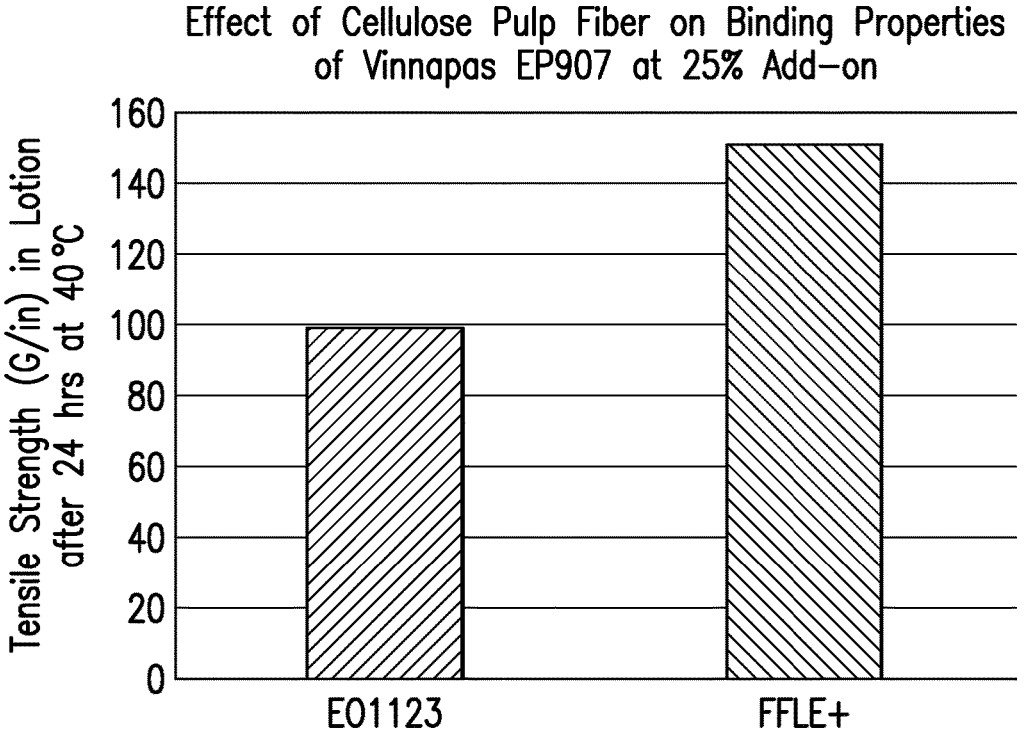
FIG. 19 depicts a graph showing the difference between the measured tensile strengths of Samples 5 and 6 in Example 24. The graph shows the tensile strength (g/in) in lotion after 24 hours at 40° C. (y-axis) for the EO1123 (Sample 5) and FFLE+ (Sample 6) samples (x-axis).

Measurement of the Tensile Strength of Samples 5 and 6:

Fully cured Samples 5 and 6 of the wipe sheets were cut in the cross-machine direction into strips having the width of 1 inch (or 25 mm) and the length of 4 inches (or 100 mm). Each strip was soaked in the lotion squeezed out from Wal-Mart's Parent's Choice baby wipes. The strips were soaked in the lotion for 24 hrs at 40° C. After that the wet strips were tested for their tensile strength using the instrument and the procedure described in Example 23. FIG. 19 illustrates the difference between the measured tensile strengths of Samples 5 and 6. It was discovered that Sample 6 containing the FFLE+ cellulose pulp fiber had a higher wet tensile strength after being soaked in the lotion than the corresponding tensile strength of Sample 5 containing the EO1123 cellulose pulp fiber. This finding means that the FFLE+, which is a modified cellulose pulp fiber, has a positive effect on the binding properties of the Vinnapas EP907 binder compared to the effect exerted by the control EO1123 cellulose pulp fiber.

Figure 20:
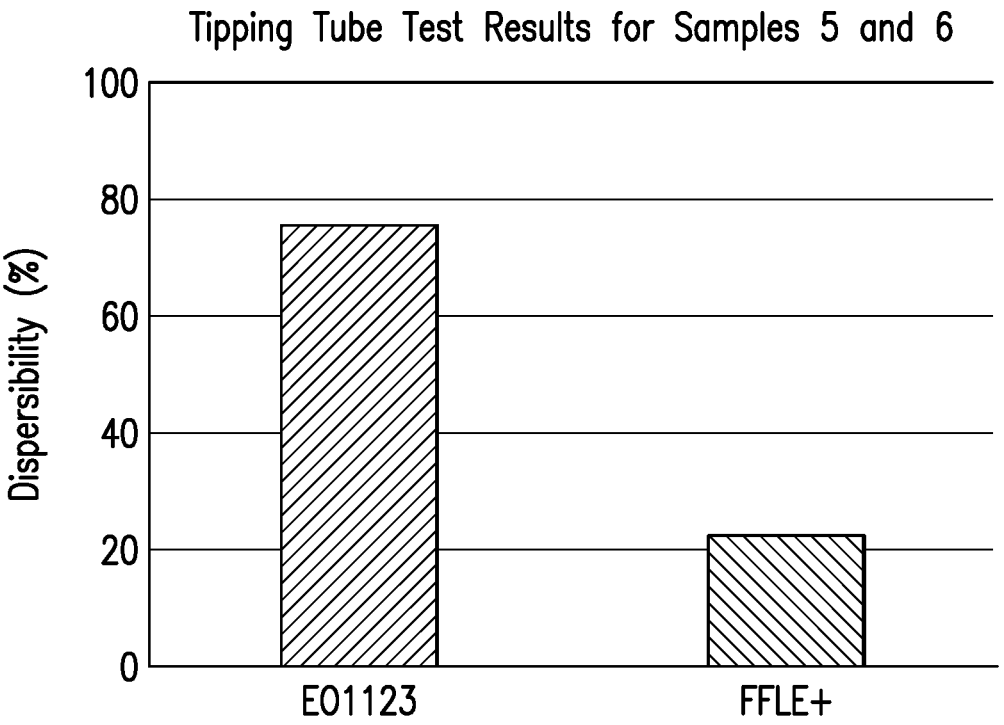
FIG. 20 depicts a graph showing the percentage of the disintegrated material of Samples 5 and 6 which passed through the screen of the Tipping Tube Test apparatus in Example 24. The graph shows the percentage dispersibility (y-axis) for the EO1123 (Sample 5) and FFLE+ (Sample 6) samples (x-axis).

Measurement of Dispersibility of Sample 5 and 6:

The dispersibility of Samples 5 and 6 was measured according to the INDA Guidelines FG 511.2 Dispersibility Tipping Tube Test. Before testing the samples were soaked in the lotion squeezed out from Wal-Mart's Parent's Choice baby wipes. The amount of the lotion used for each sample was 3.5 times the weight of the sample. Each sample had a rectangular shape with the width of 4 inches (or 10.2 cm) and the length of 4 inches (or 10.2 cm). The lotion was added to the sheets, gently massaged into the material and stored overnight. Then the samples were flushed through the test toilet once and collected. They were then placed in the tube of the Dispersibility Tipping Tube Test apparatus. The dispersibility test was carried out using 240 cycles of repeated movements of the tipping tube containing the tested samples. After each test, the sample was placed on a screen and washed with a stream of water as specified by the INDA Guidelines FG 511.2 Dispersibility Tipping Tube Test. The residual material was then collected from the screen and dried at 105° C. for 1 hour. FIG. 20 illustrates the results by showing the percent dispersibility, i.e. the percentage of the disintegrated material of Samples 5 and 6 which passed through the screen of the Tipping Tube Test apparatus. It can be seen that both Samples exhibited relatively high dispersibility. For comparison, regular wipe sheet such as commercial Parent Choice wet wipes has dispersibility of about 0%.

Example 25

Effect of Modified Cellulose Pulp Fiber on Wet Tensile Strength and Dispersibility of Three-Layer Wipe Sheets Bonded with Repulpable VAE Binder Materials: The following main materials were used in the present Example:

(i) EO1123, experimental cellulose pulp fibers used as a control, made by Buckeye Technologies Inc., (ii) FFLE+, commercial modified cellulose pulp fibers in the sheet form made by Buckeye Technologies Inc., (iii) Vinnapas EP907 repulpable binder emulsion supplied by Wacker, and (iv) Trevira 1661 bicomponent binder fiber, 2.2 dtex, 6 mm long.

Pilot-Scale Production of Experimental Wipe Sheets

Samples of wipe sheets were made on a pilot-scale airlaid drum forming line. The target compositions of the prepared samples 7 and 8 are shown in Table 214 and in Table 215.

TABLE 214

| Sample 7 | | | |
|---|---|---|---|
| Dosing System | Raw Material | Basis Weight ($g/m^2$) | Weight % |
| Surface spray 1 | Vinnapas EP907 at 10% solids | 2.3 (dry) | 3.55 |

TABLE 214-continued

| Sample 7 | | | |
|---|---|---|---|
| Dosing System | Raw Material | Basis Weight ($g/m^2$) | Weight % |
| Forming Head 1 | EO1123 pulp | 7.2 | 11.1 |
| | Trevira 1661 | 3.7 | 5.7 |
| Forming Head 2 | EO1123 pulp | 14.3 | 22.0 |
| Forming Head 3 | EO1123 pulp | 28.2 | 43.4 |
| | Trevira 1661 | 6.9 | 10.7 |
| Surface Spray 2 | Vinnapas EP907 at 10% solids | 2.3 (dry) | 3.55 |
| | Total | 65 | 100 |

TABLE 215

| Sample 8 | | | |
|---|---|---|---|
| Dosing System | Raw Material | Basis Weight ($g/m^2$) | Weight % |
| Surface spray 1 | Vinnapas EP907 at 10% solids | 2.3 (dry) | 3.55 |
| Forming Head 1 | FFLE+ pulp | 7.2 | 11.1 |
| | Trevira 1661 | 3.7 | 5.7 |
| Forming Head 2 | FFLE+ pulp | 14.3 | 22.0 |
| Forming Head 3 | FFLE+ pulp | 28.2 | 43.4 |
| | Trevira 1661 | 6.9 | 10.7 |
| Surface Spray 2 | Vinnapas EP907 at 10% solids | 2.3 (dry) | 3.55 |
| | Total | 65 | 100 |

Samples 7 and 8 they were additionally heated in the lab convection oven at 150° C. for 15 min. The caliper of these samples of the wipe sheets varied from about 0.8 mm to about 1.0 mm.

Figure 21:
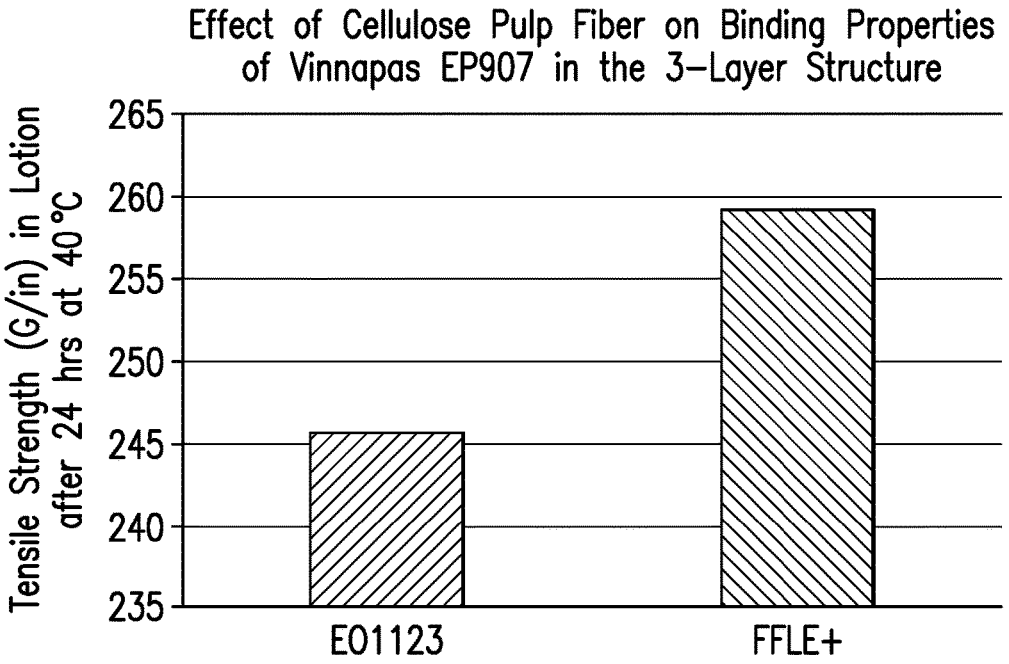
FIG. 21 depicts a graph showing the difference between the measured tensile strengths of Samples 7 and 8 in Example 25. The graph shows the tensile strength (g/in) in lotion after 24 hours at 40° C. (y-axis) for the EO1123 (Sample 7) and FFLE+ (Sample 8) samples (x-axis).

Measurement of the Tensile Strength of Samples 7 and 8:

Samples 7 and 8 of the wipe sheets were cut the cross-machine direction into strips having the width of 1 inch (or 25 mm) and the length of 4 inches (or 100 mm). Each strip was soaked in the lotion squeezed out from Wal-Mart's Parent's Choice baby wipes. The strips were soaked in the lotion for 24 hrs at 40° C. After that the wet strips were tested for their tensile strength using the instrument and the procedure described in Example 23. FIG. 21 illustrates the difference between the measured tensile strengths of Samples 7 and 8. It was found that Sample 8 containing the FFLE+ cellulose pulp fiber had a higher wet tensile strength after being soaked in the lotion than the corresponding tensile strength of Sample 7 containing the EO1123 cellulose pulp fiber. Again, this finding means that FFLE+, which is a modified cellulose pulp fiber, has a positive effect on the binding properties of the Vinnapas EP907 binder compared to the effect exerted by the control EO1123 cellulose pulp fiber. In this case the difference between the effects exerted by the two cellulose pulp fibers was not as pronounced as in Example 2 probably because the total content of the binder Vinnapas EP907 in Samples 7 and 8 was much lower than in Samples 5 and 6.

Figure 22:
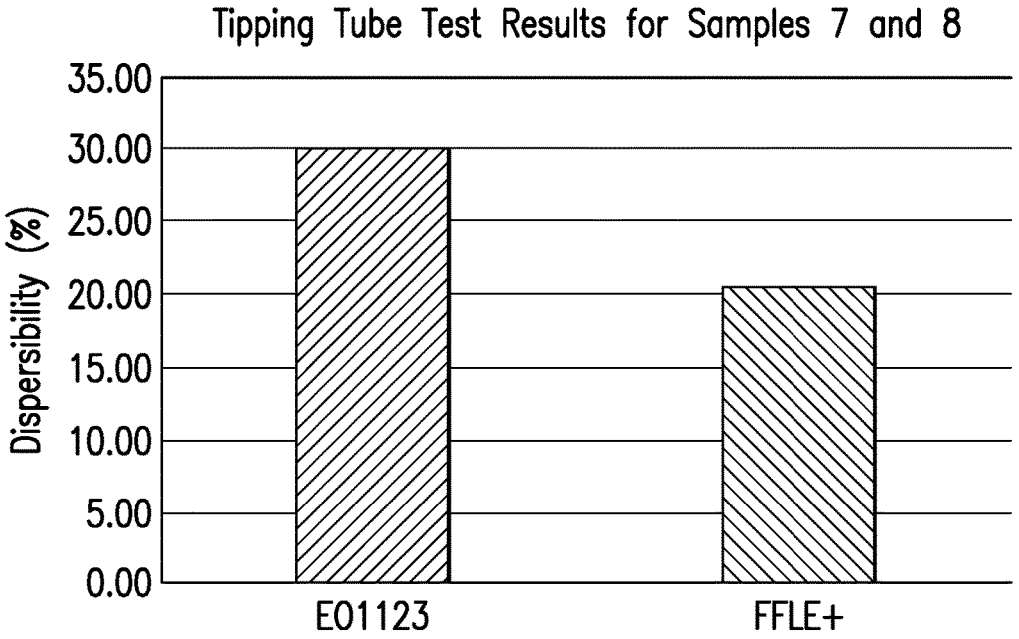
FIG. 22 depicts a graph showing the percentage of the disintegrated material of Samples 7 and 8 which passed through the screen of the Tipping Tube Test apparatus in Example 24. The graph shows the percentage dispersibility (y-axis) for the EO1123 (Sample 7) and FFLE+ (Sample 8) samples (x-axis).

Measurement of Dispersibility of Sample 7 and 8:

The dispersibility of Samples 7 and 8 was measured according to the INDA Guidelines FG 511.2 Dispersibility Tipping Tube Test. The dispersibility test was carried out using 240 cycles of repeated movements of the tipping tube containing the tested samples. FIG. 22 illustrates the results by showing the percent dispersibility, i.e. the percentage of the disintegrated material of Samples 7 and 8 which passed through the sieve of the Tipping Tube Test apparatus. In can be seen that both Samples exhibited relatively high dispersibility.

Example 26

Effect of Cellulose Pulp Fiber Modified with Polycationic Polymers on Wet Tensile Strength of Wipe Sheets Bonded with Repulpable VAE Binder Materials. The following main materials were used in the present Example:

(i) Never-dried, wet cellulose pulp fibers at a consistency of 37%, made by Buckeye Technologies Inc., (ii) Vinnapas EP907 repulpable binder emulsion supplied by Wacker, (iii) Solution of Catiofast 159(A) polyamine polymer supplied by BASF, and (iv) Solution of Catiofast 269 poly(diallyldimethylammonium chloride) supplied by BASF.

Preparation of Modified Cellulose Pulp Fibers

Never-dried, wet cellulose pulp, in an amount of 437 g, was placed in a 5 gallon bucket filled with water and stirred for 10 min. An aqueous solution of Catiofast 159(A) at a concentration of 50% was added in an amount of 14.1 g, to the slurry and the stirring continued for additional 20 min. The resultant slurry was used to make a cellulose pulp sheet on a lab dynamic handsheet former described in Example 23.

Thus made cellulose pulp sheet was pressed and dried in the same manner as described in Example 23.

The above-described procedure was repeated using, in lieu of the solution Catiofast 159(A), an aqueous solution of Catiofast 269 at a concentration of 40% in an amount of 17.7 g. Thus, two modified cellulose pulp sheets were obtained, i.e. Sample 9 containing Catiofast 159(A) and Sample 10 containing Catiofast 269. Sample 1 described in Example 23 was also prepared as an untreated control sample of cellulose pulp sheet.

Preparation of Wipe Sheet Samples

All three cellulose pulp sheets, i.e. Sample 1, 9 and 10 were conditioned and then disintegrated in the same manner as described in Example 1. After disintegration of the cellulose pulp sheets three separate fluff samples were obtained from each individual cellulose pulp sheet Sample. The obtained fluff samples were used for making wipe sheet in the same manner as described in Example 23. Vinnapas EP907 emulsion at solids content of 10% was prepared and 7.50 g of this emulsion was sprayed onto one side of each of the wipe sheets. Each thus treated wipe sheet was then dried in a lab convection oven at 150° C. for 5 min. Next, the other side of each wipe sheet was sprayed with 7.50 g of the 10% Vinnapas EP907 solution and each treated wipe sheet was dried again in the 150° C. oven for 5 min.

Measurement of the Tensile Strength of the Treated Wipe Sheets

Figure 23:
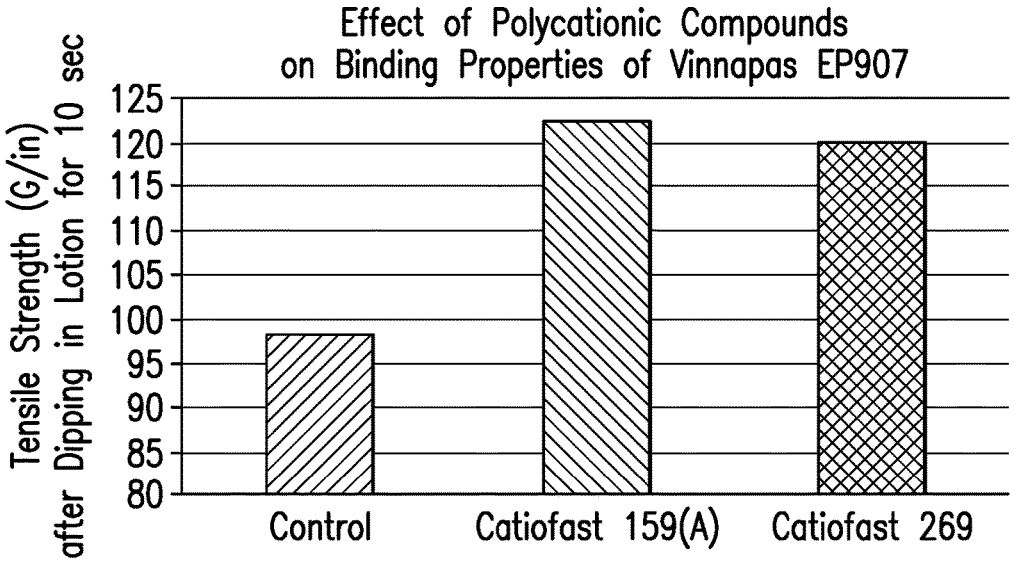
FIG. 23 depicts a graph showing the effect of the Catiofast polymers in the cellulose fiber used for the preparation of the wipe sheets in Example 26 on the tensile strength of the wipe sheets after soaking them in the lotion for 10 seconds. The graph shows the tensile strength (g/in) in dipping in lotion for 10 seconds (y-axis) for the control, Catiofast 159(A), and Catiofast 269 samples (x-axis).

The dried treated wipe sheet samples were then cut into strips having the width of 1 inch (or 25 mm) and the length of 4 inches (or 100 mm). Each strip was soaked for 10 sec in the lotion squeezed out from Wal-Mart's Parent's Choice baby wipes. Immediately after soaking the strip in the lotion for 10 sec its tensile strength was measured in the same manner as described in Example 23. FIG. 23 illustrates the effect of the Catiofast polymers in the cellulose fiber used for the preparation of the wipe sheets on the tensile strength of the wipe sheets after soaking them in the lotion for 10 sec. It has been found that the wipe sheets made with cellulose pulp fibers modified with the Catiofast polymers had higher wet tensile strengths that the wet tensile strength of the wipe sheets made with the control cellulose pulp fibers. The obtained results indicate that cellulose fibers modified with polycationic polymers increase the binding capability of the repulpable VAE binder.

Example 27

Effect of Modified Cellulose Pulp Fiber on Wet Tensile Strength of Wipe Sheets Bonded with Urethane-Based Binder Materials. The following main materials were used in the present Example:

(i) EO1123, experimental cellulose pulp fibers used as a control, made by Buckeye Technologies Inc., (ii) FFLE+, commercial modified cellulose pulp fibers in the sheet form made by Buckeye Technologies Inc., (iii) WD4047 urethane-based binder solution supplied by HB Fuller, Pilot-Scale Production of Experimental Wipe Sheets Samples of wipe sheets were made on a pilot-scale airlaid drum forming line. The target compositions of the prepared samples 11 and 12 are shown in Table 216 and in Table 217.

TABLE 216

| Sample 11 | | | |
|---|---|---|---|
| Dosing System | Raw Material | Basis Weight ($g/m^2$) | Weight % |
| Surface spray 1 | WD4047 at 10% solids | 8.1 (dry) | 12.5 |
| Forming Head 1 | EO1123 pulp | 24.4 | 37.5 |
| Forming Head 2 | EO1123 pulp | 24.4 | 37.5 |
| Surface Spray 2 | WD4047 at 10% solids | 8.1 (dry) | 12.5 |
| | Total | 65 | 100 |

TABLE 217

| Sample 12 | | | |
|---|---|---|---|
| Dosing System | Raw Material | Basis Weight ($g/m^2$) | Weight % |
| Surface spray 1 | WD4047 at 10% solids | 8.1 (dry) | 12.5 |
| Forming Head 1 | FFLE+ pulp | 24.4 | 37.5 |
| Forming Head 2 | FFLE+ pulp | 24.4 | 37.5 |
| Surface Spray 2 | WD4047 at 10% solids | 8.1 (dry) | 12.5 |
| | Total | 65 | 100 |

Samples 11 and 12 were additionally heated in the lab convection oven at 150° C. for 5 min. The caliper of Samples 11 and 12 was measured using an Ames thickness meter, Model #: BG2110-0-04. The caliper of these samples of the wipe sheets varied from about 0.7 mm to about 0.9 mm.

Figure 24:
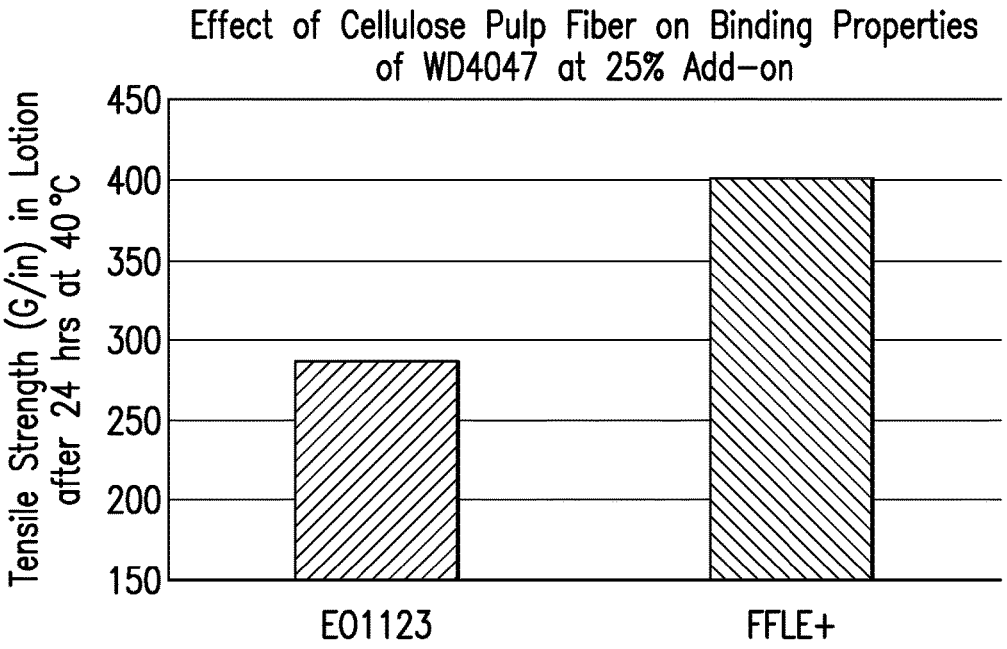
FIG. 24 depicts a graph showing the difference between the measured tensile strengths of Samples 11 and 12 in Example 27. The graph shows the tensile strength (g/in) in lotion after 24 hours at 40° C. (y-axis) for the EO1123 (Sample 11) and FFLE+ (Sample 12) samples (x-axis).

Measurement of the Tensile Strength of Samples 11 and 12:

Samples 11 and 12 of the wipe sheets were cut the cross-machine direction into strips having the width of 1 inch (or 25 mm) and the length of 4 inches (or 100 mm). Each strip was soaked in the lotion squeezed out from Wal-Mart's Parent's Choice baby wipes. The strips were soaked in the lotion for 24 hrs at 40° C. After that the wet strips were tested for their tensile strength using the instrument and the procedure described in Example 23. FIG. 24 illustrates the difference between the measured tensile strengths of Samples 11 and 12. It was found that Sample 12 containing the FFLE+ cellulose pulp fiber had a higher wet tensile strength after being soaked in the lotion than the corresponding tensile strength of Sample 11 containing the EO1123 cellulose pulp fiber. This finding means that FFLE+, which is a modified cellulose pulp fiber, has a stronger effect on the binding properties of the WD4047 binder compared to the effect exerted by the control EO1123 cellulose pulp fiber.

Example 28

Effect of Cellulose Fibers Modified with Glycerol on Wet Tensile Strength of Wipe Sheets Bonded with Cross-Linkable VAE Binder Materials. The following main materials were used in the present Example:

(i) EO1123, experimental cellulose pulp fibers used as a control, made by Buckeye Technologies Inc., (ii) FFLE+, commercial modified cellulose pulp fibers in the sheet form made by Buckeye Technologies Inc., (iii) Dur-O-Set Elite 22LV emulsion of VAE binder supplied by Celanese, (iv) Glycerol, lab grade, assay 99.5%, supplied by Mallinckrodt.

Preparation of Wipe Sheets

EO1123 cellulose pulp fibers in an amount of 4.53 g were soaked in water for about a minute. The resultant moist fiber was then processed in the same way as described in Example 23 to make a wipe sheets, using a lab wet-forming apparatus. After removing excess water with a vacuum component of the lab wet-forming apparatus, the wipe sheets, still moist were sprayed evenly on both sides with a total amount of 7.25 g aqueous solution of glycerol containing 0.25 g. Thus obtained samples of wipe sheets were dried in ambient conditions overnight. Thus prepared wipe sheets were then sprayed on one side with 7.5 g of the emulsion of 10% Dur-O-Set Elite 22LV diluted to 10% solids content. Next, the obtained wipe sheets were cured at 150° C. for 5 min. The other sides of the obtained wipe sheets were also sprayed with 7.5 g of the same binder solution and the wipe sheets were cured again at 150° C. for 5 min.

The above described procedure was repeated using the FFLE+ cellulose pulp fibers instead of the EO1123 cellulose pulp fibers.

Thus Samples 14 and 16 were obtained with target content of glycerol of 3% by the total weight of the wipe sheet Sample.

In addition to the above Samples two control wipe sheet Samples 13 and 15 were prepared using either EO1123 or FFLE+ cellulose pulp fibers, respectively. Instead of using aqueous solutions of glycerol in the above described procedure, only water was used for spraying the wet-formed, still moist wipe sheets. As a result, Samples 13 and 15 did not contain any glycerol. The compositions of the samples thus made are summarized in Table 218.

TABLE 218

| Samples 13-16 | | | |
|---|---|---|---|
| Sample | Raw Material | Basis Weight ($g/m^2$) | Weight % |
| Sample 13 | EO1123 pulp | 48.8 | 75.0 |
| | Dur-O-Set Elite 22LV at 10% solids | 16.2 (dry) | 25.0 |
| | Total | 65.0 | 100 |
| Sample 14 | EO1123 pulp | 48.1 | 71.8 |
| | Glycerol | 2.7 | 4.0 |
| | Dur-O-Set Elite 22LV at 10% solids | 16.2 (dry) | 24.2 |
| | Total | 67.0 | 100 |
| Sample 15 | FFLE+ pulp | 48.8 | 75 |
| | Dur-O-Set Elite 22LV at 10% solids | 16.2 (dry) | 25 |
| | Total | 65.0 | 100 |
| Sample 16 | FFLE+ pulp | 48.1 | 71.8 |
| | Glycerol | 2.7 | 4.0 |
| | Dur-O-Set Elite 22LV at 10% solids | 16.2 (dry) | 24.2 |
| | Total | 67.0 | 100 |

Measurements of the Tensile Strength of Samples 13-16

Figure 25:
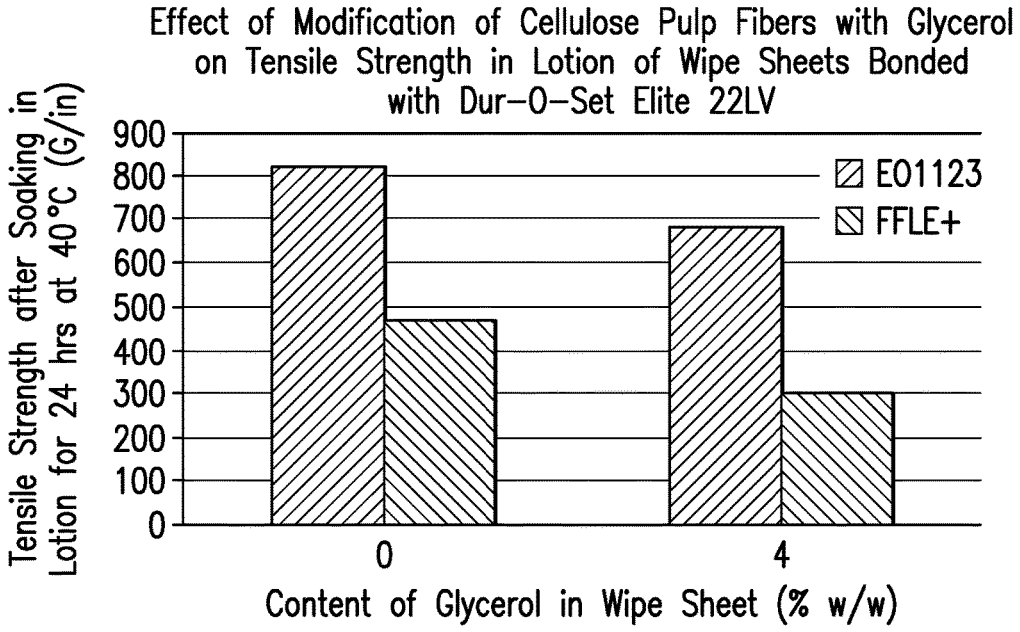
FIG. 25 depicts a graph showing the effect of glycerol in the cellulose pulp fibers used for the preparation of the wipe sheets on the tensile strength of the wipe sheets after soaking them in the lotion for 24 hrs at 40° C. The graph shows the tensile strength (g/in) in lotion after 24 hours at 40° C. (y-axis) versus the content of glycerol in the wipe sheet (% w/w) (x-axis).

Samples 13-16 were cut into strips having the width of 1 inch (or 25 mm) and the length of 4 inches (or 100 mm). Each strip was soaked in the lotion squeezed out from Wal-Mart's Parent's Choice baby wipes. The strips were soaked in the lotion for 24 hrs at 40° C. After that the wet strips were tested for their tensile strength using the instrument and the procedure described in Example 23. FIG. 25 illustrates the effect of glycerol in the cellulose pulp fibers used for the preparation of the wipe sheets on the tensile strength of the wipe sheets after soaking them in the lotion for 24 hrs at 40° C. It has been found that the Samples made with cellulose pulp fibers modified with glycerol had significantly lower tensile strengths than the Samples with no glycerol. It was also found that the FFLE+ modified pulp fibers diminished the tensile strength of the wipe sheets. This discovery provides practical tools to control the binding properties of the cross-linkable VAE binder.

Example 29

Effect of Modified Cellulose Fibers on Wet Tensile Strength and Dispersibility of Wipe Sheets Made as Three-Layer, Unitary Structures, Bonded with Various Binders Materials. The following main materials were used in the present Example:

(i) EO1123, experimental cellulose pulp used as a control, made by Buckeye Technologies Inc., (ii) FFLE+, commercial modified cellulose pulp in the sheet form made by Buckeye Technologies Inc., (iii) Dur-O-Set Elite 22LV emulsion of VAE binder supplied by Celanese, (iv) Michem Prime 4983-45N dispersion of EAA copolymer supplied by Michelman, (v) Trevira 255 bicomponent binder fiber for wetlaid process, 3 dtex, 12 mm long, and (vi) Glycerol, lab grade, supplied by assay 99.5%, supplied by Mallinckrodt.

Preparation of Three-Layer Wipe Sheets:

Each of the two grades of the cellulose pulp fibers, i.e. EO1123 and FFLE+, were soaked in water for 2 days in ambient conditions. Wipe sheet samples were then prepared following the procedures described below.

Sample 19 (1Ba EO)—three-layer wipe sheet made with the EO1123 cellulose pulp fibers, treated with glycerol at a higher add-on level and bonded with Dur-O-Set Elite 22LV and Trevira 255:

First the bottom layer was formed on the custom-made, lab wet-forming apparatus according to the general procedure described in Example 1 but without removing excess water from the sheet after it has been formed. Thus formed bottom layer was set aside. The middle layer was made in the same manner and then placed on top of the bottom layer with applying vacuum suction to combine the two layers into one unitary sheet. The combined two-layer sheet was then set aside. The top layer was made then in the same manner as the two other layers and combined with the already prepared two layer sheet. Thus obtained unitary three-layer sheet was placed on the vacuum suction component of the wet-forming apparatus to remove the remaining excess water. Thus made three layer wipe sheet was dried on the lab drum drier described in Example 23. The dried sheet was then sprayed with 7.26 g of a 3.6% aqueous solution of glycerol and allowed to dry overnight in ambient conditions. Next, 2.67 g of 10% Dur-O-Set Elite 22LV emulsion was sprayed on one side of the sheet and the sample was cured at 150° C. for 5 minutes. Then the other side was also sprayed with 2.67 g of 10% Dur-O-Set Elite 22LV emulsion and cured at 150° C. for 5 minutes. The composition of Sample 19 is shown in Table 9.

Sample 18 (1Bb EO)—three-layer wipe sheet made with the EO1123 cellulose pulp fibers, treated with glycerol at a lower add-on level and bonded with Dur-O-Set Elite 22LV and Trevira 255:

Sample 18 was prepared in the similar manner as described for Sample 19 with the exception of the concentration of the aqueous glycerol solution used for treating this Sample. The concentration of the aqueous glycerol solution used in this procedure was 1.8% instead of 3.6%. The composition of Sample 18 is shown in Table 219.

Sample 17 (1Bc EO)—three-layer wipe sheet made with the EO1123 cellulose pulp fibers, with no glycerol treatment, bonded with Dur-O-Set Elite 22LV:

Sample 17 was prepared in the similar manner as described for Sample 19 but without any treatment with glycerol. In this procedure no glycerol solution was sprayed on the sheet. The composition of Sample 17 is shown in Table 219.

Sample 20—three-layer wipe sheet made with the FFLE+ cellulose pulp fiber, with no glycerol treatment, bonded with Dur-O-Set Elite 22LV and Trevira 255:

Sample 20 was made in the similar manner as Sample 17 except for the use of the FFLE+ cellulose pulp fibers instead of the EO1123 cellulose pulp fibers. The composition of Sample 20 is shown in Table 219.

Sample 21—three-layer wipe sheet made with the FFLE+ cellulose pulp fibers, treated with glycerol at a lower add-on level and bonded with Dur-O-Set Elite 22LV and Trevira 255:

Sample 21 was made in the similar manner as Sample 18 except for the use of the FFLE+ cellulose pulp fibers instead of the EO1123 cellulose pulp fibers. The composition of Sample 21 is shown in Table 219.

Sample 22—three-layer wipe sheet made with the FFLE+ cellulose pulp fibers, treated with glycerol at a higher add-on level and bonded with Dur-O-Set Elite 22LV and Trevira 255:

Sample 22 was made in the similar manner as Sample 19 except for the use of the FFLE+ cellulose pulp fibers instead of the EO1123 cellulose pulp fibers. The composition of Sample 22 is shown in Table 219.

Sample 25 (4a)—three-layer wipe sheet made with the FFLE+ cellulose pulp fibers and bonded with Dur-O-Set Elite 22LV and Trevira 255, wherein the middle layer has been treated with higher add-on level of glycerol:

First the bottom layer was formed on the custom-made, lab wet-forming apparatus according to the general procedure described in Example 1 but without removing excess water from the sheet after it has been formed. Thus formed bottom layer was set aside. The middle layer was made in the same manner and then placed on top of the bottom layer with applying vacuum suction to combine the two layers into one unitary sheet. Next, the side of thus obtained sheet exposing the FFLE+ middle layer was sprayed with 4.5 g of 8.0% glycerine solution in water. Then the top layer was made and combined with the top surface of the glycerol-sprayed side of the previously combined two-layer sheet. The vacuum suction was applied to remove excess water from the combined, now three-layer, unitary sheet. Thus made three-layer wipe sheet was dried on the lab drum drier described in Example 23. The dried sheet was then sprayed on one side with 2.67 g of 10% Michem Prime 4983-45N dispersion and cured at 150 C oven for 5 minutes. The other side was then also sprayed 2.67 g of 10% Michem Prime 4983-45N dispersion and cured at 150 C oven for 5 minutes.

Sample 24 (4b)—three-layer wipe sheet made with the FFLE+ cellulose pulp fibers and bonded with Dur-O-Set Elite 22LV and Trevira 255, wherein the middle layer has been treated with lower add-on level of glycerol:

Sample 24 was prepared in the similar manner as described for Sample 25 with the exception of the concentration of the aqueous glycerol solution used for treating this Sample. The amount of the 8.0% aqueous glycerol solution used in this procedure was 2.25 g instead of 4.5 g. The composition of Sample 24 is shown in Table 219.

Sample 23—three-layer wipe sheet made with the FFLE+ cellulose pulp fibers and bonded with Dur-O-Set Elite 22LV and Trevira 255, wherein the middle layer has not been treated with glycerol:

Sample 23 was prepared in the similar manner as described for Sample 25 with the exception of the liquid used for treating the middle layer of this Sample. The middle layer was treated with 4.5 g water instead of the aqueous solution of glycerol. The composition of Sample 24 is shown in Table 219.

TABLE 219

Samples 17-25

| Sample | Layer | Raw Material | Basis Weight ($g/m^2$) | Weight % |
|---|---|---|---|---|
| Sample 17 | Surface Spray | Dur-O-Set Elite 22LV at 10% solids | 2.9 | 4.0 |
| | Top | EO1123 pulp fibers | 20.9 | 29.1 |
| | | Trevira 255 | 1.1 | 1.5 |
| | Middle | EO1123 pulp fibers | 22.0 | 30.7 |

TABLE 219-continued

Samples 17-25

| Sample | Layer | Raw Material | Basis Weight ($g/m^2$) | Weight % |
|---|---|---|---|---|
| | Bottom | EO1123 pulp fibers | 19.2 | 26.8 |
| | | Trevira 255 | 2.8 | 3.9 |
| | Surface Spray | Dur-O-Set Elite 22LV at 10% solids | 2.9 | 4.0 |
| | | Total | 71.8 | 100 |
| Sample 18 | Surface Spray | Glycerol solution at 1.8% | 1.4 | 1.9 |
| | | Dur-O-Set Elite 22LV at 10% solids | 2.9 | 4.0 |
| | Top | EO1123 pulp fibers | 20.9 | 28.6 |
| | | Trevira 255 | 1.1 | 1.5 |
| | Middle | EO1123 pulp fibers | 22.0 | 30.0 |
| | Bottom | EO1123 pulp fibers | 19.2 | 26.2 |
| | | Trevira 255 | 2.8 | 3.8 |
| | Surface Spray | Dur-O-Set Elite 22LV at 10% solids | 2.9 | 4.0 |
| | | Total | 73.2 | 100 |
| Sample 19 | Surface Spray | Glycerol solution at 3.6% | 2.8 | 3.8 |
| | | Dur-O-Set Elite 22LV at 10% solids | 2.9 | 3.9 |
| | Top | EO1123 pulp fibers | 20.9 | 28.0 |
| | | Trevira 255 | 1.1 | 1.5 |
| | Middle | EO1123 pulp fibers | 22.0 | 29.4 |
| | Bottom | EO1123 pulp fibers | 19.2 | 25.7 |
| | | Trevira 255 | 2.8 | 3.8 |
| | Surface Spray | Dur-O-Set Elite 22LV at 10% solids | 2.9 | 3.9 |
| | | Total | 74.6 | 100 |
| Sample 20 | Surface Spray | Dur-O-Set Elite 22LV at 10% solids | 2.9 | 4.0 |
| | Top | FFLE+ pulp fibers | 20.9 | 29.1 |
| | | Trevira 255 | 1.1 | 1.5 |
| | Middle | FFLE+ pulp fibers | 22.0 | 30.7 |
| | Bottom | FFLE+ pulp fibers | 19.2 | 26.8 |
| | | Trevira 255 | 2.8 | 3.9 |
| | Surface Spray | Dur-O-Set Elite 22LV at 10% solids | 2.9 | 4.0 |
| | | Total | 71.8 | 100 |
| Sample 21 | Surface Spray | Glycerol solution at 1.8% | 1.4 | 1.9 |
| | | Dur-O-Set Elite 22LV at 10% solids | 2.9 | 4.0 |
| | Top | FFLE+ pulp fibers | 20.9 | 28.6 |
| | | Trevira 255 | 1.1 | 1.5 |
| | Middle | FFLE+ pulp fibers | 22.0 | 30.0 |
| | Bottom | FFLE+ pulp fibers | 19.2 | 26.2 |
| | | Trevira 255 | 2.8 | 3.8 |
| | Surface Spray | Dur-O-Set Elite 22LV at 10% solids | 2.9 | 4.0 |
| | | Total | 73.2 | 100 |
| Sample 22 | Surface Spray | Glycerol solution at 3.6% | 2.8 | 3.8 |
| | | Dur-O-Set Elite 22LV at 10% solids | 2.9 | 3.9 |
| | Top | FFLE+ pulp fibers | 20.9 | 28.0 |
| | | Trevira 255 | 1.1 | 1.5 |
| | Middle | FFLE+ pulp fibers | 22.0 | 29.4 |
| | Bottom | FFLE+ pulp fibers | 19.2 | 25.7 |
| | | Trevira 255 | 2.8 | 3.8 |
| | Surface Spray | Dur-O-Set Elite 22LV at 10% solids | 2.9 | 3.9 |
| | | Total | 74.6 | 100 |
| Sample 23 | Surface Spray | Michem Prime 4983-45N at 10% solids | 2.9 | 4.0 |
| | Top | FFLE+ pulp fibers | 20.9 | 29.1 |
| | | Trevira 255 | 1.1 | 1.5 |
| | Middle | FFLE+ pulp fibers | 22.0 | 30.7 |

TABLE 219-continued

| Samples 17-25 | | | | |
|---|---|---|---|---|
| Sample | Layer | Raw Material | Basis Weight ($g/m^2$) | Weight % |
| | Bottom | FFLE+ pulp fibers | 19.2 | 26.8 |
| | | Trevira 255 | 2.8 | 3.9 |
| | Surface Spray | Michem Prime 4983-45N at 10% solids | 2.9 | 4.0 |
| | | Total | 71.8 | 100 |
| Sample 24 | Surface Spray | Michem Prime 4983-45N at 10% solids | 2.9 | 4.0 |
| | Top | FFLE+ pulp fibers | 20.9 | 28.6 |
| | | Trevira 255 | 1.1 | 1.5 |
| | Middle | FFLE+ pulp fibers | 22.0 | 30.0 |
| | | Glycerol solution at 8% | 1.4 | 1.9 |
| | Bottom | FFLE+ pulp fibers | 19.2 | 26.2 |
| | | Trevira 255 | 2.8 | 3.8 |
| | Surface Spray | Michem Prime 4983-45N at 10% solids | 2.9 | 4.0 |
| | | Total | 73.2 | 100 |
| Sample 25 | Surface Spray | Michem Prime 4983-45N at 10% solids | 2.9 | 3.9 |
| | Top | FFLE+ pulp fibers | 20.9 | 28.0 |
| | | Trevira 255 | 1.1 | 1.5 |
| | Middle | FFLE+ pulp fibers | 22.0 | 29.40 |
| | | Glycerol solution at 8% | 2.8 | 3.8 |
| | Bottom | FFLE+ pulp fibers | 19.2 | 25.7 |
| | | Trevira 255 | 2.8 | 3.8 |
| | Surface Spray | Michem Prime 4983-45N at 10% solids | 2.9 | 3.9 |
| | | Total | 74.6 | 100 |

Measurements of the Tensile Strength of Samples 17-25

Figure 26:
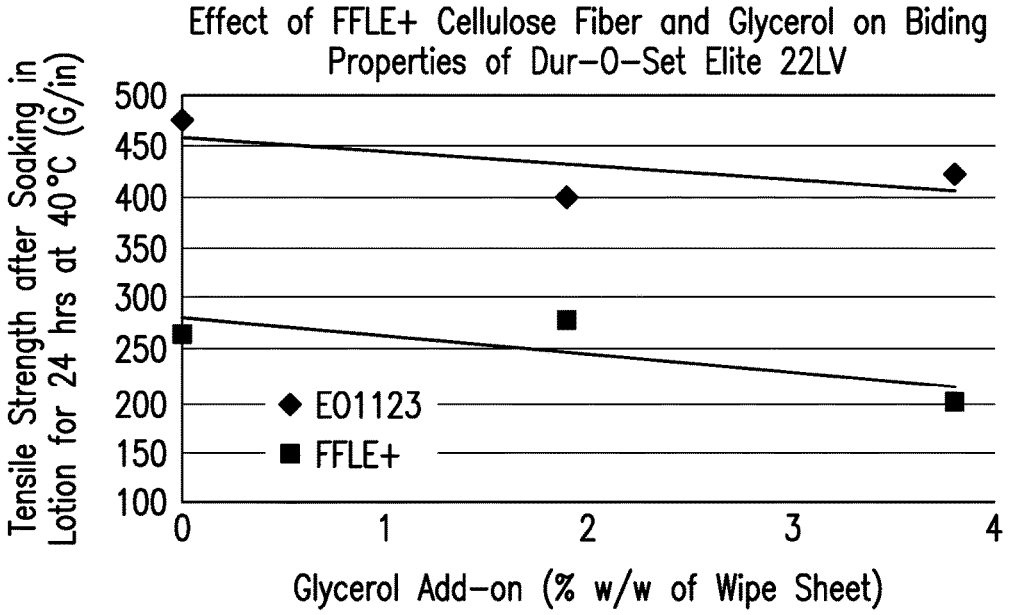
FIG. 26 depicts a graph showing the effect of glycerol in the cellulose pulp fibers and the effect of the grade of the cellulose pulp fibers used for the preparation of the wipe sheets on the tensile strength of the wipe sheet Samples 17-22 after soaking them in the lotion for 24 hrs at 40° C. The graph shows the tensile strength (g/in) in lotion after 24 hours at 40° C. (y-axis) versus glycerol add-on (% w/w of the wipe sheet) (x-axis).
Figure 27:
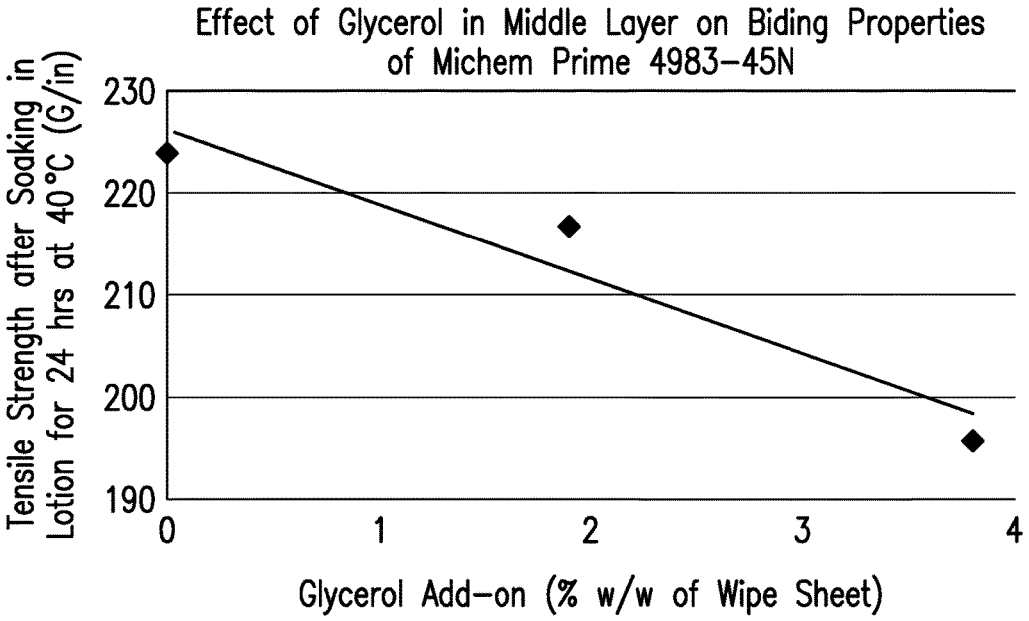
FIG. 27 depicts a graph showing the effect of glycerol in the middle layer of Samples 23-25 on their tensile strength after soaking the three-layer wipe sheets in the lotion for 24 hrs at 40° C. The graph shows the tensile strength (g/in) in lotion after 24 hours at 40° C. (y-axis) versus glycerol add-on (% w/w of the wipe sheet) (x-axis).

Samples 17-25 were cut into strips having the width of 1 inch (or 25 mm) and the length of 4 inches (or 100 mm). Each strip was soaked in the lotion squeezed out from Wal-Mart's Parent's Choice baby wipes. The strips were soaked in the lotion for 24 hrs at 40° C. After that the wet strips were tested for their tensile strength using the instrument and the procedure described in Example 23. FIG. 26 illustrates the effect of glycerol in the cellulose pulp fibers and the effect of the grade of the cellulose pulp fibers used for the preparation of the wipe sheets on the tensile strength of the wipe sheet Samples 17-22 after soaking them in the lotion for 24 hrs at 40° C. It has been found that both glycerol treatment and the use of FFLE+ cellulose pulp fibers decreased the tensile strengths of the wipe sheets. The combined effect of the FFLE+ cellulose and glycerol was in this respect surprisingly high. FIG. 27 illustrates the effect of glycerol in the middle layer of Samples 23-25 on their tensile strength after soaking the three-layer wipe sheets in the lotion for 24 hrs at 40° C. It was found that glycerol can be used to control the tensile strength of the wipe sheets bonded with a thermoplastic binder.

Measurement of Dispersibility of Samples 17-25

Figure 28:
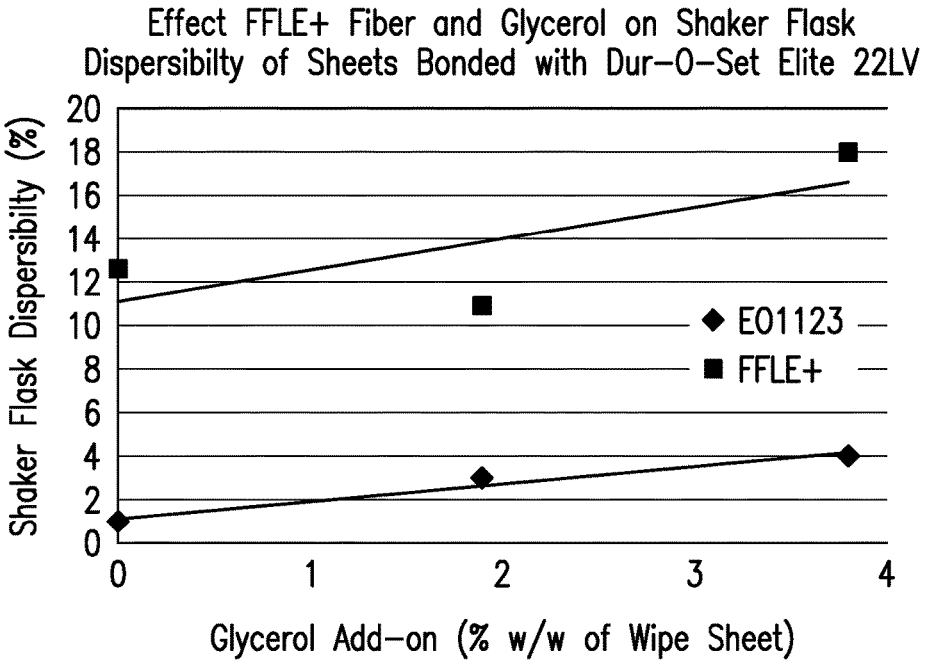
FIG. 28 depicts a graph showing the results by showing the percent dispersibility of Samples 17-22 in Example 29. The graph shows % shaker flask dispersibility (y-axis) versus glycerol add-on (% w/w of the wipe sheet) (x-axis).
Figure 29:
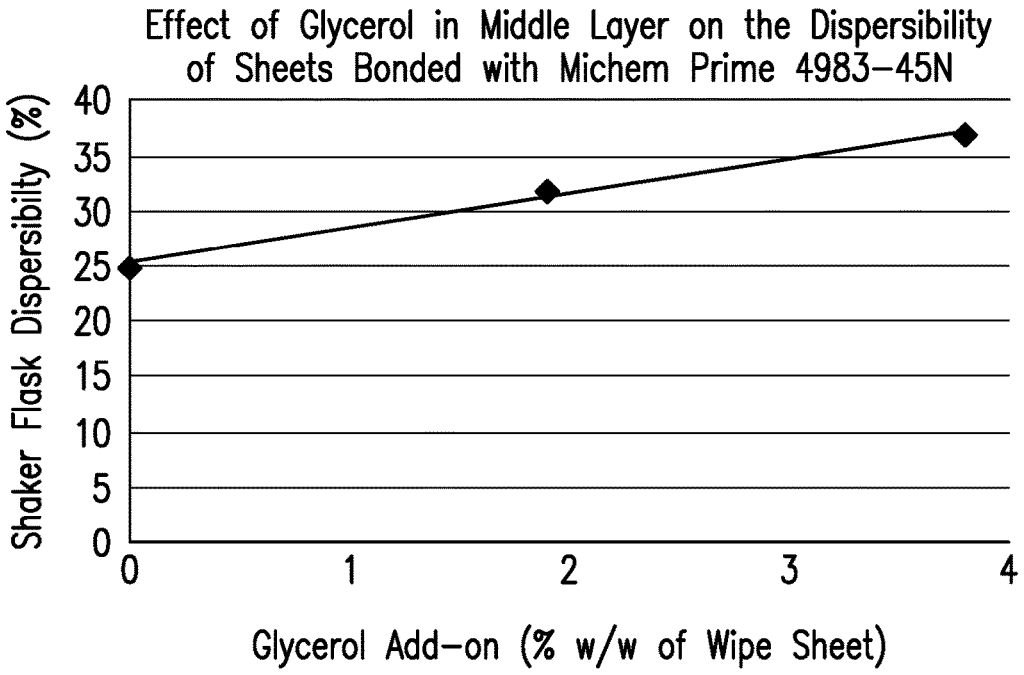
FIG. 29 depicts a graph showing the effect of glycerol in the middle layer of the three-layer sheets of Samples 23-25 on their dispersibility.

The dispersibility of Samples 17-25 was measured following the INDA Guidelines FG511.1 Tier 1 Dispersibility Shake Flask Test. Before testing the samples were soaked in the lotion squeezed out from Wal-Mart's Parent's Choice baby wipes. The amount of the lotion used for each sample was 3.5 times the weight of the sample. Each sample had a rectangular shape with the width of 4 inches (or 10.2 cm) and the length of 7.25 inches (or 18.4 cm). The lotion was added to the sheets, gently massaged into the material and stored overnight. Then the samples were flushed through the test toilet once and collected. They were then placed in the shake flask on the Shake Flask apparatus. The flask contained 1000 mL of water and rotated at a speed of 150 rpm for 6.0 hours. After 6 hours of shaking, the samples were washed on the screen as prescribed in the INDA Guidelines and as described in Example 24. The residual material was then collected from the screen and dried at 105° C. for 1 hour. FIG. 28 illustrates the results by showing the percent dispersibility, i.e. the percentage of the disintegrated material of Samples 17-22, which passed through the screen. It was found that the FFLE+ modified cellulose pulp fibers and modification of the cellulose pulp fibers with glycerol can be used as tools to control the dispersibility of the wipe sheets. FIG. 29 shows the effect of glycerol in the middle layer of the three-layer sheets of Samples 23-25 on their dispersibility. It was found that using glycerol in the middle layer of the three-layer wipe sheets made with FFLE+ cellulose pulp fibers and bonded with the thermoplastic binder allowed for getting the desired balance between their tensile strength in the lotion and their dispersibility.

Example 30

Dispersible Wipes Via a Wetlaid Process

Wipes according to the invention were prepared and tested for various parameters including basis weight and wet tensile strength. Handsheets (12"×12") consisting of three strata were made via a wetlaid process in the following manner using the Buckeye Wetlaid Handsheet Former as shown in FIG. 17.

Figure 38:
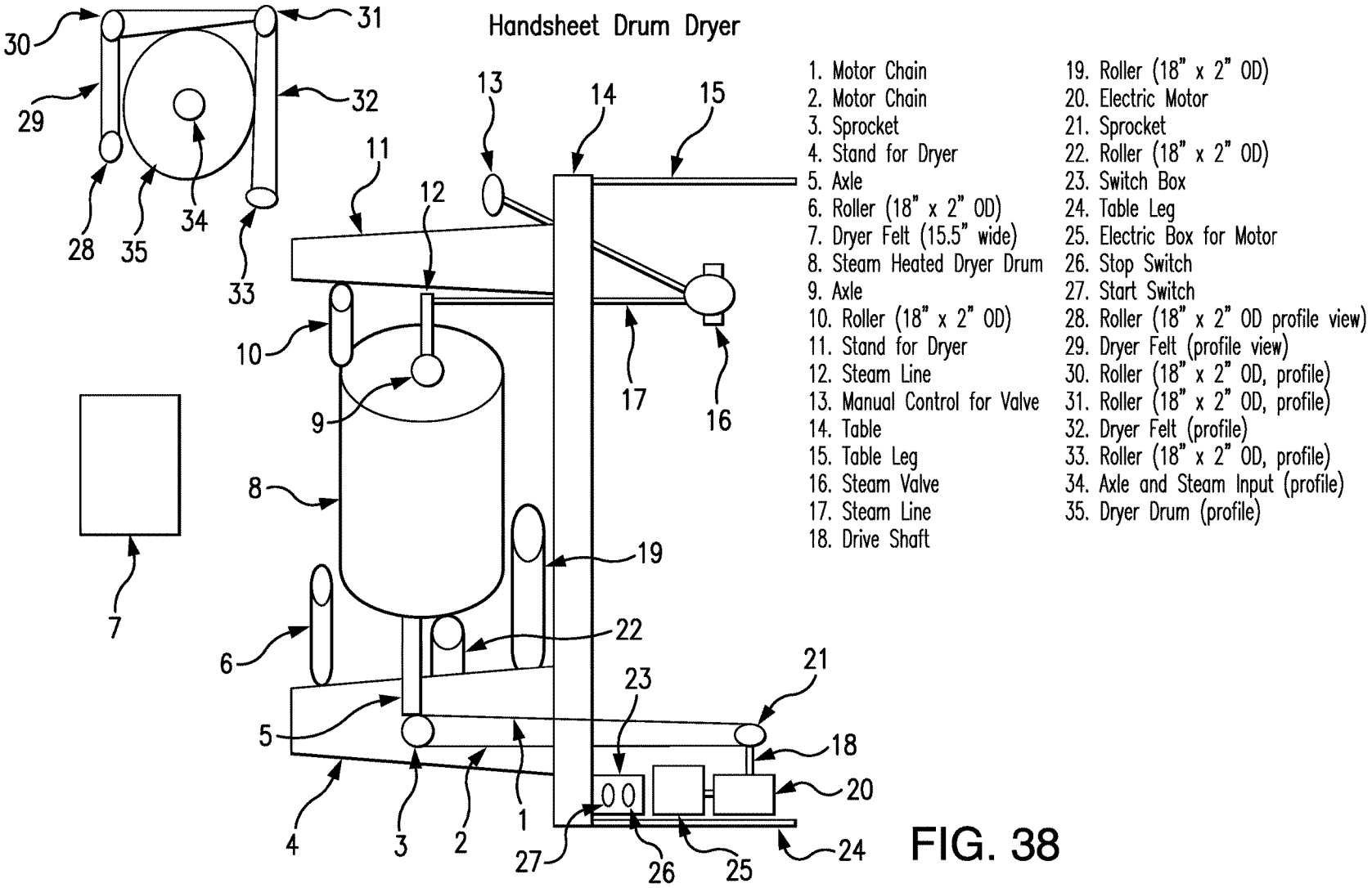
FIG. 38 depicts a schematic of the Buckeye Handsheet Drum Dryer.

METHODS/MATERIALS: The fibers comprising the individual layers were weighed out and allowed to soak overnight in room temperature tap water. The fibers of each individual layer were then slurried using the Tappi disintegrator for 25 counts. The fibers were then added to the Buckeye Wetlaid Handsheet Former handsheet basin and the water was evacuated through a screen at the bottom forming the handsheet. This individual stratum, while still on the screen, was then removed from the Buckeye Wetlaid Handsheet Former handsheet former basin. The second stratum (middle layer) were made by this same process and the wet handsheet on the screen was carefully laid on top of the first stratum (bottom layer). The two strata, while still on the screen used to form the first stratum, were then drawn across a low pressure vacuum (2.5 in. Hg) with the first stratum facing downward over the course of approximately 10 seconds. This low pressure vacuum was applied to separate the second stratum (middle layer) from the forming screen and to bring the first stratum and second stratum into intimate contact. The third stratum (top layer) was made by the same process as the first and second stratum. The third stratum, while still on the forming screen, was placed on top of the second stratum, which is atop the first stratum. The three strata were then drawn across the low pressure vacuum (2.5 in. Hg) with the first stratum still facing downward over the course of approximately 5 seconds. This low pressure vacuum was applied to separate the third stratum (top layer) from the forming screen and bring the second stratum and third stratum into intimate contact. The three strata, with the first stratum downwards and in contact with the forming screen, were then drawn across a high vacuum (8.0 in. Hg) to remove more water from the three layer structure. The three layer structure, while still on the forming screen, was then run through the Buckeye Handsheet Drum Dryer shown in FIG. 38 with the screen facing away from the drum for approximately 50 seconds at a temperature of approximately 260° F. to remove additional moisture and further consolidate the web. The three layer structure was then cured in a static air oven at approximately 150° C. for 5 minutes to cure the bicomponent fiber. The three layer structure was then cooled to room temperature. Wacker Vinnapas EP907 was then sprayed to one side of the structure at a level of 2.60 grams via a 10% solids solution and the structure was cured for 5 minutes in a 150° C. static oven. Wacker Vinnapas EP907 was then sprayed to the opposite side of the structure at a level of 2.60 grams via a 10% solids solution and the structure was cured again for 5 minutes in a static oven. Five different samples were prepared. Samples 40, 41, 42 and 43 are three layer designs made by the wetlaid process on a handsheet former. The compositions of the samples are given in Tables 220-223 below.

TABLE 220

Sample 40 Furnish with 0% Bicomponent Fiber in Middle Layer

| | Raw Material | Basis Weight (gsm) | Weight Percent |
|---|---|---|---|
| | Wacker EP907 | 2.8 | 3.9% |
| Layer 1 | FOLEY FLUFFS | 19.6 | 27.4% |
| | Trevira T255 12 mm Bicomponent Fiber | 2.4 | 3.4% |
| Layer 2 | FOLEY FLUFFS | 22.0 | 30.7% |
| | Trevira T255 12 mm Bicomponent Fiber | 0.0 | 0.0% |
| Layer 3 | FOLEY FLUFFS | 18.6 | 26.0% |
| | Trevira T255 12 mm Bicomponent Fiber | 3.4 | 4.7% |
| | Wacker EP907 | 2.8 | 3.9% |
| | TOTAL | 71.6 | |

TABLE 221

Sample 41 Furnish with 4.5% Bicomponent Fiber in Middle Layer

| | Raw Material | Basis Weight (gsm) | Weight Percent |
|---|---|---|---|
| | Wacker EP907 | 2.8 | 3.9% |
| Layer 1 | FOLEY FLUFFS | 19.6 | 27.4% |
| | Trevira T255 12 mm Bicomponent Fiber | 2.4 | 3.4% |
| Layer 2 | FOLEY FLUFFS | 21.0 | 29.3% |
| | Trevira T255 12 mm Bicomponent Fiber | 1.0 | 1.4% |
| Layer 3 | FOLEY FLUFFS | 18.6 | 26.0% |
| | Trevira T255 12 mm Bicomponent Fiber | 3.4 | 4.7% |
| | Wacker EP907 | 2.8 | 3.9% |
| | TOTAL | 71.6 | |

TABLE 222

Sample 42 Furnish with 5.9% Bicomponent Fiber in Middle Layer

| | Raw Material | Basis Weight (gsm) | Weight Percent |
|---|---|---|---|
| | Wacker EP907 | 2.8 | 3.9% |
| Layer 1 | FOLEY FLUFFS | 19.6 | 27.4% |
| | Trevira T255 12 mm Bicomponent Fiber | 2.4 | 3.4% |
| Layer 2 | FOLEY FLUFFS | 20.7 | 28.9% |
| | Trevira T255 12 mm Bicomponent Fiber | 1.3 | 1.8% |

TABLE 222-continued

Sample 42 Furnish with 5.9% Bicomponent Fiber in Middle Layer

| | Raw Material | Basis Weight (gsm) | Weight Percent |
|---|---|---|---|
| Layer 3 | FOLEY FLUFFS | 18.6 | 26.0% |
| | Trevira T255 12 mm Bicomponent Fiber | 3.4 | 4.7% |
| | Wacker EP907 | 2.8 | 3.9% |
| | TOTAL | 71.6 | |

TABLE 223

Sample 43 Furnish with 9.1% Bicomponent Fiber in Middle Layer

| | Raw Material | Basis Weight (gsm) | Weight Percent |
|---|---|---|---|
| | Wacker EP907 | 2.8 | 3.9% |
| Layer 1 | FOLEY FLUFFS | 19.6 | 27.4% |
| | Trevira T255 12 mm Bicomponent Fiber | 2.4 | 3.4% |
| Layer 2 | FOLEY FLUFFS | 20.0 | 27.9% |
| | Trevira T255 12 mm Bicomponent Fiber | 2.0 | 2.8% |
| Layer 3 | FOLEY FLUFFS | 18.6 | 26.0% |
| | Trevira T255 12 mm Bicomponent Fiber | 3.4 | 4.7% |
| | Wacker EP907 | 2.8 | 3.9% |
| | TOTAL | 71.6 | |

RESULTS: Samples of each composition were made and tested. Product lot analysis was carried out on each roll. The results of the product lot analysis are provided in Table 224. The Buckeye Wetlaid Handsheet Former does not impart machine or cross direction to the sample, so all tensile strength values in Table 224 are non-directional.

TABLE 224

Product Lot Analysis

| Sample | Basis Weight (gsm) | Caliper (mm) | Wet Tensile Strength (gli) |
|---|---|---|---|
| 40A | 72 | 1.02 | 242 |
| 40B | 71 | 1.00 | 239 |
| 40C | 71 | 0.96 | 225 |
| 40 Average | 71 | 0.99 | 235 |
| 41A | 72 | 1.02 | 304 |
| 41B | 71 | 0.96 | 278 |
| 41C | 73 | 1.04 | 318 |
| 41 Average | 72 | 1.01 | 300 |
| 42A | 69 | 1.22 | |
| 42B | 71 | 1.14 | |
| 42C | 68 | 1.12 | |
| 42 Average | 69 | 1.16 | |
| 43A | 75 | 0.88 | 401 |
| 43B | 69 | 0.88 | 352 |
| 43C | 69 | 0.80 | 318 |
| 43 Average | 71 | 0.85 | 357 |

Figure 30:
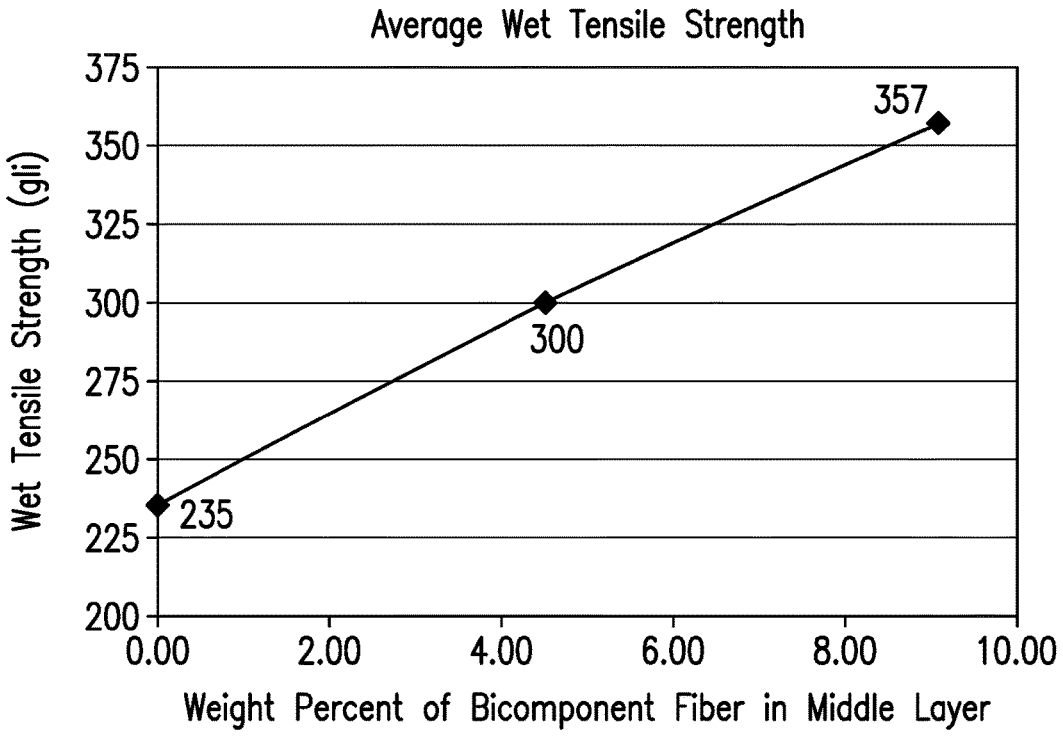
FIG. 30 depicts a graph showing the average wet tensile strength of the wipes prepared by the wetlaid process in Example 30. The graph shows the wet tensile strength (y-axis) versus the weight percent of bicomponent fiber in the middle layer (x-axis).

The composition of the two outer layers and the binder add-on of each sample were held constant. The only change in composition was in the middle layer where the ratio of pulp fiber to bicomponent fiber was varied. As the level of bicomponent fiber in the middle layer was increased from 0% to 9.1% of the overall weight in the middle layer, the wet tensile strength increased. The increase in wet tensile strength versus the weight percent of bicomponent fiber in the middle layer is plotted in FIG. 30 with the average value of the three samples for each design being used.

Example 31

Dispersibility Tipping Tube Test and Column Settling Test

The INDA Guidelines FG 511.2 Dispersibility Tipping Tube Test, from which the delamination test data is obtained, and the INDA Guidelines FG 512.1 Column Settling Test were carried out on the samples prepared in Example 30 to test the effect of varying the amount of bicomponent fiber in the middle layer.

METHODS/MATERIALS: The samples used were Sample 40-43 from Example 30. The INDA Guidelines FG 511.2 Dispersibility Tipping Tube Test, the delamination test which uses the INDA Guidelines FG 511.2 Dispersibility Tipping Tube Test, and the INDA Guidelines FG 512.1 Column Settling Test were carried out as detailed in Example 4.

Figure 31:
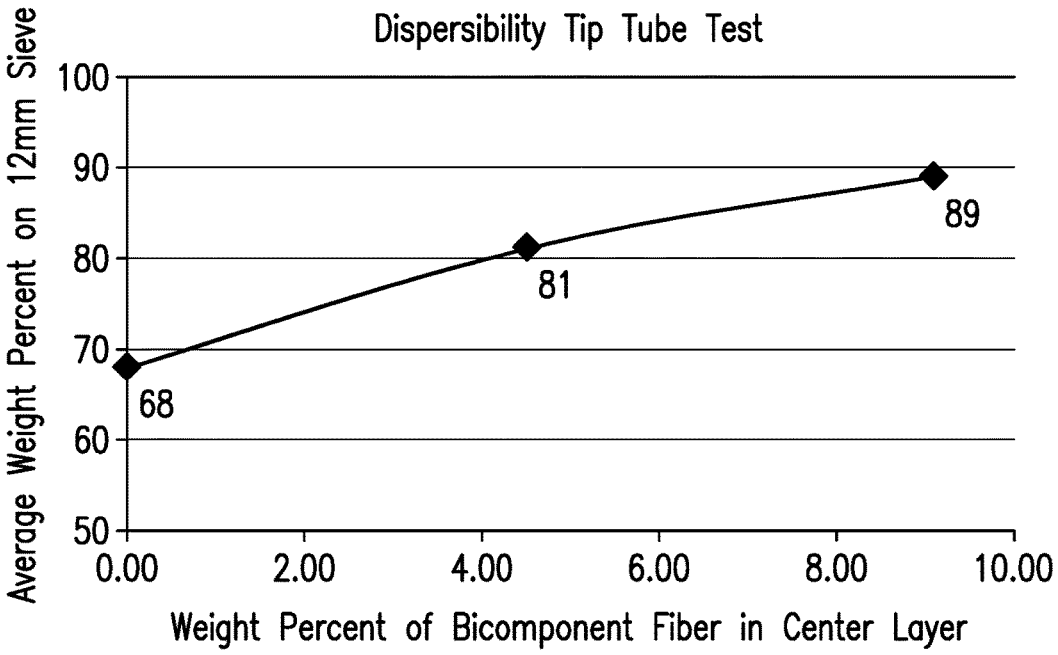
FIG. 31 depicts a graph showing the results of the dispersibility Tip Tube test in Example 31. The graph shows the average weight percent of material left on the 12 mm sieve (y-axis) versus the weight percent of bicomponent fiber in the central layer (x-axis).

RESULTS: The results of the INDA Guidelines FG 511.2 Dispersibility Tipping Tube Test are shown in Table 225 below. The summarized average results of the INDA Guidelines FG 511.2 Dispersibility Tipping Tube Test are shown in Table 226 and plotted in FIG. 31. The results of the INDA FG512.1 Column Settling Test are show in Table 227 below.

TABLE 225

Delamination testing using INDA Guidelines FG 511.2 Dispersibility Tipping Tube Test

| Sample | Layer or Total | Weight % retained on the 12 mm Sieve |
|---|---|---|
| 40A | A | 33 |
| | B | 35 |
| | Total | 68 |
| 40B | A | 33 |
| | B | 35 |
| | Total | 68 |
| 40° C. | A | 34 |
| | B | 34 |
| | Total | 68 |
| 41A | A | 42 |
| | B | 39 |
| | Total | 81 |
| 41B | A | 39 |
| | B | 43 |
| | Total | 82 |
| 41C | A | 42 |
| | B | 39 |
| | Total | 81 |
| 42A | A | 44 |
| | B | 44 |
| | Total | 88 |
| 42B | A | 43 |
| | B | 44 |
| | Total | 87 |
| 42C | A | 42 |
| | B | 42 |
| | Total | 84 |
| 43A | A | 44 |
| | B | 45 |
| | Total | 89 |
| 43B | A | 45 |
| | B | 44 |
| | Total | 89 |

TABLE 225-continued

Delamination testing using INDA Guidelines FG 511.2 Dispersibility Tipping Tube Test

| Sample | Layer or Total | Weight % retained on the 12 mm Sieve |
|---|---|---|
| 43C | A | 46 |
| | B | 43 |
| | Total | 89 |

TABLE 226

Summarized Averages of Delamination testing using INDA Guidelines FG 511.2 Dispersibility Tipping Tube Test

| Sample | Average Weight % Retained on 12 mm Sieve |
|---|---|
| 40 Layer A | 33 |
| 40 Layer B | 35 |
| 40 Total | 68 |
| 41 Layer A | 41 |
| 41 Layer B | 40 |
| 41 Total | 81 |
| 42 Layer A | 43 |
| 42 Layer B | 43 |
| 42 Total | 86 |
| 43 Layer A | 45 |
| 43 Layer B | 44 |
| 43 Total | 89 |

TABLE 227

INDA Guidelines FG 512.1 Column Settling Test

| Grade | Sample 40 | Sample 41 | Sample 43 |
|---|---|---|---|
| Bicomponent Fiber Weight Percent in the middle layer | 0 | 4.5 | 9.1 |
| Sample Size | 4 × 4" | 4 × 4" | 4 × 4" |
| Settling Column Test (min) | 1.02 | 0.82 | 1.07 |

RESULTS: Samples 40, 41 and 43 all passed the INDA Guidelines FG 512.1 Column Settling Test with a time of about 1 minute.

Sample 40, with no bicomponent fiber in the middle layer, had an average of 68 weight percent of material retained on the 12 mm sieve. Sample 41, with 4.5% by weight of bicomponent fiber in the middle layer, had an average of 81 weight percent of material retained on the 12 mm sieve. Sample 42, with 5.9% by weight of bicomponent fiber in the middle layer, had an average of 86 weight percent of material retained on the 12 mm sieve. Sample 43, with 9.1% by weight of bicomponent fiber in the middle layer, had an average of 89 weight percent of material retained on the 12 mm sieve.

DISCUSSION: A comparison of Samples 40, 41, 42 and 43 shows that the addition of bicomponent fiber into the middle layer has a significant negative impact on performance in the FG 511.2 Dispersibility Tip Tube test. The addition of bicomponent fiber at these low levels into the middle layer did not completely prevent delamination. Sample 40, having no bicomponent fiber in the middle layer, had the best performance with 68% of the material retained on the 12 mm sieve. Sample 41, with the lowest addition level of bicomponent fiber in the middle layer, had a significant drop in performance with 81% of the material retained on the 12 mm sieve.

Example 32

High Strength Flushable Dispersible Wipes with 4 Layers

Wipes according to the invention were prepared and tested for various parameters including basis weight, caliper, FG510.1 Toilet Bowl and Drainline Clearance Test, using the United States criteria of a low flush volume 6 liter toilet using a 100 mm inside diameter drainline pipe set at a 2% slope over a distance of 75 feet, after 24 hours of aging in lotion expressed from Wal-Mart Parents Choice Baby Wipes as shown in FIG. 33, FG511.1 Shake Flask Test after 24 hours of aging in lotion expressed from Wal-Mart Parents Choice Baby Wipes, FG511.2 Dispersibility Tipping Tube Test after 24 hours of aging in lotion expressed from Wal-Mart Parents Choice Baby Wipes, FG512.1 Column Settling Test after 24 hours of aging in lotion expressed from Wal-Mart Parents Choice Baby Wipes, FG521.1 Laboratory Household Pump Test after 24 hours of aging in lotion expressed from Wal-Mart Parents Choice Baby Wipes, cross direction wet strength after a quick dip in lotion expressed from Wal-Mart Parents Choice Baby Wipe lotion and cross direction wet strength after about 24 hours of aging in lotion expressed from Wal-Mart Parents Choice Baby Wipes at a temperature of 40° C.

METHODS/MATERIALS: Samples 1000 was made on a commercial scale airlaid line. The composition of Sample 1000 is given in Table 228. The type and level of raw materials for this sample was set to influence the physical properties and flushable-dispersible properties.

TABLE 228

Sample 1000

| Layer | Raw Materials | Basis Weight (gsm) | Weight % |
|---|---|---|---|
| Top | Dow NW 1845K | 2.45 | 3.77 |
| 1 | Trevira Merge 1661 T 255 bicomponent fiber, 2.2 dtex × 8 mm | 4.08 | 6.28 |
| | Weyerhaeuser Bleached Kraft Pulp NB 405 | 7.09 | 10.9 |
| | Buckeye Technologies FF TAS pulp | 15.62 | 24.03 |
| 2 | Weyerhaeuser Bleached Kraft Pulp NB 405 | 7.44 | 11.45 |
| | Buckeye Technologies FF TAS pulp | 3.04 | 4.67 |
| 3 | Weyerhaeuser Bleached Kraft Pulp NB 405 | 3.37 | 5.19 |
| | Buckeye Technologies FF TAS pulp | 6.27 | 9.64 |
| 4 | Weyerhaeuser Bleached Kraft Pulp NB 405 | 2.7 | 4.15 |
| | Buckeye Technologies FF TAS pulp | 6.41 | 9.87 |
| | Trevira Merge 1661 T 255 bicomponent fiber, 2.2 dtex × 8 mm | 4.08 | 6.28 |
| Bottom | Dow NW 1845K | 2.45 | 3.77 |
| | Total | 65 | 100 |

RESULTS: Product lot analysis was carried out on each sample. Basis weight, caliper, cross directional wet tensile strength in lotion in an aging study FG510.1 Toilet Bowl Drainline Clearance test, FG511.1 Dispersibility Shake Flask test, FG511.2 Dispersibility Tipping Tube test, FG521.1 Laboratory Household Pump Test and FG512.1 Column Settling test were done after aging in lotion for about 24 hours.

The results of the product lot analysis for basis weight, caliper and machine direction dry strength are given in Table 229. The results of the product lot analysis for cross directional wet strength with a quick dip (1-2 seconds) and about 24 hours aging in Wal-Mart Parents Choice Lotion are given in Tables 230-231.

The results of the product lot analysis for FG511.1 Dispersibility Shake Flask test after about 24 hours of aging in lotion expressed from Wal-Mart Parents Choice Baby Wipes is given in Table 232. The results of the product lot analysis for FG511.2 Dispersibility Tipping Tube test after about 24 hours of aging in lotion expressed from Wal-Mart Parents Choice Baby Wipes is given in Table 233. The results of the product lot analysis for FG512.1 Column Settling test after about 24 hours of aging in lotion expressed from Wal-Mart Parents Choice Baby Wipes is given in Table 234. The results of the product lot analysis for FG510.1 Toilet Bowl Drainline Clearance test, using the United States criteria of a low flush volume 6 liter toilet using a 100 mm inside diameter drainline pipe set at a 2% slope over a distance of 75 feet, after about 24 hours of aging in lotion expressed from Wal-Mart Parents Choice Baby Wipes using 7.87"× 5.12" wipes is given in Tables 235 and 236 and FIG. 32. The results of the product lot analysis for FG521.1 Laboratory Household Pump Test after about 24 hours of aging in lotion expressed from Wal-Mart Parents Choice Baby Wipes using 7.87"×5.12" wipes is given in Table 237.

TABLE 229

Sample 1000 Physical Properties

| Sample 1000 | Caliper (mm) | Basis Weight (gsm) | MDD (gli) | Normalized MDD (gli) | Elongation (%) |
|---|---|---|---|---|---|
| Sample 1000-1 | 0.93 | 64.3 | 697 | 745 | 25 |
| Sample 1000-2 | 0.87 | 63.4 | 627 | 635 | 22 |
| Sample 1000-3 | 0.93 | 66.5 | 776 | 802 | 24 |
| Sample 1000-4 | 0.85 | 62.8 | 735 | 735 | 24 |
| Sample 1000-5 | 0.92 | 68.4 | 848 | 843 | 24 |
| Sample 1000-6 | 0.86 | 64.0 | 760 | 754 | 24 |
| Sample 1000-7 | 0.88 | 65.9 | 783 | 772 | 26 |
| Sample 1000-8 | 0.87 | 65.3 | 758 | 746 | 22 |
| Sample 1000-9 | 0.85 | 64.0 | 744 | 730 | 24 |
| Sample 1000-10 | 0.88 | 64.9 | 731 | 732 | 25 |

TABLE 230

Quick Dip in Lotion

| Sample 1000 | Caliper (mm) | Basis Weight (gsm) | CDW (gli) | Normalized CDW (gli) | Elongation (%) |
|---|---|---|---|---|---|
| Sample 1000-11 | 0.92 | 66.7 | 257 | 262 | 37 |
| Sample 1000-12 | 0.88 | 64.6 | 239 | 240 | 29 |
| Sample 1000-13 | 0.82 | 64.2 | 262 | 247 | 38 |
| Sample 1000-14 | 0.89 | 65.9 | 256 | 256 | 31 |
| Sample 1000-15 | 0.84 | 63.4 | 260 | 254 | 36 |
| Sample 1000-16 | 0.89 | 66.9 | 254 | 250 | 33 |
| Sample 1000-17 | 0.90 | 65.2 | 258 | 263 | 39 |
| Sample 1000-18 | 0.86 | 63.6 | 241 | 241 | 30 |
| Sample 1000-19 | 0.86 | 64.4 | 247 | 244 | 34 |
| Sample 1000-20 | 0.84 | 64.8 | 248 | 238 | 39 |

TABLE 231

| 24 Hour Aging in Lotion | | | | | |
|---|---|---|---|---|---|
| Sample 1000 | Caliper (mm) | Basis Weight (gsm) | CDW (gli) | Normalized CDW (gli) | Elongation (%) |
| Sample 1000-21 | 1.01 | 69.0 | 278 | 301 | 17 |
| Sample 1000-22 | 0.90 | 67.1 | 250 | 248 | 20 |
| Sample 1000-23 | 0.81 | 63.6 | 169 | 159 | 29 |
| Sample 1000-24 | 0.87 | 69.5 | 259 | 239 | 17 |
| Sample 1000-25 | 0.90 | 72.0 | 238 | 220 | 16 |
| Sample 1000-26 | 0.94 | 72.4 | 218 | 209 | 15 |
| Sample 1000-27 | 0.89 | 70.9 | 276 | 256 | 17 |
| Sample 1000-28 | 0.91 | 71.6 | 256 | 240 | 18 |
| Sample 1000-29 | 0.86 | 67.9 | 290 | 271 | 18 |
| Sample 1000-30 | 0.88 | 64.9 | 271 | 271 | 18 |

TABLE 232

| FG511.1 Dispersibility Shake Flask Test After About 24 hours of Aging | |
|---|---|
| Sample 1000 | FG511.1 Shake Flask Test (percent remaining on 12 mm sieve) |
| Sample 1000-31 | 95.8 |
| Sample 1000-32 | 99.6 |
| Sample 1000-33 | 100.0 |
| Sample 1000-34 | 97.3 |
| Sample 1000-35 | 99.6 |

TABLE 233

| FG511.2 Dispersibility Tipping Tube Test After About 24 hours of Aging | | |
|---|---|---|
| Sample 1000 | Basis Weight (gsm) | FG511.1 Shake Flask Test (percent remaining on 12 mm sieve) |
| Sample 1000-36 | 65 | 85.8 |
| Sample 1000-37 | 65 | 92.8 |
| Sample 1000-38 | 65 | 87.9 |
| Sample 1000-39 | 65 | 87.9 |
| Sample 1000-40 | 65 | 84.2 |

TABLE 234

| FG511.1 Column Settling Test After About 24 hours of Aging | |
|---|---|
| Sample 1000 | Time (seconds) |
| Sample 1000-41 | 146 |
| Sample 1000-42 | 134 |
| Sample 1000-43 | 150 |

TABLE 235

| Sample 1000-44 FG510.1 Toilet Bowl Drainline Clearance Test After About 24 Hours of Aging | | | |
|---|---|---|---|
| Flush Number | Distance Traveled Per Flush (feet) | | Center of Mass (feet traveled) |
| 1 | 49 | | 49 |
| 2 | 54 | 75 | 65 |
| 3 | 75 | 75 | 75 |
| 4 | 75 | | 75 |
| 5 | 75 | | 75 |
| 6 | 75 | | 75 |
| 7 | 75 | | 75 |
| 8 | 54 | | 54 |
| 9 | 54 | 75 | 65 |

TABLE 235-continued

| Sample 1000-44 FG510.1 Toilet Bowl Drainline Clearance Test After About 24 Hours of Aging | | | |
|---|---|---|---|
| Flush Number | Distance Traveled Per Flush (feet) | | Center of Mass (feet traveled) |
| 10 | 57 | 75 | 66 |
| 11 | | 75 | 75 |

TABLE 236

| Sample 1000-45 FG510.1 Toilet Bowl Drainline Clearance Test After About 24 Hours of Aging | | | |
|---|---|---|---|
| Flush Number | Distance Traveled Per Flush (feet) | | Center of Mass (feet traveled) |
| 1 | 54 | | 54 |
| 2 | 75 | 75 | 75 |
| 3 | 75 | | 75 |
| 4 | 63 | | 63 |
| 5 | 75 | 75 | 75 |
| 6 | 75 | | 75 |
| 7 | 59 | | 59 |
| 8 | 75 | 75 | 75 |
| 9 | 75 | | 75 |
| 10 | 75 | | 75 |
| 11 | | | |

TABLE 237

| FG521.1 Laboratory Household Pump Test - 7 Day Testing Cycle | | | |
|---|---|---|---|
| Test Property | Sample 1000-46 | Sample 1000-47 | Sample 1000-48 |
| Sample Size | 200 mm × 130 mm | 200 mm × 130 mm | 200 mm × 130 mm |
| Sample Weight (gsm) | 65 | 65 | 65 |
| Sample Weight (grams) | 1.78 | 1.78 | 1.78 |
| Total Wipes through Toilet | 140 | 140 | 140 |
| Wipes Stuck in Valve (gram equivalent) | 0 | 0 | 0 |
| Grams of Wipes in Pump Basin | 35.4 | 11.4 | 10.1 |
| Wipe in Pump Basin | 20 | 6 | 6 |
| Wipes Making it Through System (%) | 85.8 | 95.4 | 95.9 |
| Wipes Making it Through System | 120 | 134 | 134 |

TABLE 238

| FG521.1 Laboratory Household Pump Test - 28 Day Testing Cycle | | | |
|---|---|---|---|
| Test Property | Sample 1000-49 | Sample 1000-50 | Sample 1000-51 |
| Sample Size | 200 mm × 130 mm | 200 mm × 130 mm | 200 mm × 130 mm |
| Sample Weight (gsm) | 65 | 65 | 65 |
| Sample Weight (grams) | 1.78 | 1.78 | 1.78 |
| Total Wipes through Toilet | 560 | 560 | 560 |
| Wipes Stuck in Valve (gram equivalent) | 0 | 0 | 0 |
| Grams of Wipes in Pump Basin | 14.5 | 13.2 | 6.0 |
| Wipe Equivalents in Pump Basin | 8 | 7 | 3 |
| Wipes Making it Through System (%) | 98.5 | 98.7 | 99.4 |
| Wipes Making it Through System | 552 | 553 | 557 |

DISCUSSION: Samples 1000-11 to Samples 1000-20 had a normalized average cross directional wet tensile strength after a 1-2 second dip in lotion of about 250 gli as shown in Table 230. Samples 1000-21 to Samples 1000-30 had a normalized average cross directional wet tensile strength after about 24 hours of aging in lotion of 241 gli as shown in Table 231. A comparison of the average cross directional wet tensile strength after a 1-2 second dip in lotion versus a 24 hour aging in lotion showed a drop in strength of about 4%. These results show that Sample 1000 essentially stopped degrading in lotion after about 24 hours, with a total drop in cross directional wet strength from the 1-2 second dip to the 24 hour aging in lotion of about 4%, indicating good stability in lotion.

Samples 1000-31 to 1000-35, aged in lotion for about 24 hours at 40° C., all failed the FG511.1 Shake Flask Test with an average of 98.5% of fiber remaining on the 12 mm sieve as shown in Table 232. Samples 1000-36 to 1000-40, aged in lotion about 24 hours at 40° C., all failed the FG511.2 Dispersibility Tipping Tube Test with an average of 87.7% of fiber remaining on the 12 mm sieve as shown in Table 233.

Samples 1000-41 to 1000-43, aged in lotion about 24 hours at 40° C., all passed the FG511.1 Settling Column Test with an average time of 143 seconds as shown in Table 234.

Figure 32:
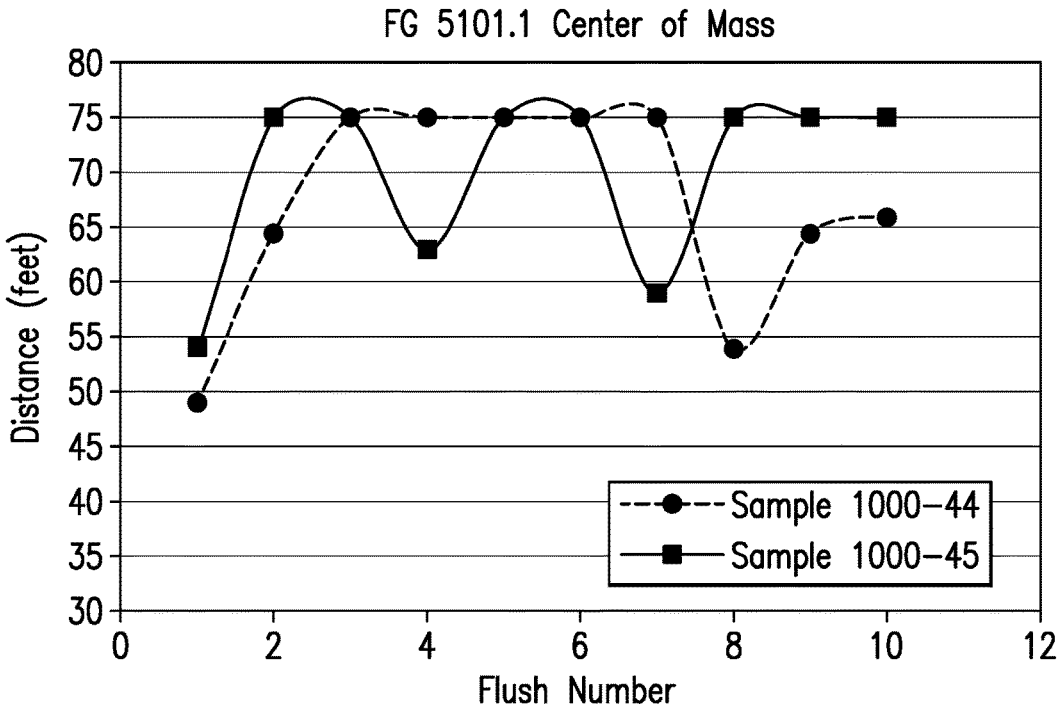
FIG. 32 depicts a graph showing the center of mass for Sample 1000-44 and Sample 1000-45. The graph shows distance in feet (y-axis) versus the number of flushes (x-axis).

Samples 1000-44 and 1000-45, aged in lotion about 24 hours at 40° C., passed the FG510.1 Toilet Bowl Drainline Clearance Test, North American protocol as shown in Tables 235 and 236 and FIG. 32. There was no consecutive downward trend in the center of mass for five flushes for either sample.

Samples 1000-46 to 1000-48, aged in lotion about 24 hours at 40° C., did not have any plugging of the toilet, pump or valve during the FG521.1 Laboratory Household Pump Test 7-day testing cycle. All of these samples had wipes remaining in the basin at the end of the 7-day testing cycle so a 28-day test was required to determine performance. Samples 1000-46 to 1000-48 had an average of about 11 wipes left in the basin at the end of the 7-day testing cycle.

Sample 1000-49 to 1000-51, aged in lotion about 24 hours at 40° C., did not have any plugging of the toilet, pump or valve during the FG521.1 Laboratory Household Pump Test 28-day testing cycle. All of these samples had wipes remaining in the basin at the end of the 28-day testing cycle. Samples 1000-49 to 1000-51 had an average of about 6 wipes left in the basin at the end of the 28-day testing cycle.

The amount of wipes left in the basin after the 28-day testing cycle was equivalent to or less than the amount of wipes left in the basin after the 7-day testing cycle which indicates that there is no build-up of wipes over time, thus these Samples all pass the FG521.1 Laboratory Household Pump Test.

Example 33

High Strength Binders for Flushable Dispersible Wipes

Wipes according to the invention were prepared and tested for various parameters including basis weight, caliper, cross direction wet strength after a quick dip in lotion expressed from Wal-Mart Parents Choice Baby Wipe lotion and cross direction wet strength after about 1 hour, 6 hours, 1 day, 3 days, 7 days, 14 days, 21 days and 28 days of aging in lotion expressed from Wal-Mart Parents Choice Baby Wipes at a temperature of 40° C.

METHODS/MATERIALS: Sample 172-1 to 172-90 were all made on an airlaid pilot line. The composition of samples 172-1 to 172-90 with Dow KSR8758 binder are given in Table 238. The type and level of raw materials for these samples were varied to influence the physical properties and flushable-dispersible properties. All of the samples were cured at 175 C in a pilot line through air oven.

TABLE 238

Sample 172 (Dow KSR8758 Binder and No Bicomponent Fiber)

| | | Sample number | | | | | | | | | |
|---|---|---|---|---|---|---|---|---|---|---|---|
| | | 172-1 | | 172-2 | | 172-3 | | 172-4 | | 172-5 | |
| Layer | Raw Materials | Basis Weight (gsm) | Weight % | Basis Weight (gsm) | Weight % | Basis Weight (gsm) | Weight % | Basis Weight (gsm) | Weight % | Basis Weight (gsm) | Weight % |
| Top | Dow KSR8758 | 10.8 | 16.1 | 10.4 | 17.6 | 11.2 | 17.0 | 11.4 | 18.1 | 11.2 | 18.6 |
| 1 | Buckeye Technologies EO1123 pulp | 45.3 | 67.8 | 38.3 | 64.7 | 43.6 | 66.1 | 40.4 | 63.8 | 37.9 | 62.8 |
| Bottom | Dow KSR8758 | 10.8 | 16.1 | 10.4 | 17.6 | 11.2 | 17.0 | 11.4 | 18.1 | 11.2 | 18.6 |
| | Total | 66.8 | 100.0 | 59.2 | 100.0 | 65.9 | 100.0 | 63.2 | 100.0 | 60.3 | 100.0 |

| | Sample | | | | | | | | | | | | | |
|---|---|---|---|---|---|---|---|---|---|---|---|---|---|---|
| | 172-6 | | 172-7 | | 172-8 | | 172-9 | | 172-10 | | 172-11 | | 172-12 | |
| Layer | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % |
| Top | 10.4 | 15.9 | 11.3 | 17.7 | 10.0 | 16.2 | 11.7 | 18.4 | 11.2 | 18.6 | 10.7 | 16.9 | 10.8 | 16.3 |
| 1 | 44.8 | 68.3 | 41.5 | 64.7 | 41.9 | 67.6 | 40.3 | 63.3 | 37.9 | 62.8 | 41.9 | 66.1 | 44.4 | 67.3 |
| Bottom | 10.4 | 15.9 | 11.3 | 17.7 | 10.0 | 16.2 | 11.7 | 18.4 | 11.2 | 18.6 | 10.7 | 16.9 | 10.8 | 16.3 |
| Total | 65.7 | 100.0 | 64.1 | 100.0 | 62.0 | 100.0 | 63.6 | 100.0 | 60.4 | 100.0 | 63.4 | 100.0 | 65.9 | 100.0 |

TABLE 238-continued

Sample 172 (Dow KSR8758 Binder and No Bicomponent Fiber)

| | Sample | | | | | | | | | | | | | |
|---|---|---|---|---|---|---|---|---|---|---|---|---|---|---|
| | 172-13 | | 172-14 | | 172-15 | | 172-16 | | 172-17 | | 172-18 | | 172-19 | |
| Layer | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % |
| Top | 10.1 | 15.8 | 11.4 | 17.8 | 10.5 | 16.6 | 10.7 | 16.8 | 11.2 | 18.4 | 11.4 | 18.4 | 11.3 | 17.7 |
| 1 | 43.5 | 68.4 | 41.3 | 64.4 | 42.3 | 66.8 | 42.4 | 66.5 | 38.4 | 63.2 | 39.3 | 63.2 | 41.3 | 64.6 |
| Bottom | 10.1 | 15.8 | 11.4 | 17.8 | 10.5 | 16.6 | 10.7 | 16.8 | 11.2 | 18.4 | 11.4 | 18.4 | 11.3 | 17.7 |
| Total | 63.6 | 100.0 | 64.2 | 100.0 | 63.3 | 100.0 | 63.8 | 100.0 | 60.8 | 100.0 | 62.1 | 100.0 | 64.0 | 100.0 |

| | Sample | | | | | | | | | | | | | |
|---|---|---|---|---|---|---|---|---|---|---|---|---|---|---|
| | 172-20 | | 172-21 | | 172-22 | | 172-23 | | 172-24 | | 172-25 | | 172-26 | |
| Layer | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % |
| Top | 10.6 | 16.6 | 10.1 | 15.5 | 11.3 | 17.5 | 11.1 | 17.9 | 10.8 | 16.3 | 10.9 | 17.6 | 10.4 | 16.4 |
| 1 | 43.0 | 66.9 | 44.7 | 64.8 | 42.0 | 64.6 | 40.0 | 62.3 | 44.9 | 66.6 | 40.1 | 61.8 | 42.5 | 63.4 |
| Bottom | 10.6 | 16.6 | 10.1 | 15.5 | 11.3 | 17.5 | 11.1 | 17.9 | 10.8 | 16.3 | 10.9 | 17.6 | 10.4 | 16.4 |
| Total | 64.3 | 100.0 | 64.8 | 100.0 | 64.6 | 100.0 | 62.3 | 100.0 | 66.6 | 100.0 | 61.8 | 100.0 | 63.4 | 100.0 |

| | Sample | | | | | | | | | | | | | |
|---|---|---|---|---|---|---|---|---|---|---|---|---|---|---|
| | 172-27 | | 172-28 | | 172-29 | | 172-30 | | 172-31 | | 172-32 | | 172-33 | |
| Layer | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % |
| Top | 10.1 | 16.5 | 11.1 | 18.6 | 11.1 | 17.5 | 9.0 | 15.1 | 11.0 | 16.8 | 10.8 | 16.7 | 10.6 | 17.6 |
| 1 | 41.1 | 67.0 | 37.5 | 62.9 | 41.2 | 65.0 | 41.4 | 69.8 | 43.5 | 66.4 | 42.7 | 66.5 | 39.1 | 64.9 |
| Bottom | 10.1 | 16.5 | 11.1 | 18.6 | 11.1 | 17.5 | 9.0 | 15.1 | 11.0 | 16.8 | 10.8 | 16.7 | 10.6 | 17.6 |
| Total | 61.3 | 100.0 | 59.7 | 100.0 | 63.3 | 100.0 | 59.4 | 100.0 | 65.6 | 100.0 | 64.2 | 100.0 | 60.3 | 100.0 |

| | Sample | | | | | | | | | | | | | |
|---|---|---|---|---|---|---|---|---|---|---|---|---|---|---|
| | 172-34 | | 172-35 | | 172-36 | | 172-37 | | 172-38 | | 172-39 | | 172-40 | |
| Layer | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % |
| Top | 10.4 | 16.8 | 11.1 | 18.1 | 10.5 | 16.6 | 10.0 | 15.9 | 10.4 | 16.9 | 11.0 | 17.1 | 10.7 | 17.2 |
| 1 | 41.0 | 66.4 | 39.3 | 63.9 | 42.5 | 66.8 | 43.0 | 68.3 | 41.0 | 66.3 | 42.3 | 65.8 | 40.8 | 65.5 |
| Bottom | 10.4 | 16.8 | 11.1 | 18.1 | 10.5 | 16.6 | 10.0 | 15.9 | 10.4 | 16.9 | 11.0 | 17.1 | 10.7 | 17.2 |
| Total | 61.8 | 100.0 | 61.6 | 100.0 | 63.5 | 100.0 | 62.9 | 100.0 | 61.8 | 100.0 | 64.3 | 100.0 | 62.3 | 100.0 |

| | Sample | | | | | | | | | | | | | |
|---|---|---|---|---|---|---|---|---|---|---|---|---|---|---|
| | 172-41 | | 172-42 | | 172-43 | | 172-44 | | 172-45 | | 172-46 | | 172-47 | |
| Layer | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % |
| Top | 11.2 | 17.6 | 10.1 | 15.5 | 10.8 | 16.9 | 10.9 | 16.9 | 10.1 | 15.7 | 10.3 | 16.3 | 11.0 | 17.2 |
| 1 | 41.1 | 63.5 | 45.2 | 65.4 | 42.3 | 63.9 | 42.7 | 64.5 | 44.2 | 64.4 | 42.4 | 63.0 | 42.3 | 64.4 |
| Bottom | 11.2 | 17.6 | 10.1 | 15.5 | 10.8 | 16.9 | 10.9 | 16.9 | 10.1 | 15.7 | 10.3 | 16.3 | 11.0 | 17.2 |
| Total | 63.5 | 100.0 | 65.4 | 100.0 | 63.9 | 100.0 | 64.5 | 100.0 | 64.4 | 100.0 | 63.0 | 100.0 | 64.4 | 100.0 |

TABLE 238-continued

Sample 172 (Dow KSR8758 Binder and No Bicomponent Fiber)

| | Sample | | | | | | | | | | | | | |
|---|---|---|---|---|---|---|---|---|---|---|---|---|---|---|
| | 172-48 | | 172-49 | | 172-50 | | 172-51 | | 172-52 | | 172-53 | | 172-54 | |
| Layer | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % |
| Top | 11.7 | 18.7 | 10.9 | 17.6 | 10.4 | 15.8 | 11.0 | 17.3 | 11.9 | 17.7 | 11.5 | 17.7 | 11.3 | 17.5 |
| 1 | 39.2 | 62.6 | 40.3 | 64.9 | 45.1 | 68.4 | 41.5 | 65.4 | 43.5 | 64.7 | 42.1 | 64.6 | 43.0 | 65.6 |
| Bottom | 11.7 | 18.7 | 10.9 | 17.6 | 10.4 | 15.8 | 11.0 | 17.3 | 11.9 | 17.7 | 11.5 | 17.7 | 11.3 | 17.5 |
| Total | 62.7 | 100.0 | 62.1 | 100.0 | 65.9 | 100.0 | 63.5 | 100.0 | 67.2 | 100.0 | 65.1 | 100.0 | 65.5 | 100.0 |

| | Sample | | | | | | | | | | | | | |
|---|---|---|---|---|---|---|---|---|---|---|---|---|---|---|
| | 172-55 | | 172-56 | | 172-57 | | 172-58 | | 172-59 | | 172-60 | | 172-61 | |
| Layer | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % |
| Top | 11.7 | 17.5 | 12.3 | 18.2 | 11.9 | 17.6 | 11.6 | 17.7 | 11.3 | 17.2 | 11.2 | 17.3 | 10.6 | 16.7 |
| 1 | 43.8 | 65.1 | 42.8 | 63.6 | 43.8 | 64.8 | 42.3 | 64.6 | 43.1 | 65.6 | 42.1 | 65.3 | 42.3 | 66.7 |
| Bottom | 11.7 | 17.5 | 12.3 | 18.2 | 11.9 | 17.6 | 11.6 | 17.7 | 11.3 | 17.2 | 11.2 | 17.3 | 10.6 | 16.7 |
| Total | 67.2 | 100.0 | 67.4 | 100.0 | 67.6 | 100.0 | 65.5 | 100.0 | 65.6 | 100.0 | 64.4 | 100.0 | 63.4 | 100.0 |

| | Sample | | | | | | | | | | | |
|---|---|---|---|---|---|---|---|---|---|---|---|---|
| | 172-62 | | 172-63 | | 172-64 | | 172-65 | | 172-66 | | 172-67 | |
| Layer | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % |
| Top | 11.4 | 17.8 | 11.3 | 18.1 | 10.9 | 16.8 | 11.0 | 17.0 | 10.1 | 15.5 | 11.0 | 16.6 |
| 1 | 41.2 | 64.5 | 39.8 | 63.9 | 42.8 | 66.3 | 42.7 | 66.1 | 45.2 | 69.1 | 44.1 | 66.8 |
| Bottom | 11.4 | 17.8 | 11.3 | 18.1 | 10.9 | 16.8 | 11.0 | 17.0 | 10.1 | 15.5 | 11.0 | 16.6 |
| Total | 64.0 | 100.0 | 62.3 | 100.0 | 64.6 | 100.0 | 64.6 | 100.0 | 65.4 | 100.0 | 66.1 | 100.0 |

| | Sample | | | | | | | | | | | | | |
|---|---|---|---|---|---|---|---|---|---|---|---|---|---|---|
| | 172-68 | | 172-69 | | 172-70 | | 172-71 | | 172-72 | | 172-73 | | 172-74 | |
| Layer | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % |
| Top | 16.0 | 10.9 | 17.2 | 10.7 | 17.2 | 11.2 | 17.5 | 11.1 | 16.5 | 10.5 | 16.5 | 10.9 | 17.1 | 11.2 |
| 1 | 46.2 | 68.1 | 41.0 | 65.7 | 42.7 | 65.5 | 41.2 | 64.9 | 42.9 | 67.1 | 44.0 | 67.0 | 43.0 | 65.7 |
| Bottom | 16.0 | 10.9 | 17.2 | 10.7 | 17.2 | 11.2 | 17.5 | 11.1 | 16.5 | 10.5 | 16.5 | 10.9 | 17.1 | 11.2 |
| Total | 67.9 | 100.0 | 62.4 | 100.0 | 65.2 | 100.0 | 63.5 | 100.0 | 64.0 | 100.0 | 65.7 | 100.0 | 65.4 | 100.0 |

| | Sample | | | | | | | | | | | | | |
|---|---|---|---|---|---|---|---|---|---|---|---|---|---|---|
| | 172-75 | | 172-76 | | 172-77 | | 172-78 | | 172-79 | | 172-80 | | 172-81 | |
| Layer | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % |
| Top | 16.8 | 10.9 | 17.3 | 11.5 | 16.8 | 10.9 | 17.0 | 10.9 | 17.2 | 11.3 | 16.8 | 10.7 | 16.6 | 10.6 |
| 1 | 43.1 | 66.5 | 43.5 | 65.3 | 42.8 | 66.3 | 42.1 | 65.9 | 43.1 | 65.7 | 42.6 | 66.5 | 42.8 | 66.9 |
| Bottom | 16.8 | 10.9 | 17.3 | 11.5 | 16.8 | 10.9 | 17.0 | 10.9 | 17.2 | 11.3 | 16.8 | 10.7 | 16.6 | 10.6 |
| Total | 64.9 | 100.0 | 66.5 | 100.0 | 64.5 | 100.0 | 63.8 | 100.0 | 65.6 | 100.0 | 64.0 | 100.0 | 64.0 | 100.0 |

TABLE 238-continued

Sample 172 (Dow KSR8758 Binder and No Bicomponent Fiber)

| | Sample | | | | | | | | | | | | | |
|---|---|---|---|---|---|---|---|---|---|---|---|---|---|---|
| | 172-82 | | 172-83 | | 172-84 | | 172-85 | | 172-86 | | 172-87 | | 172-88 | |
| Layer | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % |
| Top | 17.9 | 11.5 | 16.7 | 11.1 | 16.1 | 11.1 | 17.4 | 11.3 | 17.3 | 11.4 | 17.0 | 11.2 | 17.8 | 11.7 |
| 1 | 40.9 | 64.1 | 44.0 | 66.6 | 46.6 | 67.8 | 42.4 | 65.3 | 43.2 | 65.4 | 43.6 | 66.1 | 42.3 | 64.4 |
| Bottom | 17.9 | 11.5 | 16.7 | 11.1 | 16.1 | 11.1 | 17.4 | 11.3 | 17.3 | 11.4 | 17.0 | 11.2 | 17.8 | 11.7 |
| Total | 63.9 | 100.0 | 66.1 | 100.0 | 68.7 | 100.0 | 65.0 | 100.0 | 66.1 | 100.0 | 66.0 | 100.0 | 65.7 | 100.0 |

| | Sample | | | |
|---|---|---|---|---|
| | 172-89 | | 172-90 | |
| Layer | Basis Weight (gsm) | Weight % | Basis Weight (gsm) | Weight % |
| Top | 17.1 | 11.4 | 16.4 | 10.4 |
| 1 | 43.8 | 65.7 | 42.6 | 67.1 |
| Bottom | 17.1 | 11.4 | 16.4 | 10.4 |
| Total | 66.6 | 100.0 | 63.4 | 100.0 |

RESULTS: Product lot analysis was carried out on each sample. Basis weight, caliper, cross directional wet tensile strength in lotion in an aging study were done.

The results of the product lot analysis for basis weight, caliper and cross directional wet strength with a quick dip (1-2 seconds) in Wal-Mart Parents Choice Lotion for Sample 172 with Dow KSR8758 binder and no bicomponent fiber is given in Table 239. The results of the product lot analysis for basis weight, caliper and cross directional wet strength after aging for about 1 hour, 6 hours, 1 day, 3 days, 7 days 14 days, 21 days and 28 days in Wal-Mart Parents Choice Lotion for Sample 172 with Dow KSR8758 binder and no bicomponent fiber are given in Tables 240 to 247 respectively.

TABLE 239

Dow KSR8758 Binder after a Quick Dip in Lotion

| Sample | Caliper (mm) | Basis Weight (gsm) | CDW (gli) | Binder Add-On (weight %) | Normalized CDW (gli) |
|---|---|---|---|---|---|
| 172-1 | 0.68 | 67 | 159 | 32.18 | 146 |
| 172-2 | 0.62 | 59 | 191 | 35.28 | 165 |
| 172-3 | 0.66 | 66 | 185 | 33.90 | 159 |
| 172-4 | 0.66 | 63 | 197 | 36.18 | 165 |
| 172-5 | 0.58 | 60 | 158 | 37.18 | 119 |
| 172-6 | 0.66 | 66 | 205 | 31.72 | 189 |
| 172-7 | 0.64 | 64 | 174 | 35.32 | 143 |
| 172-8 | 0.64 | 62 | 145 | 32.42 | 134 |
| 172-9 | 0.66 | 64 | 174 | 36.72 | 143 |
| 172-10 | 0.58 | 60 | 159 | 37.19 | 119 |

TABLE 240

Dow KSR8758 Binder after 1 Hour Aging in Lotion

| Sample | Caliper (mm) | Basis Weight (gsm) | CDW (gli) | Binder Add-On (weight %) | Normalized CDW (gli) |
|---|---|---|---|---|---|
| 172-11 | 0.72 | 63 | 177 | 33.86 | 173 |
| 172-12 | 0.70 | 66 | 179 | 32.66 | 169 |
| 172-13 | 0.64 | 64 | 160 | 31.65 | 148 |
| 172-14 | 0.66 | 64 | 203 | 35.64 | 171 |
| 172-15 | 0.66 | 63 | 164 | 33.21 | 150 |
| 172-16 | 0.70 | 64 | 169 | 33.51 | 161 |
| 172-17 | 0.64 | 61 | 197 | 36.85 | 163 |
| 172-18 | 0.58 | 62 | 173 | 36.81 | 127 |
| 172-19 | 0.64 | 64 | 185 | 35.38 | 152 |
| 172-20 | 0.64 | 64 | 195 | 33.13 | 170 |

TABLE 241

Dow KSR8758 Binder after 6 Hours Aging in Lotion

| Sample | Caliper (mm) | Basis Weight (gsm) | CDW (gli) | Binder Add-On (weight %) | Normalized CDW (gli) |
|---|---|---|---|---|---|
| 172-21 | 0.70 | 65 | 158 | 31.04 | 160 |
| 172-22 | 0.60 | 65 | 212 | 35.01 | 164 |
| 172-23 | 0.66 | 62 | 192 | 35.75 | 166 |
| 172-24 | 0.70 | 67 | 175 | 32.57 | 164 |
| 172-25 | 0.64 | 62 | 165 | 35.11 | 141 |
| 172-26 | 0.64 | 63 | 173 | 32.86 | 155 |
| 172-27 | 0.62 | 61 | 178 | 32.99 | 159 |
| 172-28 | 0.56 | 60 | 184 | 37.10 | 135 |
| 172-29 | 0.62 | 63 | 202 | 34.99 | 164 |
| 172-30 | 0.58 | 59 | 171 | 30.24 | 160 |

TABLE 242

Dow KSR8758 Binder after 1 Day Aging in Lotion

| Sample | Caliper (mm) | Basis Weight (gsm) | CDW (gli) | Binder Add-On (weight %) | Normalized CDW (gli) |
|---|---|---|---|---|---|
| 172-31 | 0.68 | 66 | 160 | 33.64 | 143 |
| 172-32 | 0.70 | 64 | 203 | 33.47 | 192 |
| 172-33 | 0.60 | 60 | 193 | 35.13 | 159 |
| 172-34 | 0.62 | 62 | 163 | 33.64 | 142 |
| 172-35 | 0.70 | 62 | 185 | 36.10 | 169 |
| 172-36 | 0.64 | 64 | 178 | 33.17 | 157 |
| 172-37 | 0.66 | 63 | 187 | 31.72 | 180 |
| 172-38 | 0.60 | 62 | 185 | 33.73 | 155 |
| 172-39 | 0.72 | 64 | 191 | 34.23 | 182 |
| 172-40 | 0.60 | 62 | 166 | 34.48 | 135 |

TABLE 243

Dow KSR8758 Binder after 3 Days Aging in Lotion

| Sample | Caliper (mm) | Basis Weight (gsm) | CDW (gli) | Binder Add-On (weight %) | Normalized CDW (gli) |
|---|---|---|---|---|---|
| 172-41 | 0.68 | 64 | 145 | 35.27 | 128 |
| 172-42 | 0.72 | 65 | 139 | 30.94 | 144 |
| 172-43 | 0.68 | 64 | 156 | 33.77 | 143 |
| 172-44 | 0.70 | 65 | 208 | 33.84 | 194 |
| 172-45 | 0.60 | 64 | 135 | 31.38 | 116 |
| 172-46 | 0.64 | 63 | 163 | 32.69 | 148 |
| 172-47 | 0.64 | 64 | 157 | 34.33 | 132 |
| 172-48 | 0.68 | 63 | 183 | 37.43 | 154 |
| 172-49 | 0.64 | 62 | 157 | 35.14 | 134 |
| 172-50 | 0.74 | 66 | 173 | 31.63 | 179 |

TABLE 244

Dow KSR8758 Binder after 7 Days Aging in Lotion

| | | | | | |
|---|---|---|---|---|---|
| 172-51 | 0.68 | 63 | 158 | 34.60 | 142 |
| 172-52 | 0.70 | 67 | 162 | 35.30 | 139 |
| 172-53 | 0.74 | 65 | 171 | 35.44 | 159 |
| 172-54 | 0.74 | 66 | 133 | 34.45 | 127 |
| 172-55 | 0.72 | 67 | 197 | 34.90 | 176 |
| 172-56 | 0.68 | 67 | 155 | 36.43 | 125 |
| 172-57 | 0.78 | 68 | 187 | 35.18 | 179 |
| 172-58 | 0.66 | 66 | 182 | 35.43 | 150 |
| 172-59 | 0.76 | 66 | 158 | 34.39 | 155 |
| 172-60 | 0.72 | 64 | 162 | 34.68 | 152 |

TABLE 245

Dow KSR8758 Binder after 14 Days Aging in Lotion

| Sample | Caliper (mm) | Basis Weight (gsm) | CDW (gli) | Binder Add-On (weight %) | Normalized CDW (gli) |
|---|---|---|---|---|---|
| 172-61 | 0.76 | 63 | 167 | 33.30 | 174 |
| 172-62 | 0.72 | 64 | 187 | 35.54 | 172 |
| 172-63 | 0.62 | 62 | 149 | 36.12 | 120 |
| 172-64 | 0.66 | 65 | 155 | 33.66 | 137 |
| 172-65 | 0.68 | 65 | 177 | 33.94 | 160 |
| 172-66 | 0.66 | 65 | 154 | 30.95 | 146 |
| 172-67 | 0.70 | 66 | 191 | 33.22 | 177 |
| 172-68 | 0.68 | 68 | 160 | 31.95 | 146 |
| 172-69 | 0.66 | 62 | 142 | 34.35 | 127 |
| 172-70 | 0.70 | 65 | 176 | 34.46 | 159 |

TABLE 246

Dow KSR8758 Binder after 21 Days Aging in Lotion

| Sample | Caliper (mm) | Basis Weight (gsm) | CDW (gli) | Binder Add-On (weight %) | Normalized CDW (gli) |
|---|---|---|---|---|---|
| 172-71 | 0.72 | 64 | 170 | 35.08 | 160 |
| 172-72 | 0.66 | 64 | 169 | 32.92 | 154 |
| 172-73 | 0.82 | 66 | 249 | 33.02 | 273 |
| 172-74 | 0.76 | 65 | 165 | 34.26 | 163 |
| 172-75 | 0.72 | 65 | 183 | 33.55 | 176 |
| 172-76 | 0.72 | 66 | 166 | 34.66 | 151 |
| 172-77 | 0.78 | 64 | 187 | 33.66 | 196 |
| 172-78 | 0.74 | 64 | 167 | 34.07 | 166 |
| 172-79 | 0.72 | 66 | 164 | 34.35 | 152 |
| 172-80 | 0.72 | 64 | 169 | 33.53 | 165 |

TABLE 247

Dow KSR8758 Binder after 28 Days Aging in Lotion

| Sample | Caliper (mm) | Basis Weight (gsm) | CDW (gli) | Binder Add-On (weight %) | Normalized CDW (gli) |
|---|---|---|---|---|---|
| 172-81 | 0.72 | 64 | 139 | 33.12 | 137 |
| 172-82 | 0.68 | 64 | 170 | 35.89 | 147 |
| 172-83 | 0.76 | 66 | 163 | 33.44 | 163 |
| 172-84 | 0.80 | 69 | 159 | 32.19 | 168 |
| 172-85 | 0.72 | 65 | 169 | 34.73 | 156 |
| 172-86 | 0.80 | 66 | 162 | 34.64 | 165 |
| 172-87 | 0.72 | 66 | 173 | 33.94 | 161 |
| 172-88 | 0.72 | 66 | 170 | 35.62 | 152 |
| 172-89 | 0.82 | 67 | 167 | 34.27 | 175 |
| 172-90 | 0.78 | 63 | 127 | 32.88 | 139 |

The average of the normalized cross directional wet strength values for the Dow KSR8758 binder aging studies from Tables 239-247 are given in Table 248. Table 248 also shows the percent change in cross directional wet strength for these values versus the Quick Dip test, which is the starting point for this testing. The Quick Dip test protocol places the product in lotion for about 1-2 seconds or about 0.001 days.

TABLE 248

Dow KSR8758 Binder Average Normalized CDW Tensile Strengths After Aging in Lotion

| Time - Days | Samples | Average Normalized CDW (gli) | Change from Initial CDW Strength (%) |
|---|---|---|---|
| 0.001 | 172-1 to 172-10 | 148 | 100% - control |
| 0.04 | 172-11 to 172-20 | 158 | 107% |
| 0.25 | 172-21 to 172-30 | 157 | 106% |
| 1 | 172-31 to 172-40 | 161 | 109% |
| 3 | 172-41 to 172-50 | 147 | 99% |
| 7 | 172-51 to 172-60 | 150 | 102% |
| 14 | 172-61 to 172-70 | 151 | 103% |
| 21 | 172-71 to 172-80 | 174 | 118% |
| 28 | 172-81 to 172-90 | 157 | 106% |

Figure 35:
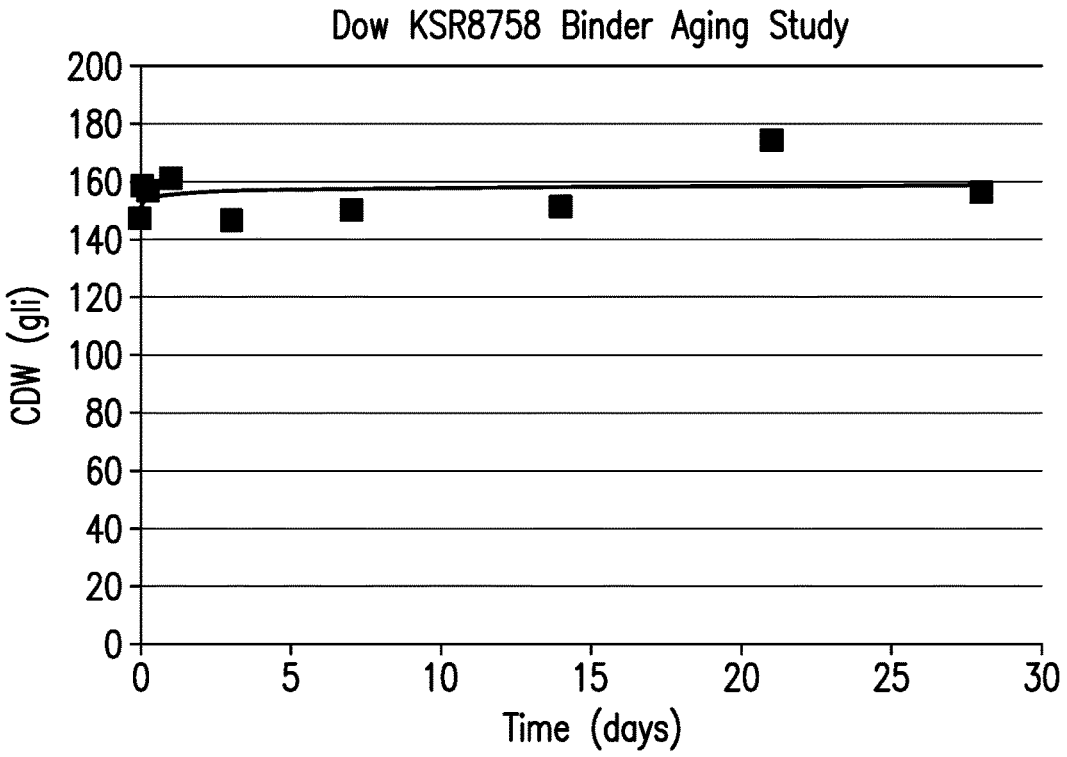
FIG. 35 depicts a graph showing the average normalized cross directional wet strength values for the Dow KSR8758 binder samples in Example 33. The graph shows the cross directional wet strength of the sample in gli (y-axis) versus time that the sample has been aged in days (x-axis).

The average normalized cross directional wet strength values for the Dow KSR8758 binder samples from Table 248 are plotted in FIG. 35.

DISCUSSION: Samples 172-1 to Samples 172-90 with Dow KSR8758 binder and no bicomponent fiber showed no appreciable drop in cross direction wet tensile strength over a 28 day aging period at 40° C. in lotion expressed from Wal-Mart Parents Choice Baby Wipes. The Dow KSR8758 binder is stable in this lotion under these conditions.

Example 34

High Strength Binders for Flushable Dispersible Wipes

Wipes according to the invention were prepared and tested for various parameters including basis weight, caliper, cross direction wet strength after a quick dip in lotion expressed from Wal-Mart Parents Choice Baby Wipe lotion and cross direction wet strength after about 1 hour, 6 hours, 1 day, 3 days, 7 days, 14 days, 21 days and 28 days of aging in lotion expressed from Wal-Mart Parents Choice Baby Wipes at a temperature of 40° C.

METHODS/MATERIALS: Sample 173-1 to 173-90 were all made on an airlaid pilot line. The composition of samples 173-1 to 173-90 with Dow KSR8855 binder are given in Table 249. The type and level of raw materials for these samples were varied to influence the physical properties and flushable-dispersible properties. All of the samples were cured at 175° C. in a pilot line through air oven.

TABLE 249

Sample 173 (Dow KSR8855 Binder and No Bicomponent Fiber)

| | | Sample number | | | | | | | | | |
|---|---|---|---|---|---|---|---|---|---|---|---|
| | | 173-1 | | 173-2 | | 173-3 | | 173-4 | | 173-5 | |
| Layer | Raw Materials | Basis Weight (gsm) | Weight % | Basis Weight (gsm) | Weight % | Basis Weight (gsm) | Weight % | Basis Weight (gsm) | Weight % | Basis Weight (gsm) | Weight % |
| Top | Dow KSR8855 | 10.7 | 15.6 | 10.4 | 15.5 | 11.4 | 17.6 | 10.6 | 15.9 | 10.2 | 15.6 |
| 1 | Buckeye Technologies EO1123 pulp | 47.3 | 68.9 | 46.2 | 69.0 | 41.8 | 64.7 | 45.5 | 68.2 | 44.9 | 68.7 |
| Bottom | Dow KSR8855 | 10.7 | 15.6 | 10.4 | 15.5 | 11.4 | 17.6 | 10.6 | 15.9 | 10.2 | 15.6 |
| | Total | 68.6 | 0.1 | 66.9 | 186.7 | 64.5 | 31.1 | 66.7 | 47.3 | 65.3 | 46.2 |

| | Sample | | | | | | | | | | | | | |
|---|---|---|---|---|---|---|---|---|---|---|---|---|---|---|
| | 173-6 | | 173-7 | | 173-8 | | 173-9 | | 173-10 | | 173-11 | | 173-12 | |
| Layer | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % |
| Top | 10.0 | 15.3 | 10.5 | 15.9 | 9.6 | 15.1 | 9.7 | 15.1 | 10.5 | 16.6 | 9.7 | 15.0 | 9.9 | 15.4 |
| 1 | 45.0 | 69.4 | 44.8 | 68.2 | 44.6 | 69.9 | 44.8 | 69.9 | 42.4 | 66.8 | 44.9 | 69.9 | 44.3 | 69.2 |
| Bottom | 10.0 | 15.3 | 10.5 | 15.9 | 9.6 | 15.1 | 9.7 | 15.1 | 10.5 | 16.6 | 9.7 | 15.0 | 9.9 | 15.4 |
| Total | 64.9 | 41.8 | 65.8 | 45.5 | 63.8 | 0.0 | 64.2 | 0.0 | 63.5 | 100.0 | 64.2 | 100.0 | 64.0 | 100.0 |

| | Sample | | | | | | | | | | | | | |
|---|---|---|---|---|---|---|---|---|---|---|---|---|---|---|
| | 173-13 | | 173-14 | | 173-15 | | 173-16 | | 173-17 | | 173-18 | | 173-19 | |
| Layer | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % |
| Top | 10.1 | 16.0 | 9.6 | 15.5 | 9.0 | 14.0 | 9.6 | 15.0 | 10.1 | 15.8 | 9.2 | 14.4 | 9.9 | 15.6 |
| 1 | 43.0 | 68.0 | 42.6 | 69.0 | 46.3 | 71.9 | 44.6 | 69.9 | 43.8 | 68.5 | 45.6 | 71.2 | 43.8 | 68.9 |
| Bottom | 10.1 | 16.0 | 9.6 | 15.5 | 9.0 | 14.0 | 9.6 | 15.0 | 10.1 | 15.8 | 9.2 | 14.4 | 9.9 | 15.6 |
| Total | 63.2 | 100.0 | 61.7 | 100.0 | 64.4 | 100.0 | 63.9 | 100.0 | 64.0 | 100.0 | 64.0 | 100.0 | 63.6 | 100.0 |

| | Sample | | | | | | | | | | | | | |
|---|---|---|---|---|---|---|---|---|---|---|---|---|---|---|
| | 173-20 | | 173-21 | | 173-22 | | 173-23 | | 173-24 | | 173-25 | | 173-26 | |
| Layer | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % |
| Top | 10.2 | 15.8 | 10.2 | 15.1 | 9.5 | 14.7 | 10.4 | 16.2 | 10.7 | 15.6 | 11.2 | 17.5 | 10.9 | 17.0 |
| 1 | 44.2 | 68.5 | 47.1 | 69.8 | 45.8 | 70.6 | 43.4 | 67.7 | 47.4 | 68.8 | 41.6 | 65.1 | 42.2 | 66.0 |
| Bottom | 10.2 | 15.8 | 10.2 | 15.1 | 9.5 | 14.7 | 10.4 | 16.2 | 10.7 | 15.6 | 11.2 | 17.5 | 10.9 | 17.0 |
| Total | 64.6 | 100.0 | 67.5 | 100.0 | 64.8 | 100.0 | 64.2 | 100.0 | 68.8 | 100.0 | 64.0 | 100.0 | 63.9 | 100.0 |

TABLE 249-continued

Sample 173 (Dow KSR8855 Binder and No Bicomponent Fiber)

| | Sample | | | | | | | | | | | | | |
|---|---|---|---|---|---|---|---|---|---|---|---|---|---|---|
| | 173-27 | | 173-28 | | 173-29 | | 173-30 | | 173-31 | | 173-32 | | 173-33 | |
| Layer | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % |
| Top | 10.1 | 15.1 | 9.7 | 15.0 | 11.1 | 16.7 | 10.4 | 15.9 | 10.0 | 15.9 | 10.9 | 16.7 | 10.0 | 15.6 |
| 1 | 46.5 | 69.8 | 45.6 | 70.1 | 44.1 | 66.6 | 44.8 | 68.2 | 42.9 | 68.2 | 43.3 | 66.5 | 44.1 | 68.8 |
| Bottom | 10.1 | 15.1 | 9.7 | 15.0 | 11.1 | 16.7 | 10.4 | 15.9 | 10.0 | 15.9 | 10.9 | 16.7 | 10.0 | 15.6 |
| Total | 66.6 | 100.0 | 65.0 | 100.0 | 66.2 | 100.0 | 65.7 | 100.0 | 63.0 | 100.0 | 65.1 | 100.0 | 64.2 | 100.0 |

| | Sample | | | | | | | | | | | | | |
|---|---|---|---|---|---|---|---|---|---|---|---|---|---|---|
| | 173-34 | | 173-35 | | 173-36 | | 173-37 | | 173-38 | | 173-39 | | 173-40 | |
| Layer | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % |
| Top | 10.9 | 16.4 | 10.5 | 16.0 | 10.4 | 15.9 | 10.6 | 15.5 | 11.2 | 17.0 | 10.3 | 16.4 | 10.2 | 16.1 |
| 1 | 44.6 | 67.3 | 44.8 | 68.1 | 44.6 | 68.2 | 47.2 | 68.9 | 43.4 | 66.0 | 42.5 | 67.3 | 43.0 | 67.8 |
| Bottom | 10.9 | 16.4 | 10.5 | 16.0 | 10.4 | 15.9 | 10.6 | 15.5 | 11.2 | 17.0 | 10.3 | 16.4 | 10.2 | 16.1 |
| Total | 66.3 | 100.0 | 65.8 | 100.0 | 65.4 | 100.0 | 68.4 | 100.0 | 65.8 | 100.0 | 63.2 | 100.0 | 63.4 | 100.0 |

| | Sample | | | | | | | | | | | | | |
|---|---|---|---|---|---|---|---|---|---|---|---|---|---|---|
| | 173-41 | | 173-42 | | 173-43 | | 173-44 | | 173-45 | | 173-46 | | 173-47 | |
| Layer | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % |
| Top | 9.9 | 15.2 | 9.9 | 15.6 | 10.9 | 16.7 | 10.5 | 16.1 | 10.8 | 16.9 | 10.6 | 16.5 | 10.5 | 16.9 |
| 1 | 45.4 | 69.7 | 43.7 | 68.9 | 43.5 | 66.7 | 44.0 | 67.7 | 42.3 | 66.3 | 42.9 | 67.0 | 41.2 | 66.3 |
| Bottom | 9.9 | 15.2 | 9.9 | 15.6 | 10.9 | 16.7 | 10.5 | 16.1 | 10.8 | 16.9 | 10.6 | 16.5 | 10.5 | 16.9 |
| Total | 65.1 | 100.0 | 63.5 | 100.0 | 65.2 | 100.0 | 65.0 | 100.0 | 63.9 | 100.0 | 64.0 | 100.0 | 62.2 | 100.0 |

| | Sample | | | | | | | | | | | | | |
|---|---|---|---|---|---|---|---|---|---|---|---|---|---|---|
| | 173-48 | | 173-49 | | 173-50 | | 173-51 | | 173-52 | | 173-53 | | 173-54 | |
| Layer | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % |
| Top | 10.5 | 16.4 | 10.4 | 16.3 | 9.6 | 15.4 | 10.6 | 16.5 | 10.1 | 15.7 | 10.2 | 16.3 | 10.3 | 15.4 |
| 1 | 42.8 | 67.1 | 43.0 | 67.5 | 43.2 | 69.3 | 43.1 | 67.0 | 44.3 | 68.7 | 42.4 | 67.5 | 46.3 | 69.2 |
| Bottom | 10.5 | 16.4 | 10.4 | 16.3 | 9.6 | 15.4 | 10.6 | 16.5 | 10.1 | 15.7 | 10.2 | 16.3 | 10.3 | 15.4 |
| Total | 63.7 | 100.0 | 63.7 | 100.0 | 62.3 | 100.0 | 64.3 | 100.0 | 64.5 | 100.0 | 62.8 | 100.0 | 67.0 | 100.0 |

| | Sample | | | | | | | | | | | | | |
|---|---|---|---|---|---|---|---|---|---|---|---|---|---|---|
| | 173-55 | | 173-56 | | 173-57 | | 173-58 | | 173-59 | | 173-60 | | 173-61 | |
| Layer | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % |
| Top | 9.9 | 15.2 | 9.9 | 15.6 | 10.9 | 16.7 | 10.5 | 16.1 | 10.8 | 16.9 | 10.6 | 16.5 | 10.5 | 16.9 |
| 1 | 45.4 | 69.7 | 43.7 | 68.9 | 43.5 | 66.7 | 44.0 | 67.7 | 42.3 | 66.3 | 42.9 | 67.0 | 41.2 | 66.3 |
| Bottom | 9.9 | 15.2 | 9.9 | 15.6 | 10.9 | 16.7 | 10.5 | 16.1 | 10.8 | 16.9 | 10.6 | 16.5 | 10.5 | 16.9 |
| Total | 65.1 | 100.0 | 63.5 | 100.0 | 65.2 | 100.0 | 65.0 | 100.0 | 63.9 | 100.0 | 64.0 | 100.0 | 62.2 | 100.0 |

TABLE 249-continued

Sample 173 (Dow KSR8855 Binder and No Bicomponent Fiber)

| | Sample | | | | | | | | | | | | | |
|---|---|---|---|---|---|---|---|---|---|---|---|---|---|---|
| | 173-62 | | 173-63 | | 173-64 | | 173-65 | | 173-66 | | 173-67 | | 173-68 | |
| Layer | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % |
| Top | 11.0 | 16.7 | 9.7 | 15.8 | 10.1 | 16.4 | 9.8 | 15.4 | 10.7 | 16.3 | 10.1 | 15.5 | 10.5 | 17.1 |
| 1 | 43.9 | 66.6 | 41.9 | 68.5 | 41.1 | 67.1 | 43.7 | 69.1 | 44.3 | 67.4 | 45.0 | 69.1 | 40.3 | 65.8 |
| Bottom | 11.0 | 16.7 | 9.7 | 15.8 | 10.1 | 16.4 | 9.8 | 15.4 | 10.7 | 16.3 | 10.1 | 15.5 | 10.5 | 17.1 |
| Total | 65.8 | 100.0 | 61.2 | 100.0 | 61.3 | 100.0 | 63.2 | 100.0 | 65.7 | 100.0 | 65.2 | 100.0 | 61.4 | 100.0 |

| | Sample | | | | | | | | | | | | | |
|---|---|---|---|---|---|---|---|---|---|---|---|---|---|---|
| | 173-69 | | 173-70 | | 173-71 | | 173-72 | | 173-73 | | 173-74 | | 173-75 | |
| Layer | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % |
| Top | 9.7 | 14.6 | 9.8 | 15.0 | 10.4 | 16.6 | 10.8 | 16.1 | 10.5 | 16.0 | 11.9 | 17.6 | 11.7 | 18.0 |
| 1 | 47.1 | 70.7 | 45.7 | 69.9 | 42.1 | 66.9 | 45.3 | 67.7 | 44.8 | 68.1 | 43.8 | 64.8 | 41.4 | 63.9 |
| Bottom | 9.7 | 14.6 | 9.8 | 15.0 | 10.4 | 16.6 | 10.8 | 16.1 | 10.5 | 16.0 | 11.9 | 17.6 | 11.7 | 18.0 |
| Total | 66.5 | 100.0 | 65.4 | 100.0 | 62.9 | 100.0 | 66.8 | 100.0 | 65.8 | 100.0 | 67.6 | 100.0 | 64.8 | 100.0 |

| | Sample | | | | | | | | | | | | | |
|---|---|---|---|---|---|---|---|---|---|---|---|---|---|---|
| | 173-76 | | 173-77 | | 173-78 | | 173-79 | | 173-80 | | 173-81 | | 173-82 | |
| Layer | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % |
| Top | 11.8 | 18.6 | 12.2 | 18.9 | 11.1 | 17.5 | 10.9 | 17.2 | 10.9 | 17.3 | 10.0 | 15.1 | 9.9 | 15.1 |
| 1 | 39.8 | 62.8 | 40.1 | 62.1 | 41.0 | 64.9 | 41.6 | 65.5 | 41.3 | 65.4 | 46.6 | 69.9 | 45.6 | 69.8 |
| Bottom | 11.8 | 18.6 | 12.2 | 18.9 | 11.1 | 17.5 | 10.9 | 17.2 | 10.9 | 17.3 | 10.0 | 15.1 | 9.9 | 15.1 |
| Total | 63.3 | 100.0 | 64.5 | 100.0 | 63.1 | 100.0 | 63.5 | 100.0 | 63.1 | 100.0 | 66.6 | 100.0 | 65.4 | 100.0 |

| | Sample | | | | | | | | | | | | | |
|---|---|---|---|---|---|---|---|---|---|---|---|---|---|---|
| | 173-83 | | 173-84 | | 173-85 | | 173-86 | | 173-87 | | 173-88 | | 173-89 | |
| Layer | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % | Basis Weight (gsm) | Weight % |
| Top | 10.5 | 15.9 | 9.5 | 14.0 | 8.7 | 13.0 | 9.4 | 14.4 | 8.1 | 12.6 | 9.2 | 14.6 | 9.4 | 14.8 |
| 1 | 45.0 | 68.2 | 49.0 | 72.1 | 49.6 | 74.0 | 46.8 | 71.3 | 47.9 | 74.7 | 44.5 | 70.8 | 45.0 | 70.4 |
| Bottom | 10.5 | 15.9 | 9.5 | 14.0 | 8.7 | 13.0 | 9.4 | 14.4 | 8.1 | 12.6 | 9.2 | 14.6 | 9.4 | 14.8 |
| Total | 65.9 | 100.0 | 67.9 | 100.0 | 67.1 | 100.0 | 65.6 | 100.0 | 64.1 | 100.0 | 62.9 | 100.0 | 63.8 | 100.0 |

| | Sample 173-90 | |
|---|---|---|
| Layer | Basis Weight (gsm) | Weight % |
| Top | 9.0 | 14.0 |
| 1 | 46.0 | 72.0 |
| Bottom | 9.0 | 14.0 |
| Total | 64.0 | 100.0 |

RESULTS: Product lot analysis was carried out on each sample. Basis weight, caliper, cross directional wet tensile strength in lotion in an aging study were done.

The results of the product lot analysis for basis weight, caliper and cross directional wet strength with a quick dip (1-2 seconds) in Wal-Mart Parents Choice Lotion for Sample 173 with Dow KSR8855 binder and no bicomponent fiber is given in Table 250. The results of the product lot analysis for basis weight, caliper and cross directional wet strength after aging for about 1 hour, 6 hours, 1 day, 3 days, 7 days 14 days, 21 days and 28 days in Wal-Mart Parents Choice Lotion for Sample 172 with Dow KSR8855 binder and no bicomponent fiber are given in Tables 251 to 259 respectively.

TABLE 250

| Dow KSR8855 Binder after a Quick Dip in Lotion | | | | | |
|---|---|---|---|---|---|
| Sample | Caliper (mm) | Basis Weight (gsm) | CDW (gli) | Binder Add-On (weight %) | Normalized CDW (gli) |
| 173-1 | 0.84 | 69 | 187 | 31.10 | 214 |
| 173-2 | 0.76 | 67 | 167 | 31.02 | 177 |
| 173-3 | 0.88 | 65 | 191 | 35.27 | 214 |
| 173-4 | 0.86 | 67 | 176 | 31.78 | 208 |
| 173-5 | 0.82 | 65 | 185 | 31.27 | 216 |
| 173-6 | 0.80 | 65 | 176 | 30.65 | 206 |
| 173-7 | 0.86 | 66 | 185 | 31.85 | 220 |
| 173-8 | 0.82 | 64 | 182 | 30.14 | 226 |
| 173-9 | 0.84 | 64 | 169 | 30.14 | 213 |
| 173-10 | 0.82 | 63 | 167 | 33.25 | 189 |

TABLE 251

| Dow KSR8758 Binder after 1 Hour Aging in Lotion | | | | | |
|---|---|---|---|---|---|
| Sample | Caliper (mm) | Basis Weight (gsm) | CDW (gli) | Binder Add-On (weight %) | Normalized CDW (gli) |
| 173-11 | 0.86 | 64 | 143 | 30.09 | 186 |
| 173-12 | 0.76 | 64 | 150 | 30.77 | 168 |
| 173-13 | 0.84 | 63 | 163 | 31.96 | 197 |
| 173-14 | 0.82 | 62 | 172 | 31.00 | 215 |
| 173-15 | 0.84 | 64 | 152 | 28.07 | 206 |
| 173-16 | 0.86 | 64 | 159 | 30.09 | 207 |
| 173-17 | 0.78 | 64 | 170 | 31.53 | 191 |
| 173-18 | 0.82 | 64 | 146 | 28.76 | 189 |
| 173-19 | 0.82 | 64 | 158 | 31.14 | 190 |
| 173-20 | 0.82 | 65 | 161 | 31.55 | 189 |

TABLE 252

| Dow KSR8758 Binder after 6 Hours Aging in Lotion | | | | | |
|---|---|---|---|---|---|
| Sample | Caliper (mm) | Basis Weight (gsm) | CDW (gli) | Binder Add-On (weight %) | Normalized CDW (gli) |
| 173-21 | 0.90 | 68 | 164 | 30.20 | 210 |
| 173-22 | 0.80 | 65 | 158 | 29.36 | 193 |
| 173-23 | 0.84 | 67 | 149 | 30.78 | 176 |
| 173-24 | 0.82 | 69 | 165 | 31.19 | 183 |
| 173-25 | 0.78 | 64 | 156 | 34.91 | 158 |
| 173-26 | 0.84 | 64 | 153 | 34.02 | 172 |
| 173-27 | 0.86 | 67 | 147 | 30.22 | 183 |
| 173-28 | 0.84 | 65 | 149 | 29.94 | 187 |
| 173-29 | 0.80 | 66 | 145 | 33.42 | 153 |
| 173-30 | 0.80 | 66 | 155 | 31.76 | 173 |

TABLE 253

| Dow KSR8758 Binder after 1 Day Aging in Lotion | | | | | |
|---|---|---|---|---|---|
| Sample | Caliper (mm) | Basis Weight (gsm) | CDW (gli) | Binder Add-On (weight %) | Normalized CDW (gli) |
| 173-31 | 0.82 | 63 | 150 | 31.84 | 178 |
| 173-32 | 0.88 | 65 | 181 | 33.46 | 212 |
| 173-33 | 0.78 | 64 | 169 | 31.25 | 191 |
| 173-34 | 0.84 | 64 | 149 | 29.62 | 192 |
| 173-35 | 0.84 | 66 | 163 | 31.42 | 193 |
| 173-36 | 0.87 | 65 | 152 | 32.76 | 182 |
| 173-37 | 0.80 | 63 | 155 | 32.35 | 179 |
| 173-38 | 0.86 | 69 | 177 | 31.97 | 202 |

TABLE 253-continued

| Dow KSR8758 Binder after 1 Day Aging in Lotion | | | | | |
|---|---|---|---|---|---|
| Sample | Caliper (mm) | Basis Weight (gsm) | CDW (gli) | Binder Add-On (weight %) | Normalized CDW (gli) |
| 173-39 | 0.86 | 65 | 155 | 32.21 | 186 |
| 173-40 | 0.82 | 63 | 153 | 30.98 | 185 |

TABLE 254

| Dow KSR8758 Binder after 3 Days Aging in Lotion | | | | | |
|---|---|---|---|---|---|
| Sample | Caliper (mm) | Basis Weight (gsm) | CDW (gli) | Binder Add-On (weight %) | Normalized CDW (gli) |
| 173-41 | 0.84 | 66 | 154 | 32.72 | 173 |
| 173-42 | 0.84 | 66 | 152 | 31.91 | 177 |
| 173-43 | 0.86 | 65 | 155 | 31.78 | 186 |
| 173-44 | 0.90 | 68 | 142 | 31.09 | 175 |
| 173-45 | 0.80 | 65 | 147 | 34.62 | 152 |
| 173-46 | 0.80 | 63 | 150 | 32.75 | 169 |
| 173-47 | 0.82 | 63 | 148 | 32.22 | 173 |
| 173-48 | 0.86 | 64 | 164 | 32.88 | 196 |
| 173-49 | 0.86 | 64 | 152 | 32.55 | 183 |
| 173-50 | 0.80 | 62 | 125 | 30.74 | 151 |

TABLE 255

| Dow KSR8758 Binder after 7 Days Aging in Lotion | | | | | |
|---|---|---|---|---|---|
| Sample | Caliper (mm) | Basis Weight (gsm) | CDW (gli) | Binder Add-On (weight %) | Normalized CDW (gli) |
| 173-51 | 0.82 | 64 | 131 | 33.05 | 147 |
| 173-52 | 0.82 | 65 | 138 | 31.34 | 163 |
| 173-53 | 0.78 | 63 | 124 | 32.50 | 138 |
| 173-54 | 0.90 | 67 | 127 | 30.78 | 161 |
| 173-55 | 0.86 | 65 | 142 | 30.35 | 180 |
| 173-56 | 0.86 | 63 | 135 | 31.13 | 170 |
| 173-57 | 0.84 | 65 | 151 | 33.33 | 169 |
| 173-58 | 0.84 | 65 | 144 | 32.27 | 168 |
| 173-59 | 0.80 | 64 | 163 | 33.71 | 177 |
| 173-60 | 0.82 | 64 | 121 | 32.96 | 137 |

TABLE 256

| Dow KSR8758 Binder after 14 Days Aging in Lotion | | | | | |
|---|---|---|---|---|---|
| Sample | Caliper (mm) | Basis Weight (gsm) | CDW (gli) | Binder Add-On (weight %) | Normalized CDW (gli) |
| 173-61 | 0.82 | 62 | 110 | 33.74 | 125 |
| 173-62 | 0.86 | 66 | 145 | 33.40 | 165 |
| 173-63 | 0.82 | 61 | 124 | 31.55 | 153 |
| 173-64 | 0.74 | 61 | 122 | 32.86 | 130 |
| 173-65 | 0.78 | 63 | 133 | 30.87 | 154 |
| 173-66 | 0.84 | 66 | 116 | 32.57 | 132 |
| 173-67 | 0.82 | 65 | 135 | 30.94 | 159 |
| 173-68 | 0.72 | 61 | 157 | 34.24 | 156 |
| 173-69 | 0.86 | 67 | 133 | 29.29 | 171 |
| 173-70 | 0.80 | 65 | 111 | 30.09 | 131 |

TABLE 257

Dow KSR8758 Binder after 21 Days Aging in Lotion

| Sample | Caliper (mm) | Basis Weight (gsm) | CDW (gli) | Binder Add-On (weight %) | Normalized CDW (gli) |
|---|---|---|---|---|---|
| 173-71 | 0.86 | 63 | 135 | 33.13 | 162 |
| 173-72 | 0.86 | 67 | 137 | 32.27 | 159 |
| 173-73 | 0.86 | 66 | 129 | 31.91 | 154 |
| 173-74 | 0.82 | 68 | 146 | 35.22 | 146 |
| 173-75 | 0.88 | 65 | 170 | 36.06 | 186 |
| 173-76 | 0.86 | 63 | 140 | 37.23 | 148 |
| 173-77 | 0.90 | 64 | 152 | 37.87 | 163 |
| 173-78 | 0.84 | 63 | 145 | 35.09 | 160 |
| 173-79 | 0.86 | 63 | 141 | 34.46 | 162 |
| 173-80 | 0.78 | 63 | 131 | 34.59 | 136 |

TABLE 258

Dow KSR8758 Binder after 28 Days Aging in Lotion

| Sample | Caliper (mm) | Basis Weight (gsm) | CDW (gli) | Binder Add-On (weight %) | Normalized CDW (gli) |
|---|---|---|---|---|---|
| 173-81 | 0.90 | 67 | 115 | 30.13 | 150 |
| 173-82 | 0.88 | 65 | 128 | 30.17 | 166 |
| 173-83 | 0.90 | 66 | 116 | 31.76 | 145 |
| 173-84 | 0.92 | 68 | 140 | 27.94 | 197 |
| 173-85 | 0.98 | 67 | 135 | 26.04 | 220 |
| 173-86 | 0.92 | 66 | 129 | 28.72 | 184 |
| 173-87 | 0.80 | 64 | 126 | 25.27 | 181 |
| 173-88 | 0.98 | 63 | 123 | 29.24 | 191 |
| 173-89 | 0.86 | 64 | 131 | 29.56 | 173 |
| 173-90 | 0.92 | 64 | 115 | 28.02 | 171 |

The average of the normalized cross directional wet strength values for the Dow KSR8855 binder aging studies from Tables 250-258 are given in Table 259. Table 259 also shows the percent change in cross directional wet strength for these values versus the Quick Dip test, which is the starting point for this testing. The Quick Dip test protocol places the product in lotion for about 1-2 seconds or about 0.001 days.

TABLE 259

Dow KSR8855 Binder Average Normalized CDW Tensile Strengths After Aging in Lotion

| Time - Days | Samples | Average Normalized CDW (gli) | Change from Initial CDW Strength (%) |
|---|---|---|---|
| 0.001 | 173-1 to 173-10 | 208 | 100% - control |
| 0.04 | 173-11 to 173-20 | 194 | 93% |
| 0.25 | 173-21 to 173-30 | 178 | 86% |
| 1 | 173-31 to 173-40 | 190 | 91% |
| 3 | 173-41 to 173-50 | 173 | 83% |
| 7 | 173-51 to 173-60 | 161 | 77% |
| 14 | 173-61 to 173-70 | 148 | 71% |
| 21 | 173-71 to 173-80 | 157 | 76% |
| 28 | 173-81 to 173-90 | 177 | 85% |

Figure 36:
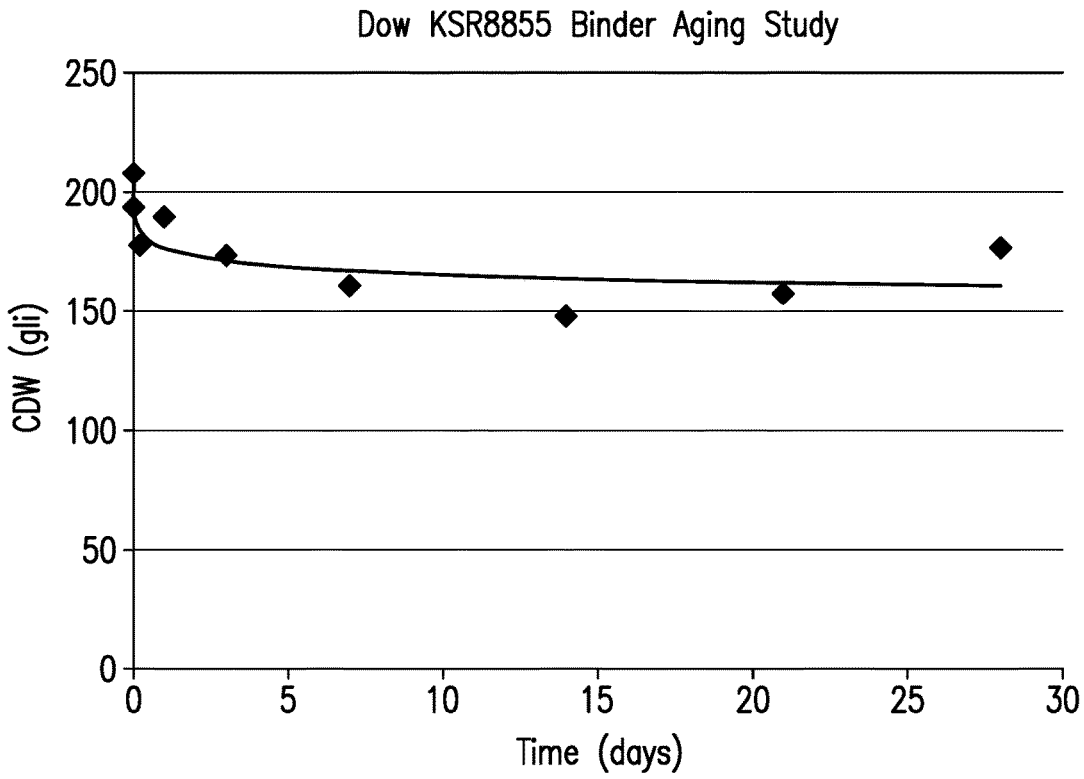
FIG. 36 depicts a graph showing the average normalized cross directional wet strength values for the Dow KSR8855 binder samples in Example 34. The graph shows the cross directional wet strength of the sample in gli (y-axis) versus time that the sample has been aged in days (x-axis).
Figure 37:
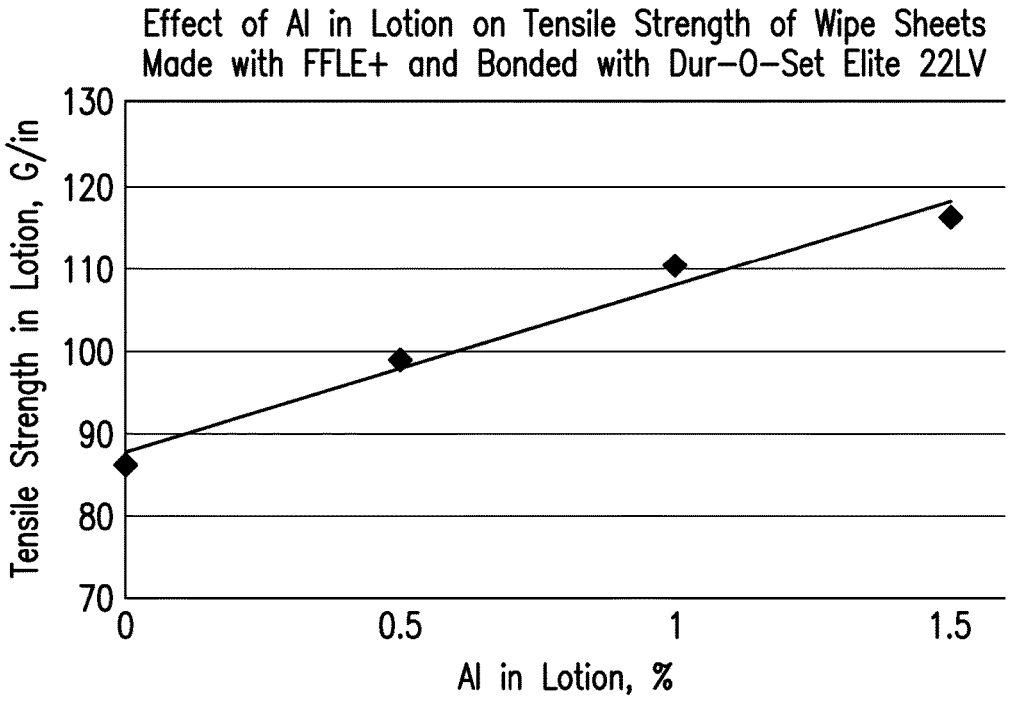
FIG. 37 depicts a graph showing the effect of aluminum content in the lotion on the tensile strength of the wipe sheet. The graph shows the tensile strength in lotion of the sample in gli (y-axis) versus the percent aluminum in lotion (x-axis).

The average normalized cross directional wet strength values for the Dow KSR8855 binder samples from Table 259 are plotted in FIG. 36.

DISCUSSION: Samples 173-1 to Samples 173-90 with Dow KSR8855 binder and no bicomponent fiber showed a measurable drop in cross direction wet tensile strength over a 28 day aging period at 40° C. in lotion expressed from Wal-Mart Parents Choice Baby Wipes. The Dow KSR8758 binder lost about 25% of its cross direction wet strength with the majority of the loss in strength occurring over the first 7 days. The Dow KSR8855 binder is moderately stable in this lotion under these conditions.

Example 35

Dispersible Wipes with Modified Bicomponent Fiber

Wipes according to the invention are prepared and are tested for various parameters including basis weight and wet tensile strength.

METHODS/MATERIALS: The following main materials are used in the present Example:

(i) Dow 8758-5 (EXP4558) binder;

(ii) FF-TAS cellulose pulp from Buckeye Technologies Inc.; and (iii) Trevira 1661 bicomponent binder fiber comprising 200 ppm PEG 200 on its surface.

Wipe sheet Sample 2B is prepared on an airlaid pilot line according to the protocol described in Example 10. The wipes are prepared with the target layer compositions described in Table 260. The target basic properties of the sample sheets are described in Table 261. Samples of each composition are made and tested. The dispersibility of Sample 2B is tested according to the INDA Guidelines FG511.1 Tier 1 Dispersibility Shake Flask Test described in Example 17 above. The cross directional wet tensile strength after aging in lotion for 7 days at 40° C. is tested as described in Example 33.

TABLE 260

Sample 2B Target Composition

| | Raw Material | Basis Weight Ranges (gsm) | Weight Percent Ranges |
|---|---|---|---|
| Layer 1 | Dow 8758-5(EXP4558) | 3-7 | 5-10 |
| | FF-TAS | 20-30 | 35-40 |
| Layer 2 | Modified Trevira 1661 | 4-8 | 5-10 |
| | FF-TAS | 0.1-3.0 | 1-5 |
| Layer 3 | FF-TAS | 20-30 | 35-40 |
| | Dow 8758-5(EXP4558) | 3-7 | 5-10 |
| | TOTAL | 50-85 | 100 |

TABLE 261

Sample 2B Target Properties

| | |
|---|---|
| Average basis weight (gsm) | 65-75 |
| Average caliper (mm) | 0.95-1.05 |
| Cross directional wet tensile strength (G/in) after aging in lotion for 7 days at 40° C. | 850-900 |

Example 36

Dispersible Wipes

Wipes according to the invention were prepared and tested for various parameters including basis weight, CDW, MDD, and caliper.

METHODS/MATERIALS: Sample 431 was made on a commercial airlaid drum forming line with through air drying. The composition of this sample is given in Table 262. The level of raw materials was varied to influence the physical properties and flushable-dispersible properties. Product lot analysis was carried out on each roll.

TABLE 262

Sample 431

| Layer | Raw Materials | Basis Weight (gsm) | Weight % |
|---|---|---|---|
| Top | Wacker Vinnapas EP907 | 2.4 | 3.5 |
| 3 | Trevira Merge 1661 T255 bicomponent fiber, 2.2 dtex × 12 mm | 1.3 | 1.9 |
| | Buckeye Technologies FFT-AS pulp | 6.4 | 9.2 |
| | Weyerhaeuser CF401 pulp | 2.4 | 3.5 |
| 2 | Buckeye Technologies FFT-AS pulp | 20.9 | 29.9 |
| 1 | Trevira Merge 1661 T255 bicomponent fiber, 2.2 dtex × 12 mm | 7.2 | 10.3 |
| | Buckeye Technologies FFT-AS pulp | 13.8 | 19.7 |
| | Weyerhaeuser CF401 pulp | 13.0 | 18.6 |
| Bottom | Wacker Vinnapas EP907 | 2.4 | 3.5 |
| | Total | 70.0 | |

RESULTS: The results of the product lot analysis of Sample 431 are provided in Table 263 below.

TABLE 263

Sample 431 Product Lot Analysis

| | First Run (18 rolls) | | Second run (21 rolls) | |
|---|---|---|---|---|
| | Average | CPKa | Average | CPKa |
| Basis Weight (gsm) | 69.94 ± 1.03 | 2.24 | 69.74 ± 1.63 | 1.38 |
| Cross Directional Wet Tensile Strength (gli) | 280.72 ± 22.88 | 1.07 | 259.48 ± 26.84 | 1.17 |
| Machine Direction Dry Tensile Strength (gli) | 894.56 ± 61.60 | 1.22 | 874.70 ± 58.76 | 1.33 |
| Machine Direction Wet Tensile Strength (gli) | 329.56 ± 37.23 | 1.03 | 304.00 ± 28.13 | 1.53 |
| Caliper After Winding (mm) | 0.88 ± 0.02 | 3.00 | 0.90 ± 0.02 | 2.14 |
| Caliper (mm) | 0.98 ± 0.03 | 1.76 | 0.98 ± 0.04 | 1.64 |

aCPK refers to the process capability index. DISCUSSION: For samples having similar compositions, an increase in the percent of bicomponent fiber in the first and third layers increases the CDW tensile strength of the material. Sample 1C has 15% by weight bicomponent fiber in the first layer and 11% by weight bicomponent fiber in the third layer. Sample 431 has 21% by weight bicomponent fiber in the first layer and 13% by weight bicomponent fiber in the third layer. Increasing the level of bicomponent fiber in the first and third stratum in Sample 431 gives an increase in CDW strength from 217 gli in Sample 1C to the range of 260-280 gli in Sample 431 is shown in Tables 10 and 263.

Example 37

Dispersible Wipes

Wipes according to the invention are prepared.

METHODS/MATERIALS: The following main materials are used in the present Example:

(i) Wacker Vinnapas EP907 binder;

(ii) FF-TAS cellulose pulp from Buckeye Technologies Inc.;

(iii) CF401 cellulose pulp from Weyerhaeuser;

(iv) Trevira 1661 bicomponent binder fiber, 2.2 dtex, 6 mm long.

Wipe sheet Sample 432 is prepared on an airlaid pilot line according to the protocol described in Example 10. The wipes are prepared with the target layer compositions described in Table 264.

TABLE 264

Sample 432 Target Composition

| Layer | Raw Materials | Basis Weight (gsm) | Weight % |
|---|---|---|---|
| Top | Wacker Vinnapas EP907 | 2.4 | 3.5 |
| 3 | Trevira Merge 1661 T255 bicomponent fiber, 2.2 dtex × 12 mm | 4.3 | 6.1 |
| | Buckeye Technologies FFT-AS pulp | 10.7 | 15.3 |
| | Weyerhaeuser CF401 pulp | 7.1 | 10.2 |
| 2 | Buckeye Technologies FFT-AS pulp | 20.9 | 29.8 |
| 1 | Trevira Merge 1661 T255 bicomponent fiber, 2.2 dtex × 12 mm | 4.3 | 6.1 |
| | Buckeye Technologies FFT-AS pulp | 10.7 | 15.3 |
| | Weyerhaeuser CF401 pulp | 7.1 | 10.2 |
| Bottom | Wacker Vinnapas EP907 | 2.4 | 3.5 |
| | Total | 70.0 | |

Example 38

Effect of FFLE+ Pulp Modified with Poly (Ethylene Glycol) on the Properties of 3-Layer Structure Wipes according to the invention were prepared and tested for various parameters including basis weight, caliper, and CDW.

METHODS/MATERIALS: Sample 174 was prepared according to the protocol described in Example 29 using the following ingredients: FF-TAS cellulose pulp fibers, FFLE+, commercial modified cellulose pulp fibers; Trevira 255 bicomponent binder fiber for wetlaid process, 3 dtex, 12 mm long; Dur-O-Set Elite 22LV emulsion of VAE binder, and Carbowax PEG 200 produced by Dow Chemical.

The composition of Sample 174 is given in Table 265 below.

TABLE 265

Composition of Sample 174

| Sample | Layer | Raw Material | Dry Basis Weight (gsm) | Weight % |
|---|---|---|---|---|
| Sample 174 | Surface Spray | Dur-O-Set Elite 22LV at 10% solids | 1.25 | 1.8 |
| | Top Layer | Trevira 255 | 2.3 | 3.3 |
| | | FF-TAS | 19.2 | 27.4 |
| | Middle Layer | FFLE+ | 20.0 | 28.6 |
| | | Carbowax 200 | 3.0 | 4.3 |
| | Bottom Layer | Trevira 255 | 4.3 | 6.2 |
| | | FF-TAS | 18.6 | 26.6 |
| | Surface Spray | Dur-O-Set Elite 22LV at 10% solids | 1.25 | 1.8 |
| | | Total | 70 | 100 |

RESULTS: Table 266 below summarizes the properties of the Sample 174 wipe sheet:

TABLE 266

Properties of Sample 174

| | |
|---|---|
| Caliper range (mm) | 1.2 |
| Wet tensile strength (G/in) after aging in lotion for 24 hrs at 40° C. | 200 |
| Dispersibility Shaker Flask 6-hour Test (percent of total dry weight remained on the 12 mm sieve screen) after aging the samples at 40° C. for 24 hrs | 80 |

DISCUSSION: By using the FFLE+ pulp modified with PEG 200 in the middle layer, the sheet could delaminate in the Dispersibility Shaker Flask test even though it was treated with the crosslinkable binder. Without being bound by theory, it is believed that the presence of aluminum in the FFLE+ fibers and additional treatment of the fibers with PEG act as agents blocking the cross-linking reaction that normally occurs during the curing process of the cross-linkable VAE binders. This is supported by the observations made in the preliminary experiments, which demonstrated that the sheets made with FFLE+ and treated with Dur-O-Set Elite 22LV had much lower tensile strength than the sheets made with FF-TAS and treated with Dur-O-Set Elite 22LV. When FFLE+ was additionally modified with PEG, the tensile strength of the sheets treated with Dur-O-Set Elite 22LV was reduced even more.

All patents, patent applications, publications, product descriptions and protocols, cited in this specification are hereby incorporated by reference in their entireties. In case of a conflict in terminology, the present disclosure controls.

While it will become apparent that the invention herein described is well calculated to achieve the benefits and advantages set forth above, the presently disclosed subject matter is not to be limited in scope by the specific embodiments described herein. It will be appreciated that the invention is susceptible to modification, variation and change without departing from the spirit thereof. For instance, the nonwoven structure is described in the context of an airlaid process. However, non-airlaid processes are also contemplated.

What is claimed is:

1. A dispersible, airlaid, multistrata nonwoven wipe material having two outer layers, comprising (A) a first layer comprising (a) from about 75 to about 100 weight percent cellulosic fibers and (b) from about 0 to about 25 weight percent bicomponent fibers;

(B) a second layer comprising (a) from about 50 to about 100 weight percent cellulosic fibers and (b) from about 0 to about 50 weight percent bicomponent fibers.

(C) a third layer comprising (a) from about 50 to about 100 weight percent cellulosic fibers and (b) from about 0 to about 50 weight percent bicomponent fibers, wherein the second layer is disposed between the first and third layers, wherein the wipe material is dispersible in water, wherein the wipe material is structurally stable in a wetting liquid, wherein each outer layer comprises bicomponent fibers, and wherein at least a portion of at least one outer layer is coated on an external surface with binder.

2. The dispersible, airlaid, multistrata nonwoven wipe material of claim 1, wherein the first layer comprises (a) from about 80 to about 100 weight percent cellulosic fibers and (b) from about 0 to about 20 weight percent bicomponent fibers.

3. The dispersible, airlaid, multistrata nonwoven wipe material of claim 1, wherein the second layer comprises (a) from about 60 to about 100 weight percent cellulosic fibers and (b) from about 0 to about 40 weight percent bicomponent fibers.

4. The dispersible, airlaid, multistrata nonwoven wipe material of claim 3, wherein the second layer comprises (a) from about 95 to about 100 weight percent cellulosic fibers and (b) from about 0 to about 5 weight percent bicomponent fibers.

5. The dispersible, airlaid, multistrata nonwoven wipe material of claim 1, wherein the third layer comprises (a) from about 75 to about 100 weight percent cellulosic fibers and (b) from about 0 to about 25 weight percent bicomponent fibers.

6. The dispersible, airlaid, multistrata nonwoven wipe material of claim 5, wherein the third layer comprises (a) from about 80 to about 100 weight percent cellulosic fibers and (b) from about 0 to about 20 weight percent bicomponent fibers.

7. The dispersible, airlaid, multistrata nonwoven wipe material of claim 6, wherein the third layer comprises (a) from about 90 to about 100 weight percent cellulosic fibers and (b) from about 0 to about 10 weight percent bicomponent fibers.

8. The dispersible, airlaid, multistrata nonwoven wipe material of claim 7, wherein the third layer comprises (a) from about 95 to about 100 weight percent cellulosic fibers and (b) from about 0 to about 5 weight percent bicomponent fibers.

9. The dispersible, airlaid, multistrata nonwoven wipe material of claim 1, wherein the third layer comprises (a) from about 50 to about 95 weight percent cellulosic fibers and (b) from about 5 to about 50 weight percent bicomponent fibers.

10. The dispersible, airlaid, multistrata nonwoven wipe material of claim 1, further comprising (D) a fourth layer comprising (a) from about 50 to about 100 weight percent cellulosic fibers and (b) from about 0 to about 50 weight percent bicomponent fibers, wherein the second layer and the third layer are disposed between the first layer and the fourth layer.

11. The dispersible, airlaid, multistrata nonwoven wipe material of claim 10, wherein the fourth layer comprises:

(a) from about 50 to about 95 weight percent cellulosic fibers and (b) from about 5 to about 50 weight percent bicomponent fibers.

12. The dispersible, airlaid, multistrata nonwoven wipe material of claim 11, wherein the fourth layer comprises:

(a) from about 50 to about 85 weight percent cellulosic fibers and (b) from about 15 to about 50 weight percent bicomponent fibers.

13. The dispersible, airlaid, multistrata nonwoven wipe material of claim 10, wherein the fourth layer comprises:

(a) from about 90 to about 100 weight percent cellulosic fibers and (b) from about 0 to about 10 weight percent bicomponent fibers.

14. The dispersible, airlaid, multistrata nonwoven wipe material of claim 1, wherein the binder is water-soluble.

15. The dispersible, airlaid, multistrata nonwoven wipe material of claim 1, wherein the binder is selected from the group comprising polyethylene powders, copolymer binders, vinylacetate ethylene binders, styrene-butadiene binders, urethanes, urethane-based binders, acrylic binders, thermoplastic binders, natural polymer based binders, and mixtures thereof.

16. The dispersible, airlaid, multistrata nonwoven wipe material of claim 1, wherein the amount of binder is from about 4 to about 12 weight percent of the material.

17. The dispersible, airlaid, multistrata nonwoven wipe material of claim 1, wherein the nonwoven wipe material has a basis weight of from about 30 gsm to about 200 gsm.

18. The dispersible, airlaid, multistrata nonwoven wipe material of claim 1, wherein the nonwoven wipe material has a caliper of from about 0.25 mm to about 4 mm.

19. The dispersible, airlaid, multistrata nonwoven wipe material of claim 1, wherein the nonwoven wipe material has a cross directional wet strength greater than about 200 gli.

20. The dispersible, airlaid, multistrata nonwoven wipe material of claim 19, wherein the nonwoven wipe material has a cross directional wet strength greater than about 250 gli.

21. The dispersible, airlaid, multistrata nonwoven wipe material of claim 1, wherein the nonwoven wipe material passes an IVDA Guidelines FG 512.1 Column Settling Test.

22. The dispersible, airlaid, multistrata nonwoven wipe material of claim 1, wherein the nonwoven wipe material passes an IVDA Guidelines FG 521.1 30 Day Laboratory Household Pump Test designed to assess compatibility of a flushable product in residential and commercial pumping systems.

23. The dispersible, airlaid, multistrata nonwoven wipe material of claim 1, wherein at least a portion of the cellulose fiber is chemically modified in at least one layer.

24. The dispersible, airlaid, multistrata nonwoven wipe material of claim 23, wherein the cellulose fiber comprises at least one compound selected from the group consisting of polyvalent cation containing compound, polycationic polymer, and polyhydroxy compound.

* * * * *